US007803507B2

(12) United States Patent
Morita et al.

(10) Patent No.: US 7,803,507 B2
(45) Date of Patent: Sep. 28, 2010

(54) ELECTROPHOTOGRAPHIC PHOTORECEPTOR AND IMAGE FORMING APPARATUS INCLUDING THE SAME

(75) Inventors: Tatsuhiro Morita, Kashiba (JP); Tomoko Kanazawa, Kashihara (JP); Akihiro Kondoh, Nara (JP); Yohichi Takesawa, Toyonaka (JP); Takatsugu Obata, Nara (JP); Shinya Mimura, Nara (JP); Hiroshi Sugimura, Habikino (JP)

(73) Assignee: Sharp Kabushiki Kaisha, Osaka (JP)

( * ) Notice: Subject to any disclaimer, the term of this patent is extended or adjusted under 35 U.S.C. 154(b) by 556 days.

(21) Appl. No.: 10/544,454

(22) PCT Filed: Feb. 6, 2004

(86) PCT No.: PCT/JP2004/001252

§ 371 (c)(1),
(2), (4) Date: May 16, 2006

(87) PCT Pub. No.: WO2004/070474

PCT Pub. Date: Aug. 19, 2004

(65) Prior Publication Data

US 2007/0026334 A1 Feb. 1, 2007

(30) Foreign Application Priority Data

Feb. 7, 2003 (JP) ..... 2003-031559
Feb. 26, 2003 (JP) ..... 2003-049790
Jul. 16, 2003 (JP) ..... 2003-275636

(51) Int. Cl.
*G03G 5/06* (2006.01)
*G03G 5/05* (2006.01)

(52) U.S. Cl. ..... 430/58.85; 430/59.6; 430/72; 430/73; 399/159

(58) Field of Classification Search ..... 430/72, 430/73, 59.6, 58.85; 399/159
See application file for complete search history.

(56) References Cited

U.S. PATENT DOCUMENTS 3,824,099 A 7/1974 Champ et al.

(Continued)

FOREIGN PATENT DOCUMENTS

| | | | |
|---|---|---|---|
| JP | 52-4188 | A | 2/1977 |
| JP | 54-150128 | A | 11/1979 |
| JP | 54-151955 | A | 11/1979 |
| JP | 55-052063 | A | 4/1980 |
| JP | 55-42380 | B | 10/1980 |
| JP | 58-49960 | A | 3/1983 |
| JP | 58-32372 | B | 7/1983 |
| JP | 58-198043 | A | 11/1983 |
| JP | 60-172045 | A | 9/1985 |
| JP | 61-062040 | | 3/1986 |
| JP | 63-149669 | A | 6/1988 |
| JP | 63-170673 | A | 7/1988 |
| JP | 64-73365 | A | 3/1989 |
| JP | 1-172857 | A | 7/1989 |
| JP | 2-51162 | A | 2/1990 |
| JP | 2-190862 | A | 7/1990 |
| JP | 3-20768 | A | 1/1991 |
| JP | 5-61215 | A | 3/1993 |

(Continued)

OTHER PUBLICATIONS

English Machine Tranlation of JP 2002-365820 (Dec. 2002).*

(Continued)

*Primary Examiner*—Christopher RoDee
(74) *Attorney, Agent, or Firm*—Birch, Stewart, Kolasch & Birch, LLP

(57) ABSTRACT

An electrophotographic photoreceptor of high durability capable of providing stable excellent electrical characteristics over a prolonged period of time, which electrophotographic photoreceptor excels in mechanical strength. A photosensitive layer (14) of an electrophotographic photoreceptor (1) includes a polyarylate resin having structural units, for example, those of formula (1)

(1)

and an enamine compound represented by, for example, formula (2)

(2)

The variables $R^1$, $R^2$, $R^3$, $R^4$, $R^7$~$R^{10}$, $X^1$, $Ar^1$, $Ar^2$, $Ar^3$, $Ar^4$, $Ar^5$, $R^{11}$, $R^{12}$, $R^{13}$, $R^{14}$, a, m, and n are as defined in the specification. By virtue of these, the electrophotographic photoreceptor (1) of excellent mechanical strength and favorable electrical characteristics can be realized.

9 Claims, 21 Drawing Sheets

U.S. PATENT DOCUMENTS

| | | | | |
|---|---|---|---|---|
| 4,123,269 | A | 10/1978 | Vom Hoene et al. | |
| 4,150,987 | A | 4/1979 | Anderson et al. | |
| 4,278,747 | A | 7/1981 | Murayama et al. | |
| 4,338,388 | A | 7/1982 | Sakai et al. | |
| 4,367,273 | A | 1/1983 | Murayama et al. | |
| 4,637,971 | A | 1/1987 | Takei et al. | |
| 4,851,960 | A | 7/1989 | Nakamura et al. | |
| 4,859,556 | A | 8/1989 | Sasaki | |
| 4,892,949 | A | 1/1990 | Sasaki | |
| RE33,724 | E | 10/1991 | Takei et al. | |
| 5,126,913 | A | 6/1992 | Araya et al. | |
| 5,492,786 | A * | 2/1996 | Sugimura et al. | 430/58.3 |
| RE35,581 | E | 8/1997 | Nakamura et al. | |
| 5,876,890 | A * | 3/1999 | Kitamura et al. | 430/59.6 |
| 6,879,794 | B2 | 4/2005 | Azuma et al. | |
| 2002/0090561 | A1 * | 7/2002 | Nagasaka et al. | 430/69 |
| 2004/0101770 | A1 | 5/2004 | Obata et al. | |
| 2006/0222979 | A1 * | 10/2006 | Ishida et al. | 430/72 |

FOREIGN PATENT DOCUMENTS

| | | | |
|---|---|---|---|
| JP | 6-43674 | A | 2/1994 |
| JP | 6-89038 | A | 3/1994 |
| JP | 6-317917 | A | 11/1994 |
| JP | 7-48324 | A | 2/1995 |
| JP | 7-114191 | A | 5/1995 |
| JP | 7-134430 | A | 5/1995 |
| JP | 8-113636 | A | 5/1996 |
| JP | 10-10761 | A | 1/1998 |
| JP | 10-20517 | A | 1/1998 |
| JP | 10-69107 | A | 3/1998 |
| JP | 10239875 | A * | 9/1998 |
| JP | 10-268535 | A | 10/1998 |
| JP | 2000-221722 | A | 8/2000 |
| JP | 2001-56595 | A | 2/2001 |
| JP | 2001-166502 | A | 6/2001 |
| JP | 2001-215741 | A | 8/2001 |
| JP | 2002-268491 | A | 9/2002 |
| JP | 2002-278096 | A | 9/2002 |
| JP | 2002-278109 | A | 9/2002 |
| JP | 2002-365869 | A | 12/2002 |
| JP | 2002365820 | A * | 12/2002 |
| JP | 2003-15327 | A | 1/2003 |
| JP | 2003-15328 | A | 1/2003 |
| JP | 2003-15340 | A | 1/2003 |
| JP | 2003-29430 | A | 1/2003 |
| JP | 2004-151666 | A | 5/2004 |

OTHER PUBLICATIONS

English translation of JP 2003-012619 (2003).*

Engllish language machine translation of JP 10-239875 (Sep. 1998).*

Partial Translation of JP 2003-12619, ¶ [0015] (2003).*

* cited by examiner

ELECTROPHOTOGRAPHIC PHOTORECEPTOR AND IMAGE FORMING APPARATUS INCLUDING THE SAME

TECHNICAL FIELD

The present invention concerns an electrophotographic photoreceptor, a process cartridge having the electrophotographic photoreceptor, and an electrophotographic apparatus and, more specifically, it relates to an electrophotographic photoreceptor having a photosensitive layer containing a specified resin and a specified charge transportation substance, a process cartridge having the electrophotographic photoreceptor, and an electrophotographic apparatus.

The present invention concerns an electrophotographic photoreceptor used for electrophotographic image forming apparatus such as copying machines, printers and facsimile apparatus, and an image forming apparatus having the same and, more specifically, it relates to an electrophotographic photoreceptor having a photosensitive layer containing a specified charge transportation substance and a specified resin, and an image forming apparatus having the same.

The invention concerns an image forming method and an image forming apparatus for forming images by an electrophotographic process and, more specifically, it relates to an image forming method and an image forming apparatus for contacting a charging member with an electrophotographic photoreceptor and conducting charging.

BACKGROUND ART

In recent years, the electrophotographic technique has been utilized not only to the field of copying machines but also to the fields of printing materials, slide films or microfilms for which the photographic technique was used so far, and it is applied also to high speed printers using lasers, light emitting diodes (referred to simply as LED), or cathode ray tubes (referred to simply as CRT). In the electrophotographic process in which images are formed using the electrophotographic technique, image formation is carried out as described below. At first, the surface of an electrophotographic photoreceptor (hereinafter also referred to simply as 'photoreceptor') is charged to a predetermined potential and exposure is applied in accordance with image information to the charged surface of the photoreceptor thereby forming electrostatic latent images. The thus formed electrostatic latent images are developed with a developer containing a toner and the like and visualized as toner images. Images are formed by transferring the toner images from the surface of the photoreceptor to a recording medium such as paper and fixing the transferred images. Along with development for the application range of the electrophotographic technique, demands for the electrophotographic photoreceptor have become severe and versatile more and more.

An electrophotographic photoreceptor comprises a conductive support formed of a conductive material and a photosensitive layer on the conductive support. As the electrophotographic photosensitive material, inorganic photoconductors having photosensitive layers comprising, as the main ingredient, inorganic photoconductive materials such as selenium, zinc oxide or cadmium have been used generally. While the inorganic photoreceptors have a basic characteristic as the photoreceptor to some extent, they involve a problem that the film formation of the photosensitive layer is difficult, the plasticity is poor and the manufacturing cost is expensive. Further, the inorganic photoconductive materials are generally highly toxic and impose large restriction in view of manufacture and handling.

More specifically, typical electrophotographic photoreceptors using inorganic type photoconductive material (hereinafter referred to as "inorganic photoreceptor") include, for example, a selenium photoreceptor using amorphous selenium (a-Se) or amorphous selenium arsenide (a-AsSe), a zinc oxide photoreceptor in which zinc oxide (ZnO) is dispersed together with a dye as a sensitizer in a binder resin, a cadmium sulfide photoreceptor in which cadmium sulfide (CdS) is dispersed in a binder resin, and an amorphous silicon photoreceptor using amorphous silicon (a-Si) (hereinafter referred to as "a-Si photoreceptor"). However, the inorganic photoreceptor involves the following drawbacks. The selenium photoreceptor and the cadmium sulfide photoreceptor involve a problem in view of heat resistance and store stability. Further, since selenium and cadmium are toxic to human bodies or environments, the photoreceptors using them have to be recovered and discarded properly after use. Further, the zinc oxide photoreceptor has a drawback of low sensitivity and low durability and it is scarcely used at present. Further, while the a-Si photoreceptor that attracts attention as an in organic photoreceptor causing no public pollution has advantages such as high sensitivity and high durability, it involves a drawback that it is difficult to form a photosensitive layer into a uniform film and tends to cause image defects since it is manufactured by using a plasma chemical vapor deposition (simply referred to as CVD). Further, it has also a drawback that the productivity is low and the production cost is high.

Further, development has been proceeded in recent years for the photoconductive material used for the electrophotographic photoreceptor and organic photoconductive materials, that is, organic photoconductors (simply referred to as OPC) have been often used instead of the inorganic photoconductive materials used so far.

The organic photoconductive materials have been studied and developed generally and they are not only utilized for the electrophotographic photoreceptor but also have been started to be applied, for example, to electrostatic recording devices, sensor materials or organic electro luminescent (simply referred to as EL) devices.

Since the organic photoreceptor having a photosensitive layer using the organic photoconductive material (hereinafter also referred to sometimes as "organic photoreceptor") has advantages that the film forming property of the photosensitive layer is favorable, it is also excellent in flexibility, reduced in weight, and excellent in transparency, and can be easily used for the design of a photoreceptor showing favorable sensitivity to a wide range of wavelength regions by an appropriate sensitizing method, it has been developed gradually as a main stream of the electrophotographic photoreceptor. While the organic photoreceptor involves some problems in view of sensitivity, durability, and stability to the environment, it has many advantages compared with the inorganic photoreceptor with respect to toxicity, production cost, degree of freedom for the design of material, etc. Further, it has also an advantage that the photosensitive layer can be formed by an easy and inexpensive method as typically represented by a dip coating method. In view of the advantages described above, the organic photoreceptor has gradually become predominant in the electrophotographic photoreceptor. Studies have been conducted particularly in recent years, and improvement for sensitivity and durability has been intended and the organic photoreceptor has been used at present as an electrophotographic photoreceptor excepting for special cases.

Particularly, the performance of the organic photoreceptor has been improved remarkably by the development of a function separated type photoreceptor in which the charge generating function and the charge transportation function are shared respectively on separate materials. Further, since the function separated type photoreceptor has a photosensitive layer in which a charge generation layer containing a charge generation substance for charge generating function and a charge transportation layer containing a charge transportation substance for charge transportation function are stacked, it has also an advantage that the range for selecting the materials for the charge generation material and the charge transportation substance is wide, and that an electrophotographic photoreceptor having arbitrary optional characteristics can be manufactured relatively easily. The charge generation layer and the charge transportation layer are usually formed with the charge generation substance and the charge transportation substance being dispersed in a binder resin as a binder.

For the organic photoconductive material used for the charge generation substance of the function separated type photoreceptor, various substances such as phthalocyanine pigment, squarylium dye, azo pigment, perylene pigment, polynuclear quinone pigment, cyanine dye, squaric acid dye, and pyrylium salt dye have been studied and various substances of excellent light fastness and having high charge generating ability have been proposed.

On the other hand, as the organic photoconductive material used for the charge transportation substance, various compounds such as pyrazoline compounds (for example, refer to Japanese Examined Patent Publication JP-B2 52-4188 (1977)), hydrazone compounds (for example, refer to Japanese Unexamined Patent Publication JP-A 54-150128 (1979), Japanese Examined Patent Publication JP-B2 55-42380 (1980), Japanese Unexamined Patent Publication JP-A 55-52063 (1980)), triphenylamine compounds (for example, refer to Japanese Examined Patent Publication JP-B2 58-32372 (1983) and Japanese Unexamined Patent Publication JP-A 2-190862 (1990)), and stilbene compounds (for example, refer to Japanese Unexamined Patent Publications JP-A 54-151955 (1979) and JP-A 58-198043 (1983)). Recently, pyrene derivatives, naphthalene derivatives and terphenyl derivatives having a condensed polynuclear hydrocarbon system at the center nuclei (for example, refer to Japanese Unexamined Patent Publication JP-A 7-48324 (1995)), etc. have also been developed.

The charge generation substance and the charge transportation substance are usually used in a manner of being dispersed or dissolved in a binder resin as a binder in order to ensure the mechanical strength of the photoreceptor. As the resin used for the binder resin, various resins such as polymethyl methacrylate resin, polycarbonate resin, and polyester resin have been proposed.

Performances required for the electrophotographic photoreceptor in the electrophotographic process are, for example, high surface potential when it is charged, high carrier retention ratio, high light sensitivity, and less fluctuation of such electric characteristics under all circumstances. Further, it is also demanded that the photosensitive layer has high film strength, is excellent in wear resistance when used repetitively, and high stability of the characteristics throughout the period of use, that is, high durability. Further, while the photosensitive layer is generally formed by coating a coating solution obtained by dissolving or dispersing the charge generation substance, the charge transportation substance and the binder resin in an appropriate solvent on an electroconductive substrate, it is demanded that the coating solution is stable both physically and chemically in order to improve the production efficiency of the photoreceptor.

Among the requirements described above, the durability is a principal subject of the organic photoreceptor put to practical use. The organic photoreceptor put to practical use involves a problem of tending to cause scraping of film in the photosensitive layer, and change of characteristics such as lowering of the charge potential and increase of the residual potential attributable to electrical change or chemical change. They are caused mainly by the insufficient printing resistance of the photosensitive layer and denaturation and decomposition of an organic photoconductive material such as the charge transportation substance contained in the photosensitive layer by the exposure of the photoreceptor to light or ozone and nitrogen oxide in the photographic process of repeating the steps of forming electrostatic latent images by charging and exposure, transfer of toner images to a recording medium and elimination of the toner remaining on the surface of the photoreceptor by a blade or the like. Accordingly, the role of the binder resin and the charge transportation substance contained mainly in the photosensitive layer as the surface layer of the photoreceptor is extremely important.

As the binder resin, among the resins described above, 2,2-bis(4-hydoroxyphenol)propane (common name; bisphenol A) or bisphenol A polycarbonate resin using the derivatives as the raw material is used mainly. However, the electrophotographic photoreceptor using the bisphenol A polycarbonate resin as the binder resin involves the following drawbacks. Since the bisphenol A polycarbonate resin has high crystallinity, the solution tends to cause gelation and the coating solution becomes no more usable in a short period of time in a case of forming a film by coating. Further, in a case of using the film by coating, when the prepared photoreceptor is used in an electrophotographic apparatus such as a copying machine since the crystallized polycarbonate resin sometimes precipitates to the surface of the formed film, toner is deposited to convex potions formed by crystallization of the polycarbonate resin, the toner at the portions is not completely removed by cleaning but sometimes remains to cause image defects due to cleaning failure. Further, the surface of the photoreceptor tends to be injured and the photosensitive layer tends to be worn by being rubbed in the developing step or cleaning step in the electrophotographic apparatus. That is, the durability is low.

In order to solve the drawbacks, various resins have been proposed. For example, a copolymer of bisphenol A and other molecules has been studied. However no sufficient result has yet been obtained. Further, a polycarbonate resin having a novel specified structure has been proposed (refer to Japanese Examined Patent Publication JP No. 3258537).

Further, in order to compensate the drawback of various resins, use of two or more kinds of resins in admixture has been studied. For example, it has been proposed mixing of a bisphenol A polycarbonate resin and a bisphenol Z polycarbonate resin (refer to Japanese Examined Patent Publication JP-B2 3-49426 (1991) or mixing of a polycarbonate resin synthesized from an asymmetric diol and a polycarbonate resin synthesized from an asymmetric diol (refer to Japanese Unexamined Patent Publication JP-A 6-317917 (1994)). However, for the improvement of the durability of the photoreceptor, mere improvement for the binder resin and the charge transportation substance independently of each other is still insufficient and improvement has to be made also taking the interaction and the compatibility between both of them into consideration.

Further, use of a polyarylate resin has been studied. While the polyarylate resin has a structure similar with the polycarbonate resin, there is a difference among the characteristics of the photoreceptors using the resins. While it has been known that the photoreceptor using the polyarylate resin is excellent in the mechanical stress, when the polyarylate resin is used as the binder rein for the charge transportation layer, it results in a drawback of tending to cause lowering of the potential retaining ratio or increase of the residual potential depending on the structure of the charge transportation substance to be used.

On the other hand, as transfer means of the electrophotographic apparatus forming images by electrophotography, a transfer charger that applies electric charges to a recording medium to generate an electric field for attracting the toner on the surface of the photoreceptor thereby transferring toner images on the surface of the photoreceptor to the recording medium has been used. However, in a case of conducting transfer by the transfer charger, since the recording medium is merely deposited electrostatically but not fixed to the photoreceptor at the transfer portion, this tends to cause a phenomenon referred to as transfer deviation in which toner images can not be transferred accurately to the recording medium during transfer. While the phenomenon was less elicited in electrophotographic apparatus of an analog system type or at low resolution, the problem of the transfer deviation has become conspicuous accompanied to digitalization and increasing resolution in resent years.

In order to prevent the transfer deviation, a transfer roller has often been used instead of the transfer charger. In a case of conducting transfer by using the transfer roller, the transfer roller as a charging member of a roller shape constituted with electroconductive rubber or the like is urged against the photoreceptor from the recording medium on the side opposite to the contact surface of the photoreceptor, thereby applying electric charges in a state where the photoreceptor and the recording medium are in press contact with each other. Use of the transfer roller can prevent the transfer deviation. However, in a case where press contact is weak, a portion of the toner images remains without being transferred to the recording medium tending to cause blanking where white portions are formed in the images, so that it is necessary to increase the pressing force. Increase of the pressing force results in an additional problem that the scraping amount of the photosensitive layer increases due to friction between the recording medium and the transfer roller. Accordingly, higher mechanical strength is required for the photoreceptor more and more.

With the requirement, various improvements have been attempted for the photoreceptor using the polyarylate resin of excellent mechanical strength described above. For example, it has been proposed a photoreceptor using a polyarylate resin and other resin in admixture (refer to Japanese Unexamined Patent Publications JP-A 10-20517 (1998) and JP-A 2000-221722), a photoreceptor in which the surface smoothness and the stabilization of electric characteristics are made compatible by the mixing of the polyarylate resin and other resin with a polysiloxane (refer to Japanese Unexamined Patent Publications JP-A 6-89038 (1994) and JP-A 7-114191 (1995)), and a photoreceptor intending to compatibilize the electric durability and the mechanical durability by the combination of a polyarylate resin or a polyester resin having a structure similar with the polyarylate resin, and a specific charge transportation substance (refer to Japanese Unexamined Patent Publications JP-A 10-268535 (1998), and JP-A 2001-215741).

However, it has not yet been obtained such a photoreceptor as capable of satisfying both the requirement for further higher mechanical strength in view of the digitalization and increased resolution of the electrophotographic apparatus and the requirement for the long time stabilization of electric characteristics in view of the demand for the longer life of the photoreceptor.

The charge transportation substances must satisfy the following requirements:

(1) being stable to light and heat;
(2) being stable to ozone, nitrogen oxides (NOx) and nitric acid that may be generated in corona discharging on a photoconductor;
(3) good charge transportation ability;
(4) being compatible with organic solvents and binder resins;
(5) being easy to produce and are inexpensive. Though partly satisfying some of these, however, the charge transportation substances could not satisfy all of these at high level.

Further, in a case where the charge transportation layer in which a charge transportation substance is dispersed in the binder resin forms the surface layer of the photoreceptor, particularly high charge transportation ability is required for the charge transportation substance.

An electrophotographic apparatus such as a copying machine or a laser beam printer comprises a photoreceptor, charging means such as a charging roller for charging a surface of the photoreceptor to a predetermined potential, exposure means for subjecting the charged surface of the photoreceptor to exposure to light, developing means for supplying a developer containing a toner by a magnetic brush or the like to the surface of the photoreceptor and developing means for developing electrostatic latent images formed by exposure, transfer means for transferring the toner images obtained by development onto a recording medium, fixing means for fixing the transferred toner images, and cleaning means for removing the toner remaining on the surface of the photoreceptor by a cleaning blade or the like after the transferring operation by the transferring means thereby cleaning the surface of the photoreceptor. In a case where, the photoreceptor is used being mounted on an electrophotographic apparatus, the surface layer of the photoreceptor is obliged to be partially scraped off by a contact member such as a cleaning blade or a charging roller. In a case where the scraping amount of the surface layer of the photoreceptor is large, the charge retainability of the photoreceptor lowers and images of good quality can no more be provided for a long period of time. Accordingly, for improving the durability of the electrophotographic apparatus such as the copying machine or the laser beam printer, it has been demanded a photoreceptor with high resistance having a surface layer resistant to the contact member, that is, a surface layer of high printing resistance with less amount scraped by the contact member.

In order to improve the durability of the photoreceptor by strengthening the surface layer, it may be considered to increase the content of the binder resin in the charge transportation layer as the surface layer. However, as the content of the binder resin in the charge transportation layer increases, the light responsivity lowers. In a case where the light responsivity is lowered, that is, the decay speed of the surface potential after exposure is slow, since it is used repeatedly in a state where the residual potential increases and the surface potential of the photoreceptor is not sufficiently decayed, the surface charges at the portion to be erased by the exposure are not erased sufficiently to result in troubles such as early lowering of the image quality. It is known that the light responsivity depends on the charge mobility of the charge transportation substance, and the lowering of the light responsivity is attributable to the low charge transportation ability of the charge transportation substance. That is, along with increase of the content of the binder resin, the charge transportation substance in the charge transportation layer is diluted to further lower the charge transportation ability of the charge transportation layer to lower the light responsivity. Accordingly, in order to prevent lowering of the light responsivity and ensure a sufficient light responsivity, a particularly high charge transportation ability is required for the charge transportation substance.

Further, the size has been reduced and the speed has been increased in electrophotographic apparatus, for example, in digital copying machines and printers in recent years, and improvement for the sensitivity has been required as the characteristics of the photoreceptor for coping with the increase of the speed, and high charge transportation ability has been demanded more and more as the charge transportation substance. Further, in the high speed electrophotographic process, since the time from exposure to development is short, a photoreceptor of high light responsivity is demanded. As described above, since the light responsivity depends on the charge transportation ability of the charge transportation substance, a charge transportation substance having a higher charge transportation ability is demanded also with such a view point.

As the charge transportation substance capable of satisfying such a demand, an enamine compound having a charge mobility higher than that of the charge transportation substance described above has been proposed (refer, for example, to Japanese Unexamined Patent Publications JP-A 2-51162 (1990), JP-A 6-43674 (1994) and JP-A 10-69107(1998)).

Further, a photoreceptor provided with a high charge transportation ability by the incorporation of a polysilane and improved with the chargeability and the film strength by the incorporation of an enamine compound having a specific structure has been proposed (refer to Japanese Unexamined Patent Publication JP-A 7-134430 (1995)).

On the other hand, the performance such as the durability of the function separation type photoreceptor greatly depends on the binder resin itself.

For the binder resin used for the charge transportation layer of the function separation type photoreceptor, it has been well-known that a bisphenol A polycarbonate resin using 2-bis(4-hydroxyphenol)propane (common name: bisphenol A) represented by the following structural formula (A) as a raw material provides favorable characteristics in view of the charge ability, the sensitivity, the residual potential, and the repetitive performance (refer, for example, to Japanese Unexamined Patent Publication JP-A 5-61215 (1993), page 4).

(A)

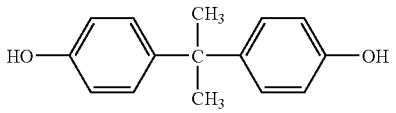

Further, it has been proposed a technique of improving the durability by incorporating a bisphenol Z polycarbonate resin using 1,1-bis(4-hydroxyphenol)cyclohexane (common name: bisphenol Z) as a raw material for the binder resin to the surface of the photosensitive layer (refer, for example, to Japanese Examined Patent Publication JP-No. 2844215).

However, the bisphenol A polycarbonate resin used for the photoreceptor described, for example, in JP-A 5-61215 involves the following drawbacks that are attributable to the structural symmetry of bisphenol A.

(1) It is poor in the solubility and shows favorable solubility only to some halogen type organic solvents such as dichloromethane or 1,2-dichloroethane. Since the halogen type organic solvents described above have low boiling point, when a photoreceptor is manufactured by using a coating solution prepared with such a solvent, since the evaporation speed of the solvent is excessively high, so that the coating film tends to be clouded due to the heat of evaporation. Further, since the halogen type organic solvent such as dichloromethane or 1,2-dichloroethane gives a significant effect such as high toxicity and destruction of ozone layers on an operator or on the global environment, administration for manufacturing steps are complicated.

(2) The resin is soluble partially to other halogen type organic solvents than those described above such as tetrahydrofurane, dioxane or cyclohexane, or mixed solvents thereof, but the coating solutions prepared with the solvents described above are poor in the aging stability such that they gel within several days after preparation. Particularly, in a case of manufacturing a photoreceptor by a manufacturing method such as dip coating, the coating solution in the coating tank gels to sometimes bring about a trouble in the production of the photoreceptor.

(3) Since the inter-molecular attraction force of the resin per se is strong, the formed coating film is poor in the adhesion and tends to suffer from crackings form the boundary with other layers. Further, since the close bondability is poor, the potential barrier layer formed near the boundary increases, so that charges generated from the charge generation substance can not be transferred smoothly as far as the surface of the photosensitive layer and, in a case where the photoreceptor is used continuously, the difference between the bright area potential as the surface potential for the exposed portion and the dark area potential as the surface potential for the not exposed area is decreased. Accordingly, fogging of formed images increases in a case of normal development, while the image density lowers in a case of reversal development, failing to form good images.

(4) Since the crystallinity of the resin per see is high, a polycarbonate resin crystallized to the surface of the film tends to precipitate to cause protrusion during formation of the coating film. Accordingly, tailing is caused in the coating film to lower the productivity. Further, the toner is deposited to the protruded portions during use of the photoreceptor, which remain without cleaning tending to cause image defects due to so-called cleaning failure.

(5) Since the resin itself lacks in the mechanical strength, the photoreceptor using the bisphenol A polycarbonate resin as the binder resin tends to surfer from injuries at the surface by being frictionally rubbed with a charge roll, a magnetic brush, or a cleaning blade and is gradually abraded.

Further, as the characteristics of the photoreceptor, it has been demanded that the light responsivity does not lower even in a case of use under a low temperature circumstance and change of characteristics is small and reliability is high also under various circumstances. However, while the photoreceptor using the bisphenol Z polycarbonate resin as the binder resin described in Japanese Patent No. 2844215 has favorable resistance to printing and wear resistance, it has low light responsivity and, particularly, the responsivity lowers when used under a low temperature circumstance to bring bout a problem that the quality of the formed images is deteriorated.

In order to suppress the lowering of the light responsivity under such a low temperature circumstance, it may be considered to use a charge transportation substance of high charge mobility as described above. However, no sufficient light responsivity can be obtained under the low temperature circumstances even using an enamine compound of high charge mobility used for photoreceptors described in JP-A 2-251162, JP-A 6-43674, or JP-A 10-69107 above. Further, while the photoreceptor described in JP-A 7-134430 is provided with a high charge transportation ability by the incorporation of polysilane, the photoreceptor using the polysilane involves a problem that it is sensible to light exposure and that various characteristics of the photoreceptor are deteriorated by exposure to light, for example, during maintenance.

In the image forming apparatus forming images by electrophotography, images are formed by way of an electrophotographic process as described below. At first, after supplying a predetermined charge potential from charging means provided to the apparatus to the surface of an electrophotographic photoreceptor (hereinafter simply referred to also as "photoreceptor"), thereby charging the surface to a predetermined potential, light is irrigated in accordance with image information by the image exposure means to subject the surface to exposure to light thereby forming an electrostatic latent image. A developer containing a toner, etc. is supplied from the developing means to the thus formed electrostatic latent images to visualize the toner images. The thus formed toner images are transferred from the surface of the photoreceptor to a recording medium such as paper by the transfer means and then they are fixed by the fixing means.

As the charging means, a charging device of corona charging system supplying a charge potential from a wire electrode to the surface of a photoreceptor by corona discharge is generally used. However, since charging is conducted in a no-contact manner in the charging device of the corona charging system, the charging efficiency to the surface of the photoreceptor is low, and a higher potential compared with the charge potential on the surface of the photoreceptor has to be applied to the wire electrode. For example, in order to charge the surface of the photoreceptor to negative (−)700 V, a voltage at about negative (−)5 kV to negative (−)6 kV has to be applied to the wire electrode. Accordingly, a large power source device is necessary, which brings about a problem of increasing the cost. Further, since a great amount of ozone is generated by corona discharge in the charging device of corona charging system, this also brings about a problem that the material constituting the photoreceptor tends to be denatured to degrade images or give undesired effects on human bodies.

In view of the above, a contact type charging device for supplying the potential directly by contacting the charging member to the surface of the photoreceptor has been developed in recent years. For example, it has been proposed a charging device using a composite material in which an electroconductive material such as electroconductive particles is dispersed in an insulative elastic material is bonded to the surface of a metal core formed in a roller shape as a charging member (for example, refer to Japanese Unexamined Patent Publications JP-A 58-49960 (1983), JP-A 63-170673 (1988), JP-A 63-149669 (1988), JP-A 64-73365 (1989), and JP-A 1-172857 (1989)). The composite material is formed such that the volumic resistance is about from $10^6$ to $10^7$ Ωcm and, by the application of a voltage to the metal core in a state of contacting the portion of the composite material to the surface of the photoreceptor, a potential is supplied by way of the electroconductive particles to the surface of the photoreceptor. As the insulative elastic material, a polymeric material such as silicone rubber, polyurethane rubber, ethylene-propylene-diene copolymer (simply referred as EPDM) rubber, or nitrile rubber is used. As the electroconductive particles, carbon powder, carbon fiber, metal powder, or graphite is used, for example.

Charging by the contact type charging device is conducted, specifically, by gap discharge generated in a minute gap between the charging member and the photoreceptor. The gap discharge is generated by applying a voltage at a certain value or higher between the charging member and the photoreceptor. That is, charging is started by applying a voltage above a charge threshold value voltage as a voltage for generating gap discharge between the charging member and the photoreceptor. Accordingly, when the photoreceptor is charged, a voltage at a predetermined value equal with or higher than the discharge threshold value voltage, for example, about 1 to 2 kV is applied to the charging member.

While the voltage is generally a DC voltage, in a case where only the DC voltage is applied to the charging member, it is difficult to attain a desired value of the surface potential on the photoreceptor. This is attributable to that the charging becomes not uniform due to the fluctuation of the charging voltage by the fluctuation of the resistance value of the charging member caused by the fluctuation of ambient temperature or humidity of the apparatus or change of the film thickness of the photosensitive layer caused by scraping of the photoreceptor during repetitive use. Then, in JP-A 63-149669, JP-A 64-73365, and JP-A 1-172857, a vibrating voltage formed by superposing an AC component having a peak-to-peak voltage higher by twice or more the discharge threshold value voltage to the DC component corresponding to the desired charging voltage is applied to the charging member with an aim of uniform charging. By the application of the vibrating voltage, when the surface potential on the photoreceptor rises to a value higher than the DC component of the vibrating voltage, since excess charges on the surface of the photoreceptor can be transferred backwardly from the photoreceptor to the charging member, it is possible to suppress the effect by an external factor such as the environment or film scraping of the photoreceptor and converge the surface potential of the photoreceptor to the DC component of the applied vibrating voltage.

On the other hand, as the photoreceptor, inorganic photoreceptors using inorganic photoconductive materials such as selenium, cadmium sulfide and zinc oxide have been used generally so far. Further, as the organic photoreceptor using the organic photoconductive material, those using a photoconductive polymer typically represented by poly(N-vinylcarbozole), those using an organic photoconductive material of low molecular weight such as 2,5-bis(p-diethylaminophenyl)-1,3,4-oxadiazole, as well as a combination of such an organic photoconductive material with various kinds of dyes and pigments are known.

Since the organic photoreceptor has a good film forming property for the photosensitive layer and can be produced by coating, it has an advantage that the productivity is extremely high and that it is inexpensive. Further, it also has an advantage that the light sensitive wavelength region can be controlled optionally by properly selecting the dyes, pigments, etc. to be used. Since the organic photoreceptors have many advantages as described above, they have been studied extensively. Particularly, the sensitivity and the durability which are concerned with the drawbacks on the existent organic photoreceptor have been remarkably improved recently by the development of a function separation type photoreceptor having a photosensitive layer in which a charge generation layer using an organic photoconductive dye or pigment as a charge generation substance and a charge transportation layer containing a photoconductive polymer or an organic photoconductive material of low molecular weight as a charge transportation substance are stacked, and the organic photoreceptor has become predominant in the electrophotographic photoreceptors.

However, since defects such as agglomerated portions of the charge transportation substance and the charge generation substance are tended to occur in the organic photoreceptor, when charging is conducted by using the contact type charging device described above to the organic photoreceptor, it results in the following problems. That is, in the contact type charging device, since a high electric field is applied being concentrated to the contact portion between the photosensitive layer and the charging member, charges from the charging member are concentrated to the defective portions, if any, in the photosensitive layer to charge the photosensitive layer not uniformly to cause spotwise or stripe-like image defects. Further, in a case where charges are concentrated remarkably from the charging member to the defective portions, leakage occurs to the photosensitive layer and the photosensitive layer itself suffers from dielectric breakdown and subsequent formation of normal images can no more be conducted. Further, the charging member itself undergoes damages by the leak current and it can be used no more.

As the technique for solving the problem caused by the leakage in the photosensitive layer, it has been proposed, for example, coating a coating solution divisionally for plural times upon forming the charge transportation layer by coating, thereby decreasing the overlap of the defects in the direction of the film thickness of the charge transportation layer (refer to Japanese Unexamined Patent Publication JP-A 10-10761 (1998)), and suppression of agglomeration of the charge transportation substance by decreasing the amount of the charge transportation substance to the binder resin in the photosensitive layer (refer to Japanese Unexamined Patent Publication JP-A 2001-56595).

Further, while corona discharge or gap discharge is utilized for charging the photoreceptor as described above, the organic photoreceptor involves a problem that the charge transportation substance tends to cause decomposition or degradation of the charge transportation substance by active gases such as ozone or NOx generated by the discharge, tending to degrade the surface of the photosensitive layer and electric characteristics such as the chargeability, the sensitivity and the responsivity are lowered due to the repetitive use to degrade the picture quality. In a case of using the contact type charging device as the charging device, since discharge occurs near the surface of the photoreceptor, degradation on the surface of the photoreceptor caused by discharge is more serious than in a case of using the charging device of corona discharging system. Further, in a case of applying the vibrating voltage to the charging member for uniform charging, discharge occurs also upon reversed transfer of the excess charges on the surface of the photoreceptor to the charging member as described above and the discharge occurs more frequently compared with the case of applying only the DC voltage, degradation of the surface of the photoreceptor is more conspicuous.

Further, in a case of using the contact type charging device, since the surface of the photosensitive layer is scraped by the contact with the charging member, the photosensitive layer suffers from more wearing due to repetitive use compared with the case of using the charging device of corona charging system. In a case where the amount of wear of the photosensitive layer is large, the charge retainability is lowered and images of high quality can no more be provided. Further, when the thickness of the photosensitive layer is thus decreased, dielectric breakdown of the photosensitive layer described above tends to generate further.

For suppressing the degradation and wear on the surface of the photosensitive layer, it has been proposed to use a charge transportation layer formed by polymerizing a hole transporting compound having two or more chain polymerizable functional groups in one identical molecule. According to the technique, since the portion that functions as the charge transportation substance is contained in the polymerized hole transferring compound and does not agglomerate, occurrence of defects to the photosensitive layer can be suppressed (refer to Japanese Unexamined Patent Publication JP-A 2001-166502).

In the technique described in JP-A 10-10761, since the occurrence of defects per se can not be suppressed, dielectric breakdown of the photosensitive layer can not be avoided. Further, since it is necessary to repeat the step of coating the coating solution and the step of drying the same for forming the charge transportation layer in this technique, the production efficiency is poor.

Further, in the technique described in Japanese Unexamined Patent Publication JP-A 2001-56595, the sensitivity and the responsivity of the photoreceptor are insufficient and, in a case of a high speed electrophotographic process, image defects such as background stains and lowering of the image density occur.

Further, in the technique described in Japanese Unexamined Patent Publication JP-A2001-166502, it is necessary to polymerize the hole transferring compound by radiation rays or the like in order to form the charge transportation layer of the photoreceptor and this is difficult to manufacture by the existent manufacturing apparatus.

DISCLOSURE OF THE INVENTION

An object of the present invention is to provide an electrophotographic photoreceptor of high durability, excellent in mechanical strength, capable of enduring increase of mechanical stress accompanied to digitalization and increasing resolution of the electrophotographic apparatus, and capable of providing favorable electric characteristics stably for a long period of time, by the combination of a specified resin excellent in the mechanical strength and a specified charge transportation substance excellent in the high charge transportation ability, a process cartridge having the electrophotographic photoreceptor and not requiring exchange for a long period of time, and an electrophotographic apparatus capable of having transfer means suitable to the increasing resolution.

Another object of the invention is to provide an electrophotographic photoreceptor having high charge potential and charge retainability, high sensitivity and sufficient light responsivity, and excellent in durability with no deterioration of the characteristics even when it is used under a low temperature circumstance or in a high speed electrophotographic process or exposed to light, having high reliability and favorable productivity, as well as an image forming apparatus having the same.

Further another object of the invention is to provide an image forming method and an image forming apparatus with no dielectric breakdown for a photosensitive layer caused by leakage upon charging by contacting a charging member to the electrophotographic photoreceptor and capable of stably providing high quality images with no image defects caused by leakage for a long period of time.

The invention provides an electrophotographic photoreceptor comprising:

an electroconductive substrate formed of an electroconductive material; and a photosensitive layer disposed on the electroconductive substrate and containing a polyarylate resin having a structural unit represented by the following general formula (1)

and an enamine compound represented by the following general formula (2):

(1)

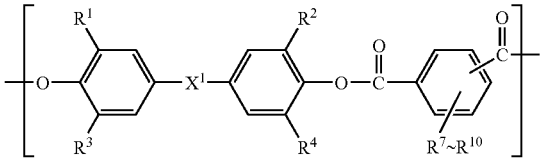

(in which $X^1$ represents a single bond or —$CR^5R^6$—. $R^5$ and $R^6$ each represents a hydrogen atom, a halogen atom, an alkyl group which may have a substituent, or an aryl group which may have a substituent. Further, $R^5$ and $R^6$ may join to each other to form a ring structure. $R^1$, $R^2$, $R^3$, and $R^4$ each represents a hydrogen atom, a halogen atom, an alkyl group which may have a substituent or an aryl group which may have a substituent. $R^7$, $R^8$, $R^9$, and $R^{10}$ each represents a hydrogen atom, a halogen atom, or an alkyl group which may have a substituent or an aryl group which may have a substituent)

(2)

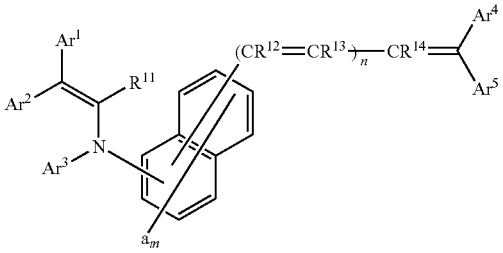

(in which $Ar^1$ and $Ar^2$ each represents an aryl group which may have a substituent or a heterocyclic group which may have a substituent. $Ar^3$ represents an aryl group which may have a substituent, a heterocyclic group which may have a substituent, an aralkyl group which may have a substituent, or an alkyl group which may have a substituent. $Ar^4$ and $Ar^5$ each represents a hydrogen atom, an aryl group which may have a substituent, a heterocyclic group which may have a substituent, an aralkyl group which may have a substituent, or an alkyl group which may have a substituent. However, both $Ar^4$ and $Ar^5$ do not form the hydrogen atoms. $Ar^4$ and $Ar^5$ may join to each other by way of an atom or an atomic group to form a ring structure. "a" represents an alkyl group which may have a substituent, an alkoxy group which may have a substituent, a dialkylamino group which may have a substituent, an aryl group which may have a substituent, a halogen atom or a hydrogen atom, and m represents an integer of 1 to 6. In a case where m is 2 or more, plural a may be identical or different with each other or may join to each other to form a ring structure. $R^{11}$ represents a hydrogen atom, a halogen atom, or an alkyl group which may have a substituent. $R^{12}$, $R^{13}$, and $R^{14}$ each represents a hydrogen atom, an alkyl group which may have a substituent, an aryl group which may have a substituent, a heterocyclic group which may have a substituent, or an aralkyl group which may have a substituent. n represents an integer of 0 to 3 and in a case where n is 2 or 3, plural $R^{12}$ may be identical or different with each other, and plural $R^{13}$ may be identical or different with each other. However, in a case where n represents 0, $Ar^3$ represents a heterocyclic ring which may have a substituent).

According to the invention, the photosensitive layer disposed on the electroconductive substrate of the electrophotographic photoreceptor contains a polyarylate resin having a structural unit represented by the general formula (1) and an enamine compound represented by the general formula (2). The polyarylate resin having the structural unit represented by the general formula (1) is excellent in mechanical strength. In the process of electrophotograpny, the photosensitive layer is scraped and worn by a contacting member used upon removing the toner remained on the surface of the photoreceptor during or after transferring the toner images on the surface of the photoreceptor obtained by developing electrostatic latent images to a recording medium. However, since the photosensitive layer disposed on the electrophotographic photoreceptor of the invention contains, as described above, the polyarylate resin having a structural unit represented by the general formula (1) excellent in the mechanical strength, it has excellent wear resistance with little wear amount of the photosensitive layer, and with less change of the characteristics caused by scraping of the film of the photosensitive layer. Further, since the enamine compound represented by the general formula (2) has excellent compatibility with the polyarylate resin having a structural unit represented by the general formula (1), and has a high charge mobility, in a case where the photosensitive layer contains the polyarylate resin having the structural unit represented by the general formula (1), it is possible obtain an electrophotographic photoreceptor having high charge potential, high sensitivity and sufficient light responsivity, and not suffering from the lowering of the electric characteristics even after repetitive use. Accordingly, by incorporating the polyarylate resin having the structural unit represented by the general formula (1) and the enamine compound represented by the general formula (2) in combination in the photosensitive layer, it is possible to obtain an electrophotographic photoreceptor of high durability, which is excellent in mechanical strength, endurable to the increase of mechanical stresses along with digitalization and increased resolution of electrophotographic apparatus, as well as capable of providing satisfactory electric characteristics stably over a long period of time.

Further, the invention is characterized in that the photosensitive layer contains a polyarylate resin having a structural unit represented by the general formula (1), in which $X^1$ is —$CR^5R^6$—, each of $R^1$, $R^2$, $R^3$, $R^4$, $R^5$, and $R^6$ is a methyl group and each of $R^7$, $R^8$, $R^9$, and $R^{10}$ is a hydrogen atom.

According to the invention, the photosensitive layer contains a polyarylate resin having a structural unit in which $X^1$ is —$CR^5R^6$—, each of $R^1$, $R^2$, $R^3$, $R^4$, $R^5$, and $R^6$ is a methyl group and each of $R^7$, $R^8$, $R^9$, and $R^{10}$ is a hydrogen atom. Since the polyarylate resin is excellent in the solubility to a solvent, it can improve the stability of the coating solution when forming a photosensitive layer by coating. Accordingly, production efficiency of the electrophotographic photoreceptor can be improved.

Further, the invention is characterized in that the enamine compound represented by the following formula (2) is an enamine compound represented by the following general formula (3).

(3)

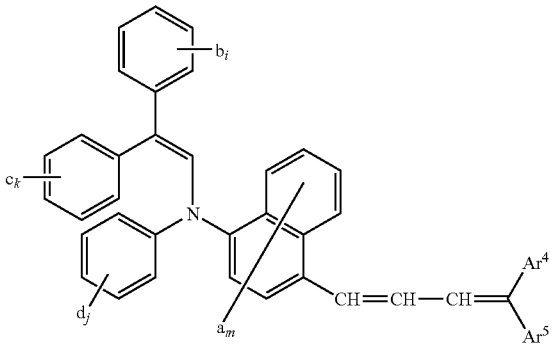

(wherein b, c and d each represent an optionally-substituted alkyl group, an optionally-substituted alkoxy group, an optionally-substituted dialkylamino group, an optionally-substituted aryl group, a halogen atom, or a hydrogen atom; i, k and j each indicate an integer of from 1 to 5; when i is 2 or more, then the "b"s may be the same or different and may bond to each other to form a cyclic structure; when k is 2 or more, then the "c"s may be the same or different and may bond to each other to form a cyclic structure; and when j is 2 or more, then the "d"s may be the same or different and may bond to each other to form a cyclic structure; $Ar^4$, $Ar^5$, "a" and "m" represent the same as those defined in formula (1)).

According to the invention, since the enamine compound represented by the general formula (2) is an enamine compound represented by the general formula (3), it has a particularly high charge mobility. Namely, since the photosensitive layer has an enamine compound represented by the following general formula (3) having a particularly high charge mobility, it is possible to obtain an electrophotographic body having high charge potential, high sensitivity and sufficient responsivity and excellent durability, and with high reliability without degradation of the characteristics even when used in a high speed electrophotographic process.

Further, the invention is characterized in that the photosensitive layer has a stacked structure in which a charge generation layer containing a charge generation substance and a charge transportation layer containing the charge transportation substance containing the enamine compound represented by the general formula (2) and a polyarylate resin having the structural unit represented by the general formula (1) are stacked in this order to the outside from the electroconductive substrate.

According to the invention, a photosensitive layer has a stacked structure in which a charge generation layer containing a charge generation substance and a charge transportation layer containing the charge transportation substance containing the enamine compound represented by the general formula (2) and a polyarylate resin having the structural unit represented by the general formula (1) are stacked in this order to the outside from the electroconductive substrate. Since a charge generating function and a charge transportation function are shared on separate layers respectively, materials suitable to respective charge generating function and charge transportation function can be selected, an electrophotographic photoreceptor having higher sensitivity and higher durability in which stability upon repetitive use is further improved can be obtained. In a photosensitive layer having such a stacked structure, although the charge transportation layer is scraped and worn by a contact member to be used upon removing a toner remained on the surface of the photoreceptor during or after the transfer of toner images on the surface of the photoreceptor obtained by developing electrostatic latent images to a recording medium, since the charge transportation layer disposed on the electrophotographic sensitive body of the invention contains the polyarylate resin having a structural unit represented by the general formula (1) having excellent mechanical strength as described above, the wear amount of the charge transportation layer is small. Accordingly, an electrophotographic photoreceptor excellent in wear resistance and with less change in the characteristics which is caused by film scraping of the photosensitive layer can be obtained.

Further, the invention is characterized in that an intermediate layer is disposed between the electroconductive substrate and the photosensitive layer.

According to the invention, the intermediate layer is disposed between the electroconductive substrate and the photosensitive layer. With such a constitution, since the injection of charges from the electroconductive substrate to the photosensitive layer can be prevented, deterioration of the chargeability of the photosensitive layer can be prevented, reduction of surface charges in a portion other than portions to be erased by exposure can be suppressed, and occurrence of defects such as fogging on images can be prevented. Further, since the defects on the surface of the electroconductive substrate can be covered to provide a uniform surface, the film-forming property of the photosensitive layer can be enhanced. Further, peeling of the photosensitive layer from the electroconductive substrate can be suppressed, to improve adhesion between the electroconductive substrate and the photosensitive layer.

Further, the invention provides a process cartridge attachable to and detachable from an electrophotographic apparatus main body, integrally comprising:

the electrophotographic photoreceptor mentioned above; and at least one of means selected from the group consisting of charging means for charging the electrophotographic photoreceptor, developing means for developing electrostatic latent images formed by subjecting the electrophotographic photoreceptor to exposure to light, and cleaning means for cleaning the electrophotographic photoreceptor after transferring the developed images onto a recording medium.

According to the invention, the process cartridge attachable to and detachable from an electrophotographic apparatus main body integrally comprises an electrophotographic photoreceptor of the invention and at least one of means selected from the group consisting of charging means, developing means, and cleaning means. With such a constitution, since it is not necessary to separately attach or detach the electrophotographic photoreceptor and at least one of means selected from the group consisting of charging means, developing means, and cleaning means individually to and from the main body of the electrophogographic apparatus, the process cartridge can be attached or detached easily to or from the main body of the electrophotographic apparatus. In addition, as described above, since the electrophotographic photoreceptor of the invention equipped to the process cartridge of the invention is excellent in the mechanical strength, endurable to the increase of mechanical stresses along with digitalization and increased resolution of the electrophotographic apparatuses, as well as capable of providing sufficient electric characteristics stably for a long period of time, it is possible to obtain a stress cartridge requiring no exchange over a long period of time.

Further, the invention provides an electrophotographic apparatus comprising:

the electrophotographic photoreceptor mentioned above;

charging means for charging the electrophotographic photoreceptor;

exposure means for subjecting the charged electrophotographic photoreceptor to exposure to light;

developing means for developing electrostatic latent images formed by the exposure to light; and transfer means for transferring the developed images onto a recording medium.

According to the invention, the electrophotographic apparatus comprises the electrophotographic photoreceptor mentioned above, the charging means, the exposure means, the developing means and the transferring means. As described above, the electrophotographic photoreceptor of the invention is excellent in the mechanical strength, capable of enduring increase of mechanical stresses accompanying digitalization and increased resolution of the electrophotographic apparatuses, and can provide sufficient electric characteristics stably for a long period of time. Accordingly, as described above, an electrophotographic apparatus with high reliability capable of providing high quality images over a long period of time can be provided by incorporating the electrophotographic photoreceptor of the invention.

The invention is characterized in that the transfer means transfer developed images onto the recording medium by press contacting the electrophotographic photoreceptor and the recoding medium.

According to the invention, the transfer means transfer developed images onto the recording medium by press contacting the electrophotographic photoreceptor and the recording medium. In a case of using such transfer means, the transfer means are pressed against the electroconductive photoreceptor. Since the photosensitive layer of the electrophotographic photoreceptor of the invention contains a polyarylate resin having a structural unit represented by the general formula (1) excellent in the mechanical strength, as described above, the wear amount of the photosensitive layer is small, and defects on the surface of the photosensitive layer are scarcely caused. Accordingly, since pressing force by the transfer means can be increased to improve the transfer efficiency to the recording medium, there it is possible to obtain an electrophotographic apparatus of high reliability capable of providing high quality images with less transfer deviation, with less image defects such as whitening or blanking.

Further, the invention provides an electrophotographic photoreceptor comprising:

an electroconductive substrate formed of an electroconductive material; and a photosensitive layer disposed on the electroconductive substrate and containing a polycarbonate resin having an asymmetric diol ingredient and an enamine compound represented by the following general formula (2):

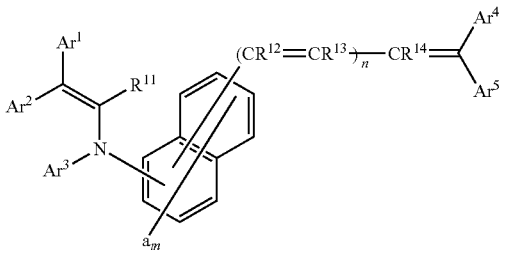

(2)

(in which $Ar^1$ and $Ar^2$ each represents an aryl group which may have a substituent or a heterocyclic group which may have a substituent. $Ar^3$ represents an aryl group which may have a substituent, a heterocyclic group which may have a substituent, an aralkyl group which may have a substituent, or an alkyl group which may have a substituent. $Ar^4$ and $Ar^5$ each represents a hydrogen atom, an aryl group which may have a substituent, a heterocyclic group which may have a substituent, an aralkyl group which may have a substituent, or an alkyl group which may have a substituent. However, both $Ar^4$ and $Ar^5$ do not form the hydrogen atoms. $Ar^4$ and $Ar^5$ may join to each other by way of an atom or an atomic group to form a ring structure. "a" represents an alkyl group which may have a substituent, an alkoxy group which may have a substituent, a dialkylamino group which may have a substituent, an aryl group which may have a substituent, a halogen atom or a hydrogen atom, and m represents an integer of 1 to 6. In a case where m is 2 or more, plural a may be identical or different with each other or may join to each other to form a ring structure. $R^{11}$ represents a hydrogen atom, a halogen atom, or an alkyl group which may have a substituent. $R^{12}$, $R^{13}$, and $R^{14}$ each represents a hydrogen atom, an alkyl group which may have a substituent, an aryl group which may have a substituent, a heterocyclic group which may have a substituent, or an aralkyl group which may have a substituent. n represents an integer of 0 to 3 and in a case where n is 2 or 3, plural $R^{12}$ may be identical or different with each other, and plural $R^{13}$ may be identical or different with each other. However, in a case where n represents 0, $Ar^3$ represents a heterocyclic ring which may have a substituent).

According to the invention, the photosensitive layer disposed on the electroconductive substrate of the electroconductive photoreceptor contains a polycarbonate resin having an asymmetric diol ingredient and an enamine compound represented by the general formula (2). Since the enamine compound represented by the general formula (2) has a high charge mobility, an electrophotographic photoreceptor having high charge potential and charge retainability, high sensitivity and sufficient light responsivity, and excellent in durability can be provided, by incorporating the enamine compound represented by the general formula (2) as a charge transportation substance in the photosensitive layer. Further, since high charge transportation ability can be attained without incorporating a polysilane in the photosensitive layer, an electrophotographic photoreceptor of high reliability with no degradation of characteristics by exposure to light can be obtained. In addition, since the polycarbonate resin having the asymmetric diol ingredient contained in the photosensitive layer exhibits high solubility to a solvent irrespective that the solvent is a halogen type organic solvent or a non-halogen type organic solvent, even when a coating solution is prepared by using the non-halogen type organic solvent upon forming the photosensitive layer by coating, the coating solution containing the polycarbonate resin having the asymmetric diol ingredient does not gelate, has satisfactory film-forming property and excellent stability, and does not gelate even after lapse of several days from the preparation. The productivity of the electrophotographic photoreceptor can be improved by using such a coating solution. Further, since the polycarbonate resin having the asymmetric diol ingredient is excellent in the mechanical strength, it can suppress occurrence of injuries on the surface of the photosensitive layer, reduce the film reduction amount of the photosensitive layer, and decrease the change of the characteristics caused by the wear of the photosensitive layer. On the other hand, in a case where the photosensitive layer is incorporated with the polycarbonate resin having the asymmetric diol ingredient, characteristics such as light responsivity is sometimes deteriorated. However, since the photosensitive layer disposed on the electrophotographic photoreceptor of the invention contains the enamine compound represented by the general formula (2) having high charge mobility as described above, the characteristics are not deteriorated even when it is used under a low temperature circumstance or in a high speed electrophotographic process. Accordingly, by incorporating the enamine compound represented by the general formula (2) and the polycarbonate resin having the asymmetric diol ingredient in combination to the photosensitive layer, it is possible to obtain an electrophotographic photoreceptor having high charge potential and charge retainability, high sensitivity and satisfactory light responsivity, excellent in durability, having high reliability without lowering of the characteristics even when used in an electrophotographic process under a low temperature circumstance or in a high speed electrophotographic process, or when exposed to light and having satisfactory productivity.

Further, the invention is characterized in that the enamine compound represented by the following formula (2) is an enamine compound represented by the following general formula (3).

(3)

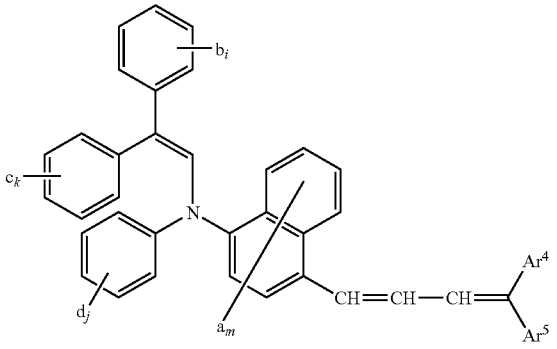

(wherein b, c and d each represent an optionally-substituted alkyl group, an optionally-substituted alkoxy group, an optionally-substituted dialkylamino group, an optionally-substituted aryl group, a halogen atom, or a hydrogen atom; i, k and j each indicate an integer of from 1 to 5; when i is 2 or more, then the "b"s may be the same or different and may bond to each other to form a cyclic structure; when k is 2 or more, then the "c"s may be the same or different and may bond to each other to form a cyclic structure; and when j is 2 or more, then the "d"s may be the same or different and may bond to each other to form a cyclic structure; $Ar^4$, $Ar^5$, "a" and "m" represent the same as those defined in formula (1)).

According to the invention, since the photosensitive layer contains the enamine compound represented by the general formula (3) having particularly high charge mobility among the enamine compounds represented by the general formula (2), an electrophotographic photoreceptor showing higher light responsivity can be obtained. Further, since the enamine compound represented by the general formula (3) can be synthesized relatively easily at high yield among the enamine compounds represented by the general formula (2), it can be produced inexpensively. Accordingly, the electrophotographic photoreceptor of the invention having excellent characteristics as described above can be produced at a low production cost.

Further, the invention is characterized in that the polycarbonate resin having the asymmetric diol ingredient is a polycarbonate resin having a structural unit containing an asymmetric diol ingredient represented by the following general formula (II).

(II)

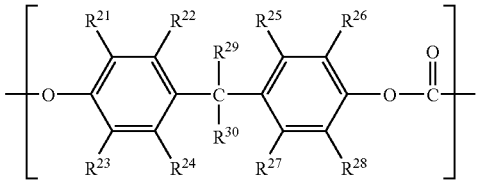

(where $R^{21}$, $R^{22}$, $R^{23}$, $R^{24}$, $R^{25}$, $R^{26}$, $R^{27}$ and $R^{28}$ each represents a hydrogen atom, a halogen atom, an alkyl group which may have a substituent, an aryl group which may have a substituent, or an alkoxy group which may have a substituent. $R^{29}$ and $R^{30}$ each represents a hydrogen atom, a halogen atom, an alkyl group which may have a substituent, or an aryl group which may have a substituent, providing that $R^{29}$ and $R^{30}$ are different from each other or join with each other to form a ring structure).

According to the invention, the polycarbonate resin having the asymmetric diol ingredient is a polycarbonate resin having a structural unit containing an asymmetric diol ingredient represented by the general formula (II), has a bulky substituent in the main chain, and has particularly high mechanical strength since the packing density of the resin per se is high. Accordingly, it is possible to obtain an electrophotographic photoreceptor having excellent durability, with less occurrence of injuries on the surface of the photosensitive layer, and with small film reduction amount of the photosensitive layer.

Further, the invention is characterized in that the polycarbonate resin having the asymmetric diol ingredient further has a siloxane structure.

According to the invention, since the polycarbonate resin having the asymmetric diol ingredient further has a siloxane structure, the surface friction coefficient of the photosensitive layer is reduced to improve the slidability. Accordingly, since the toner adhered on the surface of the photosensitive layer can be peeled easily, the transfer efficiency upon transfer of toner images formed on the surface of the photosensitive layer to a recording medium and cleaning property on the surface of the photosensitive layer after transfer are improved, so that satisfactory images can be obtained. In addition, since paper powder causing injuries on the surface of the photosensitive layer can be peeled easily, defects are scarcely formed on the surface of the photosensitive layer. Further, even in a case where a cleaning blade is slid upon removing the toner remained on the surface of the photosensitive layer after transfer, since friction and vibration accompanying the physical contact of the cleaning head with the surface of the photosensitive layer, noises so-called "ringing" less occur.

The invention is characterized in that the photosensitive layer contains an oxotitanium phthalocyanine.

According to the invention, the photosensitive layer further contains an oxotitanium phthalocyanine. Since the oxotitanium phthalocyanine is a charge generation substance having high charge generating efficiently and charge injecting efficiency, it generates a large quantity of charges by absorption of light, and efficiently injects the generated charges to the charge transportation substance without accumulation therein. Further, as described above since the photosensitive layer contains the enamine compound represented by the general formula (2) having high charge mobility, as a charge transportation substance, charges generated by the charge generation substance by light absorption are injected efficiency to the charge transportation substance and transferred smoothly. Accordingly, by incorporating the enamine compound represented by the general formula (2) and the oxotitanium phthalocyanine to the photosensitive layer, an electrophotographic photoreceptor having high sensitivity and high resolution can be obtained. Further, since the oxotitanium phthaloycanine has the maximum absorption peak in the wavelength region of a laser light irradiated from an infrared ray laser, high quality images can be provided in a digital image forming apparatus having an infrared laser as a light source for exposure by using the electrophotographic photoreceptor of the invention.

Further, the invention is characterized in that the photoreceptor has a stacked structure composed of at least a charge generation layer containing a charge generation substance and a charge transportation layer containing a charge transportation substance, the charge transportation substance contains an enamine compound represented by the general formula (2), and at least the charge transportation layer among the charge generation layer and the charge transportation layer contains a polycarbonate resin having the asymmetric diol ingredient.

According to the invention, the photosensitive layer has a stacked structure of at least a charge generation layer containing a charge generation substance and a charge transportation layer containing a charge transportation substance containing an enamine compound represented by the general formula (2). By sharing the charge generating function and the charge transporting function respectively, to separate layers, since materials suitable to respective charge generating function and the charge transporting function can be selected, an electrophotographic photoreceptor having higher sensitivity, increased stability upon repetitive use and higher durability can be obtained. Further, at least the charge transportation layer among the charge generation layer and the charge transportation layer contains the polycarbonate resin having the asymmetric diol ingredient, productivity of the electrophotographic photoreceptor can be improved. In particular, in a case where the charge transportation layer incorporating the polycarbonate resin having the asymmetric diol ingredient is used as a surface layer of the photosensitive layer, occurrence of injuries on the surface of the photosensitive layer can be suppressed, film reduction amount of the photosensitive layer can be reduced, and change of characteristics of the photosensitive layer caused by wear of the photosensitive layer can be reduced.

Further, the invention is characterized in that the photosensitive layer has a stacked structure in which the charge generation layer and the charge transportation layer containing a binder resin containing a polycarbonate resin having the asymmetric diol ingredient are stacked in this order to the outside from the electroconductive substrate, in which the ratio A/B for the charge transportation substance (A) and binder resin (B) in the charge transportation layer is from 10/12 to 10/30 by weight ratio.

According to the invention, the photosensitive layer has a stacked structure in which the charge generation layer containing the charge generation substances and the charge transportation layer containing the charge transportation substance having the enamine compound represented by the general formula (2) and a binder resin containing a polycarbonate resin having the asymmetric diol ingredient are stacked in this order to the outside from the electroconductive substrate, in which the ratio A/B for the charge transportation substance (A) and binder resin (B) in the charge transportation layer is from 10/12 to 10/30 by weight ratio. Since the charge transportation substance contained in the charge transportation layer as a surface layer of the photosensitive layer contains the enamine compound of high charge mobility, represented by the general formula (2) as described above, the light responsivity can be maintained even in a case where the ratio A/B is defined as 10/12 to 10/30, and a binder resin is added at a ratio higher than that in a case of using a charge transportation substance known so far. Namely, the binder resin containing the polycarbonate resin having the asymmetric diol ingredient can be contained at a high concentration without lowering the light responsivity in the charge transportation layer. Accordingly, since friction resistance of the charge transportation layer is improved, and change of the characteristics due to the wear of the photosensitive layer can be suppressed, durability of the electropohotographic photoreceptor can be improved. Further, since the polycarbonate resin having the asymmetric diol ingredient contained in the photosensitive layer exhibits high solubility to a solvent irrespective that the solvent is a halogen type organic solvent or a non-halogen type organic solvent as described above, even in a case of adding the binder resin at such high ratio, the coating solution is stable without gelation, so that an electrophotographic photoreceptor can be produced efficiently for a long period of time.

Further, the invention provides an image forming apparatus comprising:

the electrophotographic photoreceptor of the invention;

charging means for charging the electrophotographic photoreceptor;

exposure means for subjecting the charged electrophotographic photoreceptor to exposure to light; and developing means for developing electrostatic latent images formed by exposure.

According to the invention, the image-forming apparatus comprises the electrophotographic photoreceptor, the charging means, the exposure means, and the developing means. Since the electrophotographic photoreceptor of the invention has, as described above, high charge potential and high charge retainability, high sensitive and satisfactory light responsivity is excellent in durability, with no deteriorated of the characteristics even in a case where it is used under a low temperature circumstance or in a high speed electrophotographic process, a highly reliable image-forming apparatus capable of providing high quality images under various circumstances for a long period of time can be obtained. In addition, since the characteristics of the photographic photoreceptor of the invention are not deteriorated by exposure to light, deterioration of image quality by exposure of the electrophotographic photoreceptor to light upon maintenance or the like can be prevented to improve the reliability of the image-forming apparatus.

Further, the invention provides a method of forming images, including a step of preparing an electrophotographic photoreceptor, a contact charging step of conducting charging by bringing a charging member into contact with the obtained electrophotographic photoreceptor, an imagewise exposure step of conducting imagewise exposure to the charged electrophotographic photoreceptor, thereby forming electrostatic latent images, and a developing step of developing the formed electrostatic latent images, wherein, in the step of preparing the electrophotographic sensitive body, an electroconductive substrate formed of an electroconductive material is prepared, and a photosensitive layer containing an enamine compound represented by the following general formula (2) and a binder resin is formed on the electroconductive substrate.

(2)

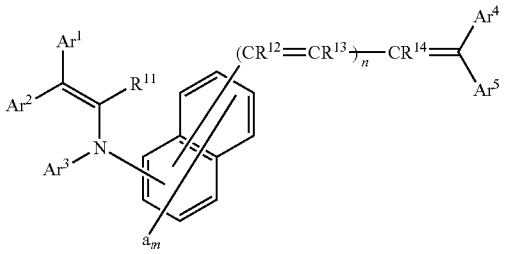

(in which $Ar^1$ and $Ar^2$ each represents an aryl group which may have a substituent or a heterocyclic group which may have a substituent. $Ar^3$ represents an aryl group which may have a substituent, a heterocyclic group which may have a substituent, an aralkyl group which may have a substituent, or an alkyl group which may have a substituent. $Ar^4$ and $Ar^5$ each represents a hydrogen atom, an aryl group which may have a substituent, a heterocyclic group which may have a substituent, an aralkyl group which may have a substituent, or an alkyl group which may have a substituent. However, both $Ar^4$ and $Ar^5$ do not form the hydrogen atoms. $Ar^4$ and $Ar^5$ may join to each other by way of an atom or an atomic group to form a ring structure. "a" represents an alkyl group which may have a substituent, an alkoxy group which may have a substituent, a dialkylamino group which may have a substituent, an aryl group which may have a substituent, a halogen atom or a hydrogen atom, and m represents an integer of 1 to 6. In a case where m is 2 or more, plural a may be identical or different with each other or may join to each other to form a ring structure. $R^{11}$ represents a hydrogen atom, a halogen atom, or an alkyl group which may have a substituent. $R^{12}$, $R^{13}$, and $R^{14}$ each represents a hydrogen atom, an alkyl group which may have a substituent, an aryl group which may have a substituent, a heterocyclic group which may have a substituent, or an aralkyl group which may have a substituent. n represents an integer of 0 to 3 and in a case where n is 2 or 3, plural $R^{12}$ may be identical or different with each other, and plural $R^{13}$ may be identical or different with each other. However, in a case where n represents 0, $Ar^3$ represents a heterocyclic ring which may have a substituent).

Further, the invention is characterized in that the enamine compound represented by the following formula (2) is an enamine compound represented by the following general formula (3).

(3)

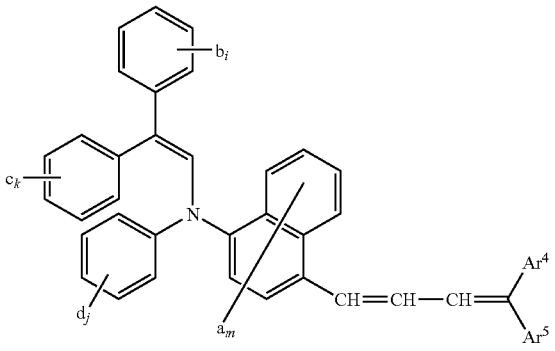

(wherein b, c and d each represent an optionally-substituted alkyl group, an optionally-substituted alkoxy group, an optionally-substituted dialkylamino group, an optionally-substituted aryl group, a halogen atom, or a hydrogen atom; i, k and j each indicate an integer of from 1 to 5; when i is 2 or more, then the "b"s may be the same or different and may bond to each other to form a cyclic structure; when k is 2 or more, then the "c" s may be the same or different and may bond to each other to form a cyclic structure; and when j is 2 or more, then the "d"s may be the same or different and may bond to each other to form a cyclic structure; $Ar^4$, $Ar^5$, "a" and "m" represent the same as those defined in formula (2).

The invention is characterized in that the ratio A/B for the enamine compound (A) represented by the general formula (2) and the binder resin (B) in the photosensitive layer is from 10/12 to 10/30 by weight ratio.

The invention provides an image forming apparatus comprising:

an electrophotographic photoreceptor;

contact charging means having a charging member, for conducting charging by bringing the charging member into contact with the electrophotographic photoreceptor;

imagewise exposure means for conducting imagewise exposure to the charged electrophotographic photoreceptor thereby forming electrostatic latent images; and developing means for developing the formed electrostatic latent images, the electrophotographic photoreceptor including:

an electroconductive substrate formed of an electroconductive material and a photosensitive layer disposed on the electroconductive substrate and containing an elamine compound represented by the general formula (2) and a binder resin.

Further, the invention is characterized in that the enamine compound represented by the general formula (2) is an enamine compound represented by the general formula (3).

The invention is characterized in that the ratio A/B for the enamine compound (A) represented by the general formula (2) and the binder resin (B) in the photosensitive layer is from 10/12 to 10/30 by weight ratio.

Further, the invention is characterized in that the charging member has a roller-like shape.

Further, the invention is characterized in that the charging member has a brush-like shape.

According to the invention, images are formed by forming a photosensitive layer containing the enamine compound represented by the general formula (2) and the binder resin to form an electrophotographic photoreceptor, and after contacting the charging member to the obtained electrophotographic photoreceptor thereby conducting charging, imagewise exposure is conducted to form electrostatic latent images and the formed electrostatic latent images are developed. Since the enamine compound represented by the general formula (2) is a charge transportation substance having a high charge mobility, it has high chargeability, sensitivity and responsivity, so that an electrophotographic photoreceptor with no deterioration of the electric characteristics even when used repetitively can be obtained. Further, since the enamine compound represented by the general formula (2) is excellent in compatibility with the binder resin and in the solubility to the solvent, it is dispersed uniformly in the binder resin without agglomeration, and when forming the photosensitive layer by coating, it dissolves uniformly in the coating solution without agglomeration. Accordingly, the electrophotographic photoreceptor has a uniform photosensitive layer with scarce injuries. Namely, by incorporating the enamine compound represented by the general formula (2) as a charge transportation substance in the photosensitive layer, an electrophotographic photoreceptor having high chargeability, sensitivity and responsivity, without deterioration of the electric characteristics and with scarce injuries of the photosensitive layer even when used repetitively can be obtained. Further, stability of the coating solution upon forming the photosensitive layer by coating can be improved thereby capable of improving the production efficiency of the electrophotographic photoreceptor.

Upon conducting charging by bringing the charging member into contact with the obtained electrophotographic photoreceptor, although high electric field is exerted concentrically to the contacting portion of the photosensitive layer and the charging member, since the photosensitive layer of the electrophotographic photoreceptor has scarce injuries, charges supplied from the charging member are not concentrated to a portion of the photosensitive layer, and the photosensitive layer is charged uniformly. Namely, the photosensitive layer does not suffer from dielectric breakdown by local leakage. Accordingly, the image forming method of the invention can provide high quality images with no image defects caused by leakage stably for a long period of time.

Further, according to the invention, since the photosensitive layer contacting the enamine compound represented by the general formula (3) having particularly high charge mobility among the enamine compounds represented by the general formula (2), an electrophotographic photoreceptor having higher sensitivity and responsivity can be obtained. Accordingly, in the image forming method of the invention, high quality images can be provided even when images are formed at high speed.

Further, according to the invention, since the ratio A/B for the weight A of the enamine compound represented by the general formula (2) and the weight B of the binder resin in the photosensitive layer is 10/12 to 10/30, and since the binder resin is contained at a high ratio in the photoreceptor, an electrophotographic photoreceptor having a tough photosensitive layer and excellent in durability can be obtained. As a result of determining the ratio A/B to 10/12 to 10/30, and increasing the ratio of the binder resin, the ratio of the enamine compound represented by the general formula (2) is lowered. However, since the enamine compound represented by the general formula (2) has high charge mobility, the electrophotographic photoreceptor has sufficiently high sensitivity and responsivity. Namely, since the electrophotographic photoreceptor has high sensitivity and responsivity, and is excellent in durability, high quality images can be provided for a long period of time.

Further, according to the invention, the image forming apparatus comprises an electrophotographic photoreceptor having a photosensitive layer containing the enamine compound represented by the general formula (2) and the binder resin, contact charging means for conducting charging by bringing the charging member into contact with the electrophotographic photosensitive layer, imagewise exposure means, and developing means. By using the contact charging means, an image forming apparatus with less generation of ozone and usable for a long period of time can be attained. Further, since the enamine compound represented by the general formula (2) contained in the photosensitive layer of the electrophotographic photoreceptor is a charge transportation substance having high charge mobility, the electrophotographic photoreceptor equipped to the image forming apparatus has high chargeability, sensitivity and responsivity, with no deterioration of the electric characteristics even when used repetitively. Further, since the enamine compound represented by the general formula (2) is excellent in the compatibility with the binder resin and in the solubility to the solvent, it is dispersed uniformly in the binder resin without agglomeration, and upon forming the photosensitive layer by coating, it is dissolved uniformly in the coating solution without causing aggregation. Accordingly, the electrophotographic photoreceptor equipped to the image forming apparatus of the invention has a uniform photosensitive layer with scarce defects. Namely, by incorporating the enamine compound represented by the general formula (2) as a charge transportation substance in the photosensitive layer, an electrophotographic photoreceptor having higher chargeability, sensitivity and respectively, with no deterioration of the electric characteristics even in a case of repetitive use and with scarce defects of the photosensitive layer can be obtained. Further, stability of the coating solution upon forming the photosensitive layer by coating can be improved, thereby capable of improving the production efficiency of the electrophotographic photoreceptor.

In a case of contacting a charge member by a contact charging means to an electrophotographic photoreceptor to conduct charging, while a high electric field is concentrated to the contacting portion in the photosensitive layer and the charging member, since the photosensitive layer of the electrophotographic photoreceptor provided to the image forming apparatus of the invention scarcely has defects as described above, charges supplied from the charging member are not concentrated to a portion in the photoreceptor but the photoreceptor is charged uniformly. That is, the photosensitive layer does not undergo insulation breakdown by local leakage. Accordingly, it is possible to obtain an image forming apparatus of high reliability capable of providing images at high quality with no image defects caused by leakage stably for a long period of time.

Further, according to the invention, since the electrophotographic photoreceptor contains, in the photosensitive layer, the enamine compound represented by the general formula (3) having particularly high charge mobility among the enamine compounds represented by the general formula (2), it has further higher sensitivity and responsivity. Accordingly, it is possible to obtain an image forming apparatus of high reliability capable of providing images at high quality even in a case of forming images at high speed. Further, since the enamine compound shown by the following general formula (3), among the enamine compounds represented by the general formula (2), can be synthesized relatively easily and can be produced at high yield and reduced cost, the electrophotographic photoreceptor having excellent electric characteristics as described above can be manufactured at a reduced manufacturing cost. Accordingly, the manufacturing cost of the image forming apparatus can be reduced, Further, according to the invention, since the ratio A/B for the weight A of the enamine compound represented by the general formula (2) and the weight B of the binder resin in the photosensitive layer is 10/12 to 10/30, and since the binder resin is contained at a high ratio in the photoreceptor, an electrophotographic photoreceptor having a tough photosensitive layer and excellent in durability can be obtained. As a result of determining the ratio A/B to 10/12 to 10/30, and increasing the ratio of the binder resin, the ratio of the enamine compound represented by the general formula (2) is lowered. However, since the enamine compound represented by the general formula (2) has high charge mobility, the electrophotographic photoreceptor has sufficiently high sensitivity and responsivity. Namely, since the electrophotographic photoreceptor has high sensitivity and responsivity, and is excellent in durability, high quality images can be provided for a long period of time.

Further, according to the invention, since the charging member has a roller-like shape, the contact portion between the charging member and the electrophotographic photoreceptor is large. Accordingly, the electrophotographic photoreceptor can be charged stably.

Further, according to the invention, since the charging member has a brush-like shape, the contact portion between the charging member and the electrophotographic photoreceptor is small. Accordingly, since the mechanical stress from the charging member to the photosensitive layer of the electrophotographic photoreceptor can be decreased, the life of the electrophotographic photoreceptor can be extended. Further, it is possible to decrease the filming caused when the toner remained on the surface of the electrophotographic photoreceptor is urged to the surface by the charging member.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1A:
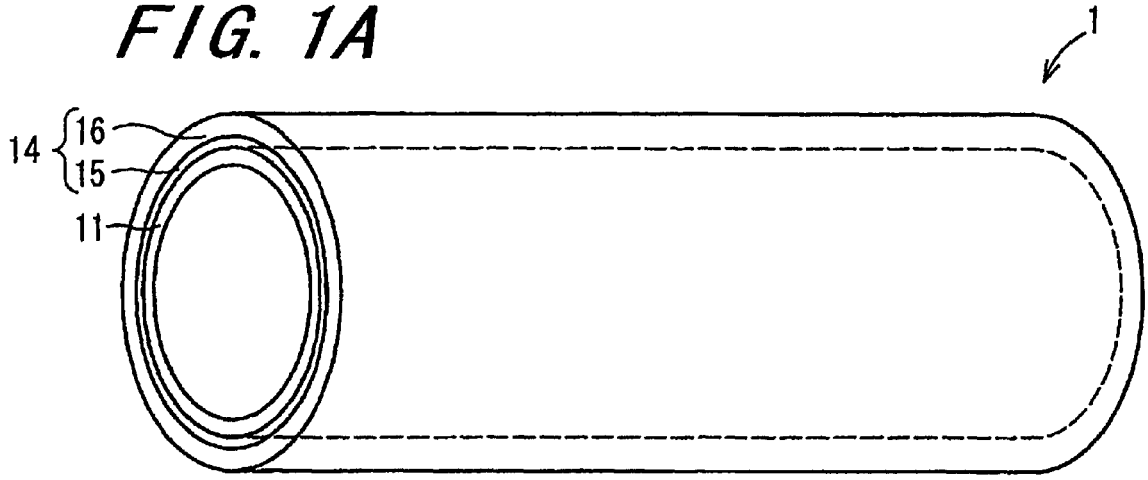
FIG. 1A is a perspective view schematically showing the constitution of an electrophotographic photoreceptor 1 according to a first embodiment of the invention.

Now referring to the drawings, preferred embodiments of the invention are described below.

Figure 1B:
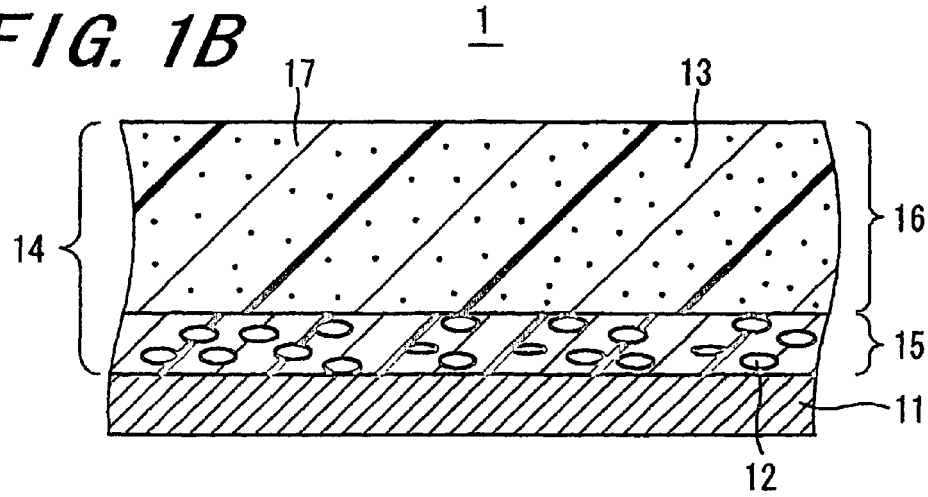
FIG. 1B is a fragmentary cross sectional view schematically showing the constitution of the electrophotographic photoreceptor 1.

FIG. 1A is a perspective view schematically showing the constitution of an electrophotographic photoreceptor 1 according to a first embodiment of the invention. FIG. 1B is a fragmentary cross sectional view schematically showing the constitution of the electrophotographic photoreceptor 1. The electrophotographic photoreceptor 1 (hereinafter sometimes referred to simply as "photoreceptor") comprises a cylindrical electroconductive substrate 11 formed of an electroconductive material and a photosensitive layer 14 disposed to the outer circumferential surface of the electroconductive substrate 11. The photosensitive layer 14 has a stacked structure in which a charge generation layer 15 containing a charge generation substance 12 that generates charges upon absorption of light and a charge transportation layer 16 containing a charge transportation substance having an ability of accepting and transferring charges generated from the charge generation substance 12 and a binder resin 17 for binding the charge transportation substance 13 stacked in this order on the outer circumferential surface of the electroconductive substrate 11. That is, the electrophotographic photoreceptor 1 is a stacked type photoreceptor.

As the binder resin 17 contained in the charge transportation layer 16, a polyarylate resin having the structural unit represented by the following general formula (1) is used.

(1)

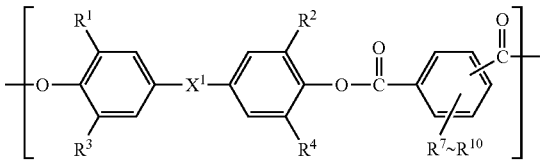

In the general formula (1), $X^1$ represents a single bond or —$CR^5R^6$—. $R^5$ and d $R^6$ each represents a hydrogen atom, a halogen atom, an alkyl group which may have a substituent or an aryl group which may have a substituent. Further, $R^5$, $R^6$ may join to each other to form a ring structure.

The single bond means that benzene rings on both sides of $X^1$ are bonded directly. In the general formula (1), specific examples in which $X^1$ is the single bond include, for example, constituent units represented by the structural formula (1-20) shown in Table 4 to be described later.

Specific examples of $R^5$ and $R^6$ include, in addition to a hydrogen atom, a halogen atom such as a fluorine atom and a chlorine atom, an alkyl group such as methyl, trifluoromethyl, isopropyl and butyl, and aryl group such as phenyl, tolyl, α-naphthyl and β-naphthyl. Specific examples of the ring structure which is formed together with a hydrogen atoms to which $R^5$ and $R^6$ are bonded when $R^5$ and $R^6$ join to each other include bivalent groups formed by removing two hydrogen atoms bonding to ring carbon atoms of a mono-nuclear or poly-nuclear hydrocarbon such as cycloalkylidene, for example, cyclohexylidene and cyclopentylidene, fluoronylidene, and 1,2,3,4-tetrahydro-2-naphthylidene group.

In the general formula (1) $R^1$, $R^2$, $R^3$, and $R^4$ each represents a hydrogen atom, a halogen atom, an alkyl group which have a substituent or an aryl group which may have a substituent. Specific example of $R^1$, $R^2$, $R^3$, and $R^4$ include, in addition to the hydrogen atom, a halogen atom such as a fluorine atom and a chlorine atom, an alkyl group such as methyl, trifluoromethyl, isopropyl and butyl, and an aryl group such as phenyl, tolyl, α-naphthyl, and β-naphthyl.

In the general formula (1) $R^7$, $R^8$, $R^9$, and $R^{10}$ each represents a hydrogen atom, a halogen atom, an alkyl group which have a substituent or an aryl group which may have a substituent. Specific example of $R^7$, $R^8$, $R^9$, and $R^{10}$ include, in addition to the hydrogen atom, a halogen atom such as a fluorine atom and a chlorine atom, an alkyl group such as methyl, trifluoromethyl, isopropyl and butyl, and an aryl group such as phenyl, α-naphthyl, and β-naphthyl.

The polyarylate resin having the structural unit represented by the general formula (1) is excellent in the mechanical strength.

Since the photosensitive layer 14 has the stacked structure formed by stacking the charge generation layer 15 and the charge transportation layer 16 in this order on the outer circumferential surface of the electroconductive substrate 11 as described above, in the electrographic process, the charge transportation layer 16 is scraped and worn by an contact member which is used, for example, upon transfer of toner images on the surface of the photoreceptor obtained by developing electrostatic latent images to the recording medium, or upon removing toners remained on the surface of the photoreceptor after transfer.

However, since the charge transportation layer 16 provided to the electrophotographic photoreceptor 1 in this embodiment contains the polyarylate resin having the structural unit represented by the general formula (1) excellent in the mechanical strength, the wear amount of the charge transportation layer 16 is small. Accordingly, it is possible to obtain an electrophotographic photoreceptor of excellent wear resistance and with less change of characteristics due to film scraping of the photosensitive layer 14.

Among the polyarylate resins having the structural unit represented by the general formula (1), preferred are polyarylate resins having a structural unit in which $X^1$ represents —$CR^5R^6$—, $R^1$, $R^2$, $R^3$, $R^4$, $R^5$, and $R^6$ each represents a methyl group, and $R^7$, $R^8$, $R^9$, and $R^{10}$ each represents a hydrogen atom in the general formula (1). Since the polyarylate resin is excellent in the solubility to a solvent, the stability of the coating solution can be improved in a case of forming the charge transportation layer 16 by coating as will be described later. Accordingly, the production efficiency of the electrophotographic photoreceptor can be improved.

Specific examples of the structural unit represented by the general formula (1) include, for example, structural units represented by the general formulae shown in the following Table 1 to Table 5, but the structural unit represented by the general formula (1) are not restricted to them.

TABLE 1

Structural formula (1-1)

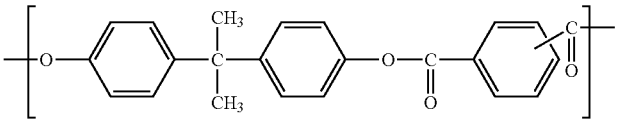

Structural formula (1-2)

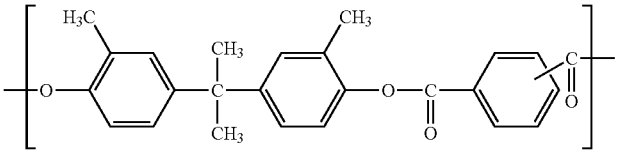

Structural formula (1-3)

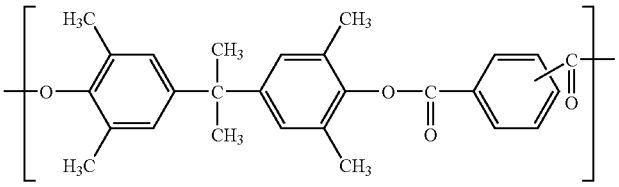

Structural formula (1-4)

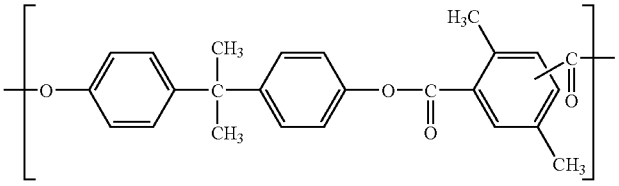

TABLE 1-continued
| | |
|---|---|
| Structural formula (1-5) | 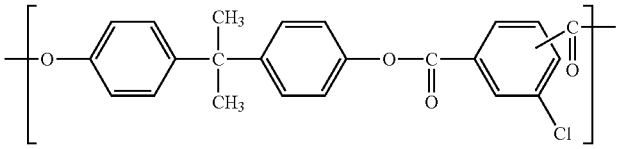 |
TABLE 2
| | |
|---|---|
| Structural formula (1-6) | 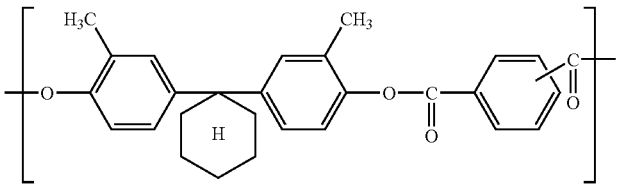 |
| Structural formula (1-7) | 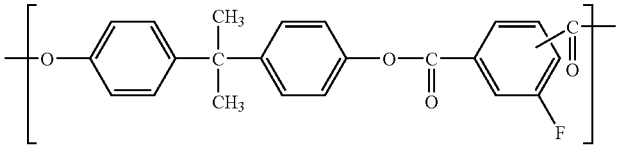 |
| Structural formula (1-8) | 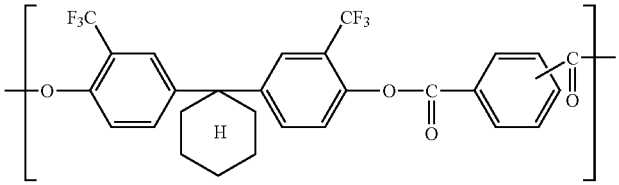 |
| Structural formula (1-9) | 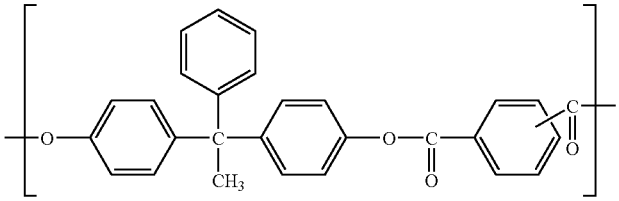 |
| Structural formula (1-10) | 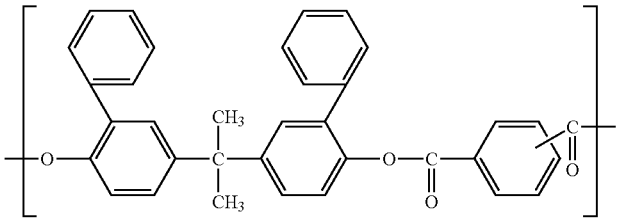 |
TABLE 3
| | |
|---|---|
| Structural formula (1-11) | 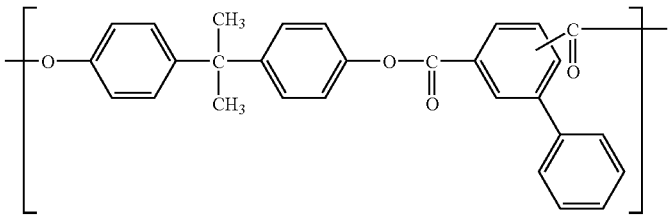 |

TABLE 3-continued
| | |
|---|---|
| Structural formula (1-12) | 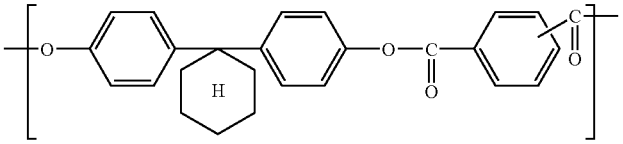 |
| Structural formula (1-13) | 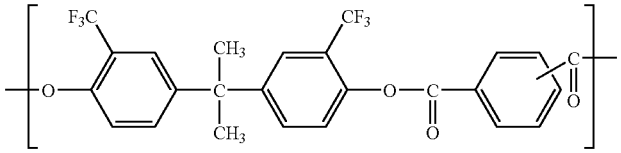 |
| Structural formula (1-14) | 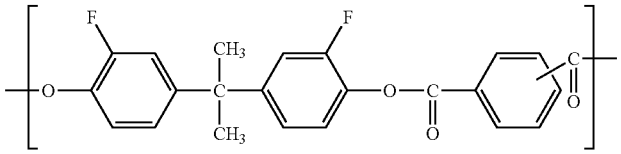 |
| Structural formula (1-15) | 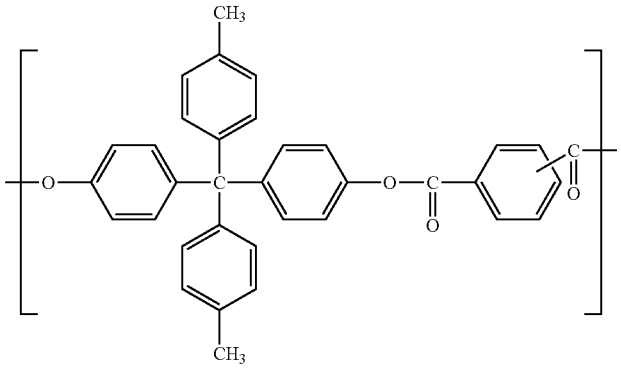 |
TABLE 4
| | |
|---|---|
| Structural formula (1-16) | 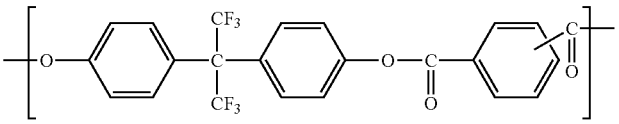 |
| Structural formula (1-17) | 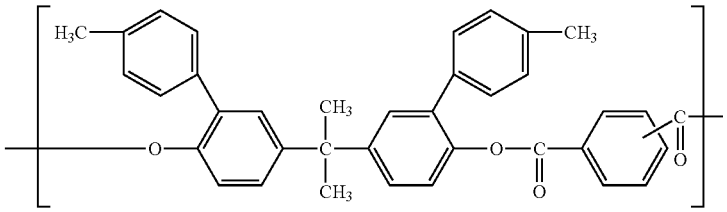 |
| Structural formula (1-18) | 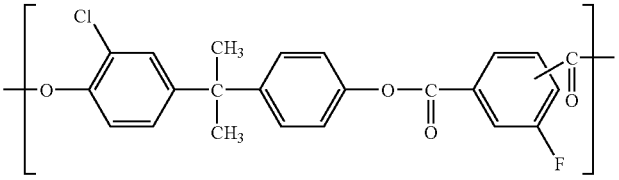 |

TABLE 4-continued

| | |
|---|---|
| Structural formula (1-19) | 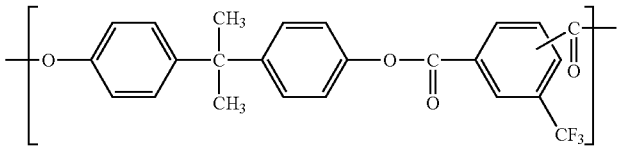 |
| Structural formula (1-20) | 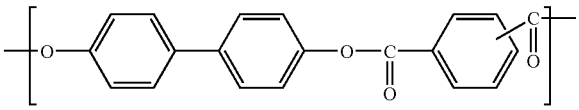 |

TABLE 5

| | |
|---|---|
| Structural formula (1-21) | 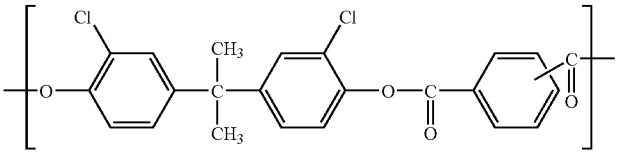 |
| Structural formula (1-22) | 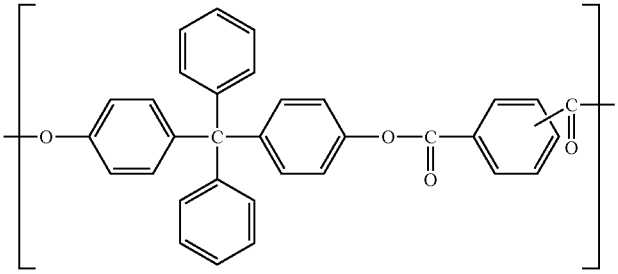 |
| Structural formula (1-23) | 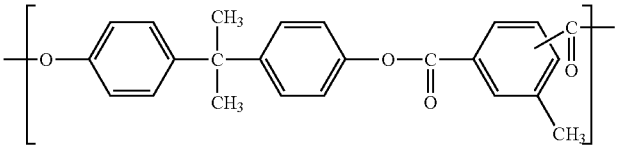 |
| Structural formula (1-24) | 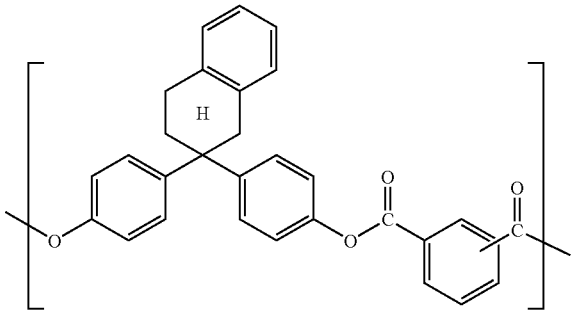 |

For the polyarylate resin having the structural unit represented by the general formula (1), resins having the structural units selected, for example, from the structural units represented by the structural formulae shown in Table 1 to Table 5 described above are used each alone or two or more or in admixture of two or more of them.

Further, the polyarylate resin having the structural unit represented by the general formula (1) may have either one or two more of structural units represented by the general formula (1). Further, it may have a structural unit other than the structural unit represented by the general formula (1) to such an extent as not deteriorating the mechanical strength.

The polyarylate resins having the structural unit represented by the general formula (1) can be manufactured by the known method. For example, they can be manufactured by stirring a phthalic acid chloride and various kinds of bisphenols in a mixed solvent of water and an organic solvent under the presence of an alkali thereby conducting interfacial polymerization.

The phthalic acid chloride is usually used as a mixture of terephthalic acid chloride and isophthalic acid chloride for controlling the solubility with the obtained polyarylate resin. Accordingly, the structural unit represented by the general formula (1) is expressed as a form to be produced from a mixture of terephthalic acid chloride and isophthalic acid chloride.

The mixing ratio between the terephthalic acid chloride and the isophthalic acid chloride is determined considering the solubility of the obtained polyarylate resin. However, since the solubility of the obtained polyarylate resin may sometimes be lowered extremely when any one of the chlorides is 30 mol % or less of the entire amount of the phthalic acid chloride, the mixing ration between the terephthalic acid chloride and the isophthalic acid chloride is preferably 1:1 by molar ratio.

The polyarylate resin having the structural unit represented by the general formula (1) has a viscosity average molecular weight, preferably, of 10,000 or more and 300,000 or less and, more preferably, 15,000 or more and 100,000 or less. In a case where the viscosity average molecular weight of the polyarylate resin having the structural unit represented by the general formula (1) is less than 10,000, the coating film becomes brittle tending to cause injuries to the surface of the photosensitive layer 14. In a case where the viscosity average molecular weight of the polyarylate resin having the structural unit represented by the general formula (1) exceeds 300,000, since the viscosity of the coating solution increases in a case of forming the charge transportation layer 16 by coating, no uniform coating can be attained to increase the unevenness of the film thickness. According, it is defined as 10,000 or more and 300,000 or less.

The polyarylate resin having the structural unit represented by the general formula (1) may be used in admixture with other binder resin within a range not deteriorating the mechanical strength. Other binder resin is selected from those excellent in the compatibility with the polyarylate resin having the structural unit represented by the general formula (1). Specific examples include, for example, vinyl polymer resins such as polymethyl methacrylate resin, polystyrene resin, and polyvinyl chloride resin, and copolymer resins thereof, as well as those resins having the structural units other than the structural unit represented by the general formula (1) such as polyarylate resin, polycarbonate resin, polyester resin, polyester carbonate resin, polysulfone resin, phenoxy resin, epoxy resin, silicone resin, polyamide resin, polyether resin, polyurethane resin, polyacrylamide resin, and phenol resin. Further, thermosetting resins obtained by partially crosslinking the resins described above may also be used.

The charge transportation layer 16 is formed by binding the charge transportation substance 13 to the binder resin 17 containing the polyarylate resin having the structural unit represented by the general formula (1). As the charge transportation substance 13, an enamine compound represented by the following general formula (2) is used.

[Ka 11]

(2)

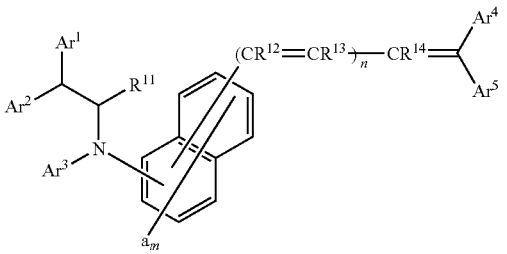

In the general formula (2), $Ar^1$ and $Ar^2$ each represents an aryl group which may have a substituent or a heterocyclic group which may have a substituent. $Ar^3$ represents an aryl group which may have a substituent, a heterocyclic group which may have a substituent, an aralkyl group which may have a substituent, or an alkyl group which may have a substituent. $Ar^4$ and $Ar^5$ each represents a hydrogen atom, an aryl group which may have a substituent, a heterocyclic group which may have a substituent, an aralkyl group which may have a substituent, or an alkyl group which may have a substituent. However, both $Ar^4$ and $Ar^5$ do not form the hydrogen atoms. $Ar^4$ and $Ar^5$ may join to each other by way of an atom or an atomic group to form a ring structure. "a" represents an alkyl group which may have a substituent, an alkoxy group which may have a substituent, a dialkylamino group which may have a substituent, an aryl group which may have a substituent, a halogen atom or a hydrogen atom, and m represents an integer of 1 to 6. In a case where m is 2 or more, plural a may be identical or different with each other or may join to each other to form a ring structure. $R^{11}$ represents a hydrogen atom, a halogen atom, or an alkyl group which may have a substituent. $R^{12}$, $R^{13}$, and $R^{14}$ each represents a hydrogen atom, an alkyl group which may have a substituent, an aryl group which may have a substituent, a heterocyclic group which may have a substituent, or an aralkyl group which may have a substituent. n represents an integer of 0 to 3 and in a case where n is 2 or 3, plural $R^{12}$ may be identical or different with each other, and plural $R^{13}$ may be identical or different with each other. However, in a case where n represents 0, $Ar^3$ represents a heterocyclic ring which may have a substituent.

In the general formula (2), specific examples of the aryl group represented by $Ar^1$, $Ar^2$, $Ar^3$, $Ar^4$, $Ar^5$, a, $R^{12}$, $R^{13}$ or $R^{14}$ include, for example, phenyl, naphthyl, pyrenyl and anthryl. The substituent which may be present on the aryl group include, for example, an alkyl group such as methyl, ethyl, propyl, and trifluoromethyl, an alkeny group such as 2-propenyl and styryl, an alkoxy group such as methoxy, ethoxy and propoxy, an amino group such as methylamino and dimethylamino, a halogen group such as fluoro, chloro and bromo, an aryl group such as phenyl and naphthyl, an aryloxy group such as phenoxy, and an arylthio group such as thiophenoxy. Specific examples of the aryl group having such substituent include, for example, tolyl, methoxyphenyl, biphenylyl, terphenyl, phenoxyphenyl, p-(phenylthio)phenyl and p-stylylphenyl.

Specific examples of the heterocyclic group represented by $Ar^1$, $Ar^2$, $Ar^3$, $Ar^4$, $Ar^5$, $R^{12}$, $R^{13}$, or $R^{14}$ in the general formula (2) include, for example, furyl, thienyl, thiazolyl, benzofuryl, benzothiophenyl, benzothiazolyl, and benzooxazolyl. The substituent which may be present on the heterocyclic group described above include those substituent identical with the substituents that may be present on the aryl group shown, for example, by $Ar^1$, and specific examples of the heterocyclic group which may have a substituent include, for example, N-methylindolyl, and N-methylcarbazolyl.

Specific examples of the aralkyl group represented by $Ar^3$, $Ar^4$, $Ar^5$, $R^{12}$, $R^{13}$, or $R^{14}$ in the general formula (2) include, for example, benzyl and 1-naphthylmethyl. The substituent which may be present on the aralkyl group described above include, those substituents identical with the substituent which may be present on the aryl group shown, for example, by $Ar^1$, and specific examples of the aralkyl group having the substituent include, for example, p-methoxybenzyl.

As the alkyl group represented by $Ar^3$, $Ar^4$, $Ar^5$, a, $R^{11}$, $R^{12}$, $R^{13}$, or $R^{14}$ in the general formula (2), those of 1 to 6 carbon atoms are preferred, and specific examples include, for example, a chained alkyl group such as methyl, ethyl, n-propyl, isopropyl, and t-butyl, as well as a cycloalkyl group such as cyclohexyl and cyclopentyl. The substituent that may be present on the alkyl groups described above include those substituents identical with the substituents that may be present on the aryl group represented, for example, by $Ar^1$ described above. Specific examples of the alkyl group having the substituent include, for example, a halogenated alkyl group such as trifuloromethyl and fluoromethyl, an alkoxyalkyl group such as 1-methoxyethyl and an alkyl group substituted with a heterocyclic group such as 2-thienylmethyl.

As the alkoxy group represented by a in the general formula (2), those of 1 to 4 carbon atoms are preferred and specific examples include, for example, methoxy, ethoxy, n-propoxy, and isopropoxy. The substituents that may be present on the alkoxy group include those substituents identical with the substituents that may be present on the aryl group represented, for example, by $Ar^1$ described above.

As the dialkylamino group represented by a in the general formula (2), those substituted with an alkyl group of 1 to 4 carbon atoms are preferred and specific examples include, for example, dimethylamino, diethylamino, and diisopropylamino. The substituent that may be present on the dialkylamino groups include those substituents identical with the substituents that may be present on the aryl group shown, for example, by $Ar^1$ described above.

Specific examples of the halogen atom represented by a or $R^{11}$ in the general formula (2) include, for example, a fluorine atoms and a chlorine atoms.

Specific examples of the atom for bonding with $Ar^4$ and $Ar^5$ in the general formula (2) include, for example, an oxygen atom, a sulfur atom and a nitrogen atom. The nitrogen atom can bond in the form of a bivalent group such as an imino group or N-alkylimino group with $Ar^4$ and $Ar^5$. Specific examples of the atomic group for bonding with $Ar^4$ and $Ar^5$ include, for example, those bivalent groups, for example, an alkylene group such as methylene, ethylene and methylmethylene, an alkenylene group such as vinylene and propenylene, an alkylene group containing a hetero atom such as oxymethylene (chemical formula: —O—$CH_2$—), as well as an alkenylene group containing a hetero atom such as thiovinylene (chemical formula: -s-CH═CH—).

Since the enamine compound represented by the general formula (2) is excellent in the compatibility with the polyarylate resin having the structural unit represented by the general formula (1) and has high charge mobility, it is possible to obtain an electrophotographic photoreceptor having high charge potential, high sensitivity, showing sufficient responsivity and not suffering from deterioration of the electric characteristics even during repetitive use also in a case where the charge transportation layer 16 contains a polyarylate resin having the structural unit represented by the general formula (1).

Accordingly, when the polyarylate resin having the structural unit represented by the general formula (1) and the enamine compound represented by the general formula (2) are incorporated in combination in the charge transportation layer 16, it is possible to obtain an electrophotographic photoreceptor of high durability that is excellent in the mechanical strength and capable of enduring increase in the mechanical stress accompanied by digitalization and increased resolution in the electrophotographic apparatus, as well as capable of providing favorable electric characteristics stably over a long period of time.

(3)

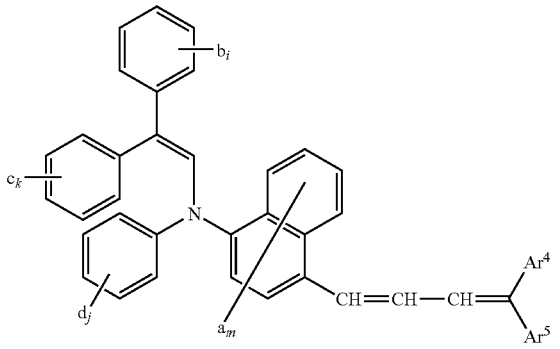

In the general formula (3), b, c and d each represent an optionally-substituted alkyl group, an optionally-substituted alkoxy group, an optionally-substituted dialkylamino group, an optionally-substituted aryl group, a halogen atom, or a hydrogen atom; i, k and j each indicate an integer of from 1 to 5; when i is 2 or more, then the "b"s may be the same or different and may bond to each other to form a cyclic structure; when k is 2 or more, then the "c"s may be the same or different and may bond to each other to form a cyclic structure; and when j is 2 or more, then the "d"s may be the same or different and may bond to each other to form a cyclic structure; $Ar^4$, $Ar^5$ "a" and "m" represent the same as those defined in formula (1).

In the general formula (3), as the alkyl group represented by b, c, and d, those of 1 to 6 carbon atoms are preferred and specific examples include, for example, a chained alkyl group such as methyl, ethyl, n-propyl, and isopropyl, and a cloalkyl group such as cyclohexyl and cyclopentyl. The substituents that can be present on the alkyl group include those substituents identical with the substituents that may be present on the aryl group shown, for example, by $Ar^1$ described above and specific examples of the alkyl group having the substituent include, for example, a halogenated alkyl group such as trifluoromethyl and fluoromethyl, an alkoxyalkyl group such as 1-methoxyethyl, and an alkyl group substituted with a heterocyclic group such as 2-thienylmethyl.

As the alkoxy group represented by b, c, and d in the general formula (3), those of 1 to 4 carbon atoms are preferred and specific examples include, for example, methoxy, ethoxy, n-propoxy and isopropoxy. The substituents that may be present on the alkoxy groups include those substituents identical with the substituents which may be present on the aryl group shown, for example, by $Ar^1$.

As the dialkylamino group represented by b, c, or d in the general formula (3), those substituted with an alkyl group of 1 to 4 carbon atoms are preferred and specific examples include, for example, dimethylamino, diethylamino, and diisopropyl amino. The substituents that may be present on the dialkylamino group include those substituents identical with the substituents that may be present on the aryl group, for example, shown by $Ar^1$.

Specific examples of the aryl group represented by b, c, or d in the general formula (3) include, for example, phenyl and naphthyl. The substituents which may be present on the aryl groups include, those substituents identical with the substituents which may be present on the aryl group, for example, shown by $Ar^1$, and specific examples of the aryl group having the substituent include, for example, tolyl and methoxyphenyl.

Specific examples of the halogen atom represented by b, c, or d in the general formula (3) include, for example, fluorine atom and chlorine atom.

The enamine compound represented by the general formula (3) has particularly high charge mobility. Accordingly, by incorporating the enamine compound represented by the general formula (3) into the photosensitive layer 14, it is possible to obtain an electrophotographic photoreceptor of high reliability showing high charge potential, high sensitivity, and sufficient responsivity, and excellent in the durability with no deterioration of the characteristics even in a case of use in the high speed electrophotographic process.

Further, among the enamine compounds represented by the general formula (2), compounds particularly excellent in view of the characteristics, the cost, the productivity, etc. include those in which $Ar^1$ and $Ar^2$ each represents a phenyl group, $Ar^3$ represents a phenyl group, tolyl group, p-methoxyphenyl group, biphenylyl group, naphthyl group or thienyl group, at least one of $Ar^4$ and $Ar^5$ represents a phenyl group, p-tolyl group, p-methyxyphenyl group, naphthyl group, thienyl group, or thiazolyl group, each of $R^{11}$, $R^{12}$, $R^{13}$, and $R^{14}$ is a hydrogen atom, and n is 1.

Specific examples of the enamine compound represented by the general formula (2) include, for example, those exemplified compounds having the groups shown in the following Table 6 to Table 37 but the enamine compounds represented by the general formula (2) are not restricted to them. Each of the groups shown in Table 6 to Table 37 corresponds to each of the groups in the general formula (2). For example, the Exemplified Compound No. 1 shown in Table 6 is an enamine compound shown by the following structural formula (2-1).

[Ka 13]

(2-1)

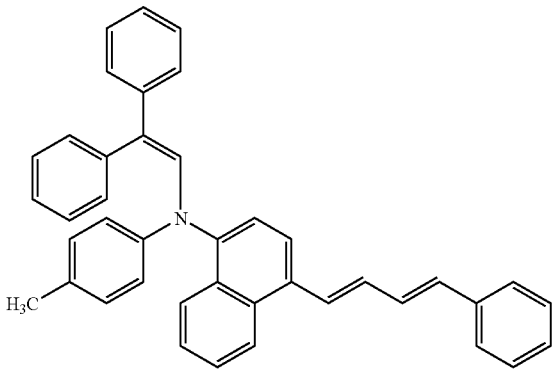

In a case where $Ar^4$ and $Ar^5$ join to each other by way of an atom or an atomic group to form a ring structure, the carbon-carbon double bond to which $Ar^4$ and $Ar^5$ are bonded, and a ring structure formed with $Ar^4$ and $Ar^5$ together with the carbon atoms of the carbon-carbon double bond are shown together from the column for $Ar^4$ to the column $Ar^5$ in Table 6 to Table 37.

TABLE 6

| Compound No. | $Ar^1$ | $Ar^2$ | $R^{11}$ | $Ar^3$ | 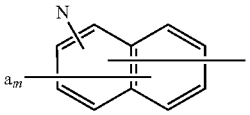 |
|---|---|---|---|---|---|
| 1 | 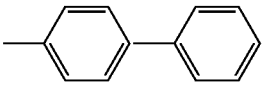 | | H | 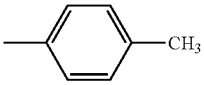 | 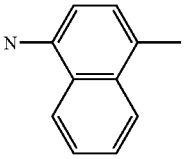 |
| 2 | 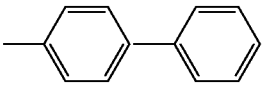 | | H | 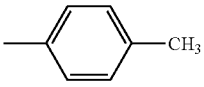 | 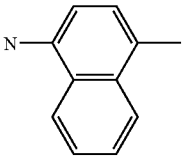 |
| 3 | 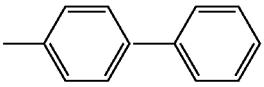 | | H | 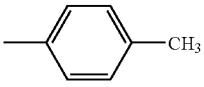 | 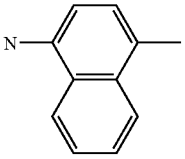 |

TABLE 6-continued
| | | | | |
|---|---|---|---|---|
| 4 | 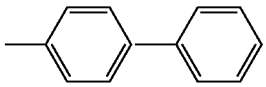 | H | 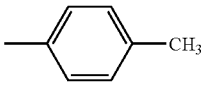 | 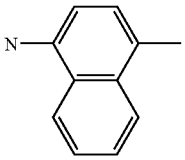 |
| 5 | 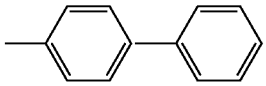 | H | 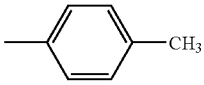 | 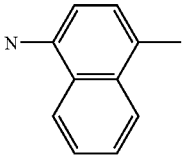 |
| 6 | 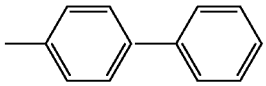 | H | 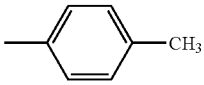 | 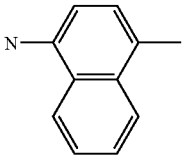 |
| 7 | 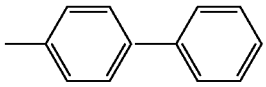 | H | 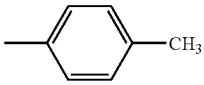 | 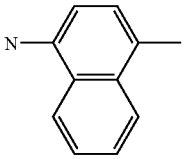 |
| Compound No. | n | $-(CR^{12}=CR^{13})_n-$ | $R^{14}$ | $Ar^4$ | $Ar^5$ |
|---|---|---|---|---|---|
| 1 | 1 | CH═CH | H | H | 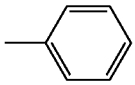 |
| 2 | 1 | CH═CH | H | H | 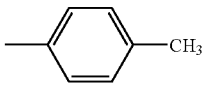 |
| 3 | 1 | CH═CH | H | —$CH_3$ | 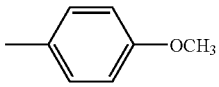 |
| 4 | 1 | CH═CH | H | H | 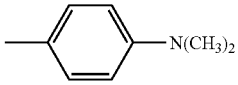 |
| 5 | 1 | CH═CH | H | H | 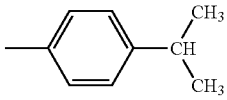 |
| 6 | 1 | CH═CH | H | H | 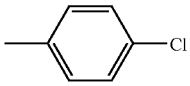 |
| 7 | 1 | CH═CH | H | —$CH_3$ | 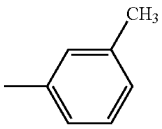 |

TABLE 7
| Compound No. | $Ar^1$ | $Ar^2$ | $R^{11}$ | $Ar^3$ | $a_m$ 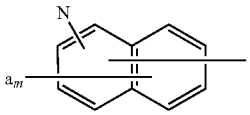 |
|---|---|---|---|---|---|
| 8 | 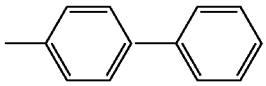 | | H | 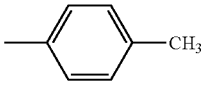 | 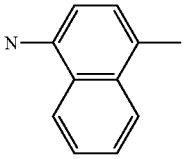 |
| 9 | 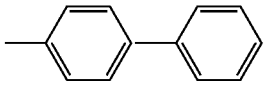 | | H | 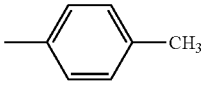 | 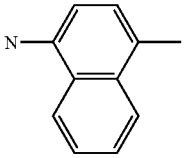 |
| 10 | 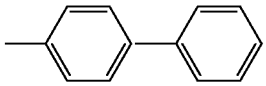 | | H | 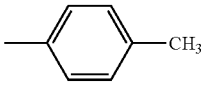 | 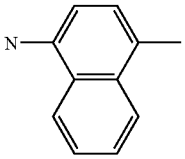 |
| 11 | 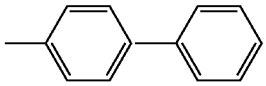 | | H | 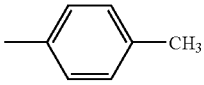 | 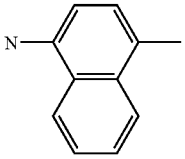 |
| 12 | 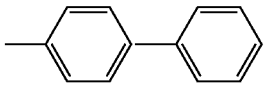 | | H | 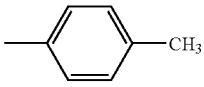 | 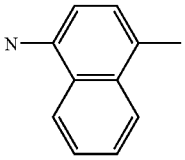 |
| 13 | 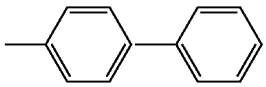 | | H | 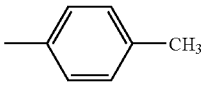 | 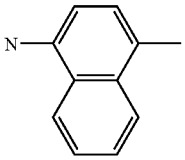 |
| 14 | 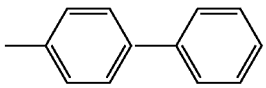 | | H | 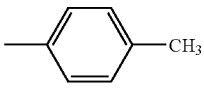 | 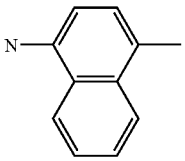 |
| Compound No. | n | $-(CR^{12}=CR^{13})_n-$ | $R^{14}$ | $Ar^4$ | $Ar^5$ |
|---|---|---|---|---|---|
| 8 | 1 | CH═CH | H | H | 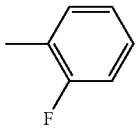 |

TABLE 7-continued
| | | | | | |
|---|---|---|---|---|---|
| 9 | 1 | CH═CH | H | —$CH_3$ | 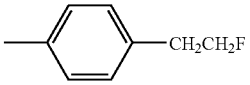 |
| 10 | 1 | CH═CH | H | —$CH_3$ | 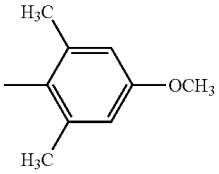 |
| 11 | 1 | CH═CH | H | H | 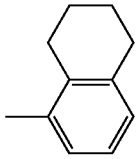 |
| 12 | 1 | CH═CH | H | H | 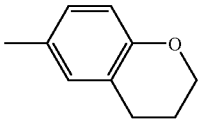 |
| 13 | 1 | CH═CH | H | H | 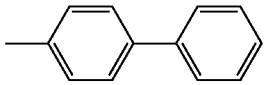 |
| 14 | 1 | CH═CH | H | H | 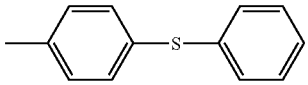 |
TABLE 8
| Compound No. | $Ar^1$ | $Ar^2$ | $R^{11}$ | $Ar^3$ | 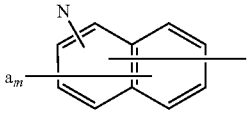 |
|---|---|---|---|---|---|
| 15 | 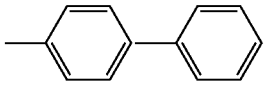 | | H | 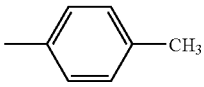 | 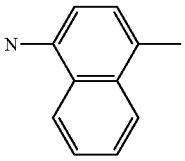 |
| 16 | 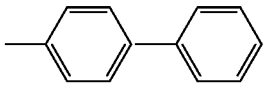 | | H | 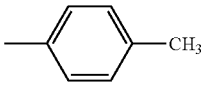 | 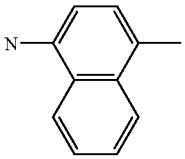 |
| 17 | 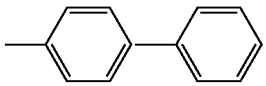 | | H | 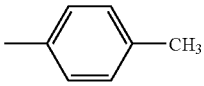 | 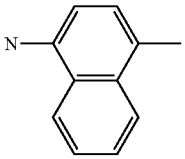 |

TABLE 8-continued
| | | | | |
|---|---|---|---|---|
| 18 | 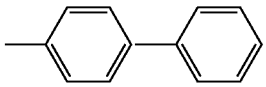 | H | 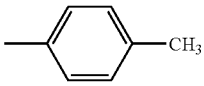 | 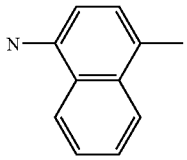 |
| 19 | 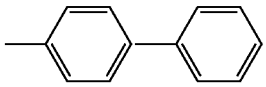 | H | 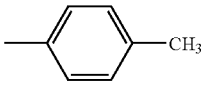 | 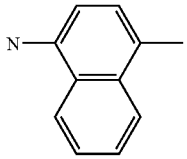 |
| 20 | 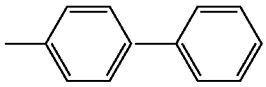 | H | 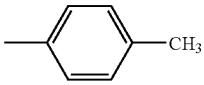 | 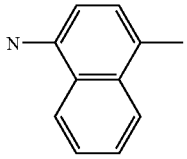 |
| 21 | 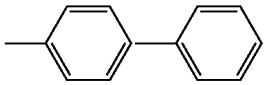 | H | 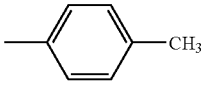 | 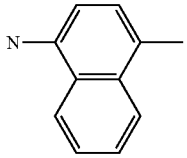 |
| Compound No. | n | $-(CR^{12}=CR^{13})_n-$ | $R^{14}$ | $Ar^4$ | $Ar^5$ |
|---|---|---|---|---|---|
| 15 | 1 | CH═CH | H | H | 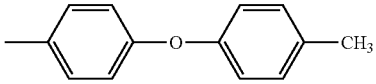 |
| 16 | 1 | CH═CH | H | —$CH_3$ | 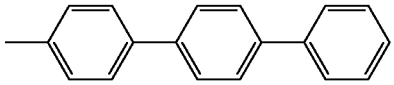 |
| 17 | 1 | CH═CH | H | H | 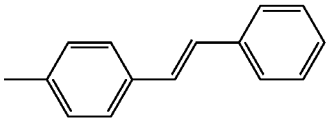 |
| 18 | 1 | CH═CH | H | —$CH_3$ | 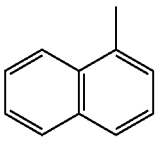 |
| 19 | 1 | CH═CH | H | H | 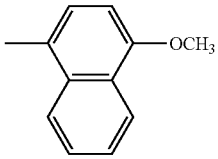 |
| 20 | 1 | CH═CH | H | H | 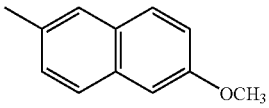 |

TABLE 8-continued
| | | | | | |
|---|---|---|---|---|---|
| 21 | 1 | CH═CH | H | H | 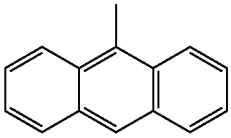 |
TABLE 9
| Compound No. | $Ar^1$ | $Ar^2$ | $R^{11}$ | $Ar^3$ | 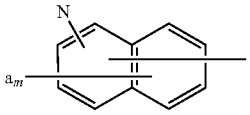 |
|---|---|---|---|---|---|
| 22 | 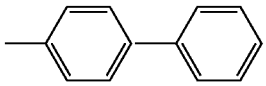 | | H | 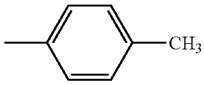 | 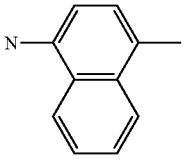 |
| 23 | 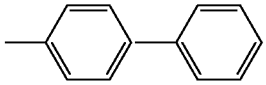 | | H | 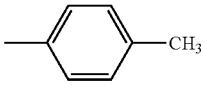 | 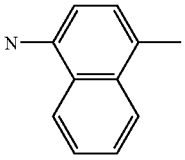 |
| 24 | 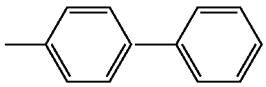 | | H | 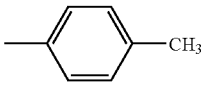 | 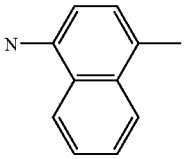 |
| 25 | 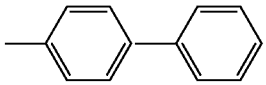 | | H | 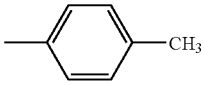 | 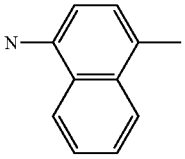 |
| 26 | 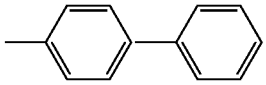 | | H | 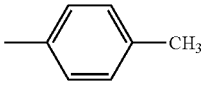 | 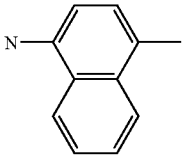 |
| 27 | 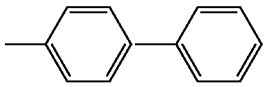 | | H | 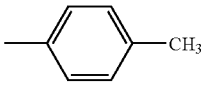 | 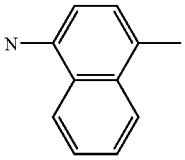 |
| 28 | 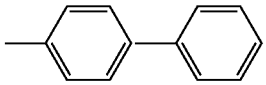 | | H | 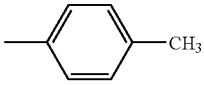 | 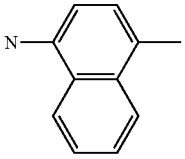 |

TABLE 9-continued
| Compound No. | n | $-(CR^{12}=CR^{13})_n-$ | $R^{14}$ | $Ar^4$ | $Ar^5$ |
|---|---|---|---|---|---|
| 22 | 1 | CH═CH | H | H | 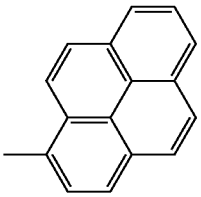 |
| 23 | 1 | CH═CH | H | —$CH_3$ | 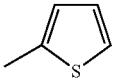 |
| 24 | 1 | CH═CH | H | —$CH_3$ | 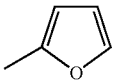 |
| 25 | 1 | CH═CH | H | H | 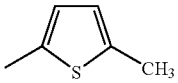 |
| 26 | 1 | CH═CH | H | H | 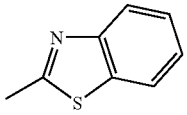 |
| 27 | 1 | CH═CH | H | H | 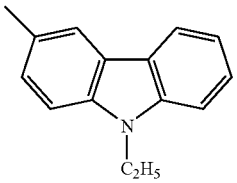 |
| 28 | 1 | CH═CH | H | 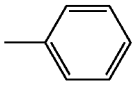 | 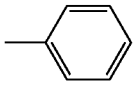 |
TABLE 10
| Compound No. | $Ar^1$ | $Ar^2$ | $R^{11}$ | $Ar^3$ | 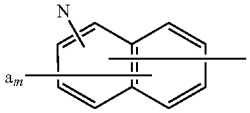 |
|---|---|---|---|---|---|
| 29 | 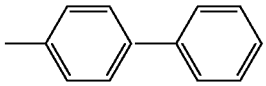 | | H | 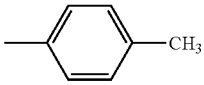 | 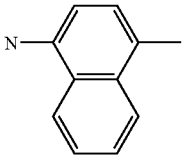 |
| 30 | 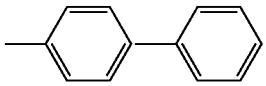 | | H | 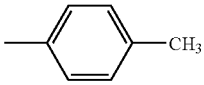 | 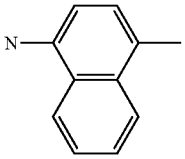 |

TABLE 10-continued
| | | | | |
|---|---|---|---|---|
| 31 | 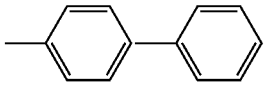 | H | 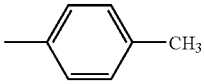 | 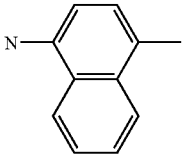 |
| 32 | 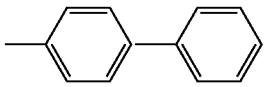 | H | 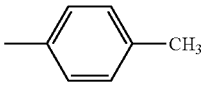 | 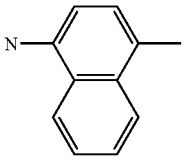 |
| 33 | 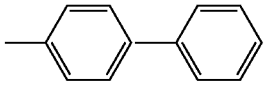 | H | 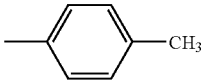 | 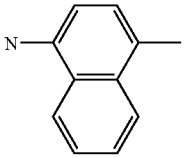 |
| 34 | 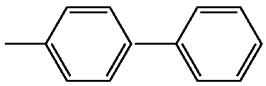 | H | 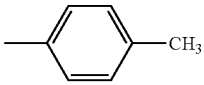 | 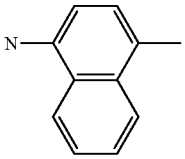 |
| 35 | 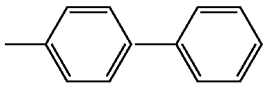 | H | 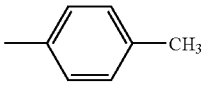 | 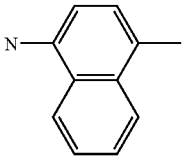 |
| Compound No. | n | $-(CR^{12}=CR^{13})_n-$ | $R^{14}$ | $Ar^4$ | $Ar^5$ |
|---|---|---|---|---|---|
| 29 | 1 | CH═CH | H | 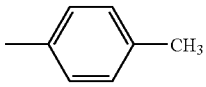 | 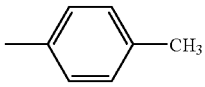 |
| 30 | 1 | CH═CH | H | 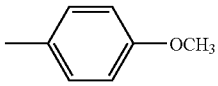 | 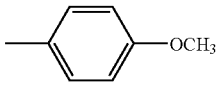 |
| 31 | 1 | CH═CH | H | 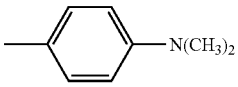 | 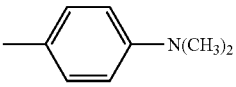 |
| 32 | 1 | CH═CH | H | 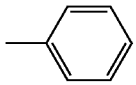 | 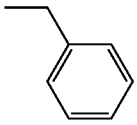 |
| 33 | 1 | CH═CH | H | 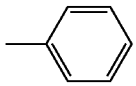 | 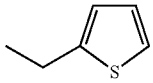 |
| 34 | 1 | CH═CH | H | 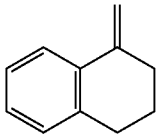 | |

TABLE 10-continued

| | | | | |
|---|---|---|---|---|
| 35 | 1 | CH═CH | H | |

TABLE 11

| Compound No. | $Ar^1$ | $Ar^2$ | $R^{11}$ | $Ar^3$ | $a_m$ |
|---|---|---|---|---|---|
| 36 | | | H | $CH_3$ | N |
| 37 | | | H | $CH_3$ | N |
| 38 | | | H | $CH_3$ | N |
| 39 | | | H | $CH_3$ | N |
| 40 | | | H | $CH_3$ | N |
| 41 | | | H | $CH_3$ | N |
| 42 | | | H | $CH_3$ | N |

TABLE 11-continued

| Compound No. | n | $-(CR^{12}=CR^{13})_n-$ | $R^{14}$ | $Ar^4$ | $Ar^5$ |
|---|---|---|---|---|---|
| 36 | 1 | CH═CH | H | | |
| 37 | 1 | CH═CH | H | | |
| 38 | 1 | CH═CH | H | | |
| 39 | 1 | CH═CH | $-CH_3$ | H | |
| 40 | 1 | CH═CH | | H | |
| 41 | 1 | $HC{=}C(CH_2F)$ | H | H | |
| 42 | 1 | | H | H | |

TABLE 12

| Compound No. | $Ar^1$ | $Ar^2$ | $R^{11}$ | $Ar^3$ | |
|---|---|---|---|---|---|
| 43 | | | H | | |
| 44 | | | H | | |

TABLE 12-continued
| | | | | |
|---|---|---|---|---|
| 45 | 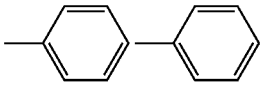 | H | 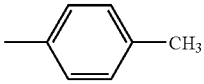 | 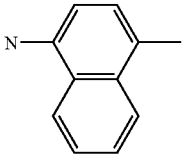 |
| 46 | 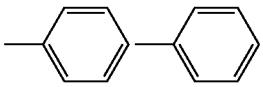 | H | 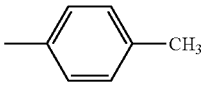 | 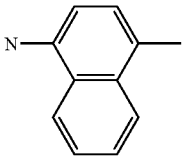 |
| 47 | 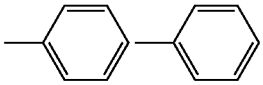 | H | 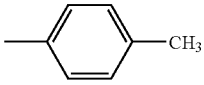 | 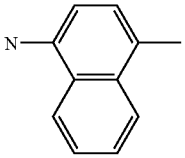 |
| 48 | 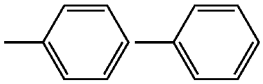 | H | 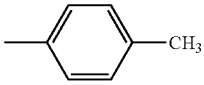 | 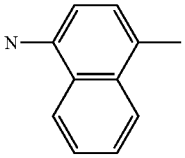 |
| 49 | 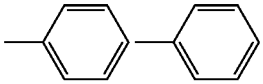 | H | 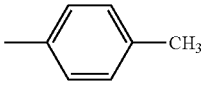 | 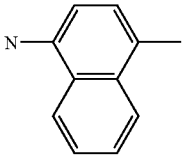 |
| Compound No. | n | $-(CR^{12}=CR^{13})_n-$ | $R^{14}$ | $Ar^4$ | $Ar^5$ |
|---|---|---|---|---|---|
| 43 | 1 | 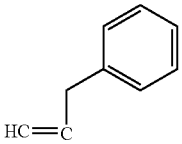 | H | H | 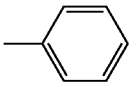 |
| 44 | 1 | 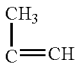 | H | H | 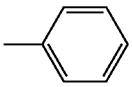 |
| 45 | 1 | 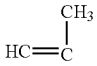 | 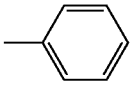 | H | 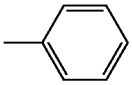 |
| 46 | 2 | CH═CH—CH═CH | H | H | 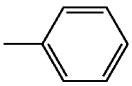 |
| 47 | 2 | CH═CH—CH═CH | H | H | 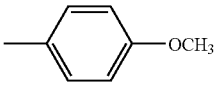 |
| 48 | 2 | CH═CH—CH═CH | H | $—CH_3$ | 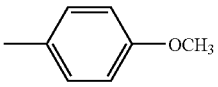 |

TABLE 12-continued
| | | | | | |
|---|---|---|---|---|---|
| 49 | 2 | CH═CH—CH═CH | H | —$CH_3$ | 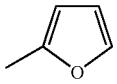 |
TABLE 13
| Compound No. | $Ar^1$ | $Ar^2$ | $R^{11}$ | $Ar^3$ | 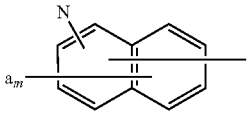 |
|---|---|---|---|---|---|
| 50 | 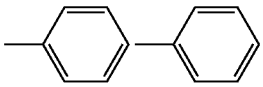 | | H | 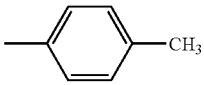 | 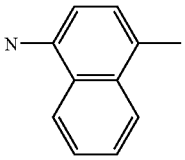 |
| 51 | 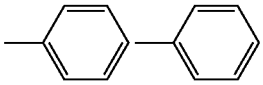 | | H | 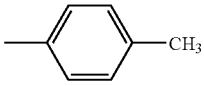 | 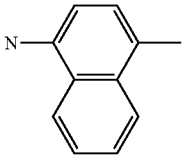 |
| 52 | 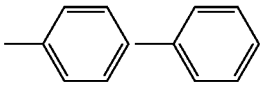 | | H | 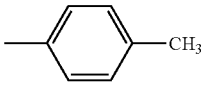 | 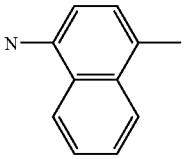 |
| 53 | 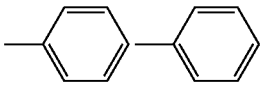 | | H | 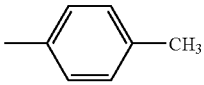 | 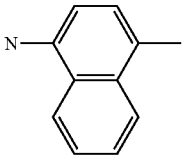 |
| 54 | 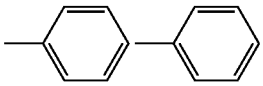 | | H | 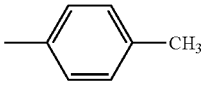 | 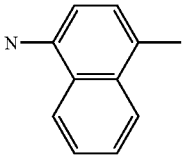 |
| 55 | 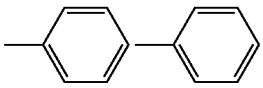 | | H | 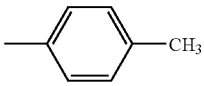 | 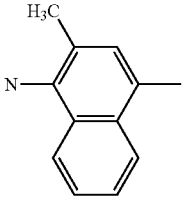 |
| 56 | 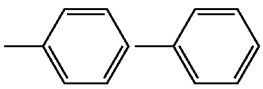 | | H | 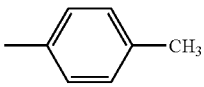 | 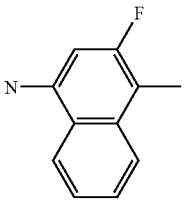 |

TABLE 13-continued
| Compound No. | n | $-(CR^{12}=CR^{13})_n-$ | $R^{14}$ | $Ar^4$ | $Ar^5$ |
|---|---|---|---|---|---|
| 50 | 2 | CH═CH—CH═CH | H | —$CH_3$ | 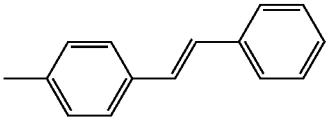 |
| 51 | 2 | CH═CH—CH═CH | H | —$CH_3$ | 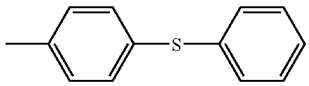 |
| 52 | 2 | 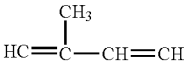 | H | H | 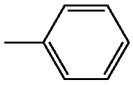 |
| 53 | 2 | 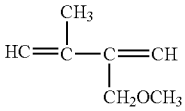 | H | H | 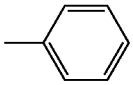 |
| 54 | 3 | $-(HC=CH)_3-$ | H | H | 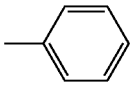 |
| 55 | 1 | CH═CH | H | H | 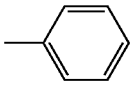 |
| 56 | 1 | CH═CH | H | H | 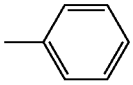 |
TABLE 14
| Compound No. | $Ar^1$ | $Ar^2$ | $R^{11}$ | $Ar^3$ | 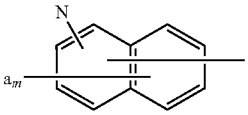 |
|---|---|---|---|---|---|
| 57 | 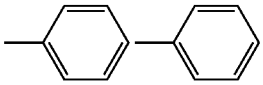 | | H | 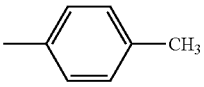 | 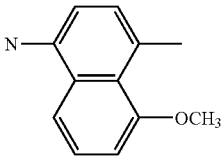 |
| 58 | 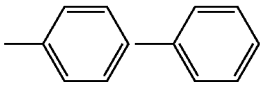 | | H | 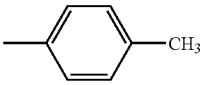 | 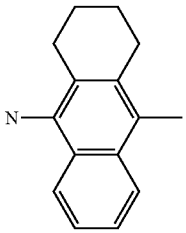 |
| 59 | 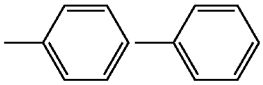 | | H | 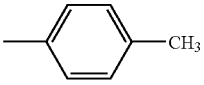 | 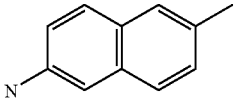 |

TABLE 14-continued
| | | | | |
|---|---|---|---|---|
| 60 | 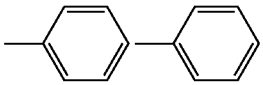 | H | 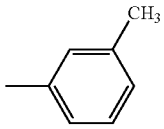 | 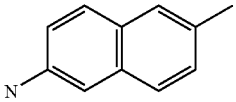 |
| 61 | 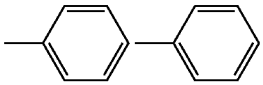 | H | 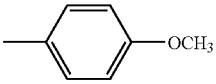 | 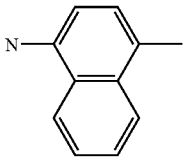 |
| 62 | 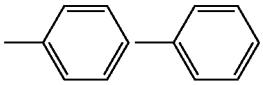 | H | 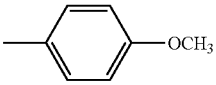 | 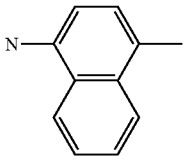 |
| 63 | 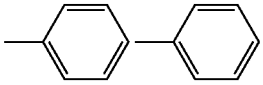 | H | 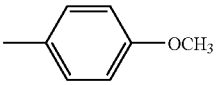 | 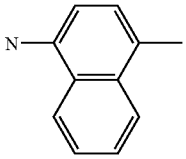 |
| Compound No. | n | $-(CR^{12}=CR^{13})_n-$ | $R^{14}$ | $Ar^4$ | $Ar^5$ |
|---|---|---|---|---|---|
| 57 | 1 | CH═CH | H | H | 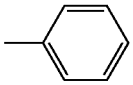 |
| 58 | 1 | CH═CH | H | H | 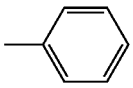 |
| 59 | 1 | CH═CH | H | H | 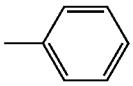 |
| 60 | 1 | CH═CH | H | H | 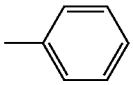 |
| 61 | 1 | CH═CH | H | H | 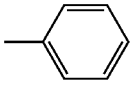 |
| 62 | 1 | CH═CH | H | H | 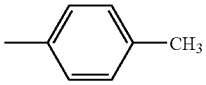 |
| 63 | 1 | CH═CH | H | $-CH_3$ | 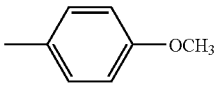 |

TABLE 15

| Compound No. | $Ar^1$ | $Ar^2$ | $R^{11}$ | $Ar^3$ | N, $a_m$ |
|---|---|---|---|---|---|
| 64 | | | H | $OCH_3$ | N |
| 65 | | | H | $OCH_3$ | N |
| 66 | | | H | $OCH_3$ | N |
| 67 | | | H | $OCH_3$ | N |
| 68 | | | H | $OCH_3$ | N |
| 69 | | | H | $OCH_3$ | N |
| 70 | | | H | $OCH_3$ | N |

| Compound No. | n | $-(CR^{12}=CR^{13})_n-$ | $R^{14}$ | $Ar^4$ | $Ar^5$ |
|---|---|---|---|---|---|
| 64 | 1 | CH═CH | H | H | $N(CH_3)_2$ |
| 65 | 1 | CH═CH | H | H | $CH_3$, CH, $CH_3$ |

TABLE 15-continued
| | | | | | |
|---|---|---|---|---|---|
| 66 | 1 | CH═CH | H | —$CH_3$ | 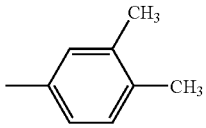 |
| 67 | 1 | CH═CH | H | H | 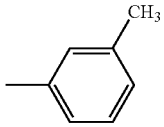 |
| 68 | 1 | CH═CH | H | H | 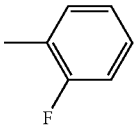 |
| 69 | 1 | CH═CH | H | H | 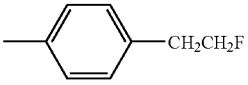 |
| 70 | 1 | CH═CH | H | H | 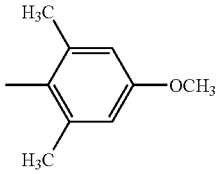 |
TABLE 16
| Compound No. | $Ar^1$ | $Ar^2$ | $R^{11}$ | $Ar^3$ | 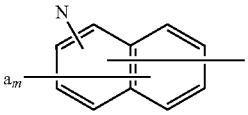 |
|---|---|---|---|---|---|
| 71 | 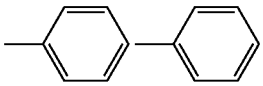 | | H | 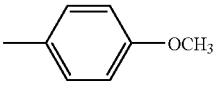 | 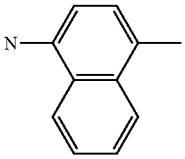 |
| 72 | 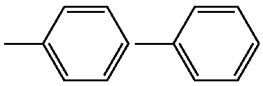 | | H | 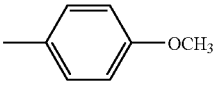 | 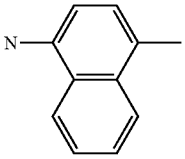 |
| 73 | 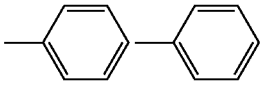 | | H | 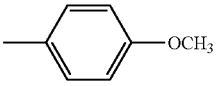 | 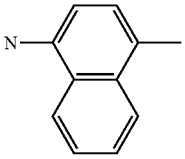 |

TABLE 16-continued
| | | | | |
|---|---|---|---|---|
| 74 | 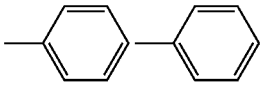 | H | 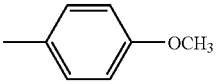 | 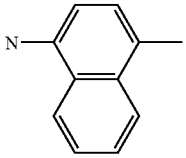 |
| 75 | 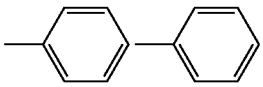 | H | 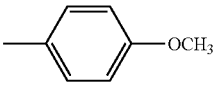 | 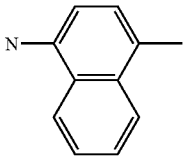 |
| 76 | 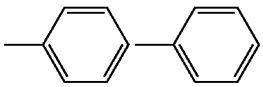 | H | 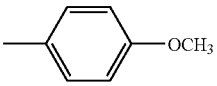 | 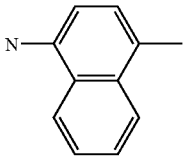 |
| 77 | 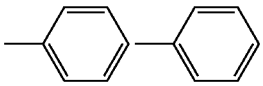 | H | 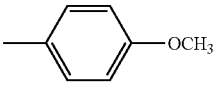 | 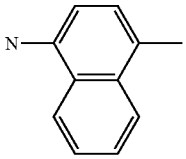 |
| Compound No. | n | $-(CR^{12}=CR^{13})_n-$ | $R^{14}$ | $Ar^4$ | $Ar^5$ |
|---|---|---|---|---|---|
| 71 | 1 | CH═CH | H | H | 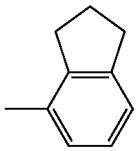 |
| 72 | 1 | CH═CH | H | H | 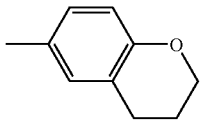 |
| 73 | 1 | CH═CH | H | H | 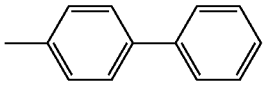 |
| 74 | 1 | CH═CH | H | H | 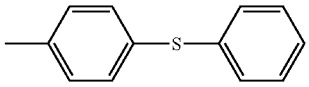 |
| 75 | 1 | CH═CH | H | H | 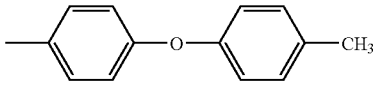 |
| 76 | 1 | CH═CH | H | H | 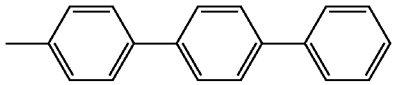 |
| 77 | 1 | CH═CH | H | H | 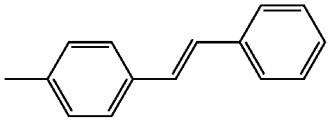 |

TABLE 17
| Compound No. | $Ar^1$ | $Ar^2$ | $R^{11}$ | $Ar^3$ | 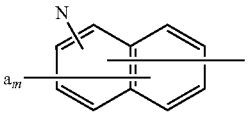 |
|---|---|---|---|---|---|
| 78 | 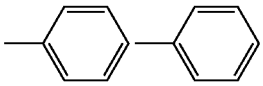 | | H | 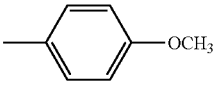 | 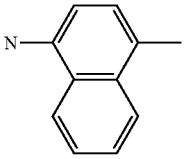 |
| 79 | 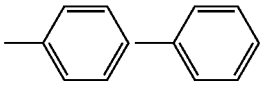 | | H | 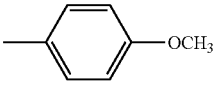 | 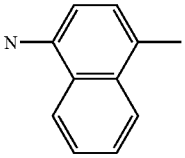 |
| 80 | 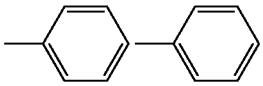 | | H | 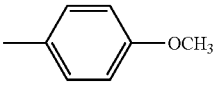 | 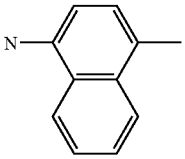 |
| 81 | 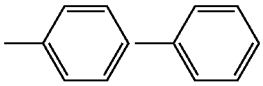 | | H | 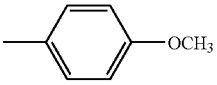 | 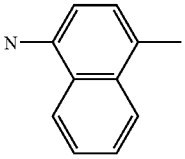 |
| 82 | 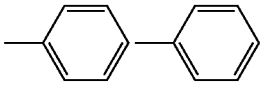 | | H | 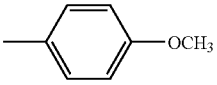 | 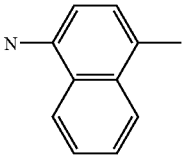 |
| 83 | 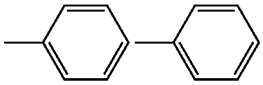 | | H | 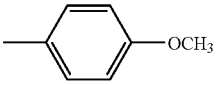 | 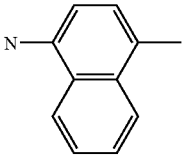 |
| 84 | 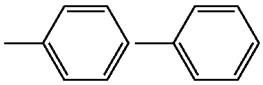 | | H | 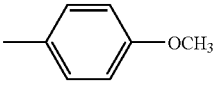 | 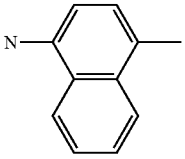 |
| Compound No. | n | $-(CR^{12}=CR^{13})_n-$ | $R^{14}$ | $Ar^4$ | $Ar^5$ |
|---|---|---|---|---|---|
| 78 | 1 | CH═CH | H | H | 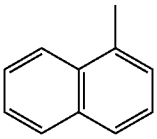 |

TABLE 17-continued

| | | | | |
|---|---|---|---|---|
| 79 | 1 | CH═CH | H | H |
| 80 | 1 | CH═CH | H | H |
| 81 | 1 | CH═CH | H | H |
| 82 | 1 | CH═CH | H | H |
| 83 | 1 | CH═CH | H | H |
| 84 | 1 | CH═CH | H | H |

TABLE 18

| Compound No. | $Ar^1$ | $Ar^2$ | $R^{11}$ | $Ar^3$ | |
|---|---|---|---|---|---|
| 85 | | | H | | |
| 86 | | | H | | |
| 87 | | | H | | |

TABLE 18-continued
| | | | | |
|---|---|---|---|---|
| 88 | 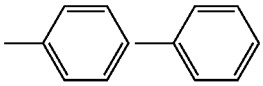 | H | 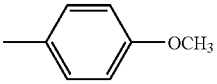 | 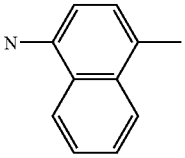 |
| 89 | 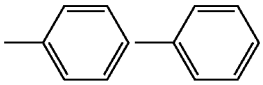 | H | 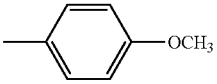 | 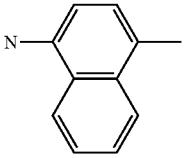 |
| 90 | 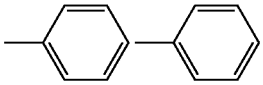 | H | 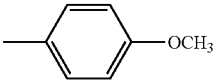 | 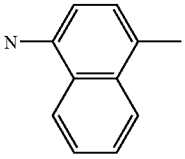 |
| 91 | 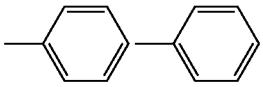 | H | 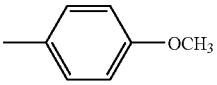 | 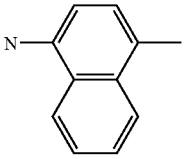 |
| Compound No. | n | $-(CR^{12}=CR^{13})_n-$ | $R^{14}$ | $Ar^4$ | $Ar^5$ |
|---|---|---|---|---|---|
| 85 | 1 | CH═CH | H | —$CH_3$ | 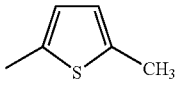 |
| 86 | 1 | CH═CH | H | —$CH_3$ | 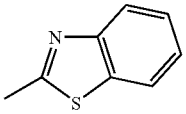 |
| 87 | 1 | CH═CH | H | —$CH_3$ | 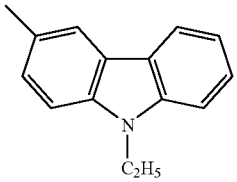 |
| 88 | 1 | CH═CH | H | 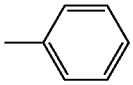 | 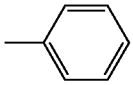 |
| 89 | 1 | CH═CH | H | 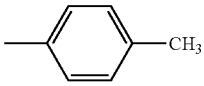 | 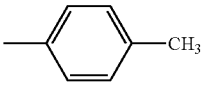 |
| 90 | 1 | CH═CH | H | 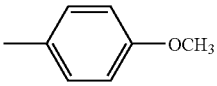 | 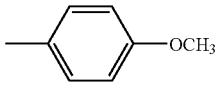 |
| 91 | 1 | CH═CH | H | 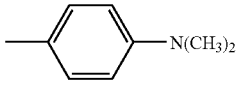 | 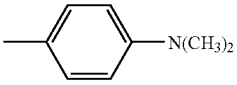 |

TABLE 19

| Compound No. | $Ar^1$ | $Ar^2$ | $R^{11}$ | $Ar^3$ | $a_m$ |
|---|---|---|---|---|---|
| 92 | | | H | $OCH_3$ | N |
| 93 | | | H | $OCH_3$ | N |
| 94 | | | H | $OCH_3$ | N |
| 95 | | | H | $OCH_3$ | N |
| 96 | | | H | $OCH_3$ | N |
| 97 | | | H | $OCH_3$ | N |
| 98 | | | H | $OCH_3$ | N |

| Compound No. | n | $-(CR^{12}=CR^{13})_n-$ | $R^{14}$ | $Ar^4$ | $Ar^5$ |
|---|---|---|---|---|---|
| 92 | 1 | CH═CH | H | | |

TABLE 19-continued
| | | | | |
|---|---|---|---|---|
| 93 | 1 | CH═CH | H | 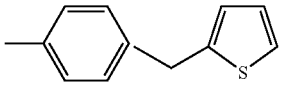 |
| 94 | 1 | CH═CH | H | 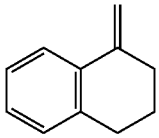 |
| 95 | 1 | CH═CH | H | 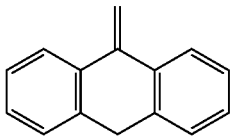 |
| 96 | 1 | CH═CH | H | 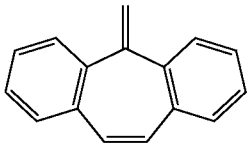 |
| 97 | 1 | CH═CH | H | 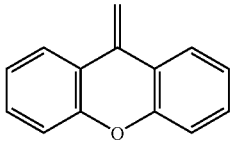 |
| 98 | 1 | CH═CH | H | 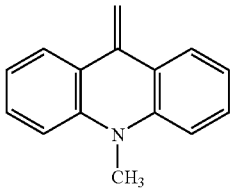 |
TABLE 20
| Compound No. | $Ar^1$ | $Ar^2$ | $R^{11}$ | $Ar^3$ | 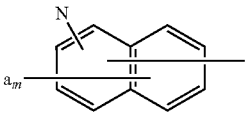 |
|---|---|---|---|---|---|
| 99 | 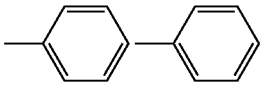 | | H | 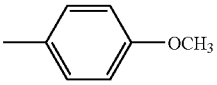 | 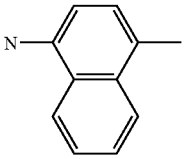 |
| 100 | 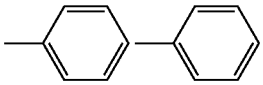 | | H | 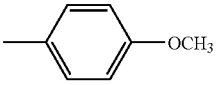 | 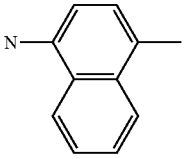 |

TABLE 20-continued
| | | | | |
|---|---|---|---|---|
| 101 | 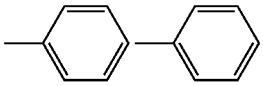 | H | 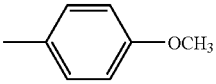 | 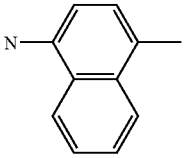 |
| 102 | 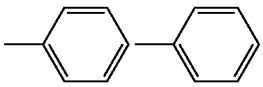 | H | 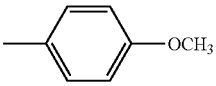 | 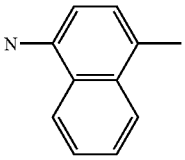 |
| 103 | 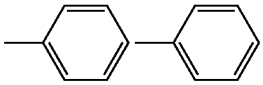 | H | 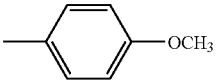 | 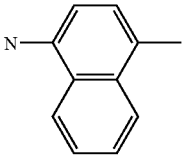 |
| 104 | 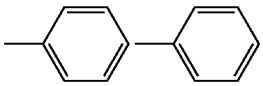 | H | 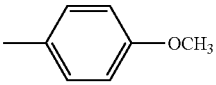 | 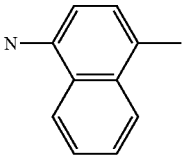 |
| 105 | 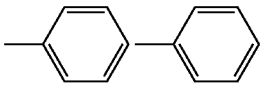 | H | 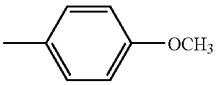 | 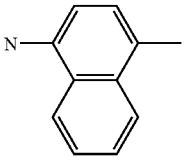 |
| Compound No. | n | $-(CR^{12}=CR^{13})_n-$ | $R^{14}$ | $Ar^4$ | $Ar^5$ |
|---|---|---|---|---|---|
| 99 | 1 | CH═CH | $-CH_3$ | H | 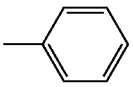 |
| 100 | 1 | CH═CH | 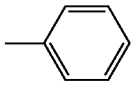 | H | 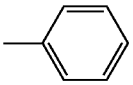 |
| 101 | 1 | 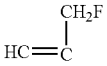 | H | H | 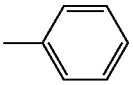 |
| 102 | 1 | 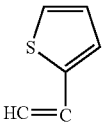 | H | H | 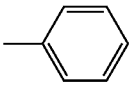 |
| 103 | 1 | 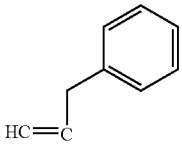 | H | H | 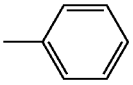 |
| 104 | 1 | 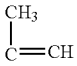 | H | H | 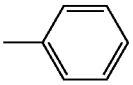 |

TABLE 20-continued

| | | | | | |
|---|---|---|---|---|---|
| 105 | 1 | HC=C(CH$_3$) | | H | |

TABLE 21

| Compound No. | Ar$^1$ | Ar$^2$ | R$^{11}$ | Ar$^3$ | |
|---|---|---|---|---|---|
| 106 | | | H | OCH$_3$ | N |
| 107 | | | H | OCH$_3$ | N |
| 108 | | | H | OCH$_3$ | N |
| 109 | | | H | OCH$_3$ | N |
| 110 | | | H | OCH$_3$ | N |
| 111 | | | H | OCH$_3$ | N |
| 112 | | | H | OCH$_3$ | N |

TABLE 21-continued
| Compound No. | n | $-(CR^{12}=CR^{13})_n-$ | $R^{14}$ | $Ar^4$ | $Ar^5$ |
|---|---|---|---|---|---|
| 106 | 2 | CH═CH—CH═CH | H | H | 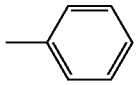 |
| 107 | 2 | CH═CH—CH═CH | H | H | 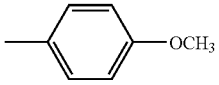 |
| 108 | 2 | CH═CH—CH═CH | H | $—CH_3$ | 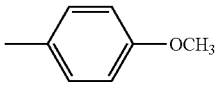 |
| 109 | 2 | CH═CH—CH═CH | H | $—CH_3$ | 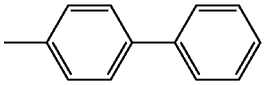 |
| 110 | 2 | CH═CH—CH═CH | H | $—CH_3$ | 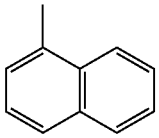 |
| 111 | 2 | CH═CH—CH═CH | H | $—CH_3$ | 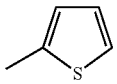 |
| 112 | 2 | CH═CH—CH═CH | H | H | 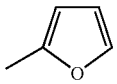 |
TABLE 22
| Compound No. | $Ar^1$ | $Ar^2$ | $R^{11}$ | $Ar^3$ | 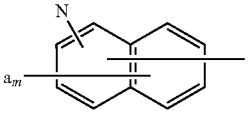 |
|---|---|---|---|---|---|
| 113 | 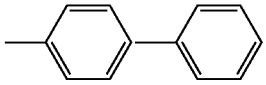 | | H | 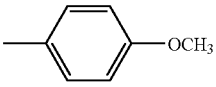 | 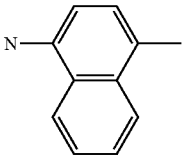 |
| 114 | 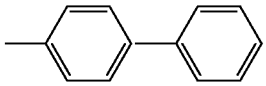 | | H | 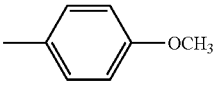 | 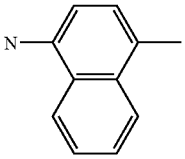 |
| 115 | 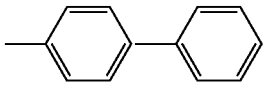 | | H | 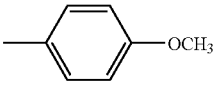 | 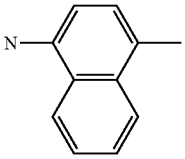 |

TABLE 22-continued
| | | | | |
|---|---|---|---|---|
| 116 | 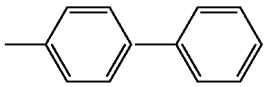 | H | 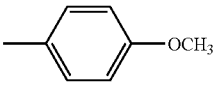 | 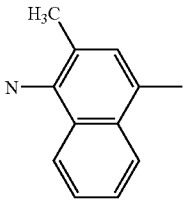 |
| 117 | 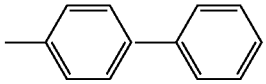 | H | 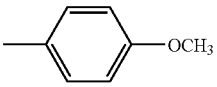 | 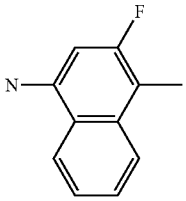 |
| 118 | 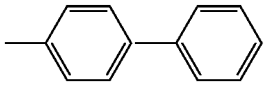 | H | 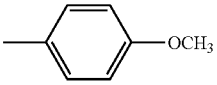 | 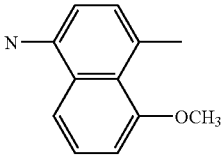 |
| 119 | 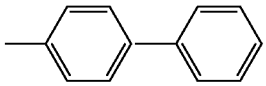 | H | 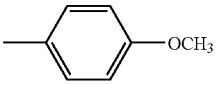 | 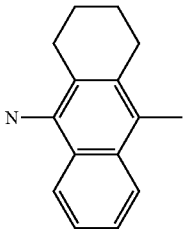 |
| Compound No. | n | $-(CR^{12}=CR^{13})_n-$ | $R^{14}$ | $Ar^4$ | $Ar^5$ |
|---|---|---|---|---|---|
| 113 | 2 | 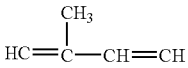 | H | H | 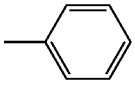 |
| 114 | 2 | 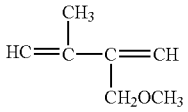 | H | H | 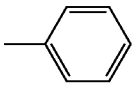 |
| 115 | 3 | $-(HC=CH)_3-$ | H | H | 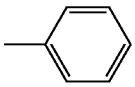 |
| 116 | 1 | CH=CH | H | H | 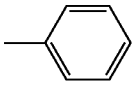 |
| 117 | 1 | CH=CH | H | H | 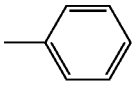 |
| 118 | 1 | CH=CH | H | H | 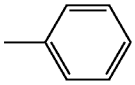 |

TABLE 22-continued
| | | | | | | | |
|---|---|---|---|---|---|---|---|
| | | 119 | 1 | CH═CH | H | H | 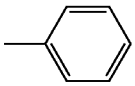 |
TABLE 23
| Compound No. | $Ar^1$ | $Ar^2$ | $R^{11}$ | $Ar^3$ | 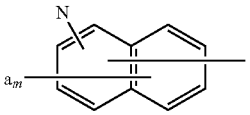 |
|---|---|---|---|---|---|
| 120 | 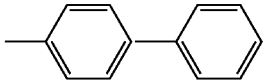 | | H | 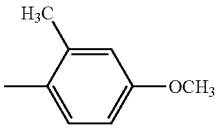 | 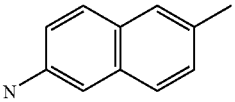 |
| 121 | 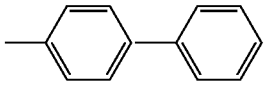 | | H | 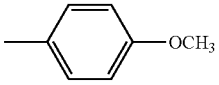 | 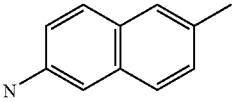 |
| 122 | 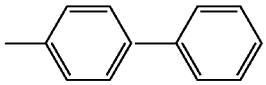 | | H | 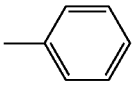 | 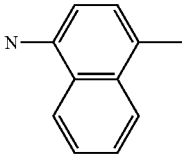 |
| 123 | 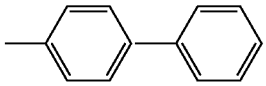 | | H | 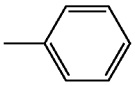 | 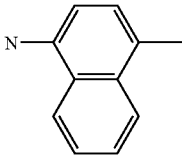 |
| 124 | 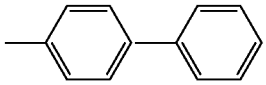 | | H | 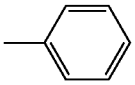 | 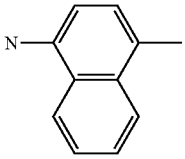 |
| 125 | 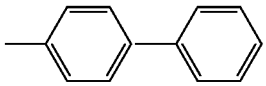 | | H | 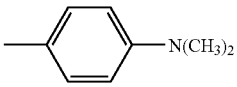 | 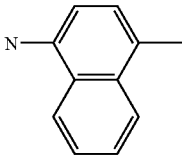 |
| 126 | 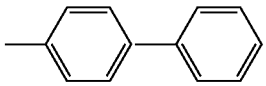 | | H | 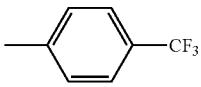 | 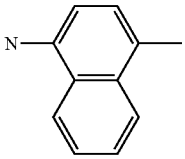 |
| Compound No. | n | $-(CR^{12}=CR^{13})_n-$ | $R^{14}$ | $Ar^4$ | $Ar^5$ |
|---|---|---|---|---|---|
| 120 | 1 | CH═CH | H | H | 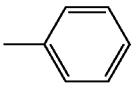 |

TABLE 23-continued
| | | | | | |
|---|---|---|---|---|---|
| 121 | 1 | CH═CH | H | H | 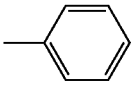 |
| 122 | 1 | CH═CH | H | H | 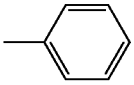 |
| 123 | 1 | CH═CH | H | —$CH_3$ | 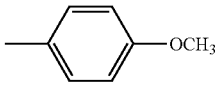 |
| 124 | 1 | CH═CH | H | 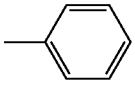 | 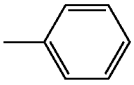 |
| 125 | 1 | CH═CH | H | H | 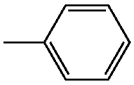 |
| 126 | 1 | CH═CH | H | H | 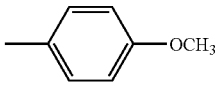 |
TABLE 24
| Compound No. | $Ar^1$ | $Ar^2$ | $R^{11}$ | $Ar^3$ | 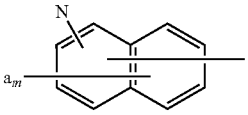 |
|---|---|---|---|---|---|
| 127 | 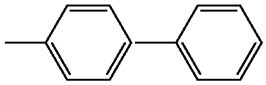 | | H | 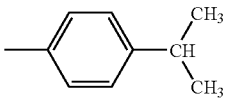 | 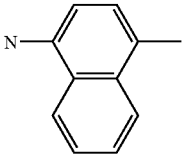 |
| 128 | 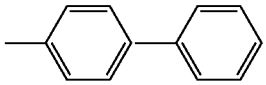 | | H | 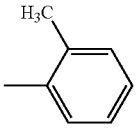 | 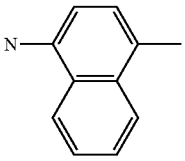 |
| 129 | 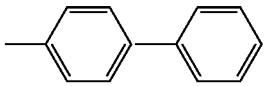 | | H | 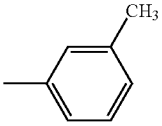 | 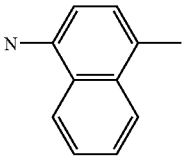 |
| 130 | 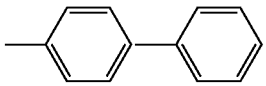 | | H | 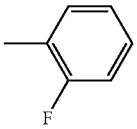 | 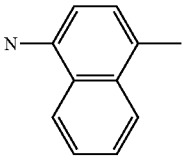 |

TABLE 24-continued
| | | | |
|---|---|---|---|
| 131 | 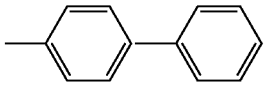 | H | 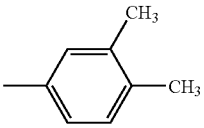 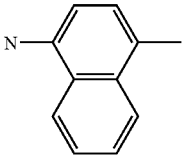 |
| 132 | 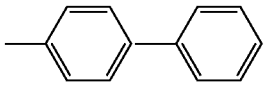 | H | 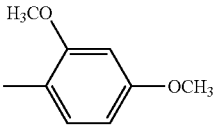 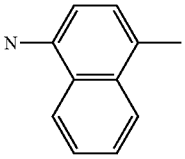 |
| 133 | 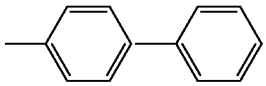 | H | 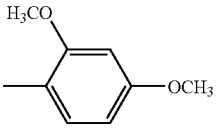 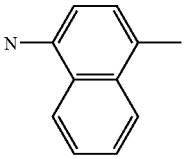 |
| Compound No. | n | $-(CR^{12}=CR^{13})_n-$ | $R^{14}$ | $Ar^4$ | $Ar^5$ |
|---|---|---|---|---|---|
| 127 | 1 | CH═CH | H | 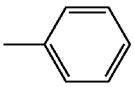 | 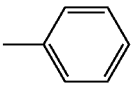 |
| 128 | 1 | CH═CH | H | H | 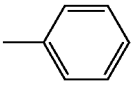 |
| 129 | 1 | CH═CH | H | H | 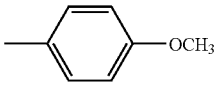 |
| 130 | 1 | CH═CH | H | 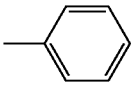 | 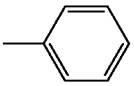 |
| 131 | 1 | CH═CH | H | H | 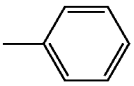 |
| 132 | 1 | CH═CH | H | $-CH_3$ | 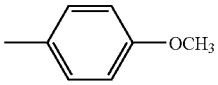 |
| 133 | 1 | CH═CH | H | 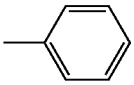 | 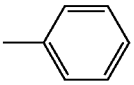 |

TABLE 25
| Compound No. | $Ar^1$ | $Ar^2$ | $R^{11}$ | $Ar^3$ | 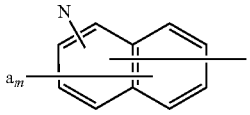 |
|---|---|---|---|---|---|
| 134 | 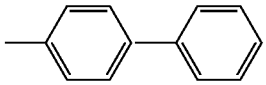 |  | H | 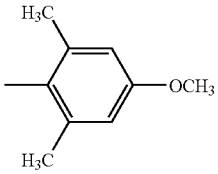 | 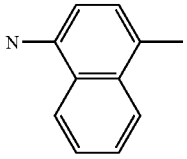 |
| 135 | 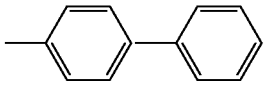 |  | H | 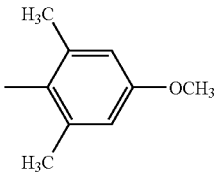 | 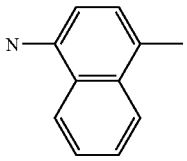 |
| 136 | 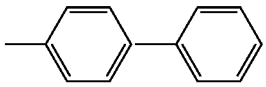 |  | H | 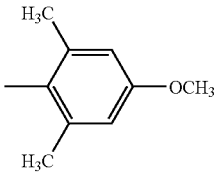 | 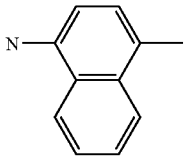 |
| 137 | 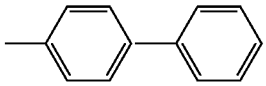 |  | H | 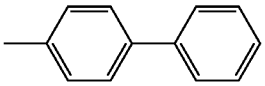 | 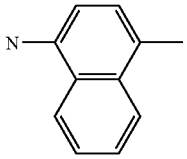 |
| 138 | 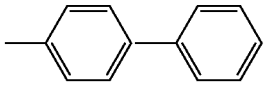 |  | H | 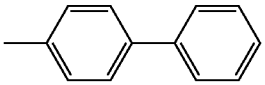 | 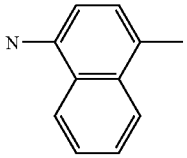 |
| 139 | 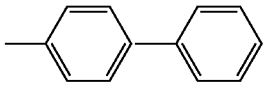 |  | H | 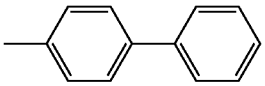 | 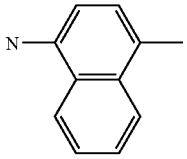 |
| 140 | 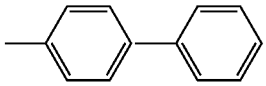 |  | H | 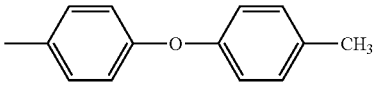 | 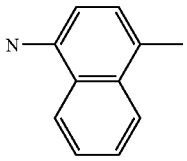 |
| Compound No. | n | $-(CR^{12}=CR^{13})_n-$ | $R^{14}$ | $Ar^4$ | $Ar^5$ |
|---|---|---|---|---|---|
| 134 | 1 | CH═CH | H | H | 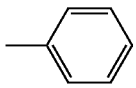 |

TABLE 25-continued
| | | | | | |
|---|---|---|---|---|---|
| 135 | 1 | CH═CH | H | H | 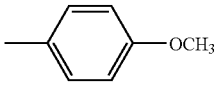 |
| 136 | 1 | CH═CH | H | 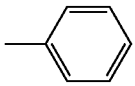 | 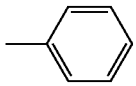 |
| 137 | 1 | CH═CH | H | H | 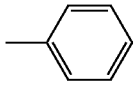 |
| 138 | 1 | CH═CH | H | —$CH_3$ | 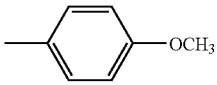 |
| 139 | 1 | CH═CH | H | 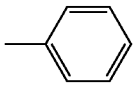 | 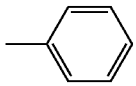 |
| 140 | 1 | CH═CH | H | H | 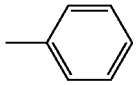 |
TABLE 26
| Compound No. | $Ar^1$ | $Ar^2$ | $R^{11}$ | $Ar^3$ | 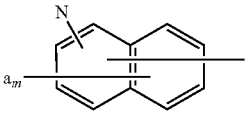 |
|---|---|---|---|---|---|
| 141 | 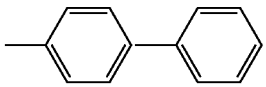 | | H | 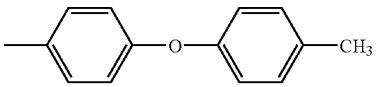 | 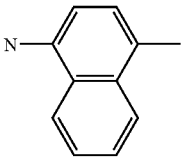 |
| 142 | 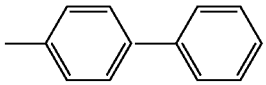 | | H | 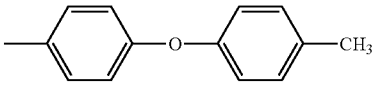 | 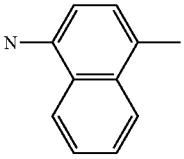 |
| 143 | 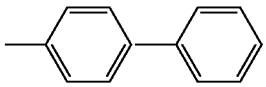 | | H | 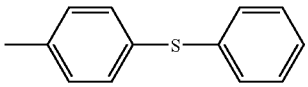 | 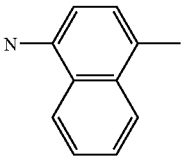 |
| 144 | 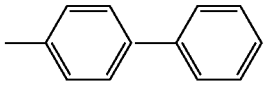 | | H | 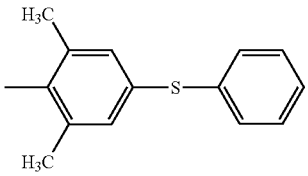 | 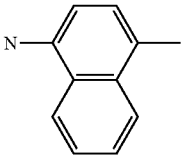 |

TABLE 26-continued
| | | | | |
|---|---|---|---|---|
| 145 | 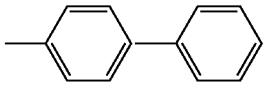 | H | 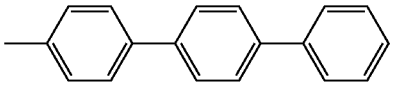 | 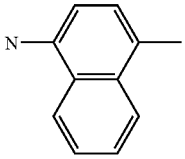 |
| 146 | 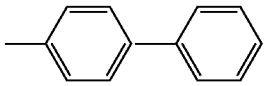 | H | 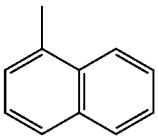 | 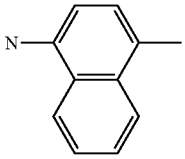 |
| 147 | 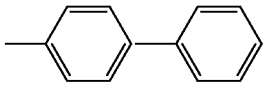 | H | 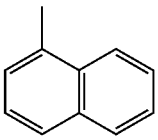 | 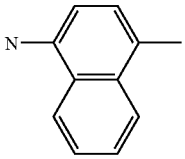 |
| Compound No. | n | $-(CR^{12}=CR^{13})_n-$ | $R^{14}$ | $Ar^4$ | $Ar^5$ |
|---|---|---|---|---|---|
| 141 | 1 | CH═CH | H | H | 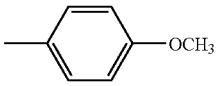 |
| 142 | 1 | CH═CH | H | —$CH_3$ | 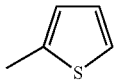 |
| 143 | 1 | CH═CH | H | H | 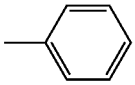 |
| 144 | 1 | CH═CH | H | —$CH_3$ | 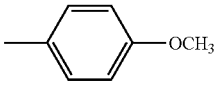 |
| 145 | 1 | CH═CH | H | —$CH_3$ | 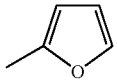 |
| 146 | 1 | CH═CH | H | H | 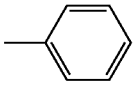 |
| 147 | 1 | CH═CH | H | —$CH_3$ | 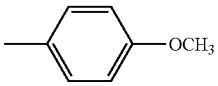 |

TABLE 27

| Compound No. | $Ar^1$ | $Ar^2$ | $R^{11}$ | $Ar^3$ | $a_m$ |
|---|---|---|---|---|---|
| 148 | | | H | | |
| 149 | | | H | | |
| 150 | | | H | | |
| 151 | | | H | | |
| 152 | | | H | | |
| 153 | | | H | | |
| 154 | | | H | | |

| Compound No. | n | $-(CR^{12}=CR^{13})_n-$ | $R^{14}$ | $Ar^4$ | $Ar^5$ |
|---|---|---|---|---|---|
| 148 | 1 | CH═CH | H | H | |
| 149 | 1 | CH═CH | H | $-CH_3$ | |

TABLE 27-continued
| | | | | | |
|---|---|---|---|---|---|
| 150 | 1 | CH═CH | H | H | 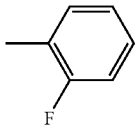 |
| 151 | 1 | CH═CH | H | —$CH_3$ | 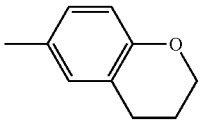 |
| 152 | 1 | CH═CH | H | —$CH_3$ | 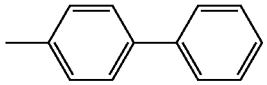 |
| 153 | 1 | CH═CH | H | —$CH_3$ | 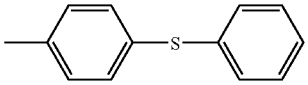 |
| 154 | 1 | CH═CH | H | H | 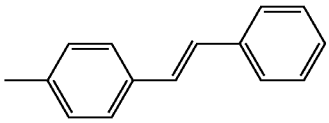 |
TABLE 28
| Compound No. | $Ar^1$ | $Ar^2$ | $R^{11}$ | $Ar^3$ | 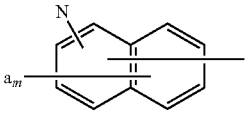 |
|---|---|---|---|---|---|
| 155 | 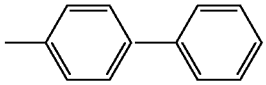 | | H | 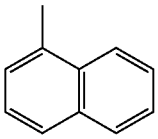 | 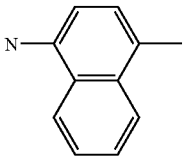 |
| 156 | 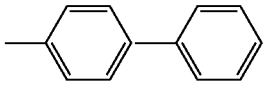 | | H | 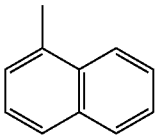 | 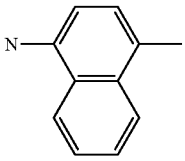 |
| 157 | 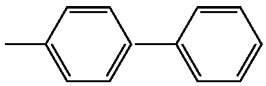 | | H | 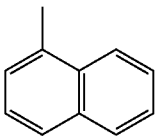 | 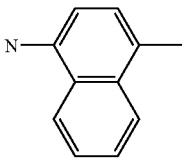 |
| 158 | 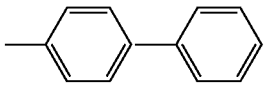 | | H | 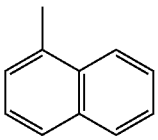 | 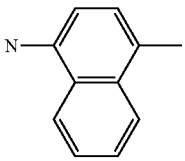 |

TABLE 28-continued
| | | | | |
|---|---|---|---|---|
| 159 | 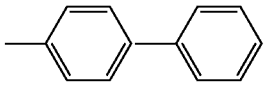 | H | 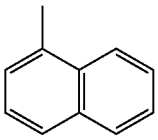 | 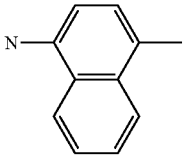 |
| 160 | 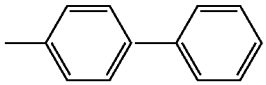 | H | 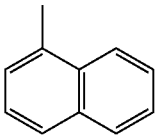 | 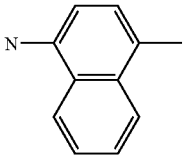 |
| 161 | 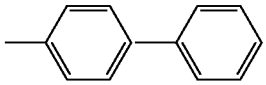 | H | 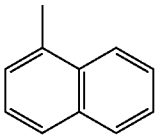 | 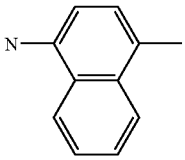 |
| Compound No. | n | $-(CR^{12}=CR^{13})_n-$ | $R^{14}$ | $Ar^4$ | $Ar^5$ |
|---|---|---|---|---|---|
| 155 | 1 | CH═CH | H | $-CH_3$ | 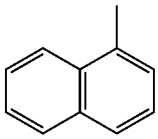 |
| 156 | 1 | CH═CH | H | $-CH_3$ | 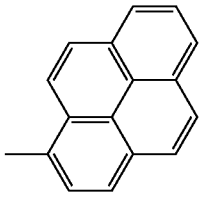 |
| 157 | 1 | CH═CH | H | $-CH_3$ | 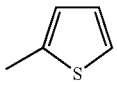 |
| 158 | 1 | CH═CH | H | H | 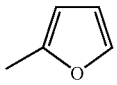 |
| 159 | 1 | CH═CH | H | 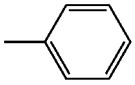 | 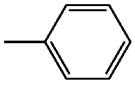 |
| 160 | 1 | CH═CH | H | 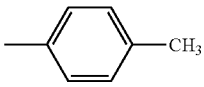 | 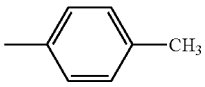 |
| 161 | 1 | CH═CH | H | 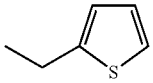 | 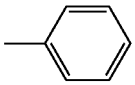 |

TABLE 29

| Compound No. | $Ar^1$ | $Ar^2$ | $R^{11}$ | $Ar^3$ | $a_m$ |
|---|---|---|---|---|---|
| 162 | | | H | | |
| 163 | | | H | | |
| 164 | | | H | | |
| 165 | | | H | | |
| 166 | | | H | | |
| 167 | | | H | | |
| 168 | | | H | | |

| Compound No. | n | $-(CR^{12}=CR^{13})_n-$ | $R^{14}$ | $Ar^4$ | $Ar^5$ |
|---|---|---|---|---|---|
| 162 | 1 | CH═CH | H | | |

TABLE 29-continued
| | | | | | |
|---|---|---|---|---|---|
| 163 | 1 | CH═CH | H | | 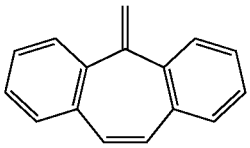 |
| 164 | 1 | CH═CH | H | | 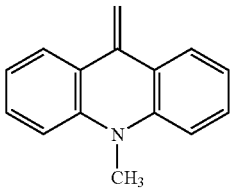 |
| 165 | 2 | CH═CH—CH═CH | H | H | 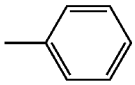 |
| 166 | 2 | CH═CH—CH═CH | H | —$CH_3$ | 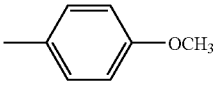 |
| 167 | 2 | CH═CH—CH═CH | H | —$CH_3$ | 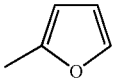 |
| 168 | 3 | —(HC═CH)$_3$— | H | H | 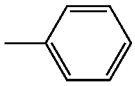 |
TABLE 30
| Compound No. | $Ar^1$ | $Ar^2$ | $R^{11}$ | $Ar^3$ | 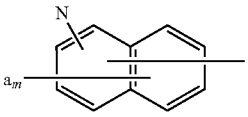 |
|---|---|---|---|---|---|
| 169 | 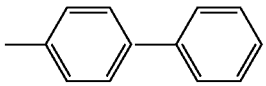 | | H | 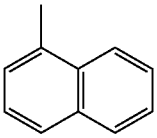 | 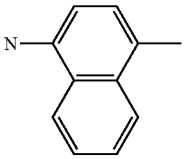 |
| 170 | 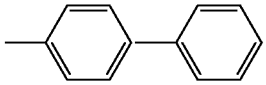 | | H | 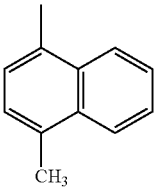 | 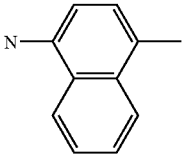 |
| 171 | 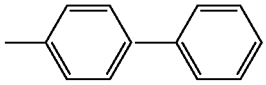 | | H | 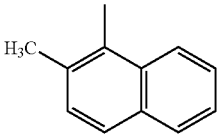 | 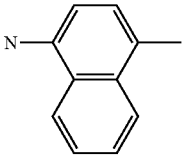 |

TABLE 30-continued
| | | | | |
|---|---|---|---|---|
| 172 | 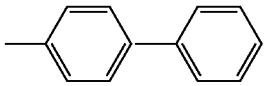 | H | 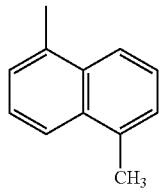 | 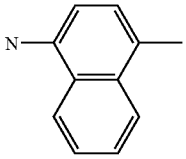 |
| 173 | 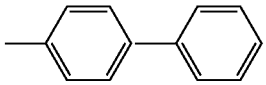 | H | 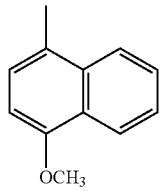 | 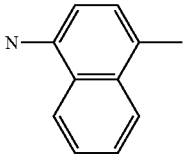 |
| 174 | 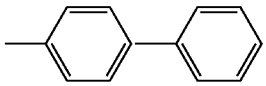 | H | 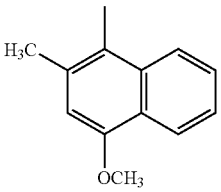 | 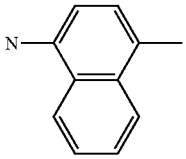 |
| 175 | 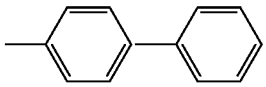 | H | 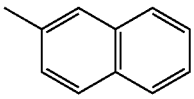 | 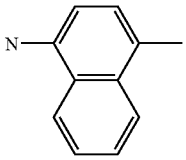 |
| Compound No. | n | $-(CR^{12}=CR^{13})_n-$ | $R^{14}$ | $Ar^4$ | $Ar^5$ |
|---|---|---|---|---|---|
| 169 | 1 | CH═CH | H | H | 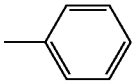 |
| 170 | 1 | CH═CH | H | H | 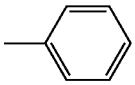 |
| 171 | 1 | CH═CH | H | H | 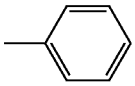 |
| 172 | 1 | CH═CH | H | H | 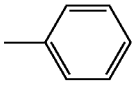 |
| 173 | 1 | CH═CH | H | H | 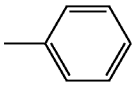 |
| 174 | 1 | CH═CH | H | H | 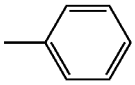 |
| 175 | 1 | CH═CH | H | H | 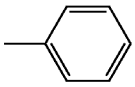 |

TABLE 31
| Compound No. | $Ar^1$ | $Ar^2$ | $R^{11}$ | $Ar^3$ | 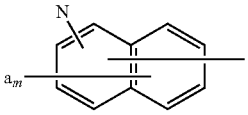 |
|---|---|---|---|---|---|
| 176 | 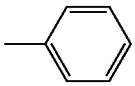 | 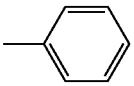 | H | 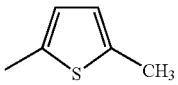 | 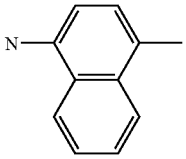 |
| 177 | 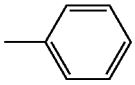 | 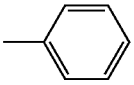 | H | 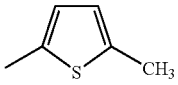 | 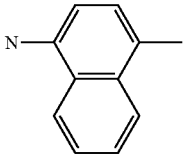 |
| 178 | 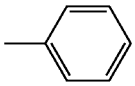 | 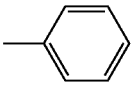 | H | 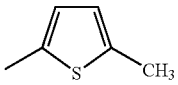 | 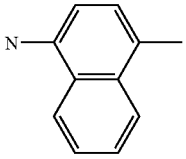 |
| 179 | 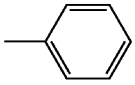 | 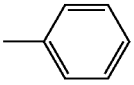 | H | 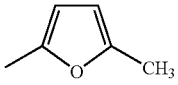 | 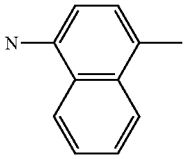 |
| 180 | 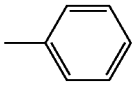 | 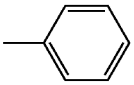 | H | 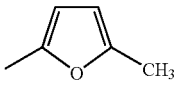 | 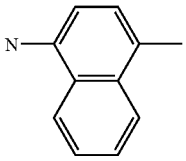 |
| 181 | 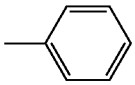 | 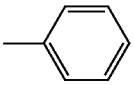 | H | 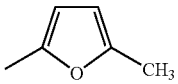 | 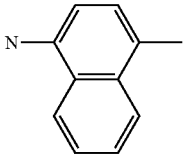 |
| 182 | 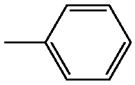 | 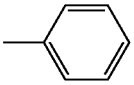 | H | 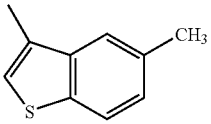 | 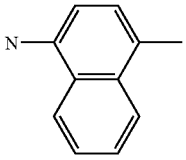 |
| Compound No. | n | $-(CR^{12}=CR^{13})_n-$ | $R^{14}$ | $Ar^4$ | $Ar^5$ |
|---|---|---|---|---|---|
| 176 | 1 | CH═CH | H | H | 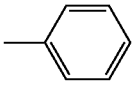 |
| 177 | 1 | CH═CH | H | H | 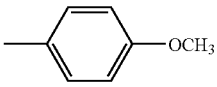 |

TABLE 31-continued

| | | | | | |
|---|---|---|---|---|---|
| 178 | 1 | CH═CH | H | | |
| 179 | 1 | CH═CH | H | H | |
| 180 | 1 | CH═CH | H | —$CH_3$ | $OCH_3$ |
| 181 | 1 | CH═CH | H | | |
| 182 | 1 | CH═CH | H | H | |

TABLE 32

| Compound No. | $Ar^1$ | $Ar^2$ | $R^{11}$ | $Ar^3$ | N, $a_m$ |
|---|---|---|---|---|---|
| 183 | | | H | N, S, $CH_3$ | N |
| 184 | | | H | $CH_3$, N, $C_2H_5$ | N |
| 185 | | | H | | N |
| 186 | | | H | $OCH_3$ | N |
| 187 | | | H | | N |

TABLE 32-continued
| | | | | | |
|---|---|---|---|---|---|
| 188 | 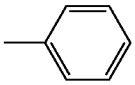 | 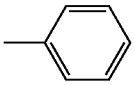 | H | 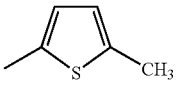 | 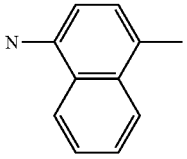 |
| 189 | 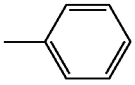 | 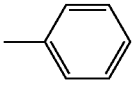 | H | 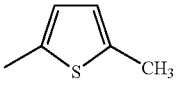 | 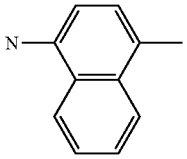 |
| Compound No. | n | $-(CR^{12}=CR^{13})_n-$ | $R^{14}$ | $Ar^4$ | $Ar^5$ |
|---|---|---|---|---|---|
| 183 | 1 | CH═CH | H | $-CH_3$ | 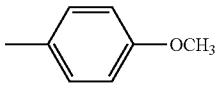 |
| 184 | 1 | CH═CH | H | 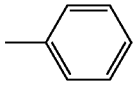 | 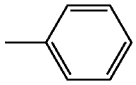 |
| 185 | 1 | CH═CH | H | H | 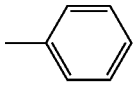 |
| 186 | 1 | CH═CH | H | H | 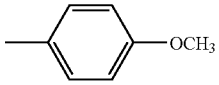 |
| 187 | 1 | CH═CH | H | 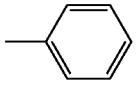 | 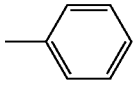 |
| 188 | 0 | — | H | H | 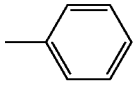 |
| 189 | 0 | — | H | H | 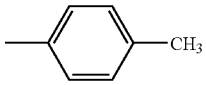 |
TABLE 33
| Compound No. | $Ar^1$ | $Ar^2$ | $R^{11}$ | $Ar^3$ | 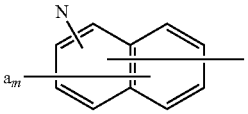 |
|---|---|---|---|---|---|
| 190 | 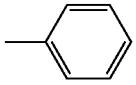 | 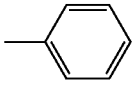 | H | 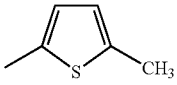 | 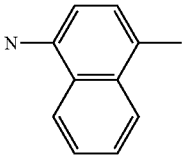 |

TABLE 33-continued
| | | | | |
|---|---|---|---|---|
| 191 | 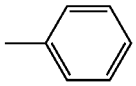 | 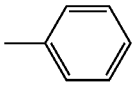 | H | 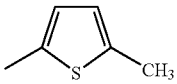  | 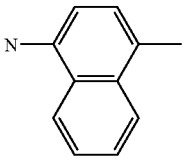  |
| 192 | 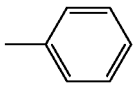 | 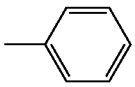 | H | 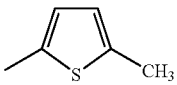  | 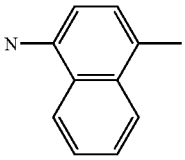  |
| 193 | 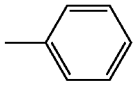 | 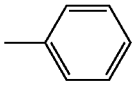 | H | 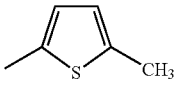  | 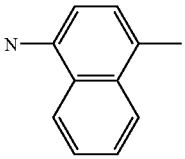  |
| 194 | 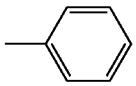 | 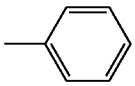 | H | 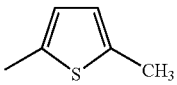  | 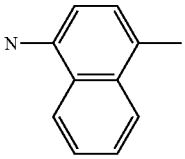  |
| 195 | 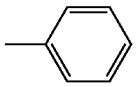 | 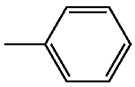 | H | 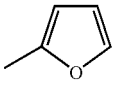  | 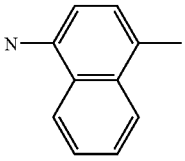  |
| 196 | 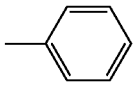 | 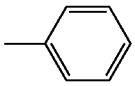 | H | 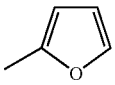  | 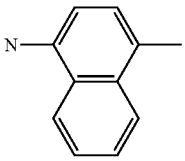  |
| Compound No. | n | $-(CR^{12}=CR^{13})_n-$ | $R^{14}$ | $Ar^4$ | $Ar^5$ |
|---|---|---|---|---|---|
| 190 | 0 | — | H | H | 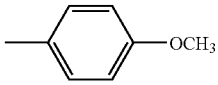  |
| 191 | 0 | — | H | H | 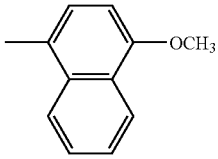  |
| 192 | 0 | — | H | H | 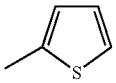  |
| 193 | 0 | — | H | H | 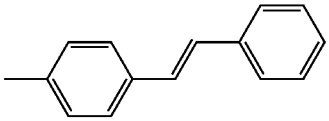 |

TABLE 33-continued
| | | | | | |
|---|---|---|---|---|---|
| 194 | 0 | — | H | 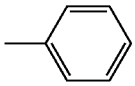 | 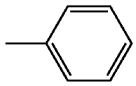 |
| 195 | 0 | — | H | H | 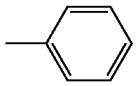 |
| 196 | 0 | — | H | H | 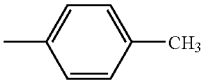 |
TABLE 34
| Compound No. | $Ar^1$ | $Ar^2$ | $R^{11}$ | $Ar^3$ | 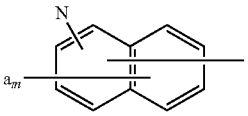 |
|---|---|---|---|---|---|
| 197 | 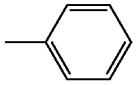 | 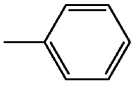 | H | 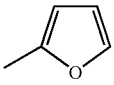 | 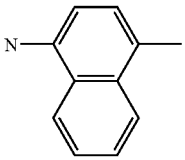 |
| 198 | 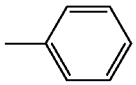 | 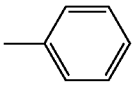 | H | 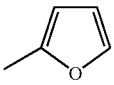 | 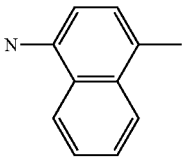 |
| 199 | 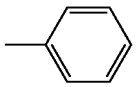 | 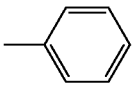 | H | 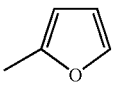 | 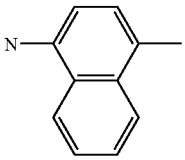 |
| 200 | 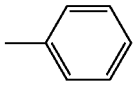 | 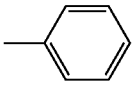 | H | 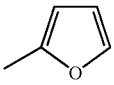 | 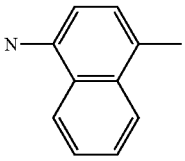 |
| 201 | 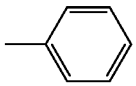 | 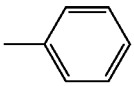 | H | 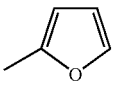 | 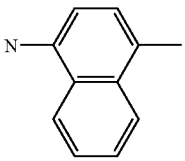 |
| 202 | 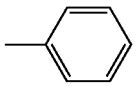 | 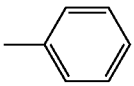 | H | 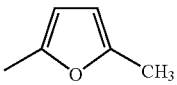 | 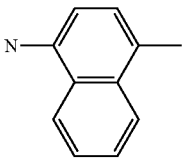 |

TABLE 34-continued
| | | | | | |
|---|---|---|---|---|---|
| 203 | 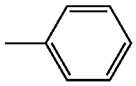 | 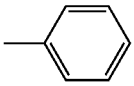 | H | 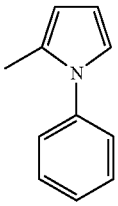 | 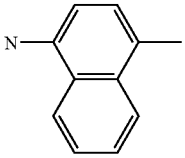 |
| Compound No. | n | $-(CR^{12}=CR^{13})_n-$ | $R^{14}$ | $Ar^4$ | $Ar^5$ |
|---|---|---|---|---|---|
| 197 | 0 | — | H | H | 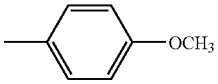 |
| 198 | 0 | — | H | H | 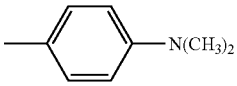 |
| 199 | 0 | — | H | H | 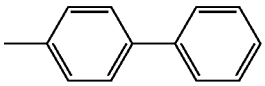 |
| 200 | 0 | — | H | H | 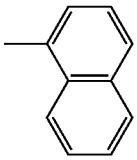 |
| 201 | 0 | — | H | 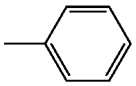 | 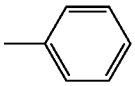 |
| 202 | 0 | — | H | H | 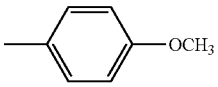 |
| 203 | 0 | — | H | H | 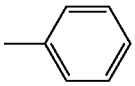 |
TABLE 35
| Compound No. | $Ar^1$ | $Ar^2$ | $R^{11}$ | $Ar^3$ | 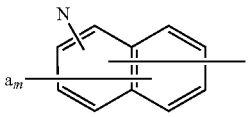 |
|---|---|---|---|---|---|
| 204 | 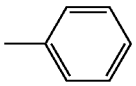 | 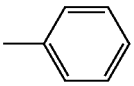 | H | 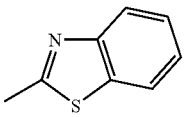 | 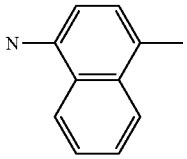 |
| 205 | 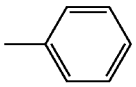 | 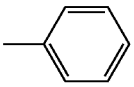 | H | 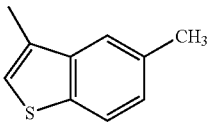 | 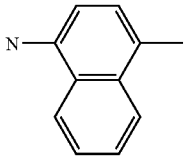 |

TABLE 35-continued
| | | | | |
|---|---|---|---|---|
| 206 | 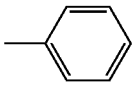 | 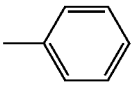 | H | 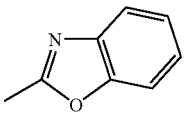  | 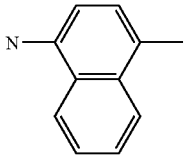  |
| 207 | 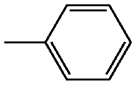 | 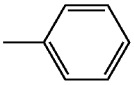 | H | 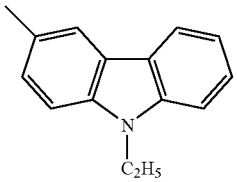  | 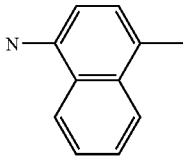  |
| 208 | 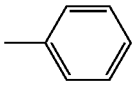 | 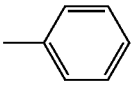 | H | 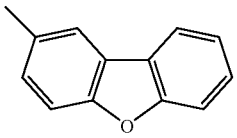  | 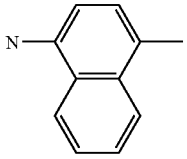  |
| 209 | 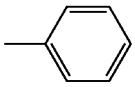 | 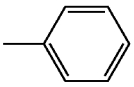 | $CH_3$ | 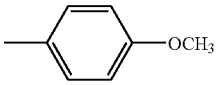  | 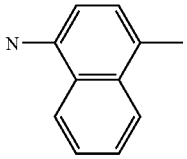  |
| 210 | 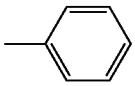 | 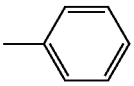 | $CH_2CF_3$ | 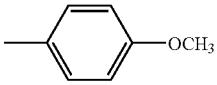  | 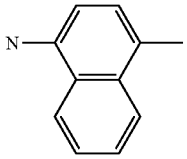  |
| Compound No. | n | $-(CR^{12}=CR^{13})_n-$ | $R^{14}$ | $Ar^4$ | $Ar^5$ |
|---|---|---|---|---|---|
| 204 | 0 | — | H | H | 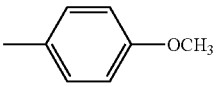  |
| 205 | 0 | — | H | 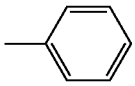 | 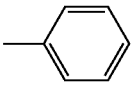 |
| 206 | 0 | — | H | H | 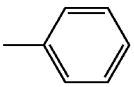 |
| 207 | 0 | — | H | H | 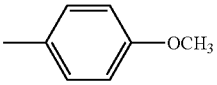  |
| 208 | 0 | — | H | 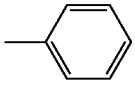 | 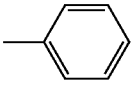 |
| 209 | 1 | CH═CH | H | H | 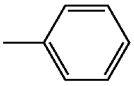 |

TABLE 35-continued
| | | | | | |
|---|---|---|---|---|---|
| 210 | 1 | CH═CH | H | H | 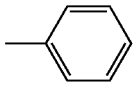 |
TABLE 36
| Compound No. | $Ar^1$ | $Ar^2$ | $R^{11}$ | $Ar^3$ |
|---|---|---|---|---|
| 211 | 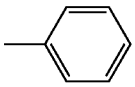 | 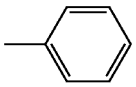 | $CH(CH_3)_2$ | 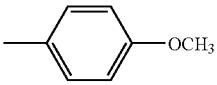 |
| 212 | 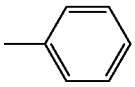 | 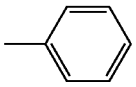 | F | 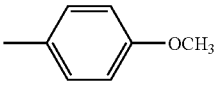 |
| 213 | 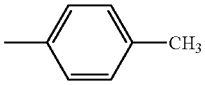 | 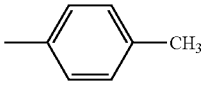 | H | 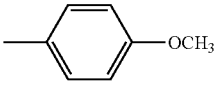 |
| 214 | 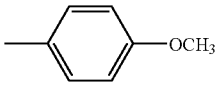 | 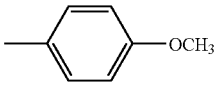 | H | 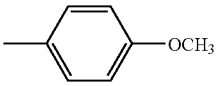 |
| 215 | 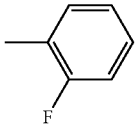 | 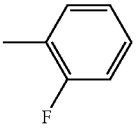 | H | 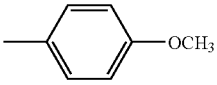 |
| 216 | 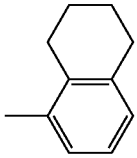 | 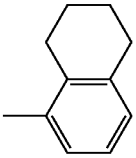 | H | 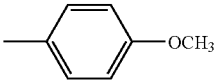 |
| 217 | 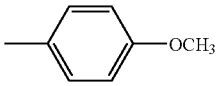 | 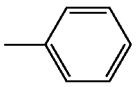 | H | 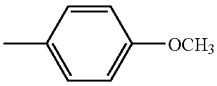 |
| Compound No. | 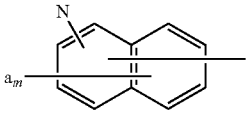 | n | $-(CR^{12}=CR^{13})_n-$ | $R^{14}$ | $Ar^4$ | $Ar^5$ |
|---|---|---|---|---|---|---|
| 211 | 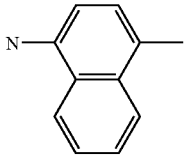 | 1 | CH═CH | H | H | 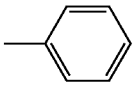 |
| 212 | 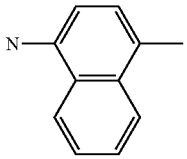 | 1 | CH═CH | H | H | 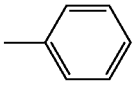 |

TABLE 36-continued
| | | | | | |
|---|---|---|---|---|---|
| 213 | 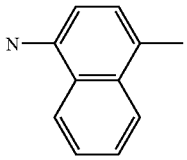 | 1 | CH=CH | H | H | 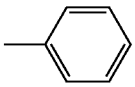 |
| 214 | 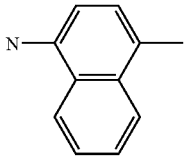 | 1 | CH=CH | H | H | 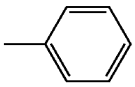 |
| 215 | 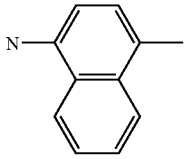 | 1 | CH=CH | H | H | 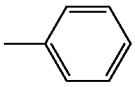 |
| 216 | 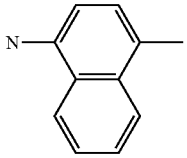 | 1 | CH=CH | H | H | 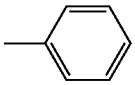 |
| 217 | 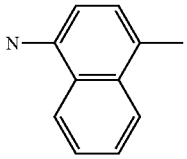 | 1 | CH=CH | H | H | 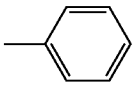 |
TABLE 37
| Compound No. | $Ar^1$ | $Ar^2$ | $R^{11}$ | $Ar^3$ | 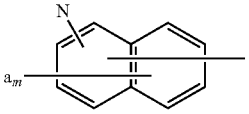 |
|---|---|---|---|---|---|
| 218 | 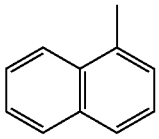 | 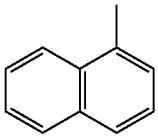 | H | 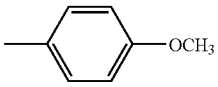 | 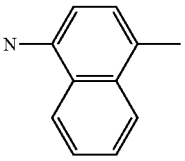 |
| 219 | 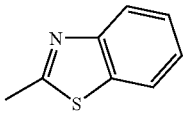 | 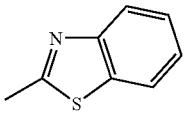 | H | 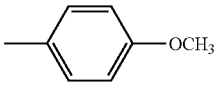 | 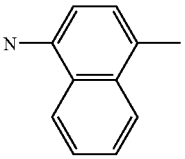 |
| 220 | 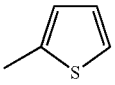 | 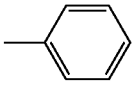 | H | 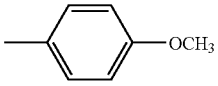 | 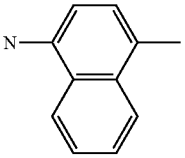 |

TABLE 37-continued

| Compound No. | n | $-(CR^{12}=CR^{13})_n-$ | $R^{14}$ | $Ar^4$ | $Ar^5$ |
|---|---|---|---|---|---|
| 218 | 1 | CH=CH | H | H | 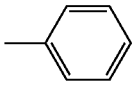 |
| 219 | 1 | CH=CH | H | H | 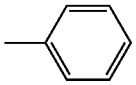 |
| 220 | 1 | CH=CH | H | H | 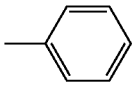 |

For the enamine compound represented by the general formula (2), the compounds selected from the group consisting, for example, of exemplified compounds shown in Table 6 to Table 37 described above are used each alone or in admixture of two or more of them.

The enamine compound represented by the general formula (2) can be produced, for example, as described below.

At first, an aldehyde compound or a ketone compound represented by the following general formula (4) and a secondary amine compound represented by the following general formula (5) are put to dehydrating condensation reaction to prepare an enamine intermediate represented by the following general formula (6):

(4)

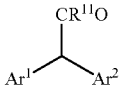

(in which $Ar^1$, $Ar^2$, and $R^{11}$ have the same meanings as defined for the general formula (2)),

[Ka 15]

(5)

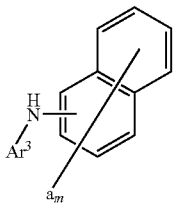

(in which $Ar^3$, a, and m have the same meanings as defined for the general formula (2)), (6)

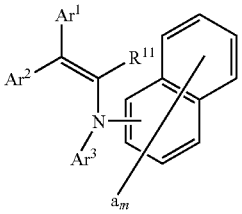

(in which $Ar^1$, $Ar^2$, $Ar^3$, $R^{11}$, a and m have the same meanings as defined for the general formula (2)).

The dehydrating condensation reaction is conducted, for example, as described below. The aldehyde compound or ketone compound represented by the general formula (4) and the secondary amine compound represented by the general formula (5) in a substantially equi-molar amount therewith are dissolved in a solvent such as an aromatic solvent, alcohols or ethers to prepare a solution. Specific examples of the solvent to be used include, for example, toluene, xylene, chlorobenzene, butanol and diethylene glycol dimethyl ether. A catalyst such as an acid catalyst, for example, p-toluene sulfonic acid, camphor sulfonic acid, or pyridinium-p-toluene sulfonic acid is added to the thus prepared solution and they are reacted under heating. The addition amount of the catalyst to the aldehyde compound or the ketone compound represented by the general formula (4) is, preferably, 1/10 to 1/1000 molar amount and, more preferably, from 1/25 to 1/500 molar amount, with 1/50 to 1/200 molar amount being optimal. Since water is by-produced during reaction to hinder the reaction, formed water is put to azeotropic boiling together with the solvent and removed out of the system. This can produce the enamine intermediate product represented by the general formula (6) at a high yield.

Then, the enamine intermediate product represented by the general formula (6) is formulated by the Vilsmeier reaction, or acylated by the Friedel-Craft reaction to produce an enamine-carbonyl intermediate represented by the following general formula (7). In this case, when formulation by the Vilsmeier reaction is taken place, an enamine-aldehyde intermediate product represented by the following general formula (7) in which $R^{15}$ is a hydrogen atom can be prepared as the enamine-carbonyl intermediate product. In this case, when acylation by the Friedel-craft reaction is taken place, an enamine-keto intermediate product represented by the following general formula (7) in which $R^{15}$ is a group other than the hydrogen atom can be produced as the enamine-carbonyl intermediate product.

(7)

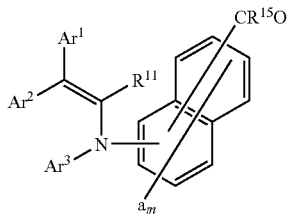

(in which $R^{15}$ represents $R^{14}$ when n is 0 and represents $R^{12}$ when n is 1, 2, or 3 in the general formula (2), and $Ar^1$, $Ar^2$, $Ar^3$ $R^{11}$, $R^{12}$, $R^{14}$, a, m, and n have the same meanings as defined for the general formula (2)).

The Vilsmeier reaction is taken place, for example, as described below. Phosphorus oxychloride and N,N-dimethylformamide, phosphorus oxychloride and N-methyl-N-phenylformamide, or phosphorus oxychloride and N,N-dimethylformamide were added in a solvent such as N,N-dimetylformamide (simply referred to as DMF) or 1,2-dichloroethane, to prepare a Vilsmeier reagent. 1.0 equivalent amount of the enamine intermediate product represented by the general formula (6) is added to 1.0 to 1.3 equivalent amount of the prepared Vilsmeier reagent and stirred under heating at 60 to 110° C. for 2 to 8 hours. Then, hydrolysis is conducted in a 1N to 8N aqueous solution of sodium hydroxide or an aqueous solution of potassium hydroxide. Thus, an enamine aldehyde intermediate product in which $R^{15}$ is a hydrogen atom in the enamine-carbonyl intermediate product represented by the general formula (7) can be prepared at a high yield.

Further, the Friedel-Craft reaction is taken place, for example, as described below. 1.0 to 1.3 equivalent amount of the reagent prepared from aluminum chloride and acid chloride, and 1.0 equivalent amount of the enamine intermediate product represented by the general formula (6) are added in a solvent such as 1,2-dichloroethane and stirred at −40 to 80° C. for 2 to 8 hours. Heating is applied depending on the case. Then, hydrolysis is conducted in a 1N to 8N aqueous solution of sodium hydroxide or aqueous solution of potassium hydroxide. Thus, an enamine-keto intermediate product represented by the general formula (7) in which $R^{15}$ is a group other than the hydrogen atom in the enamine-carbonyl intermediate product can be produced at a high yield.

Finally, by conducting Wittig-Horner reaction of reacting the enamine-carbonyl intermediate product represented by the general formula (7) and the Wittig reagent represented by the following general formula (8-1) or (8-2) under the basic condition, the enamine compound represented by the general formula (2) can be produced. In this case, when the Wittig reagent represented by the general formula (8-1) is used, the enamine compound represented by the general formula (2) in which n=0 can be obtained and, in a case of using the Wittig reagent represented by the general formula (8-2) is used, an enamine compound represented by the general formula (2) in which n is 1, 2 or 3 can be obtained.

(8-1)

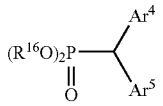

(in which $R^{16}$ represents an alkyl group which may have a substituent or an aryl group which may have a substituent, and $Ar^4$ and $Ar^5$ have the same meanings as those defined for the general formula (2))

(8-2)

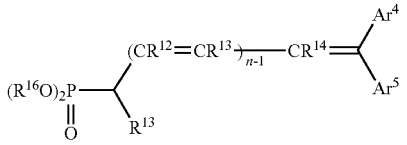

(in which $R^{16}$ represents an alkyl group which may have a substituent or an aryl group which may have a substituent, n represents an integer of 1 to 3, and $Ar^4$, $Ar^5$, $R^{12}$, $R^{13}$ and $R^{14}$ have the same meanings as those defined for the general formula (2)).

The Wittig-Horner reaction is conducted, for example, as described below. 1.0 equivalent amount of the enamine-carbonyl intermediate product represented by the general formula (7), 1.0 to 1.20 equivalent amount of the Wittig reagent represented by the general formula (8-1) or (8-2), and 1.0 to 1.5 equivalent amount of a metal alkoxide base such as potassium t-butoxide, sodium ethoxide, or sodium methoxide are added in a solvent, for example, toluene, xylene, diethylether, tetrahydrofuran (simply referred to as THF), ethylene glycol dimethyl ether, N,N-dimethylformamide, or dimethyl sulfoxide and stirred at a room temperature or under heating at 30 to 60° C., for 2 to 8 hours. Thus, the enamine compound represented by the general formula (2) can be produced at a high yield.

The enamine compound represented by the general formula (2) may be used in admixture with other charge transportation substances. The other charge transportation substances which are used in admixture with the enamine compound represented by the general formula (2) include, for example, carbazole derivatives, oxyzole derivatives, oxadiazole derivatives, thiazole derivatives, thiadiazole derivatives, triazole derivatives, imidazole derivatives, imidazolone derivatives, imidazolidine derivatives, bisimidazolidine derivatives, stylyl compounds, hydrozone compounds, polynuclear aromatic compounds, indole derivatives, pyrazoline derivatives, oxazolone derivatives, benzimidazole derivatives, quinazoline derivatives, benzofuran derivatives, acridine derivatives, phenadine derivatives, aminostilbene derivatives, triarylamine derivatives, triarylmethane derivatives, phenylenediamine derivatives, stilbene derivatives, and benzidine derivatives. Further, polymers having the groups derived from the compounds in the main chain or the side chain, for example, poly-N-vinylcarbazole, poly-1-vinylpyrene, and poly-9-vinylanthracene can also be mentioned.

However, for attaining particularly high charge transportation ability, it is preferred that the entire amount of the charge transportation substance 13 comprises the enamine compound represented by the general formula (2).

The ration (A/B) between the charge transportation substance 13 (A) and the binder resin 17 (B) in the charge transportation layer is preferably 10/12 or less by weight ratio. This can improve the wear resistance of the photosensitive layer 14.

Further, the ratio A/B is preferably 10/30 or more by weight ratio in a case of forming the charge transportation layer 16 by a dip coating method to be described later. In a case where the ratio A/B is less than 10/30 and the ratio of the binder resin 17 is excessively high, since the viscosity of the coating solution increases, it results in lowering of the coating speed to remarkably worsen the productivity. Further, in a case of increasing the amount of the solvent in the coating solution in order to suppress the increase of the viscosity of the coating solution, a brushing phenomenon occurs to cause clouding in the formed charge transportation layer 16.

An additive such as a plasticizer or a leveling agent may also be added to the charge transportation layer 16 optionally in order to improve the film forming property, flexibility and surface smoothness. The plasticizer include, for example, a dibasic acid ester such as phthalate ester, fatty acid ester, phosphorate ester, chlorinated paraffin, and epoxy plasticizer. The leveling agent include, for example, silicone type leveling agent.

Fine particles of an inorganic compound or an organic compound may be added to the charge transportation layer 16 in order to increase the mechanical strength or improve the electric characteristics.

Further, various additives such as an antioxidant and a sensitizer may be added optionally to the charge transportation layer 16. This can improve potential characteristics. Further, the stability of the coating solution upon forming the charge transportation layer 16 by coating is improved as will be described later. Further, this can mitigate the fatigue deterioration to improve the durability upon repetitive use of the photoreceptor.

As the antioxidant, hindered phenol derivatives or hindered amine derivatives are used preferably. The hindered phenol derivatives are preferably used within a range of 0.1% by weight or more and 50% by weight or less relative to the charge transportation substance 13. Further, the hindered amine derivatives are used preferably within a range from 0.1% by weight or more and 50% by weight or less relative to the charge transportation substance 13. The hindered phenol derivative and the hindered amine derivative may be used in admixture. In this case, the total amount of the hindered phenol derivative and the hindered amine derivative to be used is preferably within a range from 0.1% by weight or more and 50% by weight or less relative to the charge transportation substance 13. In a case where the amount of the hindered phenol derivative to be used, the amount of the hindered amine derivative to be used, or the total amount of the hindered phenol derivative and the hindered amine derivative to be used is less than 0.1% by weight, no sufficient effect can be obtained for the improvement of the stability of the coating solution and the improvement of the durability of the photoreceptor. Further, if the amount exceeds 50% by weight, this gives an undesired effect on the characteristics of the photoreceptor. Accordingly, it is defined as 0.1% by weight or more and 50% by weight or less.

The charge transportation layer 16 is formed, for example, by dissolving or dispersing, in an appropriate solvent, the charge transportation substance 13 containing the enamine compound represented by the general formula (2) described above and the binder resin 17 containing the polyarylate resin having the structural unit represented by the general formula (1), and the additives described above, if necessary, to prepare a coating solution for a charge transportation layer, and coating the obtained solution on the outer circumferential surface of the charge generation layer 15.

The solvent for the coating solution for the charge transportation layer can include, for example, aromatic hydrocarbons such as benzene, toluene, xylene and monochlorobenzene, halogenated hydrocarbon such as dichloromethane and dichloroethane, ethers such as tetrahydfofuran, dioxane and dimethoxymethyl ether, as well as aprotic polar solvents such as N,N-dimethylformamide. The solvents may be used each alone or two or more of them may be used in admixture. Further, the solvents described above may also be used with a further addition of alcohols or acetonitrile or methyl ethyl ketone optionally.

The coating method for the coating solution for charge transportation layer includes, for example, a spraying method, bar coating method, roll coating method, blade method, wringing method or dip coating method. Among the coating methods described above, an optimal method can be selected while taking the physical properties of the coating and the productivity into consideration. Among the coating methods described above, since the dip coating method is a method of dipping a substrate into a coating bath filled with the coating solution and then pulling up the substrate at a constant speed or at a gradually changing speed to form a layer on the surface of the substrate and, since the method is relatively simple and excellent in view of the productivity and the cost, it has been often utilized in a case of producing an electrophotographic photoreceptor and also often utilized in a case of forming the charge transportation layer 16.

The film thickness of the charge transportation layer 16 is preferably, 5 μm or more and 50 μm or less and, more preferably, 10 μm or more and 40 μm or less. In a case where the film thickness of the charge transportation layer 16 is less than 5 μm, the charge retainability on the surface of the photoreceptor is lowered. In a case where the film thickness of the charge transportation layer 16 exceeds 50 μm, resolution of the photoreceptor is lowered. Accordingly, it is defined as 5 μm or more and 50 μm or less.

As described above, the photosensitive layer 14 has a stacked structure of the charge generation layer 15 containing the charge generation substance 12 and the charge transportation layer 16 containing the charge transportation substance 13. By sharing the charge generating function and the charge transporting function respectively to separate layers, since optimal materials can be selected for the charge generating function and the charge transporting function respectively, a photoreceptor having higher sensitivity and of high durability further improved stability upon repetitive use can be obtained.

The charge generation layer 15 contains the charge generation substance 12 as a main ingredient. The material effective as the charge generation substance 12 includes azo pigments such as a monoazo pigment, bisazo pigment, and trisazo pigment, indigo pigments such as indigo and thioindigo, perylene pigments such as peryleneimide and perylenic acid anhydride, polynuclear quinone pigments such as anthraquinone and pyrenequinone, phthalocyanine pigments such as metal phthalocyanine and non-metal phthalocyanine, squarylium dyes, pyrylium salts and thiopyrylium salts, triphenylmethane dyes, and inorganic materials such as selenium and amorphous silicon. The charge generation substances are used each alone or two or more of them in combination.

Among the charge generation substances described above, use of oxotitanium phthalocyanine is preferred. Since oxotitanium phthalocyanine is a charge generation substance having high charge generating efficiency and charge injecting efficiency, it generates a great amount of charges by absorption of light and efficiently injects the generated charges, without accumulating them in the inside thereof, into the charge transportation substance 13. Further, as described above for the charge transportation substance 13, the enamine compound of high charge mobility represented by the general formula (2) is used. Accordingly, since the charges generated from the charge generation substance 12 by light absorption are efficiently injected into the charge transportation substance 13 and transported smoothly, an electrophotographic photoreceptor of high sensitivity and high resolution can be obtained.

The charge generation substance 12 may be used in combination with sensitizing dyes, for example, triphenylmethane dyes typically represented by methyl violet, crystal violet, night blue, and Victoria blue, acrydine dyes typically represented by erythrosin, rhodamine B, rhodamine 3R, acrydine orange, and flaveosin, thiazine dyes typically represents by methylene blue and methylene green, oxazine dyes typically represented by capri blue and merdora blue, cyanine dyes, stylyl dyes, pyrylium salt dyes, or thiopyrylium salt dyes.

The method of forming the charge generation layer 15 includes a method of vacuum vapor depositing the charge generation substance 12 on the outer circumferential surface of the electroconductive substrate 11, or a method of coating a coating solution for charge generation layer obtained by dispersing the charge generation substance 12 in an appropriate solvent to the outer circumferential surface of the electroconductive substrate 11. Among them, a preferred method includes dispersing the charge generation substance 12 into a binder resin solution obtained by mixing a binder resin as a binder into an appropriate solvent by a known method to prepare a coating solution for charge generation layer and coating the obtained coating solution to the outer circumferential surface of the electroconductive substrate 11. The method is to be described below.

The binder resin for the charge generation layer 15 is selected from the group consisting, for example, of polyestera resin, polystyrene resin, polyurethane resin, phenol resin, alkyd resin, melamine resin, epoxy resin, silicone resin, acryl resin, methacryl resin, polycarbonate resin, polyarylate resin, phenoxy resin, polyvinyl butyral resin, and polyvinyl formal resin, as well as copolymer resins containing two or more of repetitive units constituting the resins described above are used each alone or in admixture of two or more of them. Specific examples of the copolymer resin include, for example, those insulative resins such as vinyl chloride-vinyl acetate copolymer resin, vinyl chloride-vinyl acetate-maleic acid anhydride copolymer resin, and acrylonitrile-styrene copolymer resin. The binder resin is not restricted to them but those resins used generally can be used as the binder resin.

As a solvent for the coating liquid for charge generation layer, for example, halogenated hydrocarbons such as dichloromethane or dichloroethane, ketones such as acetone, methyl ethyl ketone or cyclohexanone, esters such as ethyl acetate or butyl acetate, ethers such as tetrahydrofuran (referred to as THF) or dioxane, alkylethers of ethylene glycol such as 1,2-dimethoxyethane, aromatic hydrocarbons such as benzene, toluene or xylene, or aprotonic polar solvents such as N,N-dimethyl formamide or N,N-dimethylacetoamide, etc, are used. The solvents may be used alone or two or more of them may be mixed and used as a mixed solvent.

As the blending ratio between the charge generation substance 12 and the binder resin, it is preferred that the ratio of the charge generation substance 12 is within a range from 10% by weight to 99% by weight. In a case where the ratio of the charge generation substance 12 is less than 10% by weight, the sensitivity is lowered. In a case where the ratio of the charge generation substance 12 exceeds 99% by weight, since not only the film strength of the charge generation layer 15 is lowered but also the dispersibility of the charge generation substance 12 is lowered to increase coarse particles to sometimes decrease the surface charges at the portion other than the portion to be erased by exposure, this increases image defects, particularly, image fogging referred to as "black speck" where toners are deposited to the white back ground to form fine black spots. Accordingly, it is defined as from 10% by weight to 99% by weight.

Before dispersing the charge generation substance 12 in the binder resin solution, the charge generation substance 12 may previously be pulverized by a pulverizer. The pulverizer used for pulverization includes, for example, a ball mill, sand mill, attritor, vibration mill, and supersonic dispersing machine.

The dispersing machine used upon dispersing the charge generation substance 12 into the binder resin solution includes, for example, a paint shaker, ball mill, and sand mill. As the dispersion conditions, appropriate conditions are selected so as not to cause intrusion of impurities due to abrasion of members constituting the container or dispersing machine to be used.

The coating method of the coating solution for charge generation layer includes, for example, a spraying method, bar coating method, roll coating method, blade method, wringing method, and dip coating method. Among the coating method described above, since the dip coating method is particularly excellent with various view points as described above, it has been often utilized also in a case of forming the charge generation layer 15. As the apparatus used for the dip coating method, a coating solution dispersing apparatus typically represented by a supersonic generation apparatus may be provided in order to stabilize the dispersibility of the coating solution.

The film thickness of the charge generation layer 15 is, preferably, 0.05 μm or more and 5 μm or less and, more preferably, 0.1 μm or more and 1 μm or less. In a case where the film thickness of the charge generation layer 15 is less than 0.05 μm, the light absorption efficiency is lowered to lower the sensitivity. In a case where the film thickness of the generation layer 15 exceeds 5 μm, the charge transfer in the charge generation layer constitutes a rate determining step in the process of erasing charges on the surface of the photoreceptor to lower the sensitivity. Accordingly, it is defined as 0.05 μm or more and 5 μm or less.

As the electroconductive material constituting the electroconductive substrate 11, metal materials, for example, elemental metals such as aluminum, copper, zinc, and titanium, as well as alloys such as aluminum alloys and stainless steels can be used. Further, with no particular restriction to such metal materials, polymeric materials such as polyethylene terephthalate, nylon, or polystyrene, hard paper or glass in which metal foils are laminated, metal materials are vapor deposited, or a layer of electroconductive compound such as electroconductive polymer, tin oxide, or indium oxide is vapor deposited or coated on the surface thereof can also be used. While the shape of the electroconductive substrate 11 is cylindrical in this embodiment, it is not restrictive but may be a circular columnar shape, sheet like shape, or endless belt shape.

The surface of the electroconductive substrate 11 may optionally be applied with an anodizing treatment, a surface treatment with chemicals or hot water, a coloring treatment or a random reflection treatment, for example, by surface roughening, within a range not affecting the picture quality. In the electrophotographic process using laser as an exposure source, since the wavelength of laser beams is coherent, the incident laser light and the light reflected in the photoreceptor may sometimes cause interference and the interference fringe caused by interference appears on the images to result in image defects. Image defects by the interference of the laser light of coherent wavelength can be prevented by applying the treatment described above to the surface of the electroconductive substrate 11.

Figure 2:
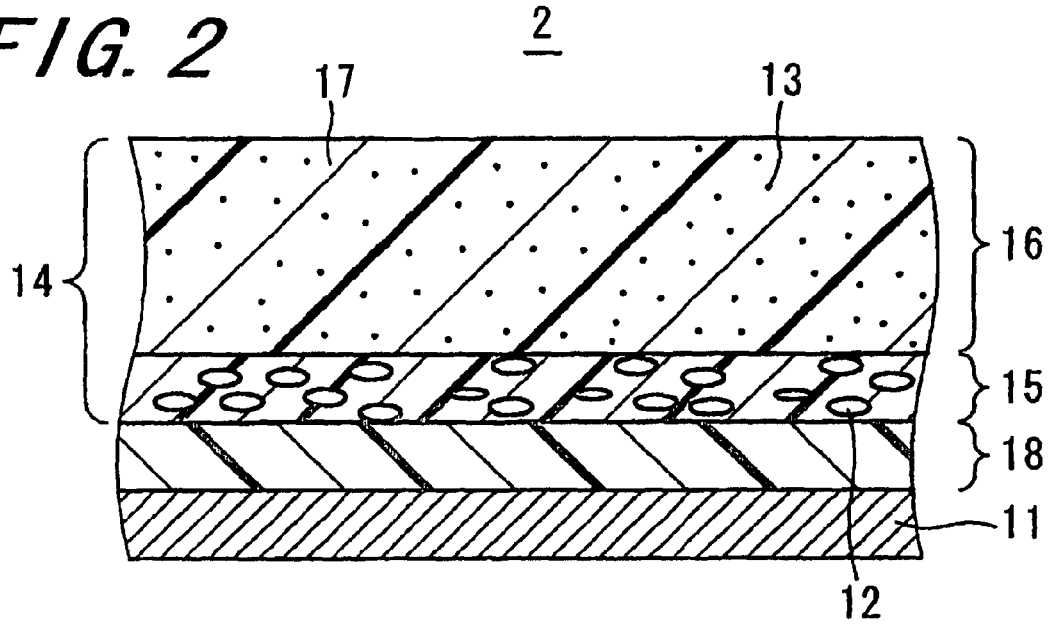
FIG. 2 is a schematic cross sectional view schematically showing the constitution of an electrophotographic photoreceptor according to a second embodiment of the invention.

FIG. 2 is a schematic cross sectional view schematically showing the constitution of an electrophotographic photoreceptor according to a second embodiment of the invention. The electrophotographic photoreceptor 2 in this embodiment is similar with the electrophotographic photoreceptor 1 of the first embodiment, and corresponding portions carry identical references, for which explanation is to be omitted.

What is to be noted in the electrophotographic photoreceptor 2 is provision of an intermediate layer 18 between the electroconductive substrate 11 and the photosensitive layer 14.

In a case where the intermediate layer 18 is not present between the electroconductive substrate 11 and the photosensitive layer 14, charges are injected from the electroconductive substrate 11 to the photosensitive layer 14 to lower the chargeability of the photosensitive layer 14, and the surface charges in the portion other than the portions to be erased by exposure are decreased to sometimes result in defects such as fogging to the images. Particularly, in a case of forming images by using a reversal development process, since toner images are formed to the portion decreased with the surface charges by exposure, when the surface charges are decreased by the factor other than the exposure, toner is deposited to the white background to result in fogging of images referred to as black speck in which fine black spots are formed by the deposition of the toner on the white background to remarkably deteriorate the image qualities. That is, in a case where the intermediate layer 18 is not present between the electroconductive substrate 11 and the photosensitive layer 14, this lowers the chargeability in the minute region due to the defects of the electroconductive substrate 11 or the photosensitive layer 14 to result in fogging of images such as black specks, which leads to remarkable image defects.

However, in the electrophotographic photoreceptor 2 in this embodiment, since the intermediate layer 18 is provided between the electroconductive substrate 11 and the photosensitive layer 14 as described above, injection of charges from the electroconductive substrate 11 to the photosensitive layer 14 can be prevented. Accordingly, lowering of the chargeability of the photosensitive layer 14 can be prevented to suppress the decrease of the surface charges in the portion other than the portions to be erased by exposure and occurrence of defects such as fogging to the images can be prevented.

Further, since the defects at the surface of the electroconductive substrate 11 can be covered to obtain a uniform surface by the provision of the intermediate layer 18, the film forming property of the photosensitive layer 14 can be improved. Further, peeling of the photosensitive layer 12 from the electroconductive substrate 11 can be suppressed to improve the adhesion between the electroconductive substrate 11 and the photosensitive layer 14.

For the intermediate layer 18, a resin layer formed of various kinds of resin materials, or an alumite layer is used.

The resin materials forming the resin layer include, those resins such as polyethylene resin, polypropylene resin, polystyrene resin, acryl resin, vinyl chloride resin, vinyl acetate resin, polyurethane resin, epoxy resin, polyester resin, melamine resin, silicone resin, polyvinyl butyral resin, and polyamide resin, as well as copolymer resins containing two or more of repetitive units constituting the resins described above. Further, casin, gelatin, polyvinyl alcohol, ethyl cellulose, etc. can also be used. Among them, use of the polyamide resin is preferred and, particularly, use of alcohol soluble nylon resin is preferred. Preferred alcohol soluble nylon resin includes, for example, so-called copolymerized nylon formed by copolymerizing 6-nylon, 6,6-nylon, 6,10-nylon, 11-nylon and 2-nylon, as well as those resin formed by chemically modifying nylon such as N-alkoxymethyl modified nylon and N-alkoxyethyl modified nylon.

The intermediate layer 18 may also contain particles such as of metal oxide. Incorporation of the particles can control the volumic resistance value of the intermediate layer 18 and improve the effect of preventing injection of charges from the electroconductive substrate 11 to the photosensitive layer 14, and can maintain the electric characteristics of the photoreceptor under various circumstances.

The metal oxide particles include, for example, those particles of titanium oxide, aluminum oxide, aluminum hydroxide, and tin oxide.

In a case of incorporating particles such as of metal oxides into the intermediate layer 18, the intermediate layer 18 can be formed, for example, by dispersing the particles into a resin solution formed by dissolving the resin described above into an appropriate solvent to prepare a coating solution for the intermediate layer and coating the coating solution to the outer circumferential surface of the electroconductive substrate 11.

As the solvent for the resin solution, water or various kinds of organic solvents is used. Particularly, a single solvent such as water, methanol, ethanol, or butanol, or mixed solvent comprising such as water and alcohol, two or more kinds of alcohols, acetone or dioxolane and alcohols, and chlorine solvent such as dichloroethane, chloroform, or trichloroethane and alcohols are used suitably.

As the method of dispersing the particles in the resin solution, a general method of using a ball mill, sand mill, attritor, vibration mill, or supersonic dispersing machine, etc. can be used.

The total content (C) for the resin and the methyl oxide in the coating solution for intermediate layer relative to the content of the solvent (D) in the coating solution for intermediate layer is, preferably, from 1/99 to 40/60 and, more preferably, from 2/98 to 30/70 by the weight ratio C/D. Further, the ratio between the resin and the metal oxide (resin/metal oxide), is preferably, from 90/10 to 1/99 and, more preferably, from 70/30 to 5/95 by weight ratio.

The coating method of the coating solution for intermediate layer includes, for example, a spraying method, a bar coating method, a roll coating method, a blade method, wringing method, and a dip coating method. Particularly, as previously stated since the dip coating method is relatively simple and is excellent in view of the productivity and the cost, it has been often utilized also in a case of forming the intermediate layer 18.

The film thickness of the intermediate layer 18 is, preferably, from 0.01 μm or more and 20 μm or less and, preferably, 0.05 μm or more and 10 μm or less. In a case where the film thickness of the intermediate layer 18 is less than 0.01 μm, it no more substantially functions as the intermediate layer 18 and no uniform surface property by coating the defects of the surface of the electroconductive substrate 11 can be obtained, and injection of charges from the electroconductive substrate 11 to the photosensitive layer 14 can not be prevented to lower the chargeability of the photosensitive layer 14. It is not preferred to increase the film thickness of the intermediate layer 18 to more than 20 μm since formation of the intermediate layer 18 is difficult and the photosensitive layer 14 can not be formed uniformly on the outer circumferential surface of the intermediate layer 18 to lower sensitivity of the photoreceptor in a case of forming the intermediate layer 18 by the dip coating method.

Figure 3:
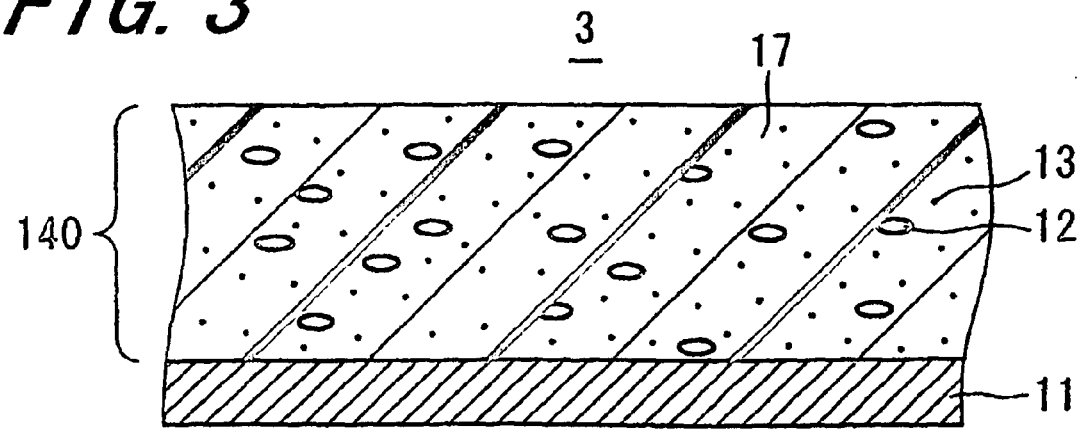
FIG. 3 is a schematic cross sectional view schematically showing the constitution of an electrophotographic photoreceptor according to a third embodiment of the invention.

FIG. 3 is a schematic cross sectional view schematically showing the constitution of an electrophotographic photoreceptor according to a third embodiment of the invention. The electrophotographic photoreceptor 3 in this embodiment is similar with the electrophotographic photoreceptor 1 of the first embodiment, and corresponding portions carry identical references, for which explanation is to be omitted.

What is to be noted for the electrophotographic photoreceptor 3 is that the photosensitive layer 140 has a single layered structure in which the charge generation substance 12 and the charge transportation substance 13 containing the enamine compound represented by the general formula (2)

are bonded by the binder resin 17 containing a polyarylate resin having the structural unit represented by the general formula (1). That is, the electrophotographic photoreceptor 3 is a single layered photoreceptor.

In the electrophotographic photoreceptor 3 of the single layered type described above, the photosensitive layer 140, like the charge transportation layer 16 provided to the electrophotographic photoreceptor 1 in the first embodiment, is scraped and worn by the contacting member used upon transfer of the toner images on the surface of the photoreceptor obtained by developing static latent images to the recording medium, or upon removing the toner remaining on the surface of the photoreceptor after transfer in the electrophotographic process.

However, since the photosensitive layer 140 provided to the electrophotographic photoreceptor 3 in this embodiment contains the polyarylate resin having the structural unit represented by the general formula (1) of excellent mechanical strength like the charge transportation layer 16 provided to the electrophotographic photoreceptor 1 of the first embodiment, the photoreceptor 3 shows a small wear amount, the wear resistance is excellent and change of characteristics caused by film scraping of the photosensitive layer 140 is small.

Further, since the enamine compound represented by the general formula (2) used for the charge transportation substance 13 is excellent in the compatibility with the polyarylate resin having the structural unit represented by the general formula (1) and has high a charge mobility, it is possible to obtain an electrophotographic photoreceptor showing high charge potential, high sensitivity and sufficient responsivity, even in a case where the photosensitive layer 140 contains the polyarylate resin having the structural unit represented by the general formula (1) and with no deterioration of the electric characteristics even in a case of repetitive use.

Accordingly, by incorporating the polyarylate resin having the structural unit represented by the general formula (1) and the enamine compound represented by the general formula (2) in combination in the photosensitive layer 140, it is possible to obtain an electrophotographic photoreceptor excellent in the mechanical strength and capable of enduring increase in the mechanical stress accompanied to digitalization and increasing resolution of the electrophotographic apparatus, as well as capable of providing favorable electric characteristics stably over a long period of time.

The photosensitive layer 140 is formed by the same method as for the charge transportation layer 16 disposed to the electrophotographic photoreceptor 1 of the first embodiment described above. For example, it is formed as described below. The charge generation substance 12, the charge transportation substance 13 containing the enamine compound represented by the general formula (2), and the binder resin 17 containing the polyarylate resin having the structural unit represented by the general formula (1) are dissolved or dispersed in the appropriate solvent described above to prepare a coating solution for photosensitive layer. The coating solution for photosensitive layer is coated on the outer circumferential surface of the electroconductive substrate 11, for example, by using a dip coating method.

The ratio (A'/B') between the charge transportation substance 13 (A') and the binder resin 17 (B') in the photosensitive layer 140 is preferably 10/12 or less by weight ratio in the same manner as the ratio (A/B) between the charge transportation substance 13 (A) and the binder resin (B) in the charge transportation layer 16 provided to the electrophotographic photoreceptor 1 of the first embodiment. This can improve the wear resistance of the photoreceptor 140. Further, in a case of forming the photosensitive layer 140 by the dip coating method, the ratio A'/B' is preferably 10/30 or more by weight ratio.

The film thickness of the photosensitive layer 140 is, preferably, 5 μm or more and 100 μm or less and, more preferably, 10 μm or more and 50 μm or less. In a case where the film thickness of the photosensitive layer 140 is less than 5 μm, the charge retainability on the surface of the photoreceptor is lowered. In a case where the film thickness of the photosensitive layer 140 exceeds 100 μm, productivity is lowered. Accordingly, it is defined as 5 μm or more and 100 μm or less.

Further, one of more electron accepting materials or dyes may also be added to the photosensitive layer 14 or the photosensitive layer 140 provided to the electrophotographic photoreceptors of first to third embodiments described above in order to improve the sensitivity and suppress the increase of the residual potential and fatigue during repetitive use.

As the electron accepting material, electron attracting materials, for example, acid anhydrides such as succinic acid anhydride, maleic acid anhydride, phthalic acid anhydride, and 4-chloronaphthalic acid anhydride, cyano compound such as tetraethylcyanoethylene and terephthal malon dinitrile, aldehydes such as 4-nitrobenzoaldehyde, anthraquinones such as anthraquinone and 1-nitroanthraquinone, polynuclear or heterocyclic nitro compounds such as 2,4,7-trinitrofluolenone and 2,4,5,7-tetranitrofluolenone, as well as diphenoquinone compounds. Those formed by making the electron attracting materials to higher molecular weight, etc. may also be used.

As the dyes, organic photoconductive compounds, for example, xanthene dyes, thiazine dyes, triphenylmethane dyes, quinoline pigments, and copper phthalocyanine can be used. Such organic photoconductive compounds function as an optical sensitizer.

Further, various kinds of additives such as antioxidant, sensitizer, and UV-ray absorbent may also be added optionally to each of the layers of the electrophotographic photoreceptor of first to third embodiments. This can improve potential characteristics. Further, the stability of the coating solution upon forming the layer by coating is improved. Further, the fatigue deterioration can be decreased to improve the durability when the photoreceptor is used repetitively.

Particularly preferred antioxidant includes, for example, phenol compounds, hydroquinone compounds, tocopherol compounds and amine compounds. The antioxidant is preferably used within a range from 0.1% by weight or more and 50% by weight or less based on the charge transportation substance 13. In a case where the amount of the antioxidant to be used is less than 0.1% by weight, no sufficient effect can be obtained for the improvement of the stability of the coating solution and the durability of the photoreceptor. In a case where the amount of the antioxidant to be used exceeds 50% by weight, it gives an undesired effect on the characteristic of the photoreceptor. Accordingly, it is defined as 0.1% by weight or more and 50% by weight or less.

Figure 4:
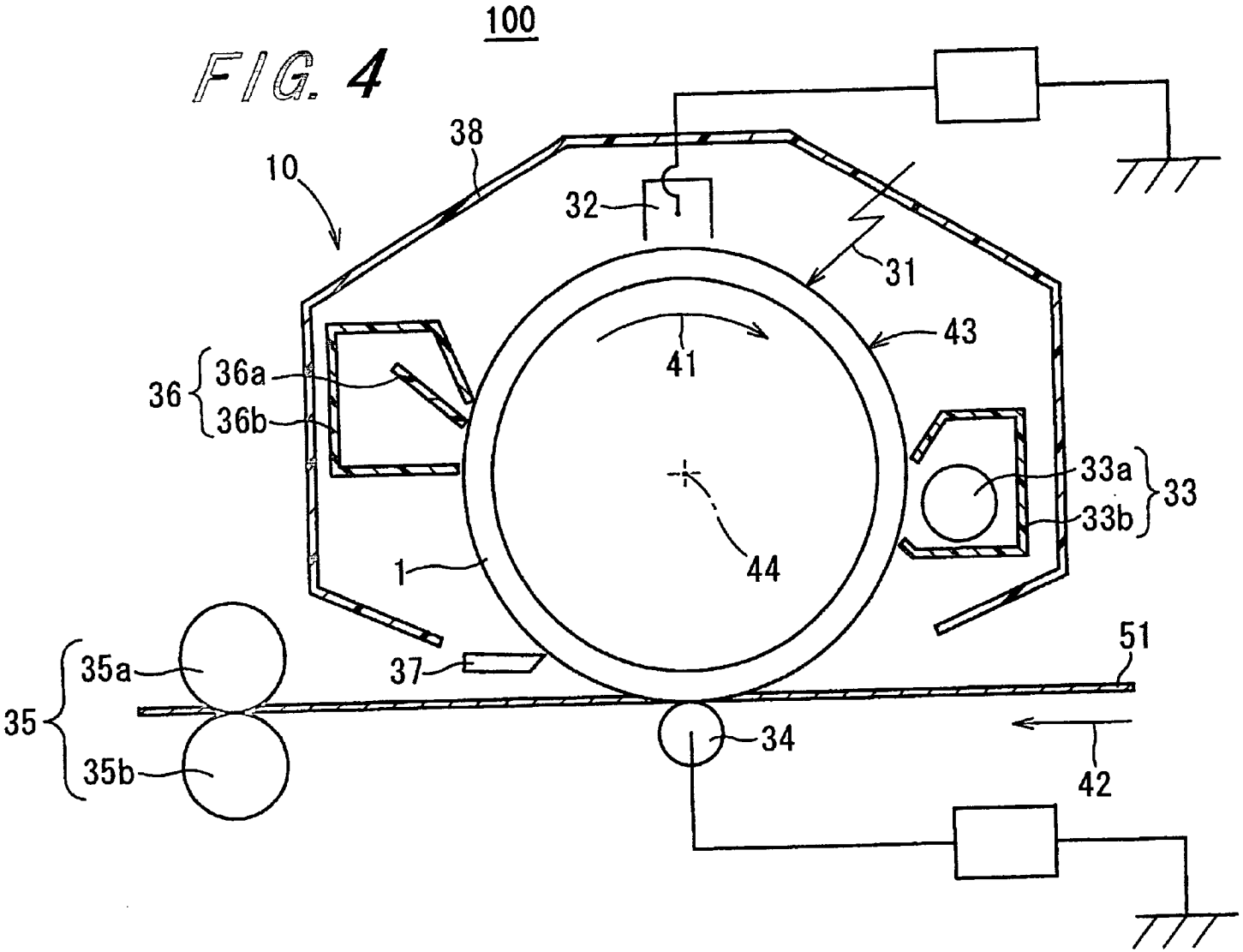
FIG. 4 is a side elevational view for the arrangement schematically showing the constitution of the electrophotographic apparatus 100.

As an electrophotographic apparatus as a fourth embodiment of the invention, an electrophotographic apparatus 100 having the electrophotographic photoreceptor 1 of the first embodiment described above (photoreceptor 1) is to be exemplified. FIG. 4 is a side elevational view for the arrangement schematically showing the constitution of the electrophotographic apparatus 100.

The electrophotographic apparatus 100 comprises a photoreceptor 1 rotationally supported on a housing 38, and driving means not illustrated for rotationally driving the photoreceptor 1 around a rotational axis 44 in the direction of an arrow 41. The not illustrated driving means comprises, for example, a motor as a power source and rotationally drives the photoreceptor 1 at a predetermined circumferential speed by transmitting the power from the motor by way of not illustrated gears to a substrate constituting the core of the photoreceptor 1.

At the periphery of the photoreceptor 1, are disposed a charger 32, not-illustrated exposure means, developing device 33, a transfer roller 34, a separation means 37, and a cleaner 36 in this order from the upstream to the downstream in the rotational direction of the photoreceptor 1 shown by the arrow 41. The cleaner 36 is disposed together with a not illustrated charge eliminator. The photoreceptor 1, the charger 32, the developing device 33, and the cleaner 36 are disposed integrally as to be incorporated in the housing 38 to constitute a process cartridge 10. The process cartridge 10 is constituted detachably relative to the electrophotographic apparatus main body by using not illustrated guide means such a rails.

The charger 32 is the charging means for charging the outer circumferential surface 43 of the photoreceptor 1 to a predetermined potential. The charger 32 is, for example, non-contact type charging means, for example, a corona charging system.

The not illustrated exposure means comprise, for example, a semiconductor laser as an optical source and irradiate a light 31 such as a laser beam outputted from the optical source to the outer circumferential surface 43 of the photoreceptor 1 situated between the charger 32 and the developing device 33 thereby subjecting the charged outer circumferentila surface 43 of the photoreceptor 1 to exposure to light in accordance with image information.

The developing device 33 is developing means for developing electrostatic latent images formed by exposure to the outer circumferential surface 43 of the photoreceptor 1 by an exposure and comprise a developing roller 33*a* opposed to the photoreceptor 1 and supplying a toner to the outer circumferential surface 43 of the photoreceptor 1 and a casing 33*b* for rotationally supporting the developing roller 33*a* around a rotational axis parallel with the rotational axis 44 of the photoreceptor 1 and housing the developer containing the toner to the inner space thereof.

The transfer roller 34 is transferring means opposed to the photoreceptor 1 for transferring the developed images to transfer paper 51 by contacting the photoreceptor 1 and the transfer paper 51 which is a recording medium supplied between the photoreceptor 1 and the transfer roller 34 by not illustrated transferring means in the direction of the arrow 42.

The separation means 37 are means for separating the photoreceptor 1 and the transfer paper 51 put in press contact.

The cleaner 36 is cleaning means for removing to recover the toner remaining on the outer circumferential surface 43 of the photoreceptor 1 after the transferring operation by the transfer roller 34 and comprises a cleaning blade 36*a* for separating the toner remaining on the outer circumferential surface 43 of the photoreceptor 1 from the outer circumferential surface 43, and a recovery casing 36*b* for housing the toner peeled by the cleaning blade 36*a*.

Further, a fixing device 35 as fixing means for fixing images transferred on the transfer paper 51 is disposed in the direction where the transfer paper 51 separated from the photoreceptor 1 by the separation means 37 is conveyed. The fixing device 35 comprises a heating roller 35*a* having heating means not illustrated and a press roller 35*b* opposed to the heating roller 35*a* and pressed by the heating roller 35*a* to form a contact portion.

The image forming operation by the electrophotographic apparatus 100 is to be described. At first, when the photoreceptor 1 is driven rotationally by the driving means in the direction of the arrow 41, the outer circumferential surface 43 of the photoreceptor 1 is uniformly charged to a predetermined positive or negative potential by the charger 32 disposed upstream to the focusing point of the light 31 from the exposure means in the rotational direction of the photoreceptor 1. Then, the light 31 is irradiated from the exposure means to the outer circumferential surface 43 of the photoreceptor 1. The light 31 from the light source is scanned repetitively in the longitudinal direction of the photoreceptor 1 which is a main scanning direction. When the photoreceptor is rotated and the light from the light source is repetitively scanned, exposure in accordance with image information is applied to the outer circumferential surface 43 of the photoreceptor 1. By the exposure, surface charges at the portion irradiated with the light 31 are eliminated to result a difference between the surface potential at the portion irradiated with the light 31 and the surface potential at the portion not irradiated with the light 31, to form electrostatic latent images to the outer circumferential surface 43 of the photoreceptor 1. Then, toner is supplied to the outer circumferential surface 43 of the photoreceptor 1 formed with the electrostatic latent images from the developing roller 33*a* of the developing device 33 located downstream to the focusing point of the light 31 from the light source in the rotationally direction of the photoreceptor 1 to develop electrostatic latent images, and toner images are formed to the outer circumferential surface 43 of the photoreceptor 1.

Further, in synchronization with exposure to the photoreceptor 1, transfer paper 51 is fed by conveying means in the direction of the arrow 42 between the photoreceptor 1 and the transfer roller 34 located downstream to the developing device 33 in the rotational direction.

When the transfer paper 51 is fed between the photoreceptor 1 and the transfer roller 34, the transfer roller 34 is pressed to the photoreceptor 1 to form a contact portion. Thus, the photoreceptor land the transfer paper 51 are in press contact and the toner images formed on the outer circumferential surface 43 of the photoreceptor 1 are transferred onto the transfer paper 51.

The transfer paper 51 transferred with the toner images are peeled from the outer circumferential surface 43 of the photoreceptor 1 by the separation means 37, then conveyed by not illustrated conveying means to the fixing device 35 and heated and pressed upon passage through the contact portion between the heating roller 35*a* and the press roller 35*b* of the fixing device 35. Thus, the toner images on the transfer paper 51 are fixed to the transfer paper 51 as firm images. The transfer paper 51 thus formed with the images are discharged by the conveying means to the outside of the electrophotographic apparatus 100.

On the other hand, a toner remaining on the outer circumferential surface 43 of the photoreceptor 1 after the transferring operation by the transfer roller 34 is peeled from the outer circumferential surface 43 of the photoreceptor 1 by the cleaning blade 36*a* of the cleaner 36 located further downstream to the separation means 37 in the rotational direction and upstream to the charger 32 in the rotational direction and recovered in the recovery casing 36*b*. Electric charges on the outer circumferential surface 43 of the photoreceptor 1 removed with the toner are eliminated by a not illustrated charge eliminator, and the electrostatic latent images on the outer circumferential surface 43 of the photoreceptor 1 are erased. Then, the photoreceptor 1 is further rotated and a series of operations starting from charging for the photoreceptor 1 are repeated again. As described above, images are formed continuously.

As described above since the photoreceptor 1 provided to electrophotographic apparatus 100 of this embodiment has a photosensitive layer 14 containing the polyarylate resin having the structural unit represented by the general formula (1) excellent in the mechanical strength and the enamine compound represented by the general formula (2) of high charge mobility, it is excellent in the mechanical strength, capable of enduring increase in the mechanical stress caused by digitalization and increasing resolution of the electrophotographic apparatus and can provide favorable electric characteristics stably for a long period of time. Accordingly, it is possible to obtain an electrophotographic apparatus with high reliability capable of providing high quality images over a long period of time.

Further, while the transfer roller 34 is pressed to the photoreceptor 1 as described above, since the photosensitive layer 14 provided to the photoreceptor 1 contains the polyarylate resin having the structural unit represented by the general formula (1) of excellent mechanical strength as described above, the wear amount of the photosensitive layer 14 is small and injuries scarcely occur at the surface of the photosensitive layer 14. Accordingly, since the pressing force by the transfer roller 34 can be increased to improve the transfer efficiency to the transfer paper 51, high quality image with less image defects such as whitening or blackening can be provided.

Further, the process cartridge 10 integrally comprises the photoreceptor 1, the charger 32, the developing device 33, and the cleaner 36 and is adapted detachably to the electrophotographic apparatus main body. Accordingly, it is not necessary to attach or detach the photoreceptor 1, the charger 32, the developing device 33 and the cleaner 36 individually to or from the electrophotographic apparatus main body, they can be easily attached or detached to or from the electrophotographic apparatus main body. Further, as describe above, since the photoreceptor 1 provided to the process cartridge 10 is excellent in the mechanical strength and can endure the increase of the mechanical stress accompanied to digitalization and increasing resolution of the electrophotographic apparatus, as well as can provide favorable electric characteristics stably for a long period of time, a process cartridge not requiring exchange for a long period of time can be obtained.

As has been described above, while the electrophotographic apparatus 100 of this embodiment has the electrophotographic photoreceptor 1 of the first embodiment but this is not limitative but it may be provided with the electrophotographic photoreceptor 2 of the second embodiment or the electrophotographic photoreceptor 3 of the third embodiment.

Further, while the process cartridge 10 comprises integrally the photoreceptor 1, the charger 32, the developing device 33, and the cleaner 36, they are not limitative but may integrally comprise one or two means selected from the group consisting of the photoreceptor 1, the charger 32, the developing device 33 and the cleaner 36 integrally.

Further, the charger 32 is a non-contact type charging means but this is not limitative but may also be a contact type charging means such as a roller charging system. As described above, since the photoreceptor 1 is excellent in the wear resistance, it is possible to obtain an electrophotographic apparatus of high reliability capable of providing high quality images for a long period of time even in a case of using such contact type charging means.

EXAMPLE

The present invention is to be described more specifically by way of examples but the invention is not restricted to them.

Preparation Example

Preparation Example 1

Preparation of Exemplified Compound No. 1

Preparation Example 1-1

Preparation of Enamine Intermediate Product 23.3 g (1.0 equivalent amount) of N-(p-tolyl)-α-naphthylamine represented by the following structural formula (9), 20.6 g (1.05 equivalent amount) of diphenylacetaldehyde represented by the following structural formula (10), and 0.23 g (0.01 equivalent amount) of DL-10-camphor sulfonic acid were added to 100 mL of toluene and heated to conduct reaction for six hours while removing by-produced water out of the system under azeotropic boiling with toluene. After the completion of the reaction, the reaction solution was concentrated to about 1/10, which was gradually dropped into 100 mL of hexane under violent stirring to form crystals. The resultant crystals were separated by filtration and cleaned with cold ethanol to obtain 36.2 g of a pale yellow powdery compound.

(9)

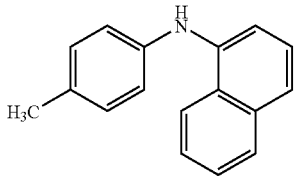

(10)

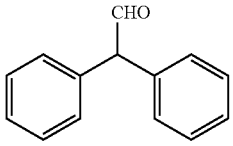

As a result of analyzing the obtained compound by liquid chromatography-mass spectrometry (simply referred to as: LC-MS), since a peak corresponding to a molecular ion $[M+H]^+$ formed by adding a proton to the enamine intermediate product shown by the following structural formula (11) (calculated value for the molecular weight: 411.20) was observed at 412.5, it was found that the resultant compound is an enamine intermediate product represented by the following structural formula (11) (yield: 88%). Further from the result of LC-MS analysis, it was found that the purity of the obtained enamine intermediate (11)

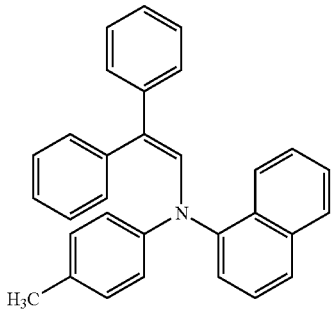

As described above, an enamine intermediate product represented by the structural formula (11) could be obtained by conducting dehydrating condensation reaction between N-(p-tolyl)-α-naphthylamine represented by the structural formula (9) as a secondary amine compound and diphenylacetaldehyde represented by the structural formula (10) as an aldehyde compound.

Preparation Example 1-2

Preparation of Enamine-aldehyde Intermediate Product 9.2 g (1.2 equivalent amount) of oxyphosphorus chloride was added gradually under ice cooling into 100 mL of anhydrous N,N-dimethylformamide (DMF), and stirred for about 30 min to prepare a Vilsmeier reagent. 20.6 g (1.0 equivalent amount) of the enamine intermediate product represented by the structural formula (11) obtained in Preparation Example 1-1 under ice cooling into the solution gradually. Then, it was gradually heated to elevate the reaction temperature to 80° C. and stirred while heating so as to keep at 80° C. for 3 hours. After the completion of the reaction, the reaction solution was allowed to cool and added gradually to 800 ml of an aqueous 4N sodium hydroxide solution to form precipitates. The resultant precipitates were separated by filtration, washed with water sufficiently and recrystallized with a mixed solvent of ethanol and ethyl acetate to obtain 20.4 g of a powdery yellow compound.

As a result of LC-MS analysis of the obtained compound, since a peak corresponding to molecular ion $[M+H]^+$ with addition of a proton to the enamine-aldehyde intermediate product (calculated value of molecular weight: 439.19) represented by the following structural formula (12) was observed at 440.5, it was found that the obtained compound was the enamine-aldehyde intermediate product represented by the following structural formula (12) (yield: 93%). Further, from the result of LC-MS analysis, it was found that the purity of the obtained enamine-aldehyde intermediate product was 99.7%.

(12)

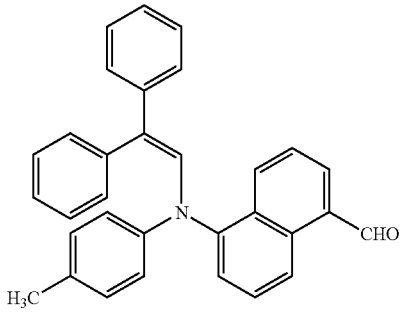

As described above, the enamine-aldehyde intermediate product represented by the structural formula (12) could be obtained by formulation of the enamine intermediate product represented by the structural formula (11) by the Vilsmeier reaction.

Preparation Example 1-3

Preparation of Exemplified Compound No. 1

8.8 g (1.0 equivalent amount) of the enamine-aldehyde intermediate product represented by the structural formula (12) obtained in Preparation Example 1-2, and 6.1 g (1.2 equivalent amount) of diethyl cinnamyl phosphate represented by the following structural formula (13) were dissolved in 80 mL of anhydrous DMF. After adding 2.8 g (1.25 equivalent amount) of potassium t-butoxide into the solution at a room temperature gradually, it was heated to 50° C. and stirred while heating so as to keep at 50° C. for 5 hours. After allowing the reaction mixture to cool, it was poured into excess methanol. Precipitates were recovered and dissolved in toluene to form a toluene solution. The toluene solution was transferred to a separation funnel, washed with water and then an organic layer was taken out and the taken out organic layer was dried with magnesium sulfate. After drying, the organic layer removed with solids was concentrated and subjected to silica gel column chromatography to obtain 10.1 g of yellow crystals.

(13)

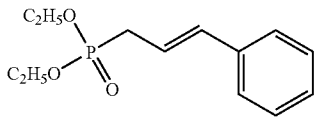

As a result of LC-MS analysis for the obtained crystals, a peak corresponding to the molecular ion $[M+H]^+$ in which a proton was added to the aimed the enamine compound of Exemplified Compound No. 1 shown in Table 6 (calculated value for molecular weight: 539.26) was observed at 540.5.

Figure 5:
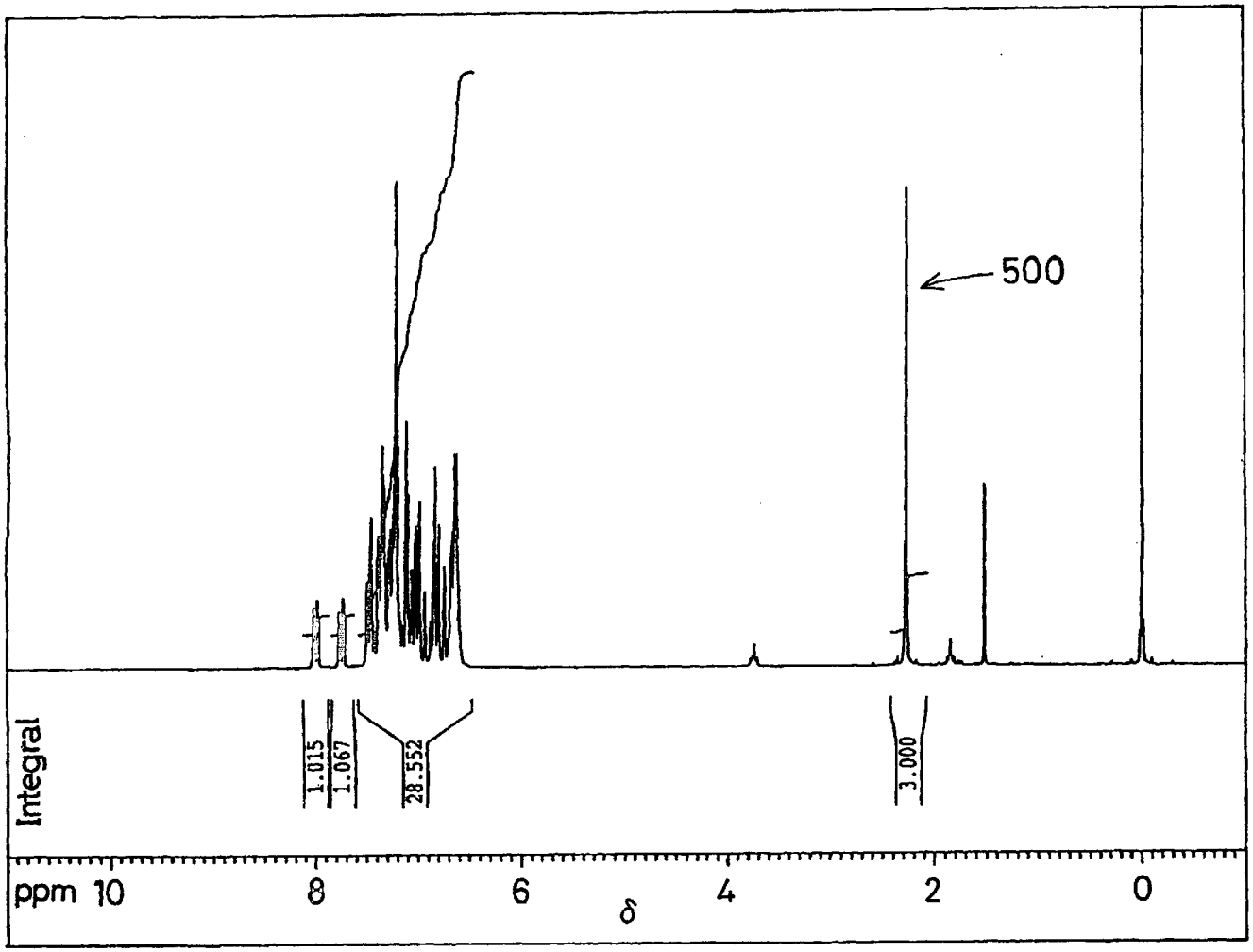
FIG. 5 is $^{1}$H-NMR spectrum for the product of Preparation Example 1-3.
Figure 6:
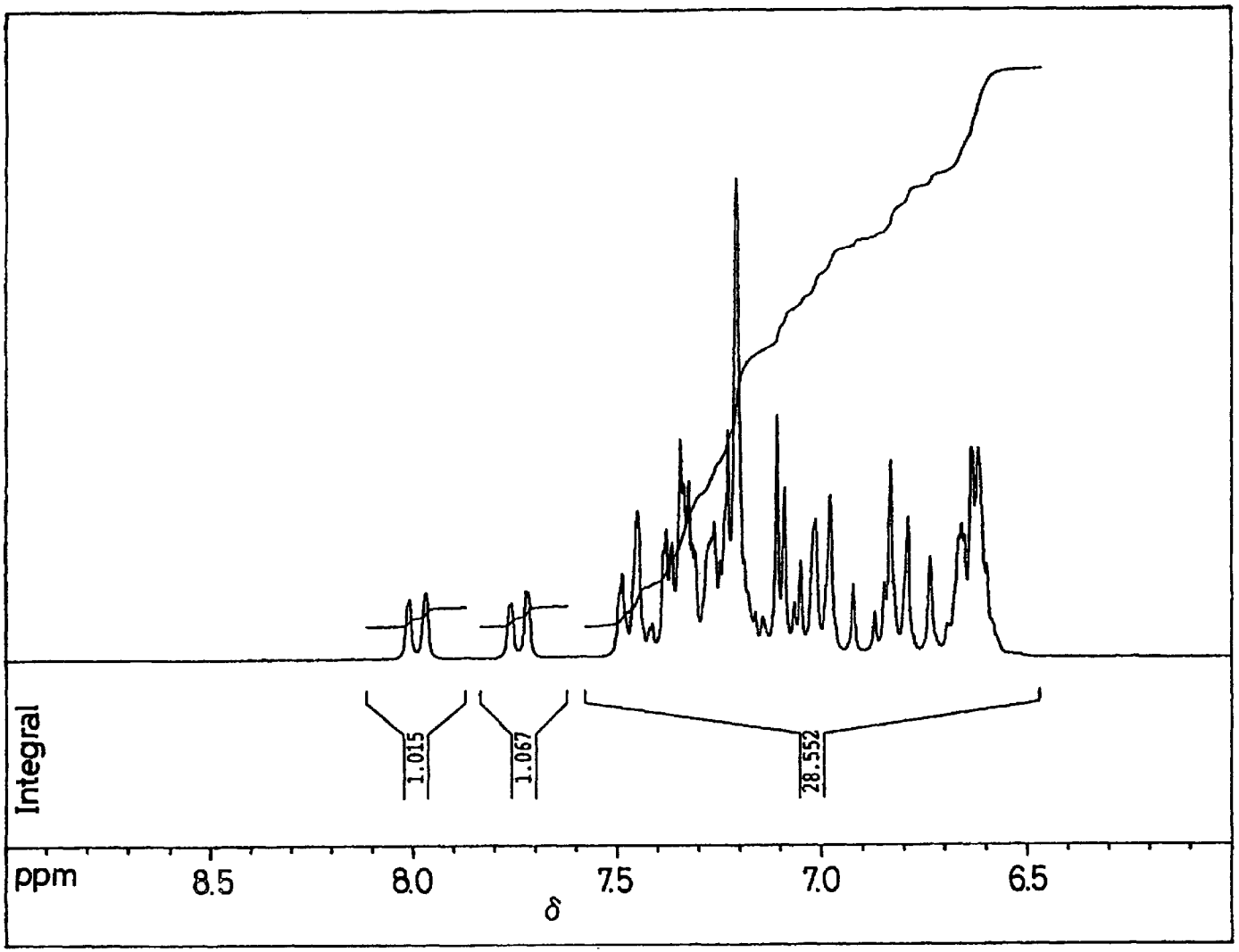
FIG. 6 is a view showing, in an enlarged scale, 6 ppm to 9 ppm of the spectrum shown in FIG. 5.
Figure 7:
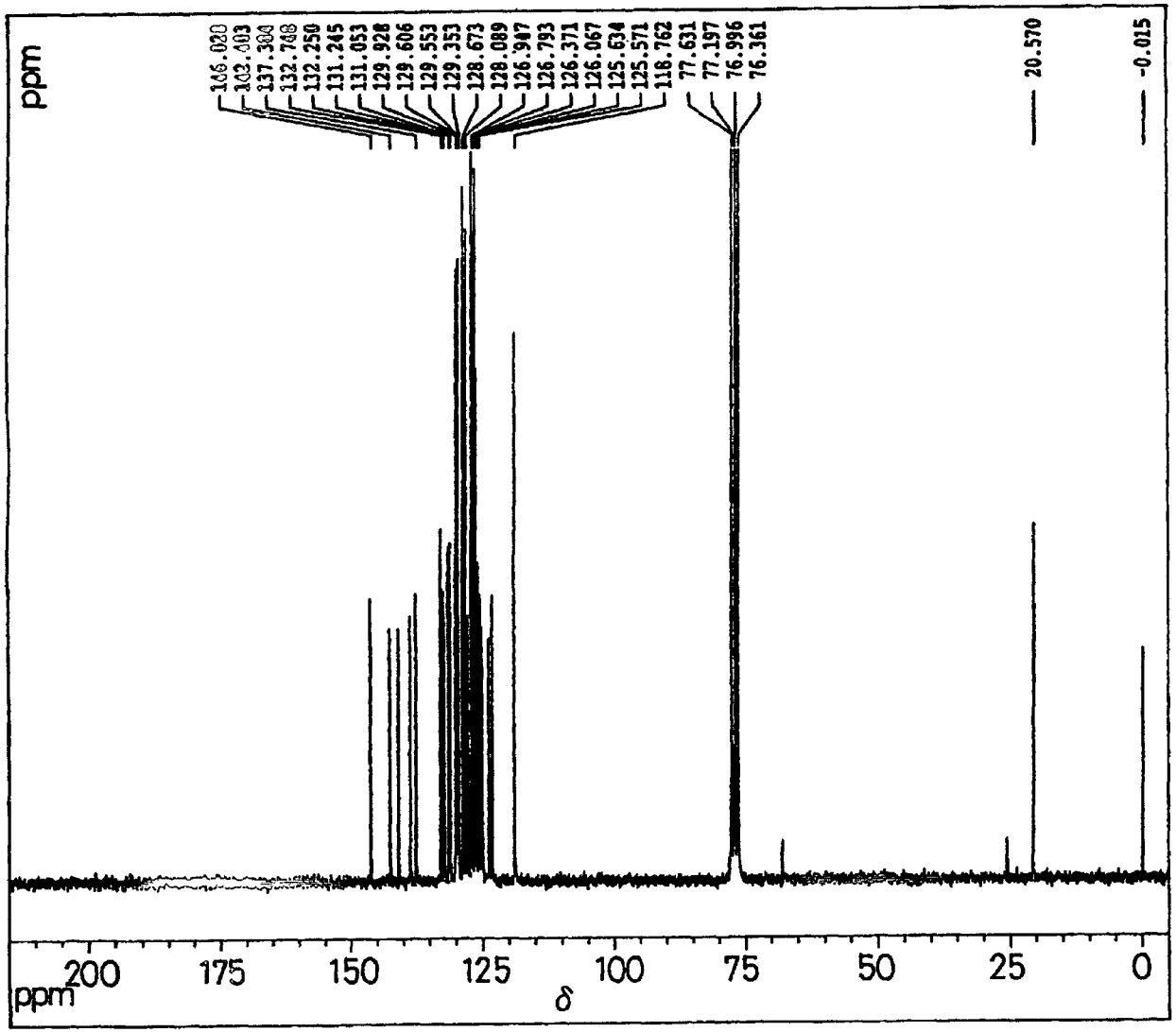
FIG. 7 is $^{13}$C-NMR spectrum according to usual measurement for the product of Preparation Example 1-3.
Figure 8:
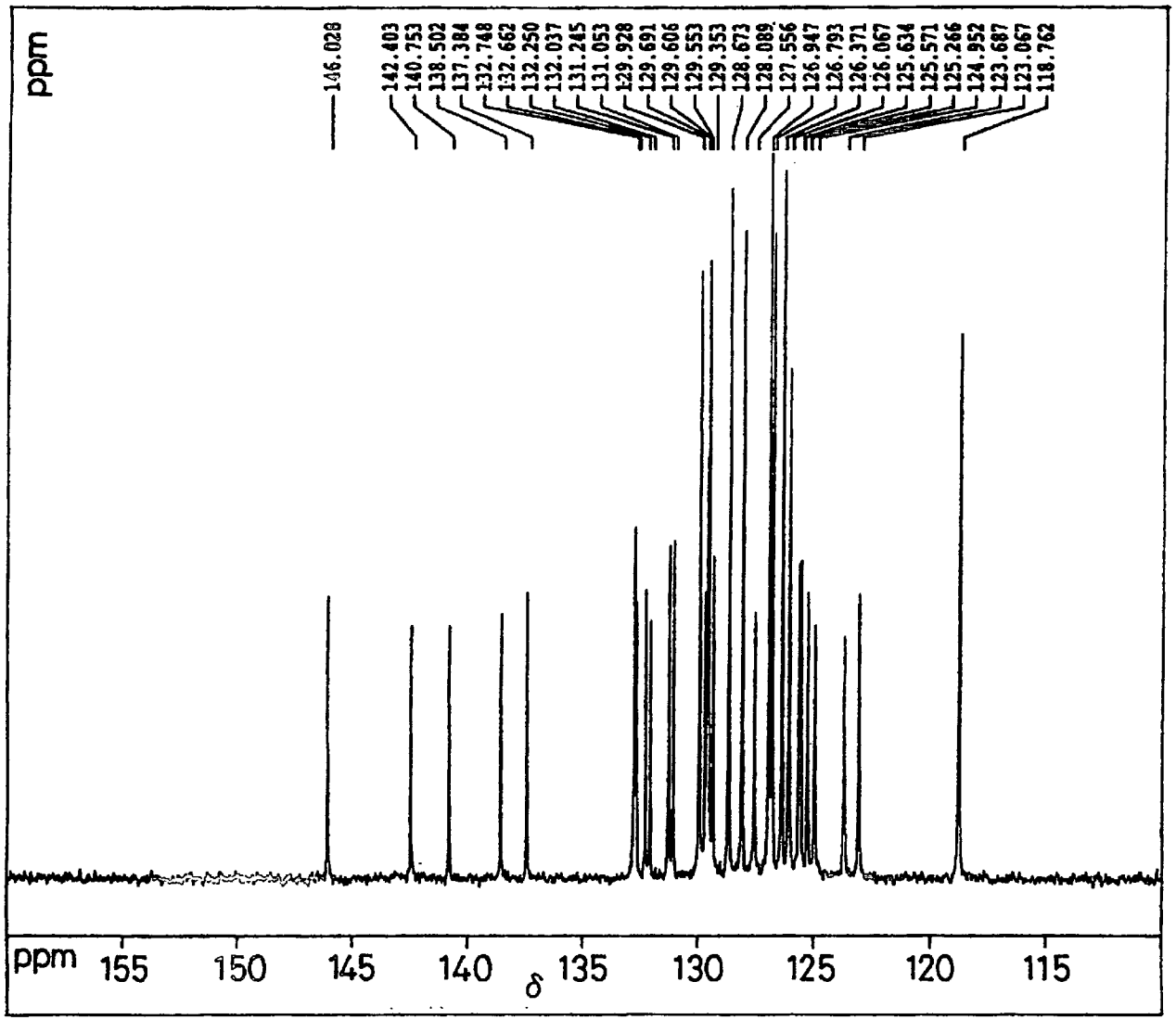
FIG. 8 is a view showing in an enlarged scale 6 ppm to 9 ppm of spectrum shown in FIG. 7.
Figure 9:
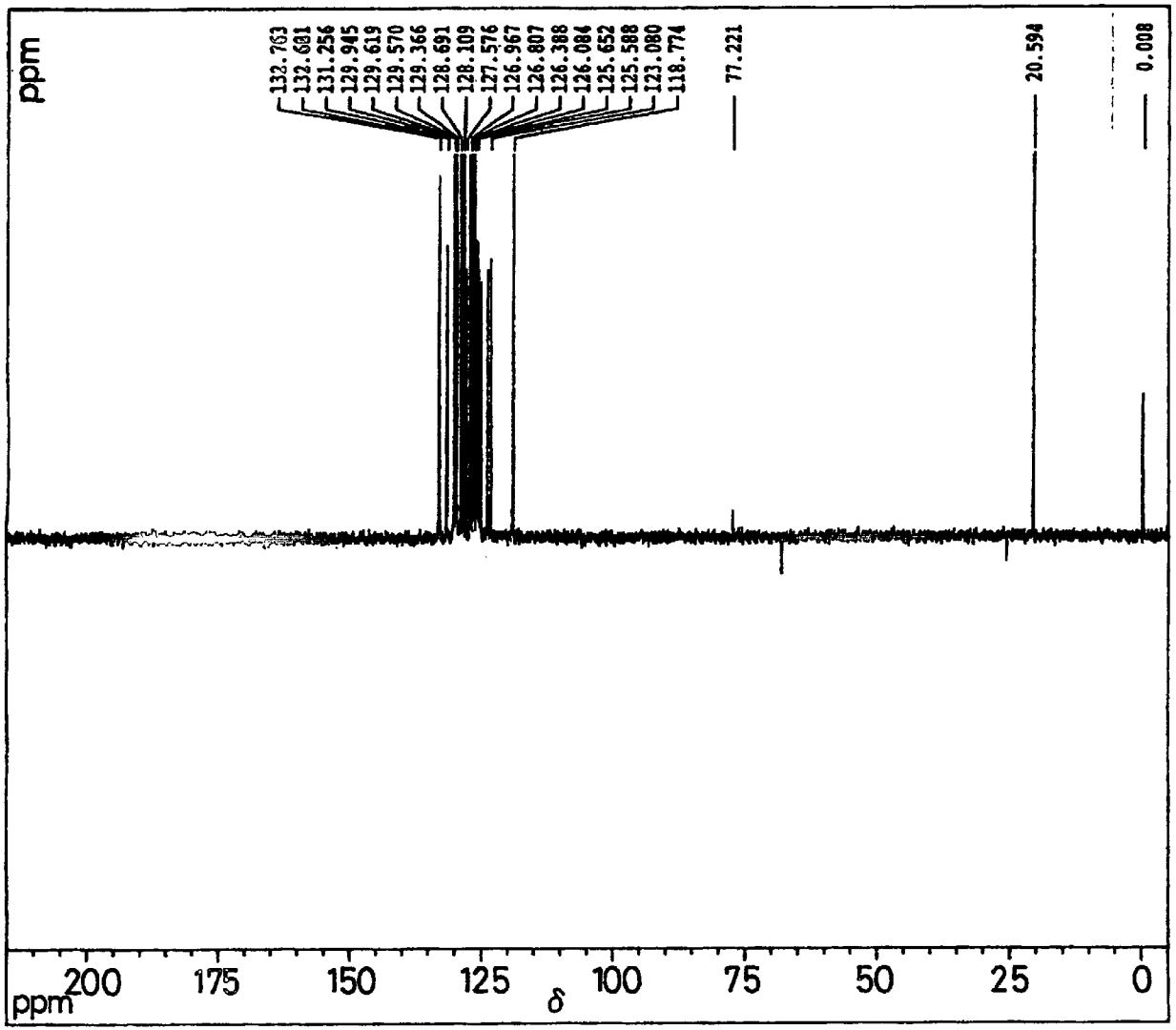
FIG. 9 is $^{13}$C-NMR spectrum according to DEPT 135 measurement for the product of Preparation Example 1-3.
Figure 10:
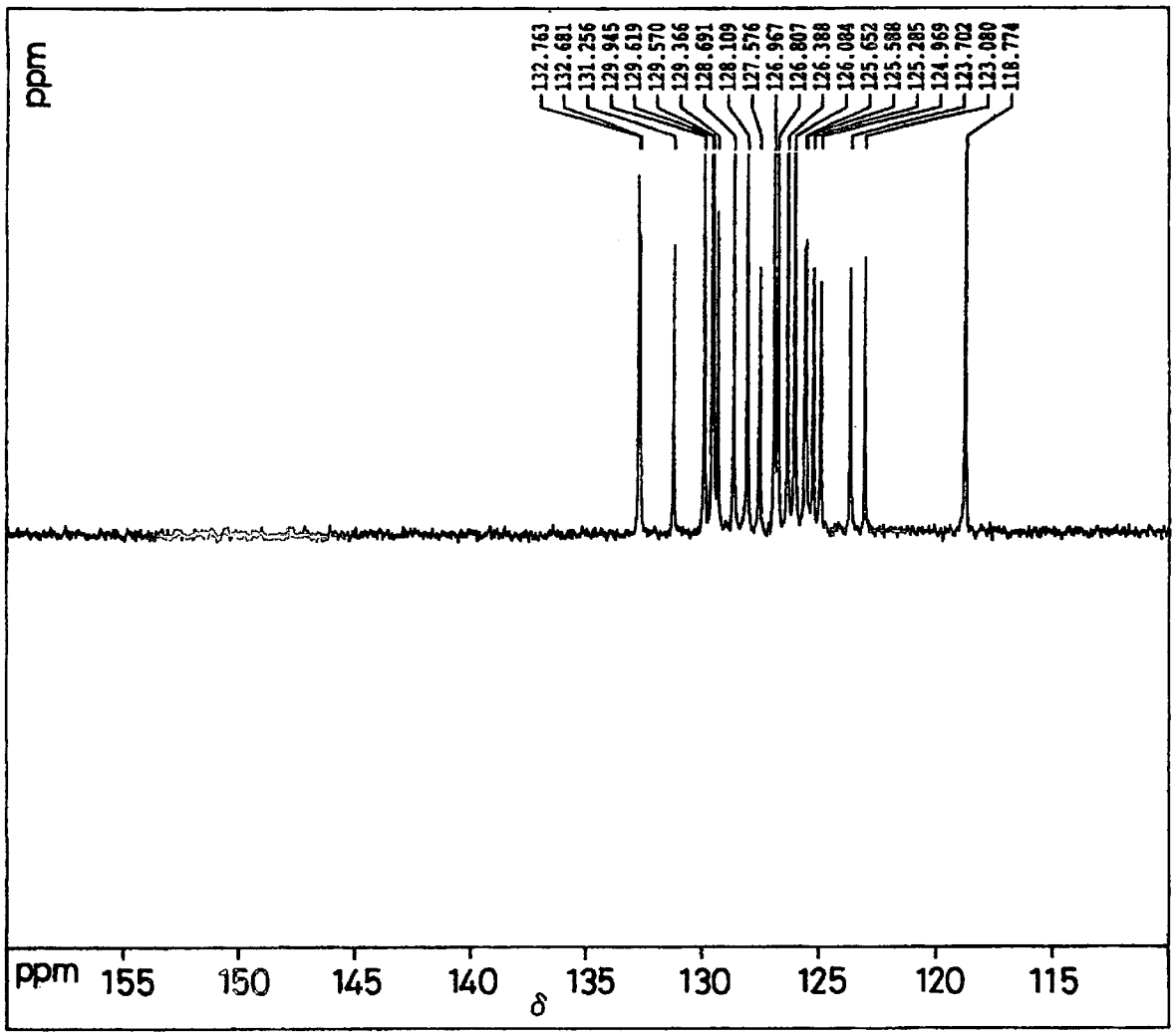
FIG. 10 is a view showing, in an enlarged scale, 110 ppm to 160 ppm of the spectrum shown in FIG. 9.

Further, when nuclear magnetic resonance (simply referred to as: NMR) spectrum of the obtained crystals in heavy chloroform (chemical formula: $CDCl_3$), was measured, a spectrum supporting the structure of the enamine compound of Exemplified Compound No. 1 was obtained. FIG. 5 is $^1$H-NMR spectrum for the product of Preparation Example 1-3 and FIG. 6 is a view showing, in an enlarged scale, 6 ppm to 9 ppm of the spectrum shown in FIG. 5. FIG. 7 is $^{13}$C-NMR spectrum according to usual measurement for the product of Preparation Example 1-3 and FIG. 8 is a view showing in an enlarged scale 6 ppm to 9 ppm of spectrum shown in FIG. 7. FIG. 9 is $^{13}$C-NMR spectrum according to DEPT 135 measurement for the product of Preparation Example 1-3, and FIG. 10 is a view showing, in an enlarged scale, 110 ppm to 160 ppm of the spectrum shown in FIG. 9. In FIG. 5 to FIG. 10, the abscissa expresses the chemical shift value δ (ppm). Further, in FIG. 5 and FIG. 6, the value described between the signal and the abscissa is a relative integration value for each signal based on the integration value for the signal shown by reference 500 in FIG. 5 being assumed as 3.

The data of LC-MS and the NMR spectrometry confirm that the crystal obtained herein is the enamine compound, Compound No. 1 (yield: 94%). In addition, the data of LC-MS further confirm that the purity of the enamine compound, Compound No. 1 obtained herein is 99.8%.

As described above, the enamine compound of Exemplified Compound No. 1 shown in Table 6 could be obtained by conducting Wittig-Horner reaction between the enamine-aldehyde intermediate product represented by the structural formula (12) and diethyl cinnamyl phosphate represented by the structural formula (13) as the Wittig reagent.

Preparation Example 2

Preparation of Exemplified Compound No. 61

The enamine intermediate product was prepared by dehydrating condensation reaction (yield: 94%) and the enamine-aldehyde intermediate product was prepared by Vilsmeier reaction (yield: 85%) in the same manner as in Preparation Example 1 except for using 4.9 g (1.0 equivalent amount) of N-(p-methoxyphenyl)-α-naphthylamine instead of 23.3 g (1.0 equivalent amount) of N-(p-tolyl)-α-naphthylamine represented by the structural formula (9) and, further, Wittig-Horner reaction was conducted to obtain 7.9 g of a powdery yellow compound. The relation of the equimolar amount between the reagent and the substrate used in each of the reactions is identical with the relation of equimolar amount between the reagent and the substrate used in Preparation Example 1.

As a result of LC-MS analysis for the obtained compound, a peak corresponding to the molecular ion $[M+H]^+$ in which a proton was added to the aimed enemine compound of Exemplified Compound No. 61 shown in Table 14 (calculated value for molecular weight: 555.26) was observed at 556.7.

Figure 11:
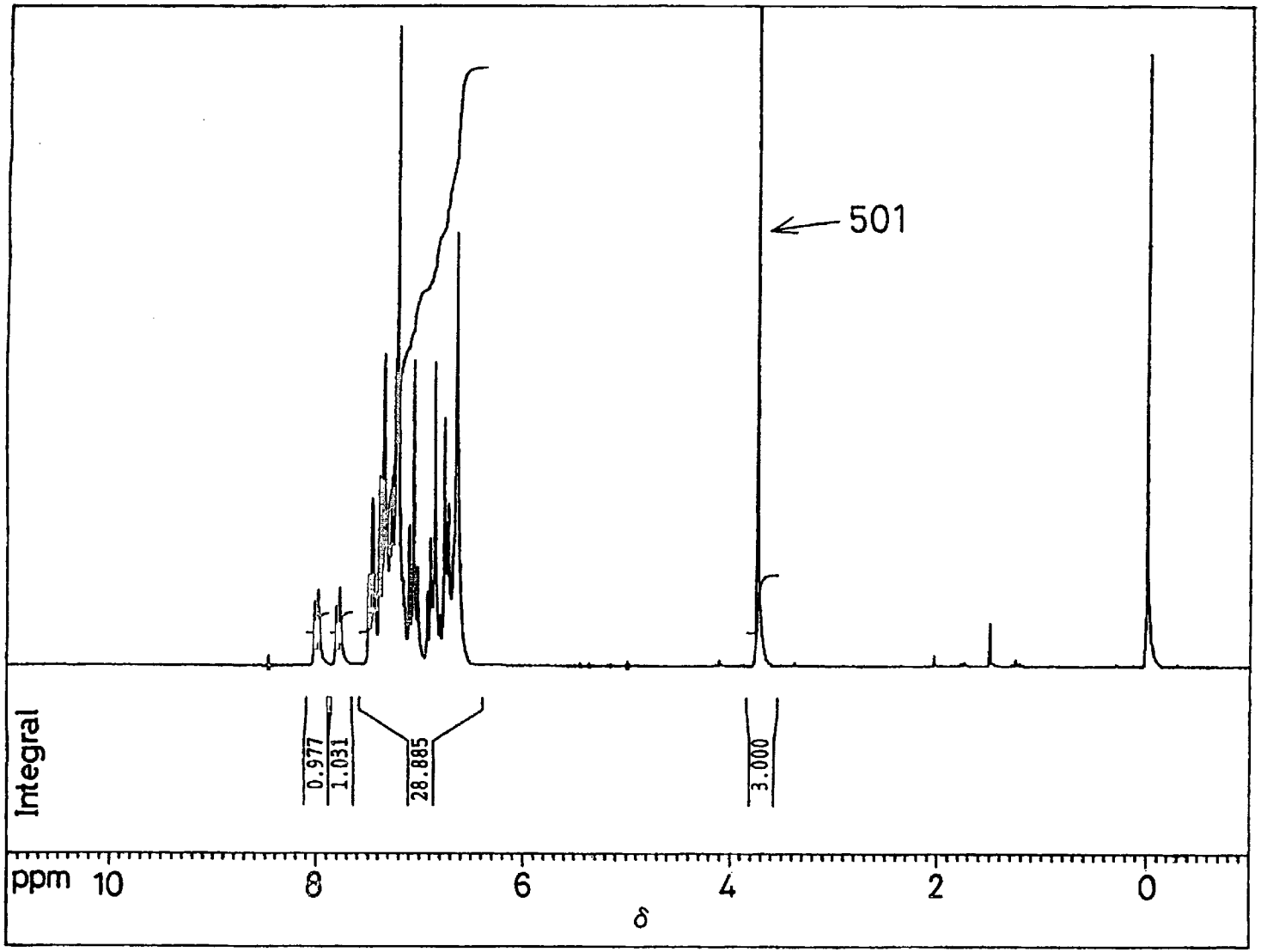
FIG. 11 is $^{1}$H-NMR spectrum for the product of Preparation Example 2.
Figure 12:
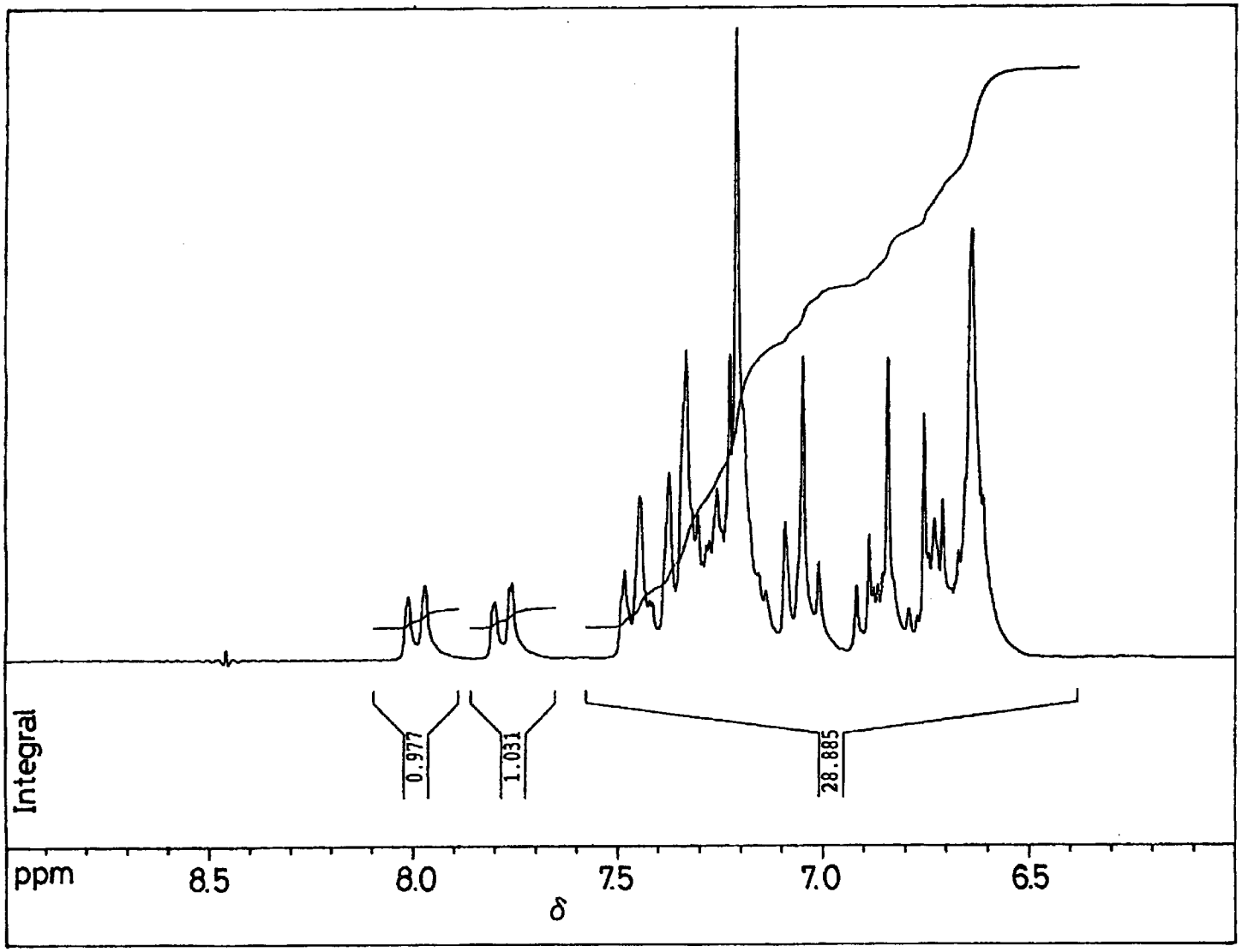
FIG. 12 is a view showing, in an enlarged scale, 6 ppm to 9 ppm of the spectrum shown in FIG. 11.
Figure 13:
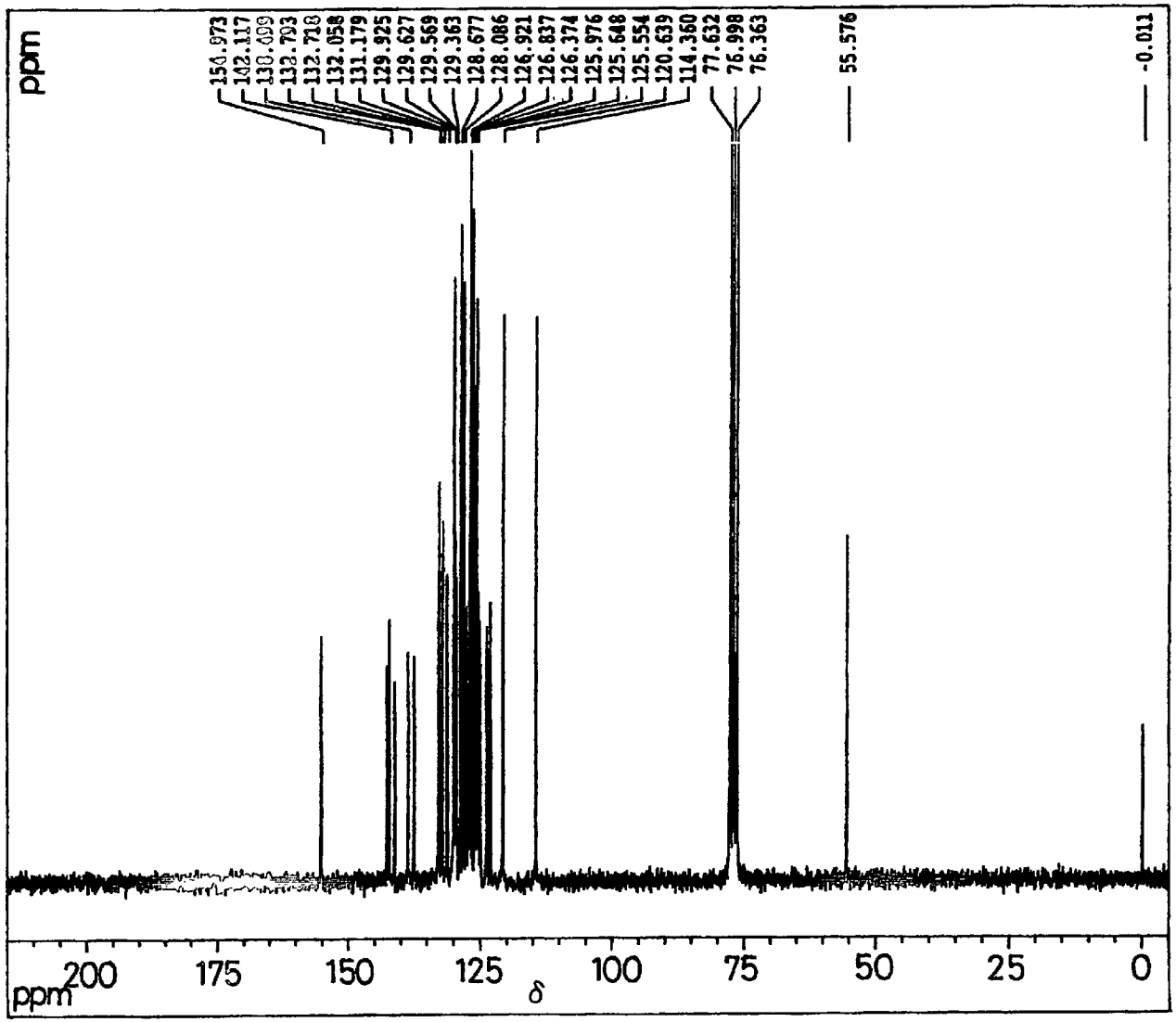
FIG. 13 is $^{13}$C-NMR spectrum according to usual measurement for the product of Preparation Example 2.
Figure 14:
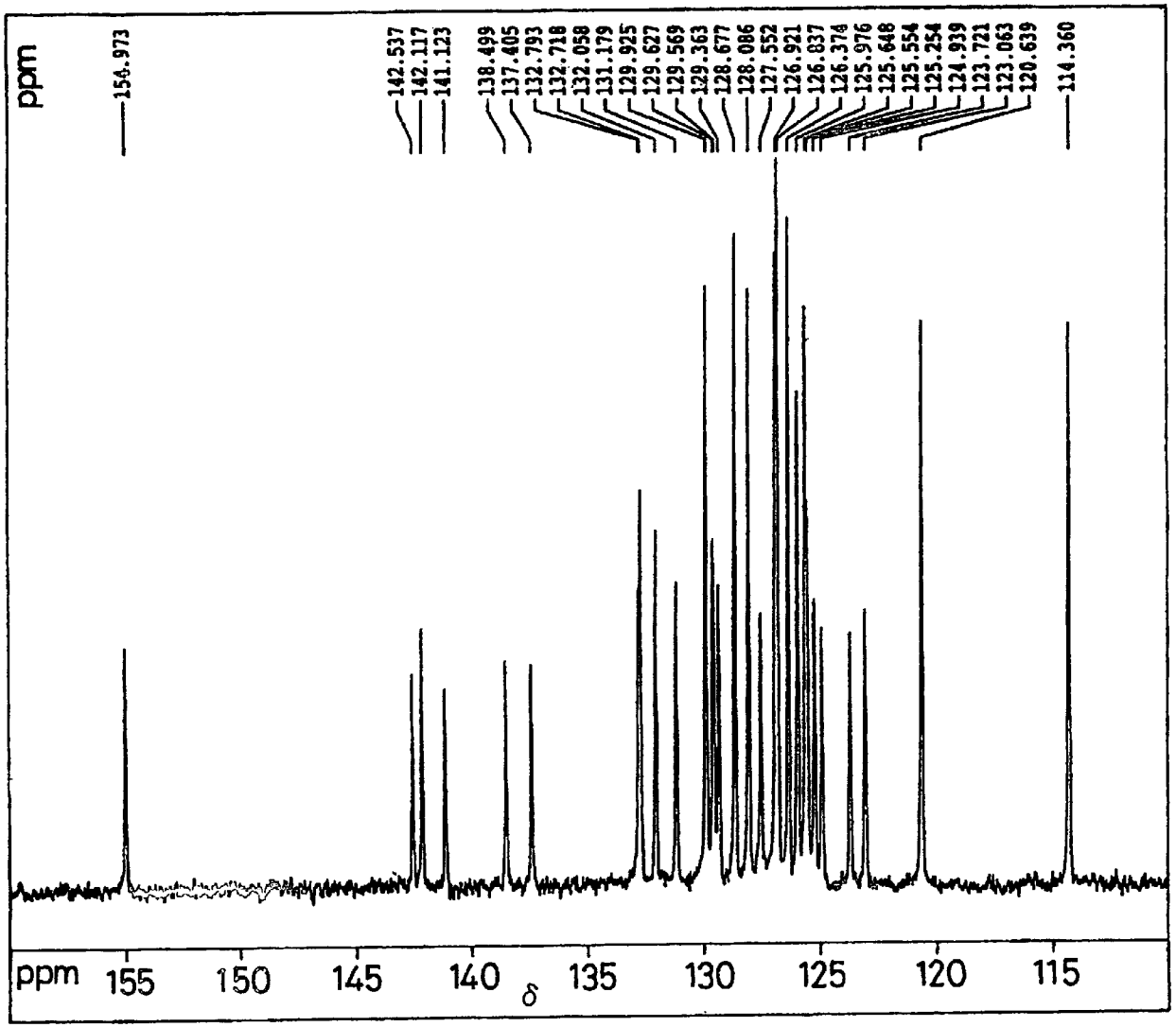
FIG. 14 is a view showing, in an enlarged scale, 110 ppm to 160 ppm of spectrum shown in FIG. 13.
Figure 15:
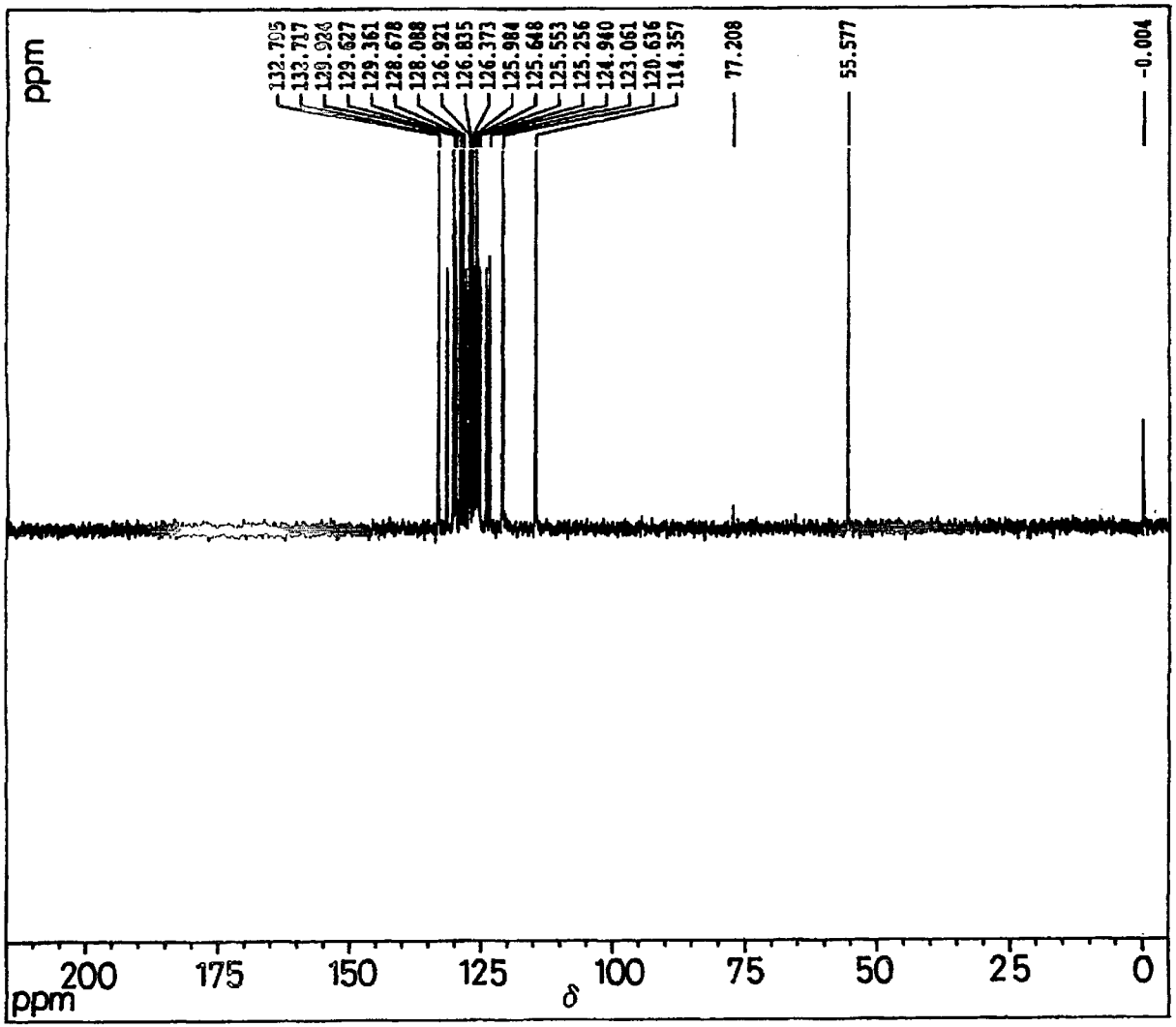
FIG. 15 is $^{13}$C-NMR spectrum according to DEPT 135 measurement for the products of Preparation Example 2.
Figure 16:
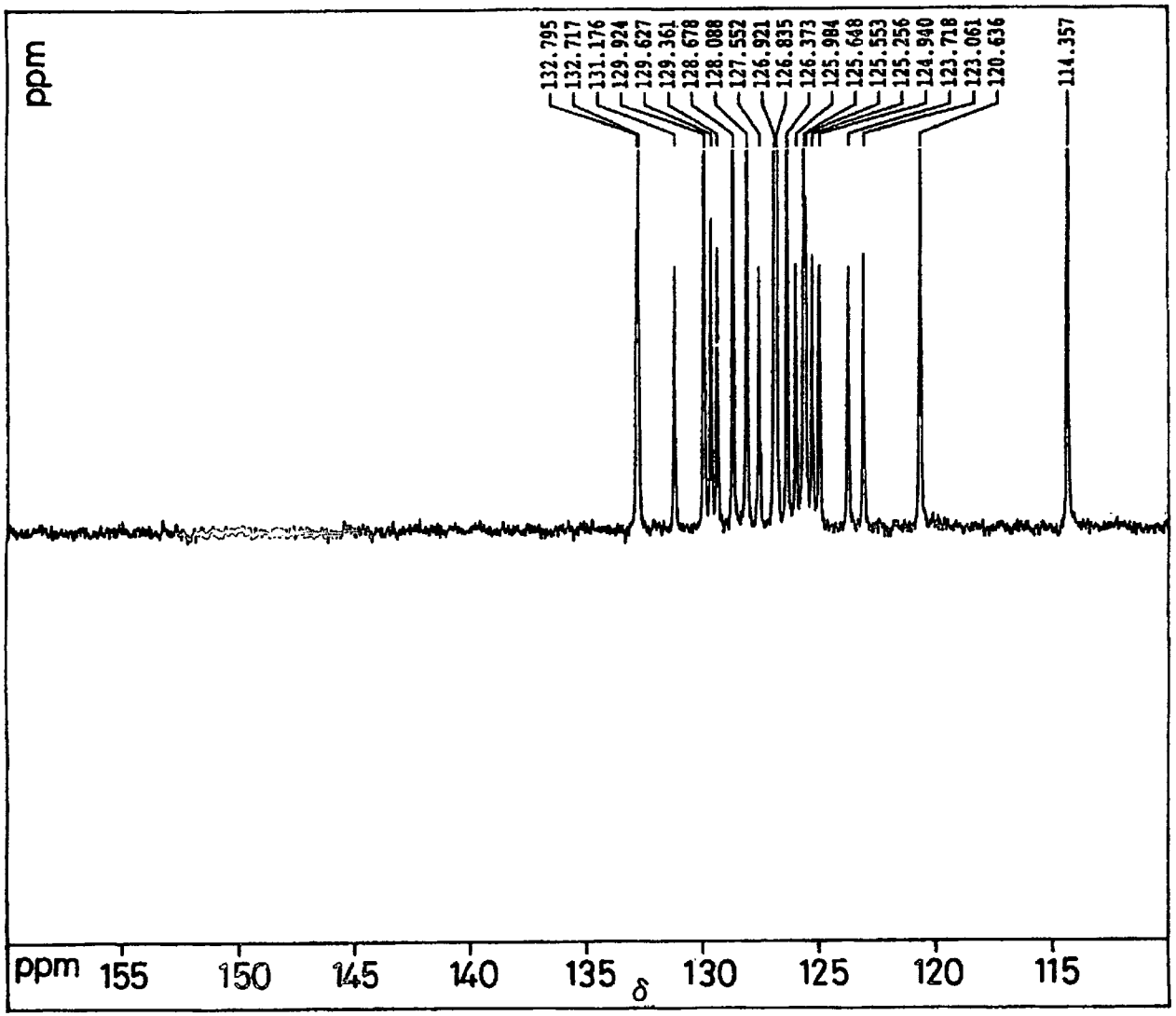
FIG. 16 is a view showing, in an enlarged scale, 110 ppm to 160 ppm of the spectrum shown in FIG. 15.

Further, when NMR spectrum of the obtained crystals in heavy chloroform (chemical formula: $CDCl_3$) was measured, a spectrum supporting the structure of the enamine compound of the Exemplified Compound No. 61 was obtained. FIG. 11 is $^1$H-NMR spectrum for the product of Preparation Example 2 and FIG. 12 is a view showing, in an enlarged scale, 6 ppm to 9 ppm of the spectrum shown in FIG. 11. FIG. 13 is $^{13}$C-NMR spectrum according to usual measurement for the product of Preparation Example 2 and FIG. 14 is a view showing, in an enlarged scale, 110 ppm to 160 ppm of spectrum shown in FIG. 13. FIG. 15 is $^{13}$C-NMR spectrum according to DEPT 135 measurement for the products of Preparation Example 2 and FIG. 16 is a view showing, in an enlarged scale, 110 ppm to 160 ppm of the spectrum shown in FIG. 15. In FIG. 11 to FIG. 16, the abscissa expresses the chemical shift value δ (ppm). Further, in FIG. 11 and FIG. 12, the value described between the signal and the abscissa is a relative integration value for each signal based on the integration value for the signal shown by Reference 501 in FIG. 11 being assumed as 3.

The data of LC-MS and the NMR spectrometry confirm that the compound obtained herein is the enamine compound, Compound No. 61 (yield: 92%). In addition, the data of LC-MS further confirm that the purity of the enamine compound, Compound No. 61 obtained herein is 99.0%.

As in the above, the three-stage reaction process that comprises dehydrating condensation, Vilsmeier reaction and Wittig-Horner reaction gives the enamine compound, Compound No. 61 shown in Table 9, and the overall three-stage yield of the product was 73.5%.

Preparation Example 3

Preparation of Exemplified Compound No. 46

2.0 g (1.0 equivalent amount) of the enamine-aldehyde intermediate product represented by the structural formula (12) obtained in Preparation Example 1-2, and 1.53 g (1.2 equivalent amount) of a Wittig reagent represented by the following structural formula (14) were dissolved in 15 mL of anhydrous DMF. After adding 0.71 g (1.25 equivalent amount) of potassium t-butoxide into the solution at a room temperature gradually, it was heated to 50° C. and stirred while heating so as to keep at 50° C. for 5 hours. After allowing the reaction mixture to cool, it was poured into excess methanol. Precipitates were recovered and dissolved in toluene to form a toluene solution. The toluene solution was transferred to a separation funnel, washed with water and then an organic layer was taken out and the organic taken out was dried with magnesium sulfate. After drying, the organic layer removed with solids was concentrated and subjected to silica gel column chromatography to obtain 2.37 g of yellow crystals.

(14)

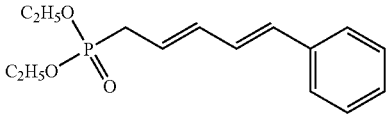

Thus obtained, the crystal was analyzed through LC-MS, which gave a peak at 566.4 corresponding to the molecular ion $[M+H]^+$ of the intended enamine compound, Compound No. 46 in Table 7 (calculated molecular weight: 565.28) with a proton added thereto. This confirms that the crystal obtained herein is the enamine compound, Compound No. 46 (yield: 92%). In addition, the data of LC-MS further confirm that the purity of the enamine compound, Compound No. 46 is 99.8%.

As described above, the enamine compound of Exemplified Compound No. 46 shown in Table 12 could be obtained by conducting Wittig-Horner reaction between the enamine-aldehyde intermediate product represented by the structural formula (12) and the Wittig reagent represented by the structural formula (14).

Comparative Preparation Example 1

Preparation of Compound represented by the following structural formula (15)

2.0 g (1.0 equivalent amount) of the enamine-aldehyde intermediate product represented by the structural formula (12) obtained in Preparation Example 1-2 was dissolved in 15 mL of anhydrous THF, and 5.23 mL (1.15 equivalent amount) of a THF solution of aryl magnesium bromide as a Grignard reagent prepared from aryl bromide and metallic magnesium (mol concentration: 1.0 mol/L) was gradually added at 0° C. in the solution. After stirring at 0° C. for 0.5 hours, when the proceeding state of the reaction was confirmed by thin layer chromatography, no distinct reaction products could be confirmed and plural products were confirmed. After conducting post treatment, extraction and condensation by a customary method, silica gel column chromatography was conducted to separate and purify the reaction mixture.

However, the aimed compound represented by the following structural formula (15) could not be obtained.

(15)

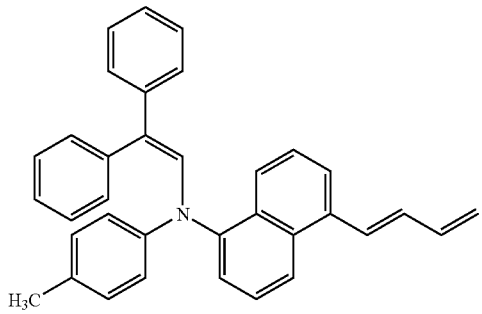

Example

Example 1

Example 1-1

After adding one part by weight of an X-type non-metal phthalocyanine as a charge generation substance 12 in a resin solution obtained by dissolving one part by weight of a polyvinyl butyral resin (manufactured by Sekisui Chemical Industry Co: S-LEC BX-1) into 98 parts by weight of tetrahydrofuran (THF), they were dispersed by a paint shaker for 2 hours to prepare a coating solution for charge generation layer. After coating the coating solution for charge generation layer on aluminum of a polyester film of 80 μm thickness as an electroconductive substrate 11 vapor deposited with aluminum on the surface thereof by a baker applicator, it was dried to form a charge generation layer 15 of 0.3 μm film thickness.

Then, 8 parts by weight of the enamine compound of Exemplified Compound No. 1 shown in Table 6 as the charge transportation substance 13 and 10 parts by weight of a polyarylate resin having the structural unit represented by the structural formula (1-3) shown in Table 1 as the binder resin 17 (viscosity average molecular weight 23,200) were dissolved in a mixed solvent of 40 parts by weight of tetrahydrofuran and 40 parts by weight of toluene, to prepare a coating solution for charge transportation layer. After coating the coating solution for charge transportation layer on the previously formed charge generation layer 15 by a baker applicator, it was dried to form a charge transportation layer 16 of 20 μm film thickness.

As described above, a stacked type electrophotographic photoreceptor of the layer constitution shown in FIG. 1 satisfying the conditions of the invention was manufactured.

Example 1-2

A sample for measuring the charge mobility was manufactured in the same manner as in Example 1-1 except for forming the charge transportation layer 16 such that the film thickness was 10 μm.

Examples 2 to 6

Five types of electrophotographic photoreceptors and samples for measuring charge mobility capable of satisfying the conditions of the invention were manufactured in the same manner as in Example 1 except for using, instead of the Exemplified Compound No. 1, the enamine compounds of Exemplified Compound No. 3 shown in Table 6, Exemplified Compound No. 61 shown in Table 14, Exemplified Compound No. 106 shown in Table 21, Exemplified Compound No. 146 shown in Table 26, and Exemplified Compound No. 177 shown in Table 31 as the charge transportation substance 13.

Example 7

One part by weight of X-type non-metal phthalocyanine as the charge generation substance 12, 12 parts of the polyarylate resin (viscosity average molecular weight: 23,200) having the structural unit represented by the structural formula (1-3) shown in Table 1 as the binder resin 17, 10 parts by weight of the enamine compound of Exemplified Compound No. 1 shown in Table 6 as the charge transportation substance 13, 5 parts by weight of 3,5-dimethyl-3',5'-di-t-butyldiphenoquinine, 0.5 parts by weight of 2,6-di-t-butyl-4-methylphenol, and 65 parts by weight of THF were dispersed in a ball mill for 12 hours to prepare a coating solution for photosensitive layer. After coating the prepared coating solution for photosensitive layer on aluminum of a polyester film of 80 μm thickness vapor deposited with aluminum on the surface thereof as the electroconductive substrate 11 by a baker applicator, it was dried by hot blow at 110° C. for one hour to form a photosensitive layer 140 of 20 μm film thickness.

As described above, a single-layered type electrophotographic photoreceptor of the layer constitution shown in FIG. 3 satisfying the conditions of the invention was manufactured.

Example 8

An electrophotographic photoreceptor satisfying the conditions of the invention was manufactured in the same manner as in Example 1-1 except for using, instead of the polyarylate resin having the structural unit represented by the structural formula (1-3), 10 parts by weight of a polyarylate resin having the structural unit represented by the structural formula (1-2) shown in Table 1 (viscosity average molecular weight: 35,000) as the binder resin 17 for the charge transportation layer 16.

Comparative Example 1

An electrophotographic photoreceptor not satisfying the conditions of the invention was manufactured in the same manner as in Example 1-1 except for using, instead of the polyarylate resin having the structural unit represented by the structural formula (1-3), 10 parts by weight of a bisphenol A polycarbonate resin (Panlite C-1400, manufactured by Teijin Chemicals Ltd.) as the binder resin 17 for the charge transportation layer 16. In the followings, the bisphenol A polycarbonate resin is sometimes referred to as PCA.

Comparative Example 2

An electrophotographic photoreceptor and a sample for measuring the charge mobility not satisfying the conditions of the invention were manufactured in the same manner as in Example 1 except for using, instead of the Exemplified Compound No. 1, a comparative compound represented by the following structural formula (16) as the charge transportation substance 13. In the followings, the comparative compound represented by the following structural formula (16) is sometimes referred to as TPD.

(16)

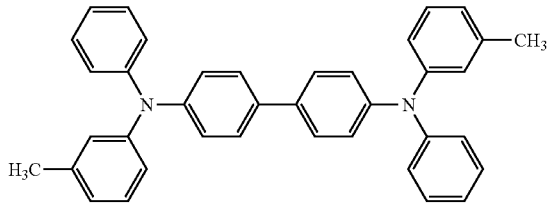

Comparative Example 3

An electrophotographic photoreceptor and a sample for measuring the charge mobility not satisfying the conditions of the invention were manufactured in the same manner as in Example 1 except for using, instead of the Exemplified Compound No. 1, a comparative compound represented by the following structural formula (17) as the charge transportation substance 13. In the followings, the comparative compound represented by the following structural formula (17) is sometimes referred to as ENA.

(17)

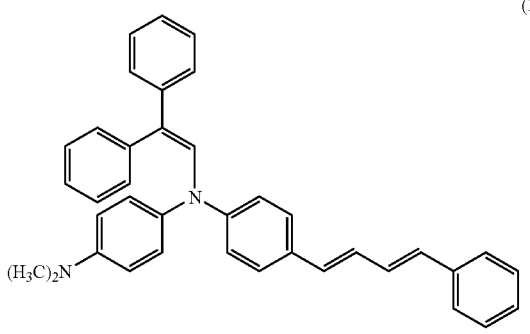

<Measurement for Charge Mobility>

For each of the samples for measuring the charge mobility manufactured in Examples 1 to 6 and Comparative Examples 2 and 3 described above, gold was vapor deposited on the surface of the charge transportation layer and the charge mobility of the charge transportation substance in the charge transportation layer was measured by a time-of-flight method at a room temperature under a reduced pressure. Table 38 shows the result of measurement. The values for the charge mobility shown in Table 38 are values at an electric field strength of $2\times10^5$ V/cm.

TABLE 38

| Sample | Charge transportation substance | Charge mobility ($cm^2/V \cdot sec$) |
|---|---|---|
| Example 1 | Exemplified Compound 1 | $5.74 \times 10^{-5}$ |
| Example 2 | Exemplified Compound 3 | $5.90 \times 10^{-5}$ |
| Example 3 | Exemplified Compound 61 | $5.35 \times 10^{-5}$ |
| Example 4 | Exemplified Compound 106 | $8.32 \times 10^{-5}$ |
| Example 5 | Exemplified Compound 146 | $1.64 \times 10^{-5}$ |
| Example 6 | Exemplified Compound 177 | $4.20 \times 10^{-5}$ |
| Comparative Example 2 | TPD | $2.24 \times 10^{-7}$ |
| Comparative Example 3 | ENA | $9.68 \times 10^{-7}$ |

From comparison between Examples 1 to 6 and Comparative Example 2, it was found that the enamine compound represented by the general formula (2) had a charge mobility higher by two digits or more compared with the comparative compound (TPD) represented by the structural formula (16) as the known charge transportation substance.

Further, from comparison between Examples 1 to 6 and Comparative Example 3, it was found that the enamine compound represented by the general formula (2) had a charge mobility higher by two digits or more also compared with the comparative compound (ENA) represented by the structural formula (17) corresponding to a compound in which the naphthylene group bonded to the nitrogen atom contained in the functional group of enamine in the general formula (2) described above is substituted with other arylene group.

Further, from comparison between Examples 1 to 3 and 6, and Example 5, it was found that the compound in which $Ar^3$ is a naphthyl group in the general formula (2) had higher charge mobility than the compound in which $Ar^3$ is not the naphthyl group.

<Evaluation for Characteristics>

Electric characteristics and wear characteristics were evaluated for each of the electrophotographic photoreceptors manufactured in Examples 1 to 8 and Comparative Examples 1 to 3 described above as shown below.

(Evaluation for Electric Characteristics)

For each of the electrophotographic photoreceptors manufactured in Examples 1 to 8 and Comparative Examples 1 to 3, initial characteristics and characteristics after repetitive use were evaluated by using an electrostatic copy paper test apparatus (manufactured by Kawaguchi Denki Seisakusho Co: EPA-8200).

The initial characteristics were evaluated as described below. The surface of the photoreceptor was charged by applying a voltage at negative (−)5 kV to a photoreceptor and the surface potential on the photoreceptor in this case was measured as the charge potential $V_0$ (V). However, in a case of the single layered type photoreceptor in Example 7, a voltage at positive (+)5 kV was applied. Then, exposure was applied to the charged surface of the photoreceptor. In this case, the energy required for decaying the surface potential on the photoreceptor to one-half of the charge potential $V_0$ was measured as a half-decay exposure amount $E_{1/2}$ ($\mu J/cm^2$) and used as the evaluation index for the sensitivity. Further, the surface potential on the photoreceptor at the time with lapse of 10 secs. from the start of exposure was measured as the residual potential $V_r$ (V) and used as the evaluation index for light responsivity. For the exposure, a light at a wavelength of 780 nm and at an exposure energy of 1 $\mu W/cm^2$ obtained by spectralyzing by a monochrometer was used.

The characteristics after repetitive use were evaluated as below. After repeating the operation of the charging and exposure for 5000 times as one cycle, the half-decay exposure amount $E_{1/2}$, the charge potential $V_0$, and the residual potential $V_r$ were measured in the same manner as in the evaluation for initial characteristics.

(Evaluation for Wear Characteristics)

For each of electrophotographic photoreceptors manufactured in Examples 1 to 8 and Comparative Examples 1 to 3, wear characteristics were evaluated by using a wear tester manufactured by Suga Test Instruments Co. Evaluation was conducted as below. Friction was applied for 2000 cycles to each of the photoreceptors using aluminum oxide #1000 as an abrasion material under a load of 1.96N. The difference between the weight of the photoreceptor before friction and the weight of the photoreceptor after friction for 2,000 cycles was determined as a wear amount (mg). As the value of the wear amount is smaller, it shows more excellent wear resistance.

Table 39 shows the result of measurement described above. In Table 39, in a case where the polyarylate resins having the structural unit represented by the general formula (1) are used as the binder resin 17, they are indicated by the number of the structural formulae representing the structural units.

TABLE 39

| | Charge transportation layer | | | | | | | | |
|---|---|---|---|---|---|---|---|---|---|
| | Charge transportation substance | Binder resin | Initial characteristics $E_{1/2}$ ($\mu J/cm^2$) | Initial characteristics $V_0$ (V) | Initial characteristics $V_r$ (V) | Characteristics after repetitive use $E_{1/2}$ ($\mu J/cm^2$) | Characteristics after repetitive use $V_0$ (V) | Characteristics after repetitive use $V_r$ (V) | Wear amount (mg) |
| Example 1 | Exemplified Compound 1 | (1-3) | 0.10 | −583 | −11 | 0.11 | −574 | −14 | 2.50 |
| Example 2 | Exemplified Compound 3 | (1-3) | 0.12 | −582 | −13 | 0.13 | −575 | −16 | 2.55 |
| Example 3 | Exemplified Compound 61 | (1-3) | 0.10 | −585 | −10 | 0.11 | −574 | −13 | 2.60 |
| Example 4 | Exemplified Compound 106 | (1-3) | 0.10 | −587 | −10 | 0.12 | −575 | −13 | 2.52 |
| Example 5 | Exemplified Compound 146 | (1-3) | 0.12 | −584 | −12 | 0.14 | −576 | −15 | 2.47 |

TABLE 39-continued

| | Charge transportation layer | | | | | | | | |
|---|---|---|---|---|---|---|---|---|---|
| | Charge transportation substance | Binder resin | Initial characteristics $E_{1/2}$ (μJ/cm²) | Initial characteristics $V_0$ (V) | Initial characteristics $V_r$ (V) | Characteristics after repetitive use $E_{1/2}$ (μJ/cm²) | Characteristics after repetitive use $V_0$ (V) | Characteristics after repetitive use $V_r$ (V) | Wear amount (mg) |
| Example 6 | Exemplified Compound 177 | (1-3) | 0.13 | −582 | −13 | 0.15 | −576 | −18 | 2.53 |
| Example 7 | Exemplified Compound 1 | (1-3) | 0.15 | +550 | +21 | 0.17 | +545 | +25 | 3.05 |
| Example 8 | Exemplified Compound 1 | (1-2) | 0.10 | −581 | −12 | 0.11 | −572 | −15 | 2.70 |
| Comp. Example 1 | Exemplified Compound 1 | PCA | 0.13 | −579 | −13 | 0.14 | −575 | −16 | 7.23 |
| Comp. Example 2 | TPD | (1-3) | 0.15 | −570 | −35 | 0.30 | −560 | −60 | 2.53 |
| Comp. Example 3 | ENA | (1-3) | 0.13 | −572 | −30 | 0.25 | −570 | −55 | 2.54 |

From the comparison between Examples 1 to 6 and 8, and Comparative Example 1, it was found that the photoreceptors of Examples 1 to 6, and 8 using polyarylate resins having the structural units represented by the general formula (1) for the binder resin 17 of the charge transportation layer 16 showed less wear amount and were excellent in the wear resistance compared with the photoreceptor of Comparative Example 1 using the polycarbonate resin for the binder resin 17.

Further, from comparison between Examples 1 to 6, 8 and Comparative Examples 2 and 3, it was found that the photoreceptors of Examples 1 to 6 and 8 using the enamine compound represented by the general formula (2) for the charge transportation substance 13 showed less half-decay exposure amount $E_{1/2}$ and higher sensitivity, and excellent in the responsivity with the residual potential $V_r$ being lower in the negative direction, that is, with less potential difference between the residual potential $V_r$ and a reference potential, compared with the photoreceptor of Comparative Example 2 using TPD or the photoreceptor of Comparative Example 3 using ENA having the enamine structure represented by the structural formula (17). Further, it was found that the characteristics were maintained also in a case of repetitive use.

Further, from comparison between Example 1 and Example 7, it was found that the stacked type photoreceptor of Example 1 having photosensitive layer having a stacked structure of the charge transportation layer and the charge generation layer had higher sensitivity and were excellent in the responsivity compared with the single layered photoreceptor of Example 7 having the photosensitive layer comprising a single layer.

As described above, by incorporating the polyarylate resin having the structural unit represented by the general formula (1) and the enamine compound represented by the general formula (2) in combination in the photosensitive layer, an electrophotographic photoreceptor of excellent mechanical strength and capable of providing favorable electric characteristics stably over a long period of time could be obtained.

Example 9

7 parts by weight of titanium oxide (manufactured by Ishihara Sangyo Co.: TTO55A), and 13 parts by weight of copolymer nylon resin (manufactured by Toray Co.: Amilan CM8000) were added to a mixed solvent of 159 parts by weight of methanol and 106 parts by weight of 1,3-dioxolane, dispersed by a paint shaker for 8 hours to prepare a coating solution for intermediate layer. A cylindrical aluminum support of 30 mm diameter and 322.3 mm length as an electroconductive substrate 11 was dipped in a coating tank filled with the obtained coating solution for intermediate layer and then pulled up and dried spontaneously to form an intermediate layer 18 of 1 μm film thickness.

Then, one part by weight of oxotitanium phthalocyanine and one part by weight of polyvinyl butyral resin (manufactured by Denki Kagaku Kogyo Co.: #6000-C) were mixed with 98 parts by weight of methyl ethyl ketone and dispersed by a paint shaker to prepare a coating solution for charge generation layer. The obtained coating solution for charge generation layer was filled in a coating tank and put to dip coating on the previously formed intermediate layer 18 and dried spontaneously to form a charge generation layer 15 of 0.4 μm film thickness in the same manner as in the intermediate layer 18.

Then, 8 parts by weight of the enamine compound of Exemplified Compound No. 1 shown in Table 6 as the charge transportation substance 13, and 10 parts by weight of the polyarylate resin having the structural formula represented by the structural formula (1-3) shown in Table 1 as the binder resin 17 (viscosity average molecular weight: 23,200) were dissolved in a mixed solvent of 40 parts by weight of tetrahydrofuran and 40 parts by weight of toluene, to prepare a coating solution for charge transportation layer. The obtained coating layer for charge transportation layer was filled in a coating tank and, after dip coating on the previously formed charge generation layer 15, it was dried to form a charge transportation layer 16 of 25 μm film thickness.

As described above, a stacked type electrophotographic photoreceptor of the layer constitution shown in FIG. 2 satisfying the conditions of the invention was manufactured.

Comparative Example 4

An electrophotographic photoreceptor was manufactured in the same manner as in Example 9 except for using, instead of Exemplified Compound No. 1, the comparative compound (TPD) represented by the structural formula (16) as the charge transportation substance 13.

<Evaluation for Image Quality>

Quality of images formed by using the photoreceptors was evaluated for each of the electrophotographic photoreceptors manufactured in Example 9 and Comparative Example 4 described above. The evaluation was conducted as below.

Each of the photoreceptors manufactured in Example 9 and Comparative Example 4 was mounted respectively to commercially available copying machine (manufactured by Sharp Corp.: AR-265FP), to form half-tone images on transfer paper. The half-tone images are images expressing the gradation by white and black dots for the dark and light of the images. The obtained images were observed with naked eyes to evaluate the quality of the images.

Images formed by the copying machine mounting the photoreceptor of Example 9 using the enamine compound represented by the general formula (2) for the charge transportation substance 13 were favorable images with no defects.

On the other hand, a number of white spots were formed in the images formed by the copying machine mounting the photoreceptor of Comparative Example 4 using TPD for the charge transportation substance 13. It is considered that this attributable to that TPD was poor in the compatibility with the polyarylate resin having the structural unit represented by the general formula (1) used as the binder resin 17 of the charge transportation layer 16.

From the results described above, it can be seen that the enamine compound represented by the general formula (2) is excellent in the compatibility with the polyarylate resin having the structural unit represented by the general formula (1).

Figure 17A:
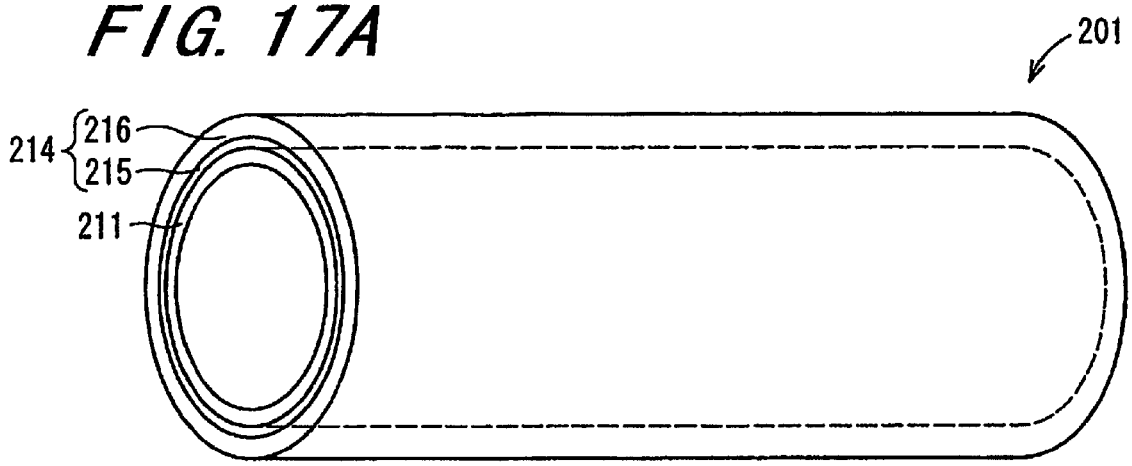
FIG. 17A is a perspective view schematically showing the constitution of an electrophotographic photoreceptor 201 according to a fifth embodiment of the invention.
Figure 17B:
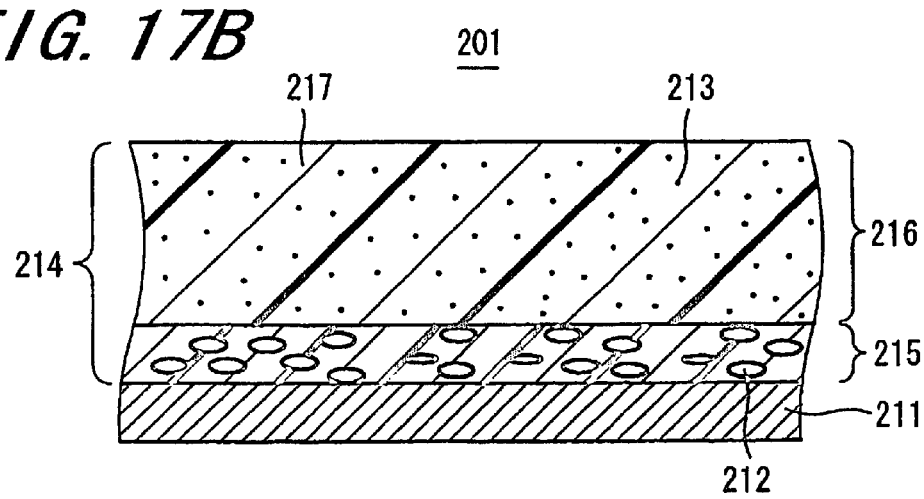
FIG. 17B is a fragmentary cross sectional view schematically showing the constitution of an electrophotographic photoreceptor 201.

FIG. 17A is a perspective view schematically showing the constitution of an electrophotographic photoreceptor 201 according to a fifth embodiment of the invention. FIG. 17B is a fragmentary cross sectional view schematically showing the constitution of an electrophotographic photoreceptor 201. The electrophotographic photoreceptor 201 (hereinafter sometimes simply referred to as "photoreceptor") comprises a cylindrical electroconductive substrate 211 formed of an electroconductive substance and a photosensitive layer 214 disposed on the outer circumferential surface of the electroconductive substrate 211. The photosensitive layer 214 has a stacked structure in which a charge generation layer 215 containing a charge generation substance 212 that generates charges by absorption of light and a charge transportation layer 216 containing a charge transportation substance 213 having an ability of accepting and transferring charges generated in the charge generation substance 212 and a binder resin 217 for binding the charge transportation substance 213 are stacked in this order on the outer circumferential surface of the electroconductive substrate 211. That is, the electrophotographic photoreceptor 201 is a stacked type photoreceptor.

In the charge transportation layer 216, the charge transportation substance 213 is bonded to the binder resin 217. As the charge transportation substance 213, the enamine compound represented by the general formula (2) is used.

(2)

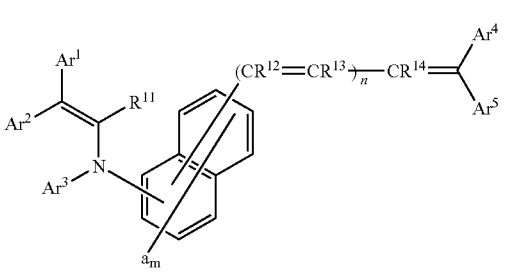

Since the enamine compound represented by the general formula (2) has a high charge mobility, it is possible to obtain an electrophotographic photoreceptor having high charge potential and charge retainability and high sensitivity, sufficient light responsivity and also excellent in the durability by incorporating the enamine compound represented by the general formula (2) as the charge transportation substance 213 in the photosensitive layer 214. Further, since high charge transportation ability can be obtained with no incorporation of the polysilane to the photosensitive layer 214, an electrophotographic photoreceptor of high reliability not suffering from lowering of the characteristics due to exposure to light can be obtained.

Among the enamine compounds represented by the general formula (2), preferred compounds include enamine compounds represented by the general formula (3).

(3)

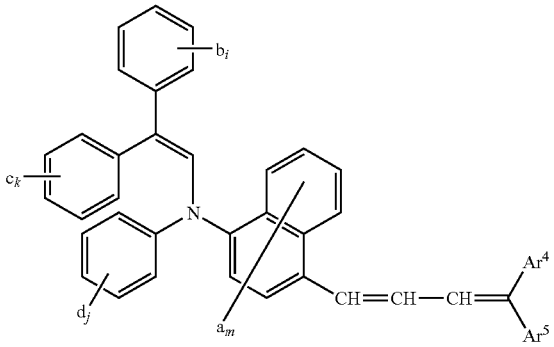

Since the enamine compound represented by the general formula (3) has a particularly high charge mobility among the enamine compounds represented by the general formula (2), an electrophotographic photoreceptor showing further higher light responsivity can be obtained by using the enamine compound represented by the general formula (3) for the charge transportation substance 213. Further, since the enamine compound represented by the general formula (3) can be synthesized relatively easily and at a high yield among the enamine compounds represented by the general formula (2), it can be prepared at a reduced cost. Accordingly, the electrophotographic photoreceptor having excellent characteristics as described above can be manufactured at a reduced production cost.

Further, among the enamine compounds represented by the general formula (1), those compounds particularly excellent in view of characteristics, cost, productivity, etc. include, in the same manner as described above, those in which $Ar^1$ and $Ar^2$ each represents a phenyl group, $Ar^3$ represents a phenyl group, tolyl group, p-methoxyphenyl group, biphenylyl group, naphthyl group or thienyl group, at least one of $Ar^4$ and $Ar^5$ represents a phenyl group, p-tolyl group, p-methoxyphenyl group, naphthyl group, thienyl group, or thiazolyl group, each of $R^{11}$, $R^{12}$, $R^{13}$, and $R^{14}$ represents a hydrogen atom, and n is 1.

As the enamine compound represented by the general formula (2), those, for example, selected from the group consisting of the exemplified compounds shown in Table 6 to Table 37 are used each alone or in admixture of two or more of them.

The enamine compound represented by the general formula (2) can be prepared in the same manner as described above.

The enamine compound represented by the general formula (2) may be used in admixture with other charge transportation substance in the same manner described above. Further, it also includes, for example, polymers having the groups derived from the compounds in the main chain or the side chain, for example, poly-N-vinylcarbazole, poly-1-vinylpyrene, and poly-9-vinylanthracene.

However, in order to attain the particularly high charge transportation ability, it is considered that the entire amount of the charge transportation substance 213 comprises the enamine compound represented by the general formula (2).

For the binder resin 217 contained in the charge transportation layer 216, a polycarbonate resin having a specified diol ingredient is used.

The polycarbonate resin is a polymer having the structural unit represented by the following general formula (18) and is synthesized from the diol compound represented by the following general formula (19). The diol compound is a compound having two hydroxyl groups (chemical formula: —OH) in one molecule as shown in the following general formula (19).

(18)

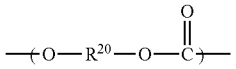

(19)

In the general formulae (18) and (19), $R^{20}$ represents an organic group.

In the structural unit represented by the general formula (18), since the moiety for —O—$R^{20}$—O— is derived from the diol compound represented by the general formula (19), the moiety is referred to as the diol ingredient in this specification.

The polycarbonate resin used in this embodiment has the specified diol ingredient as described above, and the specified diol ingredient is an asymmetric diol ingredient derived from the asymmetric diol compound.

An asymmetric diol compound is a diol compound having an organic group (—$R^{20}$—) to which two hydroxyl groups (—OH) are bonded as the main chain, in which the main chain is linearly arranged in the horizontal direction extending to right and left with respect to the drawing, and the two hydroxyl groups are not symmetry with respect to the line including the main chain on the drawing, when expressed by a planar structural formula as arranged on both ends of the main chain.

Since the polycarbonate resin having the asymmetric diol ingredient shows high solubility to a solvent irrespective that whether the solvent is a halogen type organic solvent or non-halogen type organic solvent, even when a coating solution is prepared by using a non-halogen type organic solvent in a case of forming the charge transportation layer 216 by coating as will be described later, the coating solution containing the polycarbonate resin having the asymmetric diol ingredient does not gelate, has a favorable film forming property, also exhibits excellent stability and does not gelate even lapse of several days after preparation. By the use of the coating solution, productivity of the electrophotographic photoreceptor can be improved. Further, since the polycarbonate resin having the asymmetric diol ingredient is excellent in the mechanical strength, it can suppress the occurrence of injuries on the surface of the photosensitive layer and decrease the film reduction amount of the photosensitive layer 214 to reduce the change of characteristics caused by the wear of the photosensitive layer 214. Furthermore, since the polycarbonate resin having the asymmetric diol ingredient is excellent in the insulative property with the volumic resistance of $10^{13}$ Ω·cm or higher and has high withstanding voltage, satisfactory electric characteristics can be obtained.

On the other hand, in the case of using the polycarbonate resin having the asymmetric diol ingredient for the binder resin 217, characteristics such as the light responsivity is sometimes lowered. However, in this embodiment, since the enamine compound of high transferability represented by the general formula (2) is used for the charge transportation substance 213, the characteristics described above are not deteriorated even in a case of use under a low temperature circumstance or in a high speed electrophotographic process.

Accordingly, by the incorporation of the enamine compound represented by the general formula (2) and the polycarbonate resin having the asymmetric diol ingredient in combination in the photosensitive layer 214, it is possible to obtain an electrophotographic photoreceptor having high charge potential and charge retainability, high sensitivity and sufficient light responsivity, excellent in durability, with no deterioration of the characteristics even in a case of use under a low temperature circumstance or in a high speed electrophotographic process or in a case of light exposure, as well as having high reliability and favorable productivity.

Among the polycarbonate resins having the asymmetric diol ingredient, preferred are those having the asymmetric diol ingredients derived from the asymmetric diol compound represented by the following general formula (20), that is, those having a structural unit containing the asymmetric diol ingredient represented by the following general formula (I).

(20)

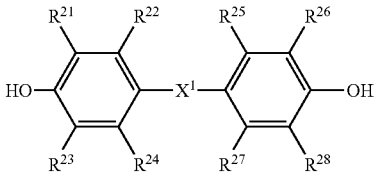

(I)

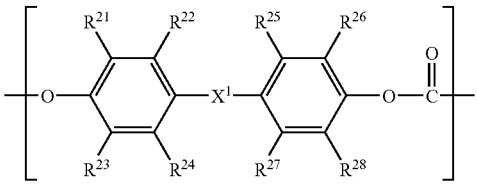

In the general formulae (20) and (I), $X^1$ represents a single bond, —$CR^{29}R^{30}$—, an alkylene group which may have a substituent, —S—, —O—, —$SO_2$—, —SO—, or —CO—.

The single bond means herein that benzene rings on both sides of $X^1$ are bonded directly. Specific examples in which $X^1$ is the single bond in the general formula (1) include, for example, structural units represented by the structural formulae (22-17) shown in Table 43 to be described later.

Further, in —$CR^{29}R^{30}$—, $R^{29}$, and $R^{30}$ each represents a hydrogen atom, a halogen atom, an alkyl group which may have a substituent, or an aryl group which may have a substituent. Specific examples for $R^{29}$ and $R^{30}$ include, in addition to the hydrogen atom, an alkyl group such as methyl, ethyl, propyl, isopropyl, isobutyl, cyclohexyl, and cycloheptyl, an aryl group such as phenyl and naphthyl, as well as a halogen atom such as a fluorine atom, a chlorine atom, and a bromine atom. The alkyl group preferably has 1 to 7 carbon atoms. The substituent which may be present on the alkyl group and the aryl group includes, for example, an alkyl group of 1 to 7 carbon atoms such as methyl, ethyl, propyl, and isopropyl, an aryl group such as phenyl and naphthyl, an aralkyl group such as benzyl or phenethyl, an alkoxy group of 1 to 7 carbon atoms such as methoxy, ethoxy, and propoxy, as well as a halogen atom such as a fluorine atom, a chlorine atom, and a bromine atom. The substituents may join to each other to form a ring structure.

$R^{29}$ and $R^{30}$ may join to each other to form a ring structure. Specific examples of —$CR^{29}R^{30}$— in a case where $R^{29}$ and $R^{30}$ join each other and form a ring structure together with carbon atoms (C) to which $R^{29}$ and $R^{30}$ are bonded include, for example, bivalent groups formed by removing two hydrogen atoms bonded to cyclo carbon atoms of mononuclear or polynuclear hydrocarbons such as cyclohexylidene, cyclopentylidene, fluorenylilene, and indanylidene.

Further, specific examples of the alkylene group as $X^1$ include a linear alkylene group such as a 1,2-ethylene group and a 1,3-propylene group, as well as a cyclic alkylene group such as a 1,6-cyclohexylene group.

Further, in the general formulae (20) and (I), $R^{21}$, $R^{22}$, $R^{23}$, $R^{24}$, $R^{25}$, $R^{26}$, $R^{27}$ and $R^{28}$ each represents a hydrogen atom, a halogen atom, an alkyl group which may have a substituent, an aryl group which may have a substituent, or an alkoxy group which may have a substituent. Specific examples for $R^{21}$, $R^{22}$, $R^{23}$, $R^{24}$, $R^{25}$, $R^{26}$, $R^{27}$ and $R^{28}$ include, in addition to the hydrogen atom, an alkyl group such as methyl, ethyl, and cyclohexyl, and an aryl group such as phenyl and naphthyl, an alkoxy group such as methoxy, ethoxy and propoxy, as well as a halogen atom such as a fluorine atom, a chlorine atom and a bromine atom. The alkyl group preferably has 1 to 7 carbon atoms. The alkoxy group preferably has 1 to 7 carbon atoms. The substituent which may be present on the alkyl group, aryl group, and alkoxy group include an alkyl group of 1 to 7 carbon atoms such as methyl, ethyl, propyl, and isopropyl, an aryl group such as phenyl and naphthyl, an aralkyl group such as benzyl and phenethyl, an alkoxy group of 1 to 7 carbon atoms such as methoxy, ethoxy, and propoxy, as well as a halogen atom such as a fluorine atom, a chlorine atom, and a bromine atom. The substituents may join to each other to form a ring structure.

However, in the general formulae (20) and (I), in a case where $R^{21}$ and $R^{23}$; $R^{22}$ and $R^{24}$; $R^{25}$ and $R^{27}$; and $R^{26}$ and $R^{28}$, respectively an identical groups, $X^1$ is —$CR^{29}R^{30}$—, $R^{29}$ and $R^{30}$ are groups different from each other, or $R^{29}$ and $R^{30}$ may join to each other to form a ring structure, or $X^1$ is an alkylene group and having two or more substituents different from each other or have two or more substituents on different substitution positions.

Further, in the general formulae (20) and (I), in a case where $X^1$ is —$CR^{29}R^{30}$—, $R^{29}$, $R^{30}$ are identical groups and they do not join to each other, or in a case where $X^1$ is an alkylene group and all substituents present on the alkylene group are identical groups and they are present on identical substitution positions, $R^{21}$ and $R^{23}$ are groups different from each other, $R^{22}$ and $R^{24}$ are groups different from each other, $R^{25}$ and $R^{27}$ are groups different from each other, or $R^{26}$ and $R^{28}$ are groups different from each other.

Among the polycarbonate resins having the structural unit containing the asymmetric diol ingredient represented by the general formula (1), those having the asymmetric diol ingredient derived from the asymmetric diol compound, that is, those having the structural unit containing the asymmetric diol ingredient represented by the following the general formula (II) are used particularly preferably.

(21)

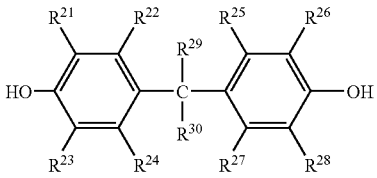

(II)

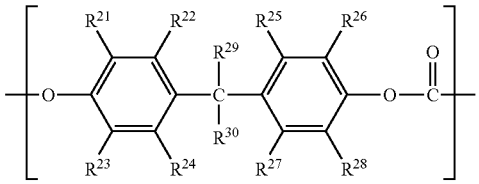

In the general formulae (21) and (II), $R^{21}$, $R^{22}$, $R^{23}$, $R^{24}$, $R^{25}$, $R^{26}$, $R^{27}$, $R^{28}$, $R^{29}$, and $R^{30}$ have the same meanings as those defined for the general formulae (20) and (I).

However, in the general formulae (21) and (II), $R^{29}$ and $R^{30}$ are groups different from each other or join to each other to form a ring structure.

Since the polycarbonate resin having the structural unit containing the asymmetric diol ingredient represented by the general formula (II) has a bulky substituent on the main chain and the packing density of the resin per se is high, it has a particularly high mechanical strength. Accordingly, by using the polycarbonate resin having the structural unit containing asymmetric diol ingredient represented by the general formula (II) for the binder resin 217, it is possible to obtain an electrophotographic photoreceptor particularly excellent in the durability, with less occurrence of injuries at the surface of the photosensitive layer and with less film reduction amount of the photosensitive layer 214.

While specific examples for the polycarbonate resin having the asymmetric diol ingredient include, for example, those having the structural units containing the asymmetric diol ingredient represented by the structural formulae (22-1) to (22-18) shown in the following Table 40 to Table 43, the polycarbonate resin having the asymmetric diol ingredient is not restricted to them.

TABLE 40

| | |
|---|---|
| Structural formula (22-1) | 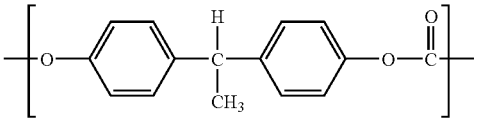 |
| Structural formula (22-2) | 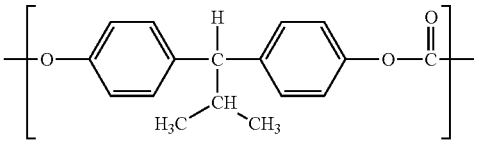 |
| Structural formula (22-3) | 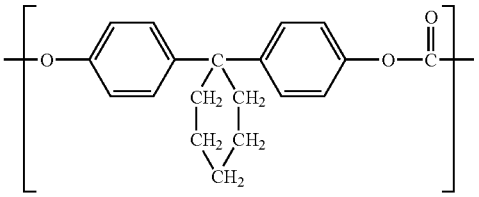 |

TABLE 40-continued
Structural formula (22-4)
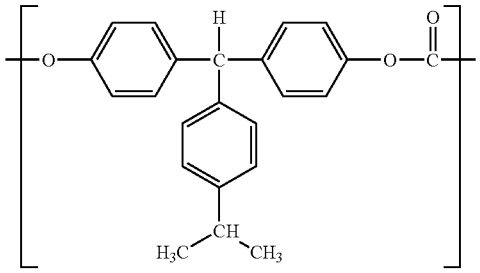
Structural formula (22-5)
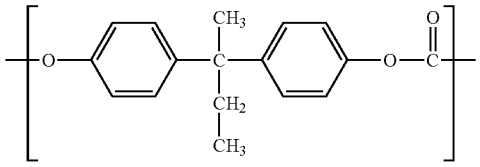
TABLE 41
Structural formula (22-6)
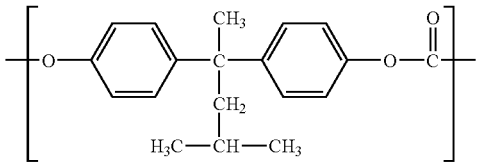
Structural formula (22-7)
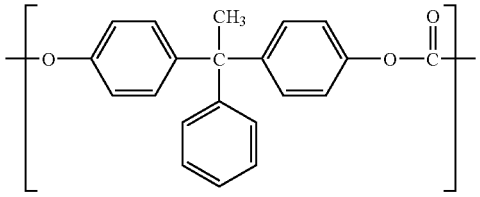
Structural formula (22-8)
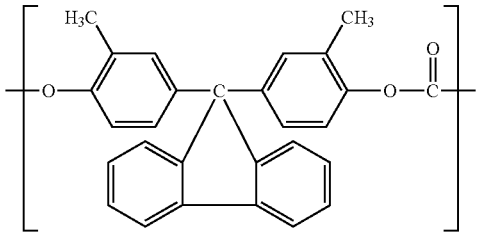
Structural formula (22-9)
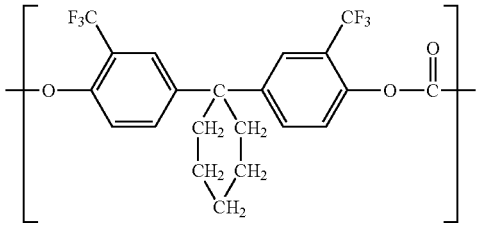
TABLE 41-continued
Structural formula (22-10)
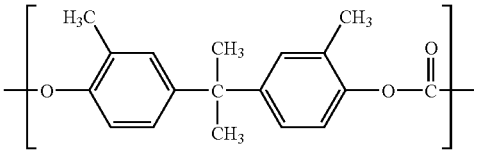
TABLE 42
Structural formula (22-11)
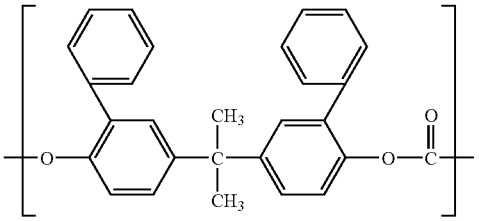
Structural formula (22-12)
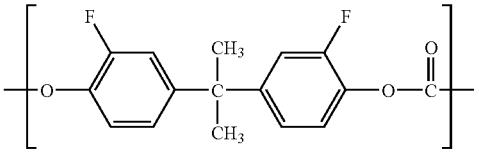
Structural formula (22-13)
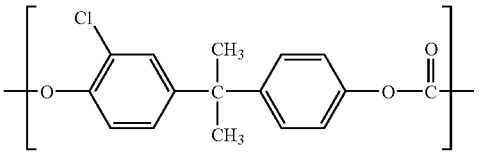
Structural formula (22-14)
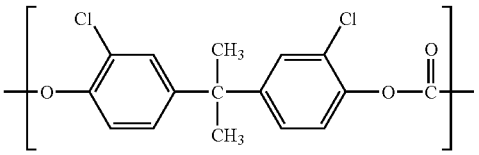
Structural formula (22-15)
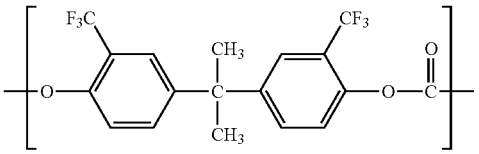

TABLE 43

| | |
|---|---|
| Structural formula (22-16) | 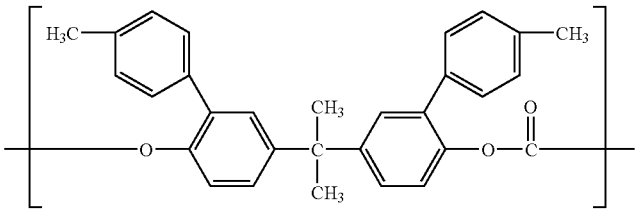 |
| Structural formula (22-17) | 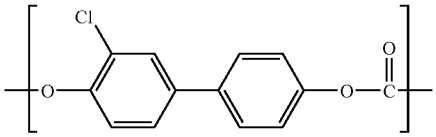 |
| Structural formula (22-18) | 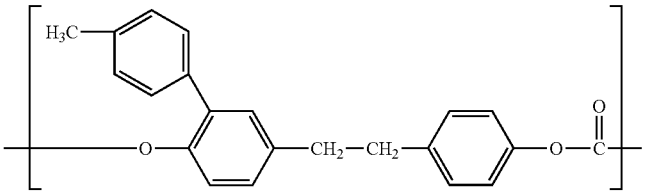 |

The polycarbonate resin having the asymmetric diol ingredient may have, for example, those structural units selected from the group consisting of structural units containing the asymmetric diol ingredients represented by the structural formulae (22-1) to (22-18) shown in Table 40 to Table 43 described above each alone or by two or more of them.

Further, the polycarbonate resin having the asymmetric diol ingredient preferably has, in addition to the asymmetric diol ingredient, a siloxane structure further. The siloxane structure is a structure containing a siloxane bond (Si—O).

By using the polycarbonate resin having the asymmetric diol ingredient and the siloxane structure for the binder resin 217, the surface friction coefficient of the photosensitive layer 214 is decreased to improve the slidability. Accordingly, since the toner deposited to the surface of the photosensitive layer tends to be peeled, the transfer efficiency upon transferring the toner images formed on the surface of the photosensitive layer to the recording medium, or the cleaning property for the surface of the photosensitive layer after transfer is improved to obtain satisfactory images. Further, since paper dusts, etc. causing injuries formed to the surface of the photosensitive layer are also tended to be peeled, the surface of the photosensitive layer is less injured. Further, even when the cleaning blade is moved slidably upon removing the toner remaining on the surface of the photosensitive layer after transfer, since friction and vibration accompanied to physical contact between the surface of the photosensitive layer and the cleaning blade are small, abnormal sounds referred to as ringing less occurs.

The polycarbonate resin having the asymmetric diol ingredient and the siloxane structure includes, for example, a copolycarbonate resin having the structural unit containing the asymmetric diol ingredient and the siloxane structure represented by the following general formula (23):

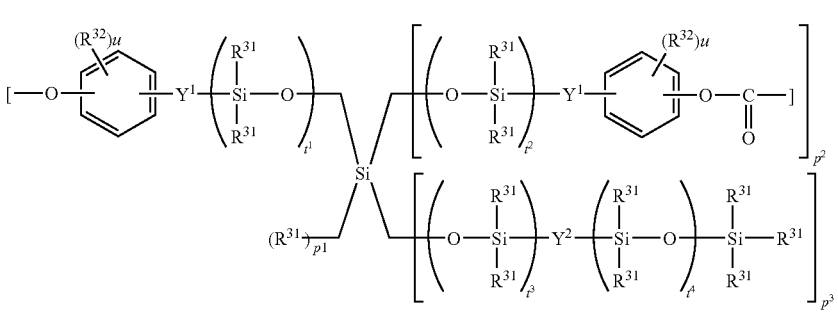

(23)

In the general formula (23) plural $R^{31}$ each represents a monovalent hydrocarbon group not containing an aliphatic unsaturated bond. The monovalent hydrocarbon group as $R^{31}$ includes, for example, an alkyl group which may have a substituent and aryl group which may have a substituent. Specific examples of the alkyl group as $R^{31}$ include, for example, an alkyl group of 1 to 6 carbon atoms such as a methyl group, an ethyl group, a propyl group, an isopropyl group, a butyl group, an s-butyl group, a t-butyl group, an isobutyl group, a pentyl group, and a hexyl group. Among them, the methyl group, the ethyl group, the propyl group, the isopropyl group, the butyl group, the s-butyl group, and the t-butyl group are preferred. Specific examples of the aryl group as $R^{31}$ include an aryl group of 6 to 12 carbon atoms such as a phenyl group, naphthyl group, and biphenylyl group. Among all, the phenol group is preferred.

In the general formula (23), plural $R^{32}$ each represents an alkyl group which may have a substituent, an alkoxy group which may have a substituent, an aryl group which may have a substituent, a halogen atom or a hydrogen atom, and plural u each represents an integer of 1 to 4. Specific examples of the alkyl group as $R^{32}$ include, for example, an alkyl group of 1 to 6 carbon atoms such as a methyl group, an ethyl group, a propyl group, an isopropyl group, a butyl group, an s-butyl group, a t-butyl group, an isobutyl group, a pentyl group, and a hexyl group. Among them, the methyl group, the ethyl group, the propyl group, the isopropyl group, the butyl group, the s-butyl group, and the t-butyl group are preferred. Specific examples of the alkoxy group for $R^{32}$ include, for example, alkoxy group of 1 to 6 carbon atoms such as a methoxy group, an ethoxy group, a propoxy group, an isopropoxy group, a butoxy group, an s-butoxy group, a t-butoxy group, an isobutoxy group, a pentyloxy group, and a hexyloxy group. Among them, the methoxy group, the ethoxy group, the propoxy group, and the isopropoxy group are preferred. Specific examples of the aryl group as $R^{32}$ include, for example, an aryl group of 6 to 12 carbon atoms such as a phenyl group, a naphthyl group and a biphenylyl group. Among them, the phenyl group is preferred. Specific examples of the halogen atom as $R^{32}$ include a fluorine atom, a chlorine atom, a bromine atom, and an iodine atom. Among them, the fluorine atom, the chlorine atom and the bromine atom are preferred.

Further, in the general formula (23), plural $Y^1$ each represents an alkylene group which may have a substituent, or an alkylene oxyalkylene group which may have a substituent.

Further, in the general formula (23), $Y^2$ represents an alkylene group which may have a substituent, an alkylene oxyalkylene group which may have a substituent, or an oxygen atom.

Specific examples of the alkylene group as $Y^1$ and $Y^2$ include, for example, an alkylene group of 2 to 6 carbon atoms such as an ethylene group, a trimethylene group, a tetramethylene group, a pentamethylene group, and a hexamethylene group. Among them, the ethylene group, trimethylene group, and the tetramethylene group are preferred. The alkylene oxyalkylene group as $Y^1$ and $Y^2$ include, for example, an alkylene oxyalkylene group of 4 to 10 carbon atoms such as a methylene oxypropylene group, a methylene oxybutylene group, an ethylene oxyethylene group, an ethylene oxypropylene group, an ethylene oxybutylene group, a propylene oxyhexylene group, and a butylene oxyhexylene group. Among them, the ethylene oxypropylene group and ethylene oxybutylene group are preferred.

Further, in the general formula (23), $p^1$ represents 0 or 1, $p^2$ represents 1 or 2, and $p^3$ represents 1 or 2, providing that the sum for $p^1$, $p^2$, and $p^3$ ($p^1+p^2+p^3$) is 3. In a case where $p^3$ is 2, plural $Y^2$ may identical or different.

Further, in the general formula (23), $t^1$, $t^2$, $t^3$, and $t^4$ each represents an integer of 0 or more, providing that the sum for $t^1$, $t^2$, $t^3$, and $t^4$ ($t^1+t^2+t^3+t^4$) is an integer of 0 to 450. $t^1$ and $t^2$ is each preferably an integer of 1 to 20. The sum for $t^3$ and $t^4$ ($t^3+t^4$) is preferably an integer of 0 to 100. The sum for $t^1$, $t^2$, $t^3$, and $t^4$ ($t^1+t^2+t^3+t^4$) is preferably an integer of 2 to 100.

The polycarbonate resin having the asymmetric diol ingredient may also have the asymmetric diol ingredient and other structure than the siloxane structure within a range not deteriorating the effect of the invention.

The polycarbonate resin having the asymmetric diol ingredient has a viscosity average molecular weight, preferably, from 10,000 or more to 70,000 or less, and, more preferably, 30,000 or more to 60,000 or less. In a case where the viscosity average molecular weight of the polycarbonate resin having asymmetric diol ingredient is less than 10,000, the mechanical strength is remarkably weakened to form a photoreceptor with large film reduction amount of the photosensitive layer 14 and sensitive to injuries. In a case where the viscosity average molecular weight of the polycarbonate resin having the asymmetric diol ingredient exceeds 70,000, the viscosity is excessively high upon preparation of the coating solution tending to cause coating unevenness. Accordingly, it is defined as 10,000 or more and 70,000 or less.

The polycarbonate resin having the asymmetric diol ingredient can be prepared by a method used generally upon preparing a polycarbonate resin from a diol compound, that is, a phosgene method or an ester exchange method.

As the binder resin 217, a polycarbonate resin having the asymmetric diol ingredient may be used alone, or two or more polycarbonate resins having different asymmetric diol ingredients may be used in admixture.

Further, the polycarbonate resin having the asymmetric diol ingredient may be used being mixed with other resin for the binder resin 217. As the other resin used in admixture with the polycarbonate resin having the asymmetric diol ingredient, those excellent in the compatibility with the charge transportation substance 213 are used. For example, one or more resins selected from the group consisting of polyarylate, polyvinyl butyral, polyamide, polyester, epoxy resin, polyurethane, polyketone, polyvinyl ketone, polystyrene, polyacrylamide, phenol resin, phenoxy resin, and polysulfone resin, as well as copolymer resins thereof can be used in admixture with the polycarbonate resin having the asymmetric diol ingredient described above. Among the resins described above, since the resin such as polystyrene, polyarylate or polyester is excellent in the insulation property with the volume resistivity of $10^{13}$ Ω·cm or higher like the polycarbonate resin having the asymmetric diol ingredient described above, and is also excellent in the film forming property and the potential characteristic, it is preferred to use such resin.

In a case of use being mixed with other resin, it is preferred that the polycarbonate resin having the asymmetric diol ingredient is incorporated by 5% by weight or more and 95% by weight or less and, more preferably, by 10% by weight or more and 90% by weight or less for the entire amount of the binder resin 217.

In the charge transportation layer 216, the ratio A/B for the charge transportation substance 213 (A) and the binder resin 217 (B) is, preferably, from 10/12 to 10/30 by weight ratio. In a case of using the known charge transportation substance, the ratio A/B is about 10/12 since the light responsivity may sometimes be lowered in a case where the ratio of the binder resin 217 is increased as being 10/12 or less for the ratio A/B. However, in the electrophotographic photoreceptor 1 in this embodiment, since the charge transportation substance 213 contains the enamine compound represented by general formula (2) of high charge mobility, the light responsivity can be maintained even when the binder resin is added at a higher ratio than in the case of using the known charge transportation substance, with the ratio A/B being 10/12 to 10/30. That is, the binder resin 217 containing the polycarbonate resin having the asymmetric diol ingredient can be incorporated at a high concentration to the charge transportation layer 216 without lowering the light responsivity. Accordingly, since the printing resistance of the charge transportation layer 216 can be improved and the change of characteristics caused by the wear of the photosensitive layer 214 can be suppressed, the durability of the electrophotographic photoreceptor can be improved. In addition, since the polycarbonate resin having the asymmetric diol ingredient contained in the binder resin 217 exhibits high solubility to a solvent irrespective that the solvent is a halogen type organic solvent or a non-halogen type organic solvent as described above, the coating solution is not gelled but stable even in a case where the binder resin 217 is added at a such a high ratio and an electrophotographic photoreceptor can be produced efficiently for a long period of time.

In a case where the ratio A/B exceeds 10/12 to lower the ratio of the binder resin 217 excessively, the printing resistance of the charge transportation layer 216 is lowered to increase the film reduction amount of the photosensitive layer 214 compared with a case where the ratio of the binder resin 217 is high even in a case of using a polycarbonate resin having the asymmetric diol ingredient excellent in the mechanical strength as described above. Further, in a case where the ratio A/B is less than 10/30 to increase the ratio of the binder resin 217 excessively, since the viscosity of the coating solution increases in a case of forming the charge transportation layer 216 by the dip coating method to be described later, the coating speed is lowered to remarkably worsen the productivity. Further, in a case of increasing the amount of the solvent in the coating solution in order to suppress the increase of the viscosity of the coating solution, a brushing phenomenon occurs to cause clouding in the formed charge transportation layer 216. Accordingly, it was defined as 10/12 to 10/30.

An additive such as a plasticizer or a leveling agent may also be added to the charge transportation layer 216 optionally in order to improve the film forming property, flexibility and surface smoothness. The plasticizer include, for example, a dibasic acid ester such as phthalate ester, fatty acid ester, phosphate ester, chlorinated paraffin, and epoxy plasticizer. The leveling agent include, for example, silicone type leveling agent.

Fine particles of an inorganic compound or an organic compound may be added to the charge transportation layers 216 in order to increase the mechanical strength or improve the electric characteristics.

Further, various additives such as an antioxidant and a sensitizer may be added optionally to the charge transportation layer 216. This can improve potential characteristics. Further, the stability of the coating solution upon forming the charge transportation layer 216 by coating is improved as will be described later. Further, this can mitigate the fatigue deterioration to improve the durability upon repetitive use of the photoreceptor.

As the antioxidant, hindered phenol derivatives or hindered amine derivatives are used preferably. The hindered phenol derivatives are preferably used within a range of 0.1% by weight or more and 50% by weight or less relative to the charge transportation substance 213. Further, the hindered amine derivatives are used preferably within a range from 0.1% by weight or more and 50% by weight or less relative to the charge transportation substance 213. The hindered phenol derivative and the hindered amine derivative may be used in admixture. In this case, the total amount of the hindered phenol derivative and the hindered amine derivative to be used is preferably within a range from 0.1% by weight or more to 50% by weight or less relative to the charge transportation substance 213. In a case where the amount of the hindered phenol derivative to be used, the amount of the hindered amine derivative to be used, or the total amount of the hindered phenol derivative and the hindered amine derivative to be used is less than 0.1% by weight, no sufficient effect can be obtained for the improvement of the stability of the coating solution and the improvement of the durability of the photoreceptor. Further, if the amount exceeds 50% by weight, this gives an undesired effect on the characteristics of the photoreceptor. Accordingly, it is defined as 0.1% by weight or more and 50% by weight or less.

The charge transportation layer 216 is formed, for example, by dissolving or dispersing, in an appropriate solvent, the charge transportation substance 213 containing the enamine compound represented by the general formula (18) described above and the binder resin 17 containing the polycarbonate resin having asymmetric diol ingredient, and the additives described above, if necessary, to prepare a coating solution for a charge transportation layer, and coating the obtained solution on the outer circumferential surface of the charge generation layer 215.

As the solvent for the coating solution for charge transportation layer, those selected, for example, from the group consisting of aromatic hydrocarbons such as benzene, toluene, xylene, and monochlorobenzene, halogenated hydrocarbons such as dichloromethane and dichloroethane, ether such as tetrahydrofuran, dioxane, and dimethoxymethyl ether, as well as non-protonic polar solvents such a N,N-dimethylformamide are used each alone or in admixture of two or more of them. Further, if necessary, a solvent such as alcohols, acetonitriles, or methyl ethyl ketone may further be added to the solvent described above and used. However, among the solvent described above, use of the non-halogen type organic solvent is preferred in view of the global environment. As described above, since the polycarbonate resin having the asymmetric diol ingredient exhibits a high solubility to the solvent irrespective that the solvent is a halogen type organic solvent or a non-halogen type organic solvent, even when the coating solution is prepared by using the non-halogen type organic solvent, the coating solution is not gelled, satisfactory in the film forming property and in the stability, and is not gelled even after lapse of several days from preparation.

The coating method for the coating solution for charge transportation layer includes, for example, a spraying method, bar coating method, roll coating method, blade method, wringing method or dip coating method. Among the coating methods described above, an optimal method can be selected while taking the physical properties of the coating and the productivity into consideration. Among the coating methods described above, since the dip coating method is a method of dipping a substrate into a coating bath filled with the coating solution and then pulling up the substrate at a constant speed or at a gradually changing speed to form a layer on the surface of the substrate and, since the method is relatively simple and excellent in view of the productivity and the cost, it has been often utilized in a case of producing an electrophotographic photoreceptor and also often utilized in a case of forming the charge transportation layer 216.

The film thickness of the charge transportation layer 216 is preferably, 5 μm or more and 50 μm or less and, more preferably, 10 μm or more and 40 μm or less. In a case where the film thickness of the charge transportation layer 216 is less than 5 μm, the charge retainability on the surface of the photoreceptor is lowered. In a case where the film thickness of the charge transportation layer 216 exceeds 50 μm, resolution of the photoreceptor is lowered. Accordingly, it is defined as 5 μm or more and 50 μm or less.

As described above, the photosensitive layer 214 has a stacked structure of the charge generation layer 215 containing the charge generation substance 212 and the charge transportation layer 216 containing the charge transportation substance 213. By sharing the charge generating function and the charge transporting function respectively to separate layers, since optimal materials can be selected for the charge generating function and the charge transporting function respectively, a photoreceptor having higher sensitivity and of high durability further improved stability upon repetitive use can be obtained.

The charge generation layer 215 contains the charge generation substance 212 as a main ingredient. The material effective as the charge generation substance 212 includes azo pigments such as a monoazo pigment, bisazo pigment, and trisazo pigment, indigo pigments such as indigo and thioindigo, perylene pigments such as peryleneimide and perylenic acid anhydride, polynuclear quinone pigments such as anthraquinone and pyrenequinone, phthalocyanine pigments such as metal phthalocyanine and non-metal phthalocyanine, squarylium dyes, pyrylium salts and thiopyrylium salts, triphenylmethane dyes, and inorganic materials such as selenium and amorphous silicon. The charge generation substances are used each alone or two or more of them in combination.

Among the charge generation substances described above, use of oxotitanium phthalocyanine is preferred. Since oxotitanium phthalocyanine is a charge generation substance having high charge generating efficiency and charge injecting efficiency, it generates a great amount of charges by absorption of light and efficiently injects the generated charges, without accumulating them in the inside thereof, into the charge transportation substance 213. Further, for the charge transportation substance 213, since the enamine compound of high charge mobility represented by the general formula (2) is used, the charges generated from the charge generation substance 212 by light absorption are efficiently injected into the charge transportation substance 13 and transferred smoothly. Accordingly, an electrophotographic photoreceptor of high sensitivity and high resolution can be obtained by incorporating the enamine compound represented by the general formula (2) and the oxytitanium phthalocyanine to the photosensitive layer 214. Further, while an infrared laser has been used for an exposure light source along with digitalization of image forming apparatus in recent years, since the oxotitanium phthalocyanine has a maximum absorption peak in the wavelength region of a laser light irradiated from the IR-ray laser, images at high quality can be provided in a digital image forming apparatus with the IR-ray laser being as the exposure light source by using such an electrophotographic photoreceptor.

The charge generation substance 212 may be used in combination with sensitizing dyes, for example, triphenylmethane dyes typically represented by methyl violet, crystal violet, night blue, and Victoria blue, acrydine dyes typically represented by erythrosin, rhodamine B, rhodamine 3R, acrydine orange, and flaveosin, thiazine dyes typically represents by methylene blue and methylene green, oxazine dyes typically represented by capri blue and merdora blue, cyanine dyes, stylyl dyes, pyrylium salt dyes, or thiopyrylium salt dyes.

The method of forming the charge generation layer 215 includes a method of vacuum vapor depositing the charge generation substance 212 on the outer circumferential surface of the electroconductive substrate 211, or a method of coating a coating solution for charge generation layer obtained by dispersing the charge generation substance 212 in an appropriate solvent on the outer circumferential surface of the electroconductive substrate 211. Among them, a preferred method includes dispersing the charge generation substance 212 into a binder resin solution obtained by mixing a binder resin as a binder into an appropriate solvent by a known method to prepare a coating solution for charge generation layer and coating the obtained coating solution on the outer circumferential surface of the electroconductive substrate 211. The method is to be described below.

The binder resin for the charge generation layer 215 is selected from the group consisting, for example, of polyestera resin, polystyrene resin, polyurethane resin, phenol resin, alkyd resin, melamine resin, epoxy resin, silicone resin, acryl resin, methacryl resin, polycarbonate resin, polyarylate resin, phenoxy resin, polyvinyl butyral resin, and polyvinyl formal resin, as well as copolymer resins containing two or more of repetitive units constituting the resins described above are used each alone or in admixture of two or more of them. Specific examples of the copolymer resin include, for example, those insulative resins such as vinyl chloride-vinyl acetate copolymer resin, vinyl chloride-vinyl acetate-maleic acid anhydride copolymer resin, and acrylonitrile-styrene copolymer resin. The binder resin is not restricted to them but those resins used generally can be used as the binder resin. However, among the resins, the polycarbonate resin having the asymmetric diol ingredient described above used as the binder resin 217 for the charge transportation layer 216 is used preferably. Since the polycarbonate resin having the asymmetric diol ingredient exhibits a high solubility to the solvent irrespective that the solvent is a halogen type organic solvent or a non-halogen type organic solvent as described above, a coating solution for charge generation layer which is not gelled, satisfactory in the film forming property and excellent in the stability and is not gelled even after lapse of several days from preparation can be obtained by using the same, to improve the productivity of the photoreceptor.

As a solvent for the coating solution for charge generation layer, for example, halogenated hydrocarbons such as dichloromethane or dichloroethane, ketones such as acetone, methyl ethyl ketone or cyclohexanone, esters such as ethyl acetate or butyl acetate, ethers such as tetrahydrofuran (referred to as THF) or dioxane, alkylethers of ethylene glycol such as 1,2-dimethoxyethane, aromatic hydrocarbons such as benzene, toluene or xylene, or aprotonic polar solvents such as N,N-dimethyl formamide or N,N-dimethylacetoamide, etc, are used. The solvents may be used alone or two or more of them may be mixed and used as a mixed solvent. However, among the solvents described above, the non-halogen type organic solvent is used preferably in view of the global environment. In this case, as the binder resin for the charge generation layer 215, the polycarbonate resin having the asymmetric diol ingredient is used preferably.

As the blending ratio between the charge generation substance 212 and the binder resin, it is preferred that the ratio of the charge generation substance 212 is within a range from 10% by weight to 99% by weight. In a case where the ratio of the charge generation substance 212 is less than 10% by weight, the sensitivity is lowered. In a case where the ratio of the charge generation substance 212 exceeds 99% by weight, since not only the film strength of the charge generation layer 215 is lowered but also the dispersibility of the charge generation substance 212 is lowered to increase coarse particles to sometimes decrease the surface charges at the portion other than the portion to be erased by exposure, this increases image defects, particularly, image fogging referred to as "black speck" where toners are deposited to the white background to form fine black spots. Accordingly, it is defined as from 10% by weight to 99% by weight.

Before dispersing the charge generation substance 212 in the binder resin solution, the charge generation substance 212 may previously be pulverized by a pulverizer. The pulverizer used for pulverization includes, for example, a ball mill, sand mill, attritor, vibration mill, and supersonic dispersing machine.

The dispersing machine used upon dispersing the charge generation substance 212 into the binder resin solution includes, for example, a paint shaker, ball mill, and sand mill. As the dispersion conditions, appropriate conditions are selected so as not to cause intrusion of impurities due to abrasion of members constituting the container or dispersing machine to be used.

The coating method of the coating solution for charge generation layer includes, for example, a spraying method, bar coating method, roll coating method, blade method, wringing method, and dip coating method. Among the coating method described above, since the dip coating method is particularly excellent with various view points as described above, it has been often utilized also in a case of forming the charge generation layer 215. As the apparatus used for the dip coating method, a coating solution dispersing apparatus typically represented by a supersonic generation apparatus may be provided in order to stabilize the dispersibility of the coating solution.

The film thickness of the charge generation layer 215 is, preferably, 0.05 μm or more and 5 μm or less and, more preferably, 0.1 μm or more and 1 μm or less. In a case where the film thickness of the charge generation layer 215 is less than 0.05 μm, the light absorption efficiency is lowered to lower the sensitivity. In a case where the film thickness of the generation layer 215 exceeds 5 μm, the charge transfer in the charge generation layer constitutes a rate determining step in the process of erasing charges on the surface of the photoreceptor to lower the sensitivity. Accordingly, it is defined as 0.05 μm or more and 5 μm or less.

As the electroconductive material constituting the electroconductive substrate 211, metal materials, for example, elemental metals such as aluminum, copper, zinc, and titanium, as well as alloys such as aluminum alloys and stainless steels can be used. Further, with no particular restriction to such metal materials, polymeric materials such as polyethylene terephthalate, nylon, or polystyrene, hard paper or glass in which metal foils are laminated, metal materials are vapor deposited, or a layer of electroconductive compound such as electroconductive polymer, tin oxide, or indium oxide is vapor deposited or coated on the surface thereof can also be used. While the shape of the electroconductive substrate 211 is cylindrical in this embodiment, it is not restrictive but may be a circular columnar shape, sheet like shape, or endless belt shape.

The surface of the electroconductive substrate 211 may optionally be applied with an anodizing treatment, a surface treatment with chemicals or hot water, a coloring treatment or a random reflection treatment, for example, by surface roughening, within a range not affecting the picture quality. In the electrophotographic process using laser as an exposure source, since the wavelength of laser beams is coherent, the incident laser light and the light reflected in the photoreceptor may sometimes cause interference and the interference fringe caused by interference appears on the images to result in image defects. Image defects by the interference of the laser light of coherent wavelength can be prevented by applying the treatment described above to the surface of the electroconductive substrate 211.

For improving the sensitivity and suppressing the increase of the residual potential and fatigue in the case of repetitive use one or more electron accepting materials or dyes may also be added to the photosensitive layer 214.

As the electron accepting material, electron attracting materials, for example, acid anhydrides such as succinic acid anhydride, maleic acid anhydride, phthalic acid anhydride, and 4-chloronaphthalic acid anhydride, cyano compound such as tetraethylcyanoethylene and terephthal malon dinitrile, aldehydes such as 4-nitrobenzoaldehyde, anthraquinones such as anthraquinone and 1-nitroanthraquinone, polynuclear or heterocyclic nitro compounds such as 2,4,7-trinitrofluolenone and 2,4,5,7-tetranitrofluolenone, as well as diphenoquinone compounds. Those formed by making the electron attracting materials to higher molecular weight, etc. may also be used.

As the dyes, organic photoconductive compounds, for example, xanthene dyes, thiazine dyes, triphenylmethane dyes, quinoline pigments, and copper phthalocyanine can be used. Such organic photoconductive compounds function as an optical sensitizer.

A protective layer may also be disposed to the surface of the photosensitive layer 214. Provision of the protective layer can improve the printing resistance of the photosensitive layer 214, as well as prevent undesired chemical effects on the photosensitive layer 214 caused by ozone or nitrogen oxides generated by corona discharge upon charging the surface of the photoreceptor. For the protective layer, a layer comprising, for example, a resin, an inorganic filler-containing resin, or an inorganic oxide is used.

Figure 18:
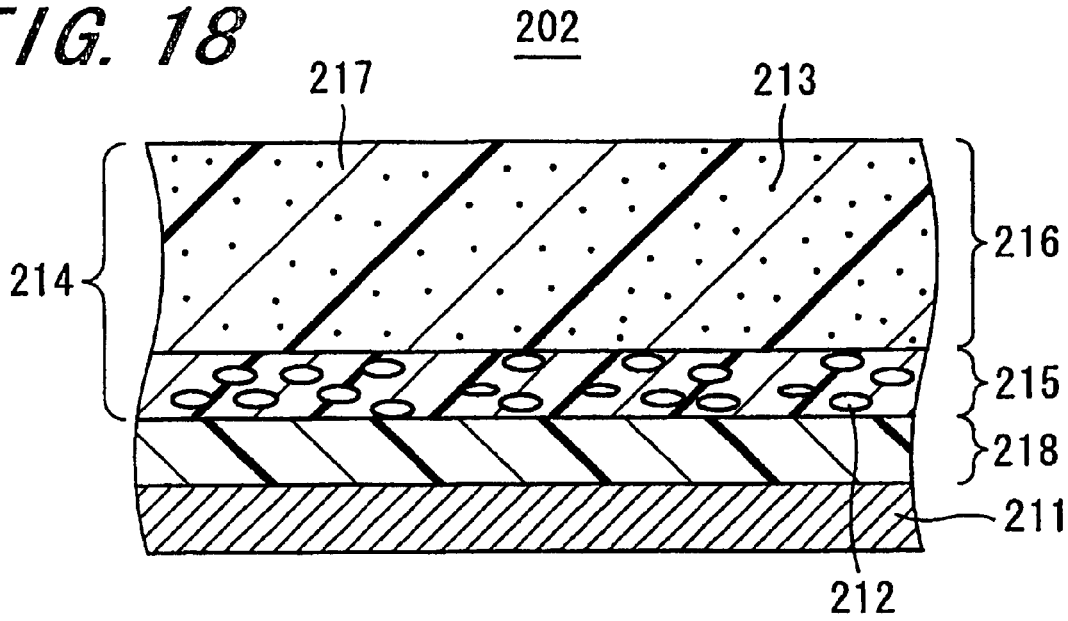
FIG. 18 is a schematic cross sectional view schematically showing the constitution of an electrophotographic photoreceptor 202 according to a sixth embodiment of the invention.

FIG. 18 is a schematic cross sectional view schematically showing the constitution of an electrophotographic photoreceptor 202 according to a sixth embodiment of the invention. The electrophotographic photoreceptor 202 in this embodiment is similar with the electrophotographic photoreceptor 201 of the fourth embodiment, and corresponding portions carry identical references, for which explanation is to be omitted.

What is to be noted in the electrophotographic photoreceptor 202 is provision of an intermediate layer 218 between the electroconductive substrate 211 and the photosensitive layer 214.

In a case where the intermediate layer 118 is not present between the electroconductive substrate 211 and the photosensitive layer 214, charges are injected from the electroconductive substrate 211 to the photosensitive layer 214 to lower the chargeability of the photosensitive layer 214, and the surface charges in the portion other than the portions to be erased by exposure are decreased to sometimes result in defects such as fogging to the images. Particularly, in a case of forming images by using a reversal development process, since toner images are formed to the portion decreased with the surface charges by exposure, when the surface charges are decreased by the factor other than the exposure, toner is deposited to the white background to result in fogging of images referred to as black speck in which fine black spots are formed by the deposition of the toner on the white background to remarkably deteriorate the image qualities. That is, in a case where the intermediate layer 218 is not present between the electroconductive substrate 211 and the photosensitive layer 214, this lowers the chargeability in the minute region due to the defects of the electroconductive substrate 211 or the photosensitive layer 214 to result in fogging of images such as black specks, which leads to remarkable image defects.

However, in the electrophotographic photoreceptor 202 in this embodiment, since the intermediate layer 218 is provided between the electroconductive substrate 211 and the photosensitive layer 214 as described above, injection of charges from the electroconductive substrate 211 to the photosensitive layer 214 can be prevented. Accordingly, lowering of the chargeability of the photosensitive layer 214 can be prevented to suppress the decrease of the surface charges in the portion other than the portions to be erased by exposure and occurrence of defects such as fogging to the images can be prevented.

Further, since the defects at the surface of the electroconductive substrate 211 can be covered to obtain a uniform surface by the provision of the intermediate layer 218, the film forming property of the photosensitive layer 214 can be improved. Further, peeling of the photosensitive layer 214 from the electroconductive substrate 211 can be suppressed to improve the adhesion between the electroconductive substrate 211 and the photosensitive layer 214.

For the intermediate layer 218, a resin layer formed of various kinds of resin materials, or an alumite layer is used.

The resin materials forming the resin layer include, those resins such as polyethylene resin, polypropylene resin, polystyrene resin, acryl resin, vinyl chloride resin, vinyl acetate resin, polyurethane resin, epoxy resin, polyester resin, melamine resin, silicone resin, polyvinyl butyral resin, and polyamide resin, as well as copolymer resins containing two or more of repetitive units constituting the resins described above. Further, casin, gelatin, polyvinyl alcohol, ethyl cellulose, etc. can also be used. Among them, use of the polyamide resin is preferred and, particularly, use of alcohol soluble nylon resin is preferred. Preferred alcohol soluble nylon resin includes, for example, so-called copolymerized nylon formed by copolymerizing 6-nylon, 6,6-nylon, 6,10-nylon, 11-nylon and 2-nylon, as well as those resin formed by chemically modifying nylon such as N-alkoxymethyl modified nylon and N-alkoxyethyl modified nylon.

The intermediate layer 218 may also contain particles such as of metal oxide. Incorporation of the particles can control the volumic resistance value of the intermediate layer 218 and improve the effect of preventing injection of charges from the electroconductive substrate 211 to the photosensitive layer 214, and can maintain the electric characteristics of the photoreceptor under various circumstances.

The metal oxide particles include, for example, those particles of titanium oxide, aluminum oxide, aluminum hydroxide, and tin oxide.

In a case of incorporating particles such as of metal oxides in the intermediate layer 218, the ratio for the resin and the metal oxide (resin/metal oxide) is preferably from 90/10 to 1/99 and, more preferably, from 70/30 to 5/95 by weight ratio.

The intermediate layer 218 can be formed, for example, by dispersing the particles into a resin solution obtained by dissolving the resin described above into an appropriate solvent to prepare a coating solution for intermediate layer and coating the coating solution on the outer circumferential surface of the electroconductive substrate 211.

As the solvent for the resin solution, water or various kinds of organic solvents, or a mixed solvent thereof is used. particularly, a single solvent such as water, methanol, ethanol, or butanol, or mixed solvent comprising such as water and alcohol, two or more kinds of alcohols, acetone or dioxolane and alcohols, and chlorine solvent such as dichloroethane, chloroform, or trichloroethane and alcohols are used suitably.

As the method of dispersing the particles in the resin solution, a general method of using a ball mill, sand mill, attritor, vibration mill, or supersonic dispersing machine, etc. can be used.

The coating method of the coating solution for intermediate layer includes, for example, a spraying method, a bar coating method, a roll coating method, a blade method, wringing method, and a dip coating method. Particularly, since the dip coating method is relatively simple and is excellent in view of the productivity and the cost, it has been often utilized also in a case of forming the intermediate layer 218.

The film thickness of the intermediate layer 218 is, preferably, from 0.01 μm or more to 20 μm or less and, preferably, 0.05 μm or more to 10 μm or less. In a case where the film thickness of the intermediate layer 218 is less than 0.01 μm, it no more substantially functions as the intermediate layer 218 and no uniform surface property by coating the defects of the surface of the electroconductive substrate 211 can be obtained, and injection of charges from the electroconductive substrate 211 to the photosensitive layer 214 can not be prevented to lower the chargeability of the photosensitive layer 214. It is not preferred to increase the film thickness of the intermediate layer 218 to more than 20 μm since formation of the intermediate layer 18 is difficult and the photosensitive layer 214 can not be formed uniformly on the outer circumferential surface of the intermediate layer 218 to lower sensitivity of the photoreceptor in a case of forming the intermediate layer 218 by the dip coating method.

Further, various additives such as an antioxidant a sensitizer and a UV-absorber may be added optionally to each of the layers of the photosensitive layer in the fifth embodiment and the sixth embodiment described above. This can improve potential characteristics. Further, the stability of the coating solution upon forming the layer by coating is improved. Further, this can mitigate the fatigue deterioration to improve the durability upon repetitive use of the photoreceptor.

Particularly preferred antioxidant includes, for example, phenol compounds, hydroquinone compounds, tocopherol compounds and amine compounds. The antioxidant is preferably used within a range from 0.1% by weight or more and 50% by weight or less based on the charge transportation substance 213. In a case where the amount of the antioxidant to be used is less than 0.1% by weight, no sufficient effect can be obtained for the improvement of the stability of the coating solution and the durability of the photoreceptor. In a case where the amount of the antioxidant to be used exceeds 50% by weight, it gives an undesired effect on the characteristic of the photoreceptor. Accordingly, it is defined as 0.1% by weight or more and 50% by weight or less.

Further, while the photosensitive layer 214 disposed to the electrophotogrphic photoreceptor of the fifth embodiment or the sixth embodiment described above is a stacked type photosensitive layer having a stacked structure of the charge generation layer 215 containing the charge generation substance 212 and the charge transportation layer 216 containing the charge transportation substance 213 and the binder resin 217, this is not limited thereto but may also be a single-layered type photosensitive layer having a single layer containing the charge generation martial 212, the charge transportation substance 213 containing the enamine compound represented by the general formula (2) and the binder resin 217 containing the polycarbonate resin having the asymmetric diol ingredient.

As the image forming apparatus according to a seventh embodiment of the invention, an image forming apparatus 300 having the electrophotographic photoreceptor 201 (photoreceptor 201) of the fourth embodiment described above is to be exemplified. The image forming apparatus according to the invention is not restricted to the content of the following descriptions.

Figure 19:
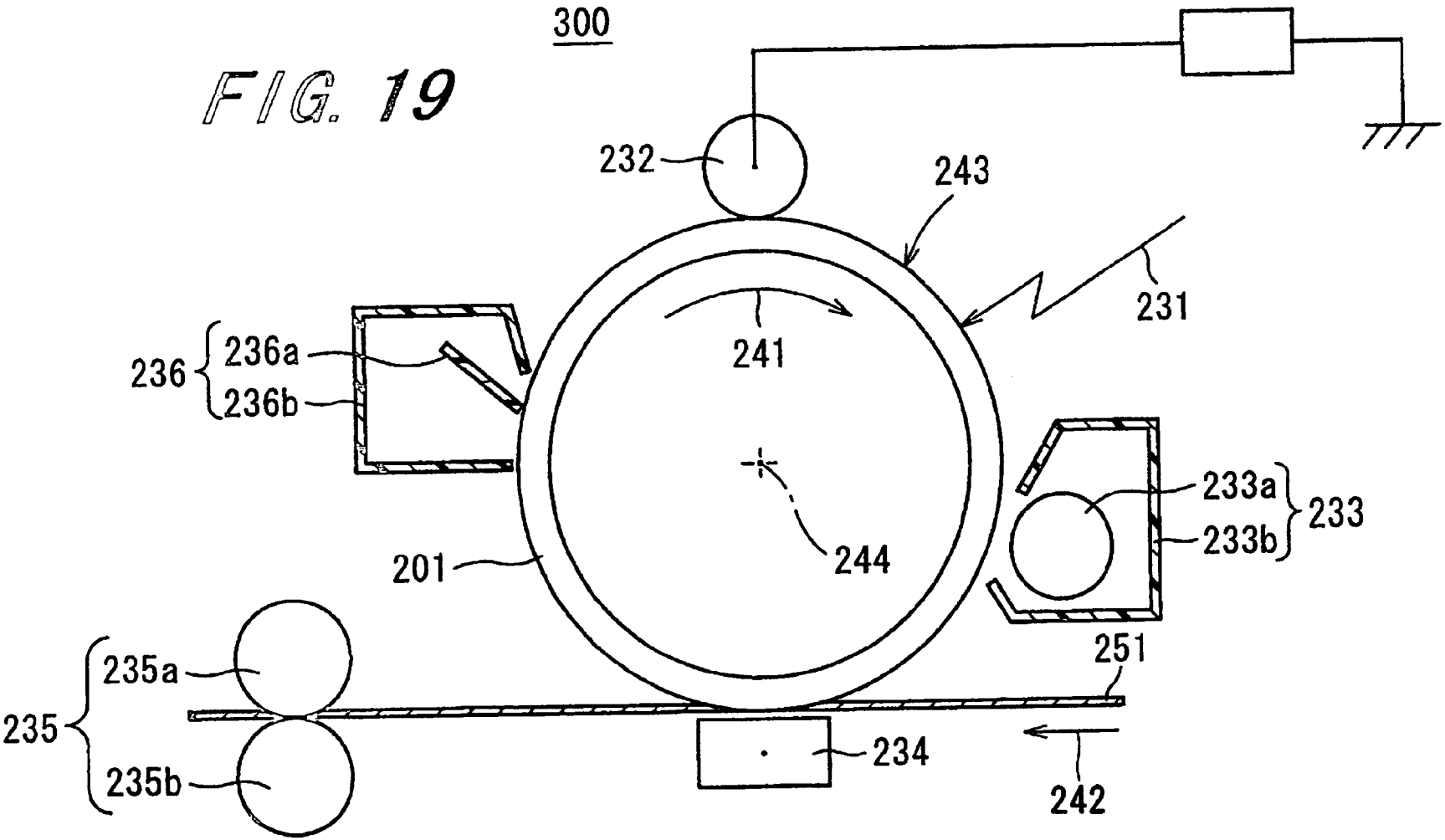
FIG. 19 is a view for side elevation arrangement schematically showing the constitution of the image forming apparatus 300.

FIG. 19 is a view for side elevation arrangement schematically showing the constitution of the image forming apparatus 300.

The image forming apparatus 300 comprises a photoreceptor 201 rotationally supported on not illustrated image forming apparatus main body, and driving means not illustrated for rotationally driving the photoreceptor 201 around a rotational axis 244 in the direction of an arrow 241. The not illustrated driving means comprises, for example, a motor as a power source and rotationally drives the photoreceptor 201 at a predetermined circumferential speed by transmitting the power from the motor by way of not illustrated gears to a substrate constituting the core of the photoreceptor 201.

At the periphery of the photoreceptor 201, are disposed a charger 232, not-illustrated exposure means, a developing device 233, a transfer charger 234 and a cleaner 236 in this order from the upstream to the downstream in the rotational direction of the photoreceptor 201 shown by the arrow 241. The cleaner 236 is disposed together with a not illustrated charge eliminator.

The charger 232 is the charging means for charging the outer circumferential surface 243 of the photoreceptor 201 to a predetermined potential. The charger 232 is a contact type charging means such as a roller charging system.

The exposure means comprise, for example, a semiconductor laser as a light source and irradiate a light 231 such as a laser beam outputted from the light source to the outer circumferential surface 243 of the photoreceptor 201 situated between the charger 232 and the developing device 233 thereby subjecting the charged outer circumferential surface 243 of the photoreceptor 201 to exposure to light in accordance with image information.

The developing device 233 is developing means for developing electrostatic latent images formed by exposure to the outer circumferential surface 243 of the photoreceptor 201 by a developer and comprise a developing roller 233*a* opposed to the photoreceptor 201 and supplying a toner to the outer circumferential surface 243 of the photoreceptor 201 and a casing 233*b* for rotationally supporting the developing roller 233*a* around a rotational axis parallel with the rotational axis 244 of the photoreceptor 201 and housing the developer containing the toner to the inner space thereof.

The transfer charger 234 is transferring means for transferring the toner images formed on the outer circumferential surface 243 of the photoreceptor 201 by applying charges at the polarity opposite to the toner on the transfer paper 251 supplied between the photoreceptor 201 and the transfer charger 234 by not illustrated transferring means in the direction of the arrow 242.

The cleaner 236 is cleaning means for removing to recover the toner remaining on the outer circumferential surface 243 of the photoreceptor 201 after the transferring operation by the transfer charger 234 and comprises a cleaning blade 236*a* for separating the toner remaining on the outer circumferential surface 243 of the photoreceptor 201 from the outer circumferential surface 243, and a recovery casing 236*b* for housing the toner peeled by the cleaning blade 236*a*.

Further, a fixing device 235 as fixing means for fixing transferred images is disposed in the direction where the transfer paper 251 is conveyed after passage between the photoreceptor 201 and the transfer charger 234. The fixing device 235 comprises a heating roller 235*a* having heating means not illustrated and a press roller 235*b* opposed to the heating roller 235*a* and pressed by the heating roller 235*a* to form a contact portion.

The image forming operation by the image forming apparatus 300 is to be described. At first, when the photoreceptor 201 is driven rotationally by the driving means in the direction of the arrow 241, the outer circumferential surface 243 of the photoreceptor 201 is uniformly charged to a predetermined positive or negative potential by the charger 232 disposed upstream to the focusing point of the light 231 from the exposure means in the rotational direction of the photoreceptor 201. Then, the light 231 is irradiated from the exposure means to the outer circumferential surface 243 of the photoreceptor 201. The light 231 from the light source is scanned repetitively in the longitudinal direction of the photoreceptor 201 which is a main scanning direction. When the photoreceptor 201 is rotated and the light 231 from the light source is repetitively scanned, exposure in accordance with image information is applied to the outer circumferential surface 243 of the photoreceptor 201. By the exposure, surface charges at the portion irradiated with the light 231 are eliminated to result a difference between the surface potential at the portion irradiated with the light 231 and the surface potential at the portion not irradiated with the light 231, to form electrostatic latent images to the outer circumferential surface 243 of the photoreceptor 201. Then, a toner is supplied to the outer circumferential surface 243 of the photoreceptor 201 formed with the electrostatic latent images from the developing roller 233*a* of the developing device 233 located downstream to the focusing point of the light 231 from the light source in the rotationally direction of the photoreceptor 201 to develop the electrostatic latent images, and toner images are formed to the outer circumferential surface 243 of the photoreceptor 201.

Further, in synchronization with exposure to the photoreceptor 201, transfer paper 251 is fed by the conveying means in the direction of the arrow 242 between the photoreceptor 201 and the transfer roller 234 located downstream to the developing device 233 in the rotational direction of the photoreceptor 201.

When the transfer paper 251 is fed between the photoreceptor 201 and the transfer charger 234, the transfer charger 234 gives charges at the polarity opposite to that of the toner to the transfer paper 251. Thus, the toner images formed on the outer circumferential surface 243 of the photoreceptor 201 are transferred onto the transfer paper 251.

The transfer paper 251 transferred with the toner images are conveyed by conveying means to the fixing device 235 and heated and pressed upon passage through the contact portion between the heating roller 235*a* and the press roller 235*b* of the fixing device 235. Thus, the toner images on the transfer paper 251 are fixed to the transfer paper 251 as firm images. The transfer paper 251 thus formed with the images are discharged by the conveying means to the outside of the imaging forming apparatus 300.

On the other hand, a toner remaining on the outer circumferential surface 243 of the photoreceptor 201 after the transferring operation by the transfer charger 234 is peeled from the outer circumferential surface 243 of the photoreceptor 201 by the cleaning blade 236*a* of the cleaner 236 located downstream to the transfer charger 234 in the rotational direction of the photoreceptor 201 and upstream to the charger 232 in the rotational direction and recovered in the recovery casing 236*b*. Electric charges on the outer circumferential surface 243 of the photoreceptor 201 removed with the toner are eliminated by a charge eliminator, and the electrostatic latent images on the outer circumferential surface 243 of the photoreceptor 201 are erased. Then, the photoreceptor 201 is further rotated and a series of operations starting from charging for the photoreceptor 1 are repeated again. As described above, images are formed continuously.

Since the photoreceptor 201 provided to the image forming apparatus 300 has the photosensitive layer 214 containing the polycarbonate resin having the asymmetric diol ingredient and the enamine compound represented by the general formula (2) as described above, it has high charge potential and charge retainability, high sensitivity and sufficient light responsivity, as well as excellent durability and characteristics thereof are not deteriorated even in a case of use under a low temperature circumstance or in a high speed electrophotographic process. Accordingly, an image forming apparatus of high reliability capable of providing high quality images over a long period of time under various circumstances can be obtained. Further, since the characteristics of the photoreceptor 201 are not deteriorated even by light exposure, deterioration of image quality due to exposure of the photoreceptor to light for example during maintenance can be prevented and reliability of the image forming apparatus can be improved.

As has been described above, while the imaging forming apparatus 300 of this embodiment has the electrophotographic photoreceptor 201 of the film embodiment but this is not limitative but it may be provided with the electrophotographic photoreceptor 202 of the sixth embodiment.

Further, while the charger 232 is contact type charging means but it is not restricted thereto and may also be non-contact type charging means such as a corona charging system.

Example 10

After adding 9 parts by weight of dendritic titanium oxide applied with a surface treatment with aluminum oxide (chemical formula: $Al_2O_3$) and zirconium dioxide (chemical formula: $ZrO_2$) (manufactured by Ishihara Sangyo Co.: TTO-D-1), and 9 parts by weight of copolymerized nylon resin (manufactured by Toray Co.: Amilan CM8000) to a mixed solvent of 41 parts by weight of 1,3-dioxolane and 41 parts by weight of methanol, they were dispersed for 8 hours by a paint shaker to prepare a coating solution for intermediate layer. The coating solution for intermediate layer was dipped in a coating tank and, after dipping a cylindrical electroconductive substrate 211 made of aluminum of 65 mm diameter and 334 mm entire length into the coating tank, and then pulling up therefrom, an intermediate layer 218 of 1.0 μm film thickness was formed on the outer circumferential surface of the electroconductive substrate 211.

Then, 2 parts by weight of oxotitanium phthalocyanine having a crystal structure showing a distinct diffraction peak at least at a Bragg angle (2θ±0.2°) of 27.2° in X-ray diffraction spectrum by Cu—Kα characteristic X-rays (wavelength: 1.54 Å) as oxotitanium phthalocyanine for the charge generation substance 212, one part by weight of a polyvinyl butyral resin (manufactured by Sekisui Chemical Industry Co.: S-leck BM-S), and 97 parts by weight of methyl ethyl ketone were mixed, and dispersed by a paint shaker to prepare a coating solution for charge generation layer. By coating the coating solution for charge generation layer on the outer circumferential surface of the previously formed intermediate layer 218 by the same dip coating method as in the intermediate layer 218, a charge generation layer 215 of 0.4 μm thickness was formed on the outer circumferential surface of the intermediate layer 218.

Then, 10 parts by weight of the enamine compound of Exemplified Compound No. 1 shown in Table 6, 10 parts by weight of the polycarbonate resin having the structural unit containing the asymmetric diol ingredient represented by the structural formula (22-3) shown in Table 40 as a binder resin 217 (viscosity average molecular weight: 40,000), one part by weight of 2,6-di-t-butyl-4-methylphenol, and 0.01 parts by weight of dimethyl polysiloxane (manufactured by Shinetsu Chemical Industry Co.: KF-96) were dissolved in 80 parts by weight of tetrahydrofuran to prepare a coating solution for charge transportation layer. After coating the coating solution for charge transportation layer by the same dip coating method as for the intermediate layer 218 formed previously onto the outer circumferential surface of the charge generation layer 215 formed previously, it was dried at 130° C. for one hour to prepare a charge transportation layer 216 of 30 μm thickness.

As described above, the electrophotographic photoreceptor of the constitution shown in FIG. 18 satisfying the conditions of the invention was prepared.

Examples 11 to 14

Four kinds of electrophotographic photoreceptors satisfying the conditions of the invention were prepared in the same manner as in Example 10 except for changing the amount of the polycarbonate resin having the structural unit containing the asymmetric diol ingredient represented by the structural formula (22-3) as the binder resin 217 for the charge transportation layer 216 to 12 parts by weight, 18 parts by weight, 30 parts by weight or 40 parts by weight. However, the amount of tetrahydrofuran in the coating solution for each charge transportation layer was controlled such that the solid concentration of the coating solution for charge transportation layer was 20% by weight.

The viscosity of the coating solution for charge transportation layer was increased extremely in Example 14 where the amount of the polycarbonate resin having the structural unit containing the asymmetric diol ingredient represented by the structural formula (22-3) was changed to 40 parts by weight.

Examples 15 to 19

Five kinds of electrophotographic photoreceptors satisfying the conditions of the invention were prepared in the same manner as in Example 10 except for using the enamine compound of Exemplified Compound No. 61 shown in Table 14 instead of Exemplified Compound No. 1 as the charge transportation substance 213 and using 10 parts by weight, 12 parts by weight, 18 parts by weight, 30 parts by weight or 40 parts by weight of the polycarbonate resin having the structural unit containing the asymmetric diol ingredient represented by the structural formula (22-5) shown in Table 40 (viscosity average molecular weight: 40,000) as the binder resin 217 of the charge transportation layer 216 instead of the polycarbonate resin having the structural unit containing the asymmetric diol ingredient represented by the structural formula (22-3). However, the amount of tetrahydrofuran in the coating solution for each charge transportation layer was controlled such that the solid concentration of the coating solution for charge transportation layer was 20% by weight.

The viscosity of the coating solution for charge transportation layer was increased extremely in Example 19 where the amount of the polycarbonate resin having the structural unit containing the asymmetric diol ingredient represented by the structural formula (22-5) was changed to 40 parts by weight.

Example 20

An electrophotographic photoreceptor satisfying the conditions of the invention was prepared in the same manner as in Example 10 except for using, instead of the polycarbonate resin having the structural unit containing the asymmetric diol ingredient represented by the structural formula (22-3), 18 parts by weight of a copolymerized polycarbonate resin having the structural unit containing the asymmetric diol ingredient represented by the structural formula (22-3) and the structural unit containing the siloxane structure represented by the following structural formula (24) (viscosity average molecular weight: 40,000) as the binder resin 217 of the charge transportation layer 216. However, the amount of tetrahydrofuran in the coating solution for charge transportation layer was controlled such that the solid concentration in the coating solution for charge transportation layer was 20% by weight.

(24)

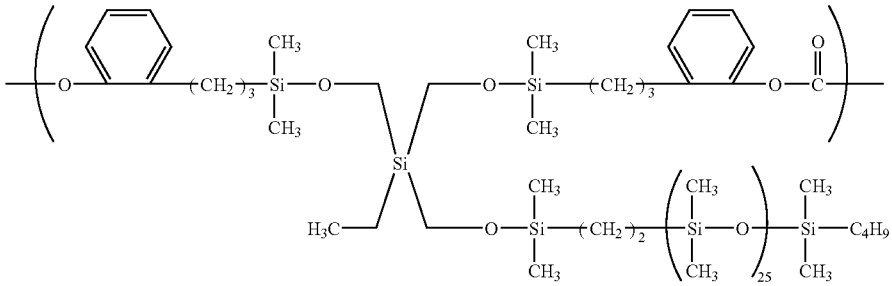

Comparative Examples 5 to 9

Five kinds of electrophotographic photoreceptors not satisfying the conditions of the invention were manufactured in the same manner as in Example 10 except for using, instead of a polycarbonate resin having the structural unit containing the asymmetrical diol ingredient represented by structural formula (22-3), 10 parts by weight, 12 parts by weight, 18 parts by weight, 30 parts by weight, or 40 parts by weight of bisphenol A polycarbonate resin having the structural unit containing the diol ingredient derived from bisphenol A represented by the following structural formula (A-1) (viscosity average molecular weight: 40,000) as the binder resin 217 of a charge transportation layer 216.

However, in Comparative Example 8 in which the amount of the bisphenol A polycarbonate resin was 30 parts by weight and in Comparative Example 9 in which it was 40 part by weight, a portion of the bisphenol A polycarbonate resin was not dissolved and the coating solution for charge transportation layer was gelled upon preparation of the coating solution for charge transportation layer, and the photoreceptor could not be prepared.

Further, in Comparative Example 5 where the amount of the bisphenol A polycarbonate resin was set to 10 parts by weight and in Comparative Example 6 where it was set to 12 parts by weight and in Comparative Example 7 where it was set to 18 parts by weight, although the photoreceptors could be prepared, the coating solution for charge transportation layer to be used was gelled in several days after the preparation.

(A-1)

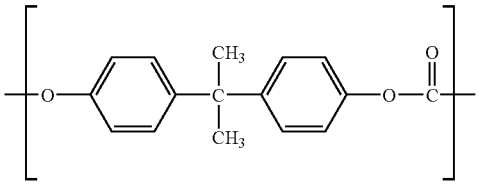

Comparative Example 10

An electrophotographic photoreceptor not satisfying the conditions of the invention was manufactured in the same manner as in Example 10 except for using the Comparative Compound A represented by the following structural formula (25) instead of the Exemplified Compound 1 as the charge transportation substance 213, and changing the amount of the polycarbonate resin having the structural unit containing the asymmetric diol ingredient represented by the structural formula (22-3) as the binder resin 217 of the charge transportation layer 216 to 18 parts by weight. However, the amount of the tetrahydrofuran in the coating solution for charge transportation layer was controlled such that the solid concentration in the coating solution for charge transportation layer was 20% by weight.

(25)

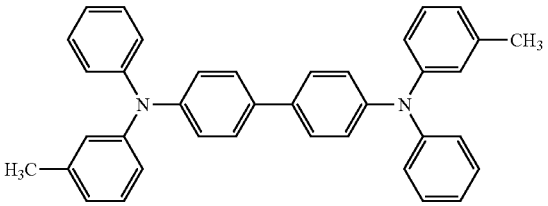

Comparative Example 11

An electrophotographic photoreceptor not satisfying the conditions of the invention was manufactured in the same manner as in Example 10 except for using the Comparative Compound B represented by the following structural formula (26) instead of the Exemplified Compound 1 as the charge transportation substance 213, and changing the amount of the polycarbonate resin having the structural unit containing the asymmetric diol ingredient represented by the structural formula (22-3) as the binder resin 217 of the charge transportation layer 216 to 18 parts by weight. However, the amount of the tetrahydrofuran in the coating solution for charge transportation layer was controlled such that the solid concentration in the coating solution for charge transportation layer was 20% by weight.

(26)

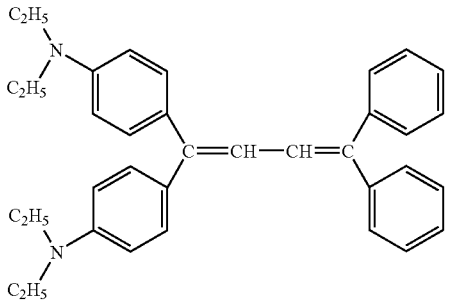

Comparative Example 12

An electrophotographic photoreceptor not satisfying the conditions of the invention was manufactured in the same manner as in Example 10 except for using the enamine compound represented by the structural formula (27) (hereinafter referred to as "Comparative Compound C") instead of the Exemplified Compound 1 as the charge transportation substance 213, and changing the amount of the polycarbonate resin having the structural unit containing the asymmetric diol ingredient represented by the structural formula (22-3) as the binder resin 217 of the charge transportation layer 216 to 18 parts by weight. However, the amount of the tetrahydrofuran in the coating solution for charge transportation layer was controlled such that the solid concentration in the coating solution for charge transportation layer was 20% by weight.

(27)

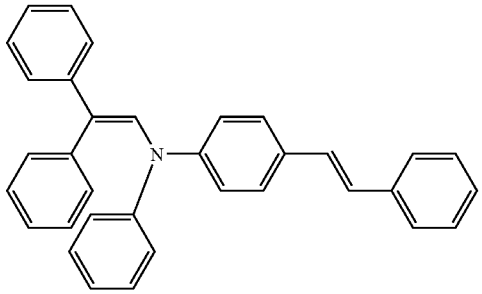

Evaluation 1

Printing resistance and stability of electric characteristics were evaluated for each of the electrophotographic photoreceptors prepared in Examples 10 to 20 and Comparative Examples 5 to 7, and 10 to 12 described above. Evaluation was conducted as described below.

(Printing Resistance)

Each of the electrophotographic photoreceptors prepared in Examples 10 to 20 and Comparative Examples 5 to 7, and 10 to 12 was mounted to a digital copying machine (manufactured by Sharp Corp: AR-S507) set at a copying speed of 50 sheets of Japanese Industrial Standards (JIS) A4 size paper per min, respectively. After conducting image formation for 300,000 sheets, the film thickness d1 of the photosensitive layer was measured, and a difference between the value and the film thickness d0 of the photosensitive layer after preparation was determined as a film reduction amount Δd (=d0−d1), which was used as the evaluation index for a printing resistance. It was evaluated as excellent (⊙) in a case where the film reduction amount Δd was 10 μm or less, evaluated as good (○) in a case where the film reduction amount Δd was more than 10 μm and 16 μm or less, evaluated as ordinary (Δ) in a case where the film reduction amount Δd was more than 16 μm and 20 μm or less, and evaluated as poor (x) in a case where the film reduction amount Δd was more than 20 μm. In a copying machine mounting the photoreceptor of Comparative Example 5, since the film reduction of the photosensitive layer was excessively large and image formation can not be conducted up the specified number of sheets (300,000), it was evaluated as poor (x).

(Stability of Electric Characteristics)

Each of electrophotographic photoreceptors prepared in Examples 10 to 20 and Comparative Examples 5 to 7, and 10 to 12 was mounted respectively to a digital copying machine (manufactured by Sharp Corp.: AR-S508) in which a surface potential meter (manufactured by Treck: Model 347) was disposed to the inside such that the surface potential of the photoreceptor in the image forming process could be measured, and the surface of the photoreceptor was charged by applying a voltage at negative (−) 6 kV to the photoreceptor under a normal temperature/normal humidity circumstance (hereinafter referred to as "N/N circumstance") at a temperature of 22° C. and at a relative humidity of 65% (22° C./65% RH), and the surface potential of the photoreceptor just after charging was measured as a charge potential $V_0$ (V). Then, exposure was applied by using a laser light to the charged surface of the photoreceptor, and the surface potential of the photoreceptor just after-exposure was measured as the after-exposure potential $V_L$(V).

Further, the after-exposure potential $V_L$ as the surface potential of the photoreceptor just after being subjected to exposure to a laser light was measured under a low temperature/low humidity circumstance (hereinafter referred as "L/L circumstance") at a temperature of 5° C. and at a relative humidity of 20% (5° C./20% RH) in the same manner as that under the N/N circumstance.

The difference between the absolute value for $V_L(1)$ and the absolute value $V_L(2)$ assuming the after-exposure potential $V_L$ measured under the N/N circumstance as $V_L(1)$ and the after-exposure potential $V_L$ measured under L/L circumstance as $V_L(2)$ was determined as a potential fluctuation $\Delta V_L$ ($=|V_L(2)|-|V_L(1)|$), which was used as the index for the evaluation of the stability for the electric characteristics. The potential fluctuation $\Delta V_L$ shows that as the value is larger, the difference between the after-exposure potential $V_L(2)$ under the L/L circumstance and the difference potential is larger compared with the potential difference between the after-exposure potential $V_L(1)$ under the N/N circumstance and the reference potential, that is, the light responsivity under the L/L circumstance is lowered compared with that under the N/N circumstance. Accordingly, it was evaluated as good (○) in a case where the value for the potential fluctuation $\Delta V_L$ was lower than 110 V, as ordinary (Δ) in a case where the value for the potential fluctuation $\Delta V_L$ was 110 V or higher and lower than 130 V, and as poor (x) in a case where the value for the potential fluctuation $\Delta V_L$ was 130 V or higher.

Evaluation 2

The state of coating solutions for charge transportation layer used respectively in Examples 10 to 20 and Comparative Examples 5 to 12 was evaluated and used as the evaluation index for the aging stability of the coating solution for charge transportation layer. It was evaluated as good (○) in a case where the coating solution for charge transportation layer had a viscosity suitable to dip coating and was not gelled even lapse of several days from preparation, evaluated as ordinary (Δ) in a case where the coating solution for charge transportation layer had a high viscosity but was not gelled, and evaluated as poor (x) in a case where the coating solution for charge transportation layer was gelled.

Table 44 shows the result of evaluations. In Table 44, the polycarbonate resins used for the binder resin 217 are shown by the numbers of structural formulae showing the structural units thereof.

TABLE 44

| Photo-receptor | Charge transportation layer: Charge transportation substance (A) | Charge transportation layer: Binder resin (B) | Charge transportation layer: A/B | Printing resistance: Film reduction amount Δ d(μm) | Printing resistance: Evaluation | Stability for electric characteristics: N/N electric characteristic $V_0$(V) | Stability for electric characteristics: N/N electric characteristic $V_L$ (V) | Stability for electric characteristics: L/L potential flu $\Delta V_L$(V) | Stability for electric characteristics: Evaluation | Aging stability: State of coating solution | Aging stability: Evaluation | Remarks |
|---|---|---|---|---|---|---|---|---|---|---|---|---|
| Example 10 | Exemplified Compound 1 | Structural formula (22-3) | 10/10 | 20 | Δ | −628 | −20 | 70 | ○ | | ○ | |
| Example 11 | Exemplified Compound 1 | Structural formula (22-3) | 10/12 | 16 | ○ | −624 | −23 | 80 | ○ | | ○ | |
| Example 12 | Exemplified Compound 1 | Structural formula (22-3) | 10/18 | 14 | ○ | −629 | −30 | 90 | ○ | | ○ | |
| Example 13 | Exemplified Compound 1 | Structural formula (22-3) | 10/30 | 10 | ⊙ | −618 | −40 | 100 | ○ | | ○ | |
| Example 14 | Exemplified Compound 1 | Structural formula (22-3) | 10/40 | 8 | ⊙ | −624 | −50 | 120 | Δ | high viscosity | Δ | |
| Example 15 | Exemplified Compound 61 | Structural formula (22-5) | 10/10 | 18 | Δ | −624 | −15 | 60 | ○ | | ○ | |
| Example 16 | Exemplified Compound 61 | Structural formula (22-5) | 10/12 | 14 | ○ | −626 | −17 | 68 | ○ | | ○ | |
| Example 17 | Exemplified Compound 61 | Structural formula (22-5) | 10/18 | 12 | ○ | −619 | −23 | 79 | ○ | | ○ | |
| Example 18 | Exemplified Compound 61 | Structural formula (22-5) | 10/30 | 9 | ⊙ | −624 | −28 | 90 | ○ | | ○ | |
| Example 19 | Exemplified Compound 61 | Structural formula (22-5) | 10/40 | 6 | ⊙ | −617 | −35 | 113 | Δ | high viscosity | Δ | |
| Example 20 | Exemplified Compound 61 | Structural formula (22-3) + Structural formula (24) | 10/18 | 13 | ○ | −618 | −25 | 88 | ○ | | ○ | |
| Comp. Ex. 5 | Exemplified Compound 1 | Structural formula (A) | 10/10 | — | X | −621 | −21 | 75 | ○ | gelled in several days | X | |
| Comp. Ex. 6 | Exemplified Compound 1 | Structural formula (A) | 10/12 | 20 | Δ | −629 | −25 | 88 | ○ | gelled in several days | X | |
| Comp. Ex. 7 | Exemplified Compound 1 | Structural formula (A) | 10/18 | 17 | Δ | −625 | −33 | 97 | ○ | gelled in several days | X | |
| Comp. Ex. 8 | Exemplified Compound 1 | Structural formula (A) | 10/30 | — | — | — | — | — | — | partially not dissolved but gelled | X | Photo-receptor could not be prepared |
| Comp. Ex. 9 | Exemplified Compound 1 | Structural formula (A) | 10/40 | — | — | — | — | — | — | partially not dissolved but gelled | X | Photo-receptor could not be prepared |
| Comp. Ex. 10 | Comp. compound A | Structural formula (22-3) | 10/18 | 14 | ○ | −620 | −80 | 140 | X | | ○ | |
| Comp. Ex. 11 | Comp. compound B | Structural formula (22-3) | 10/18 | 15 | ○ | −619 | −100 | 150 | X | | ○ | |
| Comp. Ex. 12 | Comp. compound C | Structural formula (22-3) | 10/18 | 14 | ○ | −623 | −95 | 138 | X | | ○ | |

From the comparison between Examples 10 to 20 and Comparative Examples 5 to 9, it was found that, in a case of using tetrahydrofuran as an non-halogen type organic solvent for the solvent, while the coating solution for charge transportation layer gelled in Comparative Examples 5 to 9 using a bisphenol A polycarbonate resin as the binder resin 217 for the charge transportation layer 216, the coating solution for charge transportation layer was not gelled but stable in Examples 10 to 20 using the polycarbonate resin having the asymmetric diol ingredient.

Further, from the comparison between Examples 11 and 16 and Comparative Example 6 and the comparison between Examples 12 and 17 and Comparative Example 7, it was found that the photoreceptors of Examples 11, 12, 16, and 17 using the polycarbonate resin having the asymmetric diol ingredient as the binder resin 17 for the charge transportation layer 216 showed less film reduction amount Δd of the photosensitive layer and were excellent in the printing resistance compared with the photoreceptors of Comparative Examples 6, and 7 using the bisphenol A polycarbonate resin.

Further, from the comparison between Examples 12, 17, and 20 and Comparative Examples 10 to 12, the photoreceptors of Examples 12, 17, and 20 using the enamine compound represented by the general formula (2) for the charge transportation substance 213, different from the photoreceptor of Comparative Example 10 using the Comparative Compound A, the photoreceptor of Comparative Example 11 using the Comparative Compound B, and the light sensitive of Comparative Example 12 using the Comparative Compound C, showed smaller potential difference between the after-exposure potential $V_L$ under the N/N circumstance and reference potential and had excellent light responsivity even in a case where the ratio A/B for the charge transportation substance 213 (A) and binder resin 217 (B) in the charge transportation layer 216 was defined as 10/18 by weight ratio and the binder resin 217 was added at a high ratio. Further, it was found that the value of the potential fluctuation $\Delta V_L$ was small and it had a sufficient light responsivity also under the L/L circumstance.

Further, from the comparison between Example 10 and Examples 11 to 14 and comparison between Example 15 and Examples 16 to 19, it was found that the photoreceptors of Examples 10 and 15 in which the ratio A/B was 10/10 by weight ratio that exceeds 10/12, and the ratio of the binder resin was lowered had larger film reduction amount Δd and were poor in the printing resistance compared with the photoreceptors of Examples 11 to 14 and Examples 16 to 19 with the ratio A/B being 10/12 or less.

Further, from the comparison between Examples 10 to 13 and Example 14, and comparison between Examples 15 to 18 and Example 19, it was found that the photoreceptors of Examples 14 and 19 in which the ratio A/B was 10/40 was below 10/30 and the ratio of the binder resin was higher showed smaller film reduction amount Δd and were excellent in the printing resistance compared with the photoreceptors of Examples 10 to 13 and Examples 15 to 18 in which the ratio A/B was 10/30 or more, but they showed larger value for potential fluctuation $\Delta V_L$ and were poor in the light responsivity under the L/L circumstance. Further, since the viscosity of the coating solution for charge transportation layer was extremely high in Examples 14 and 19, the productivity was low and the uniformness of the formed charge transportation layer 216 was worsened, and a number of image failure due to local unevenness of the film thickness was formed in the images formed by the copying machine mounting the photoreceptors described above.

Further, from the comparison between Example 20 and Example 12, it was found that the photoreceptor of Example 20 using the polycarbonate resin having the asymmetrical diol ingredient and the siloxane structure in the binder resin 217 of the charge transportation layer 216 had smaller film reduction amount Δd and was excellent in the printing resistance compared with the photoreceptor of the Example 12 using the polycarbonate resin not having the siloxane structure. Further, the surface of the photoreceptor of Example 20 suffered from less injuries even after formation of images by 300,000 sheets and image defects due to cleaning failure were not observed in the images formed by the copying machine mounting the photoreceptor of Example 20.

As described above, by incorporating the enamine compound represented by the general formula (2), and the polycarbonate resin having the asymmetric diol ingredient in combination to the photosensitive layer as described above, it is possible to obtain an electrophotographic photoreceptor having high charge potential, high sensitivity and sufficient light responsivity, as well as excellent in durability, with no deterioration for the characteristics thereof even in a case of use under the low temperature circumstance, and having high reliability and preferred productivity. Further, the printing resistance of the photosensitive layer could be improved without lowering the light responsivity by defining the ratio A/B for the charge transportation substance (A) and the binder resin (B) as 10/12 to 10/30 by weight ratio.

Figure 20:
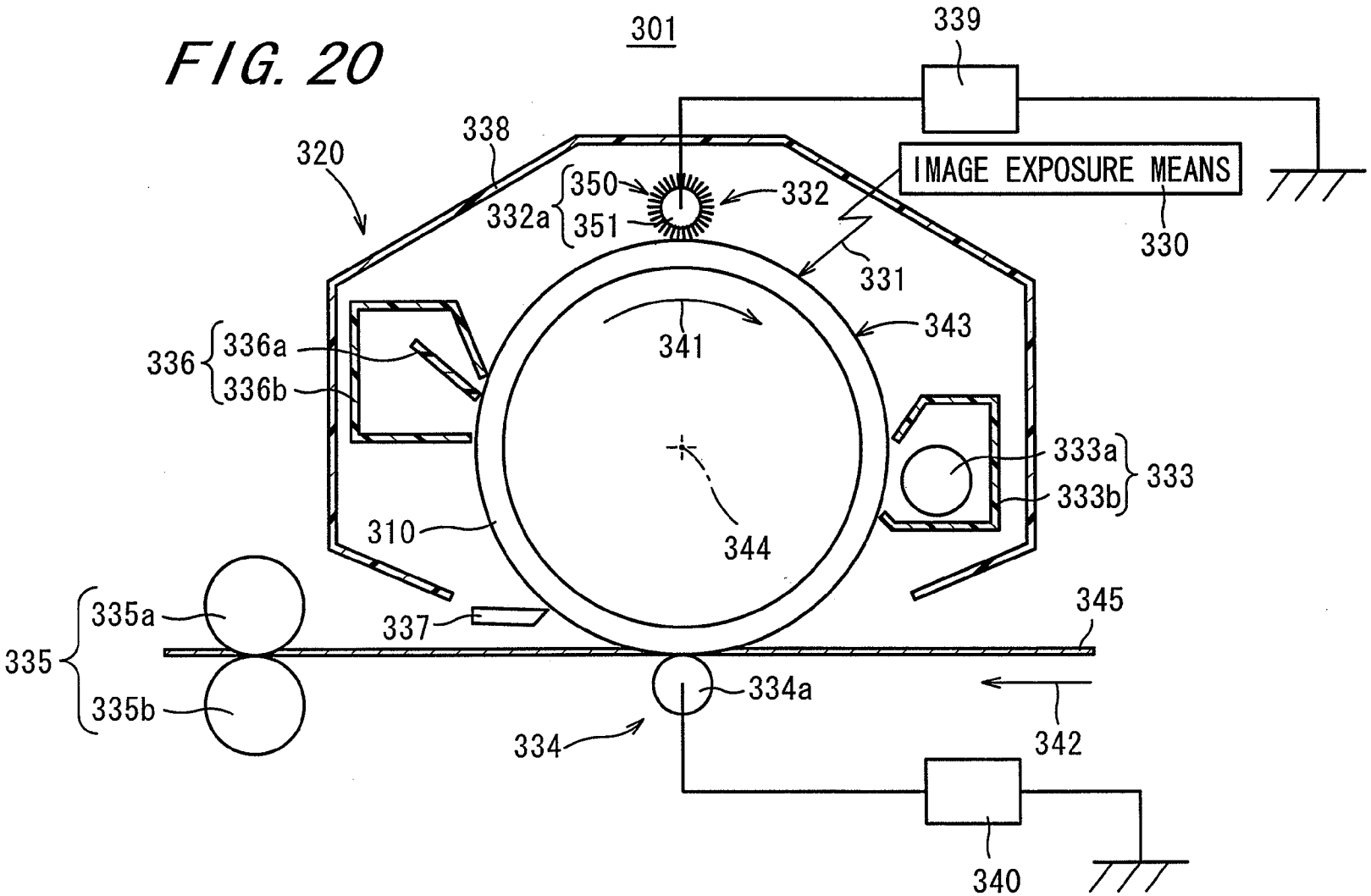
FIG. 20 is a side elevational view for the arrangement schematically showing the constitution of an image forming apparatus 301 accordig to an eighth embodiment of the invention.

FIG. 20 is a side elevational view for the arrangement schematically showing the constitution of an image forming apparatus 301 according to an eighth embodiment of the invention and FIG. 21 is a view schematically showing the constitution of an electrophotographic photoreceptor 310 provided to the image forming apparatus 301 shown in FIG. 20. At first, an electrophotographic photoreceptor 310 (hereinafter also referred to simply as "photoreceptor") as a characteristic member for the image forming apparatus 301 of the invention is to be described with reference to FIG. 21.

Figure 21A:
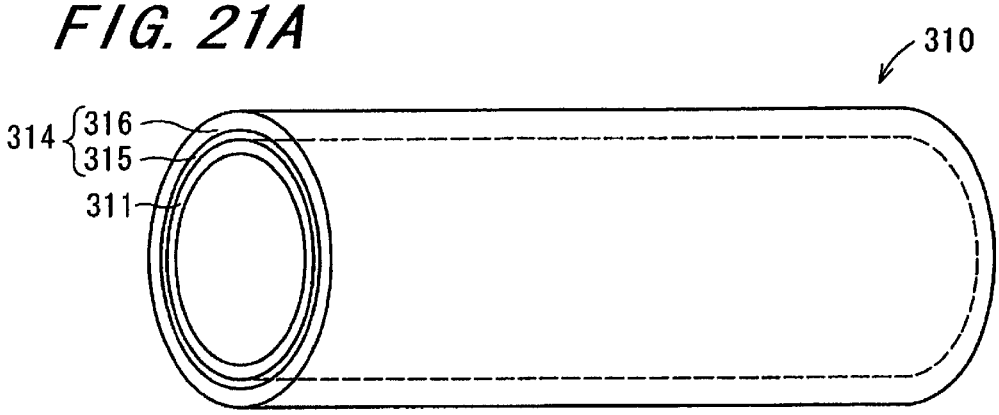
FIG. 21A is a perspective view schematically showing the constitution of a photoreceptor 310.
Figure 21B:
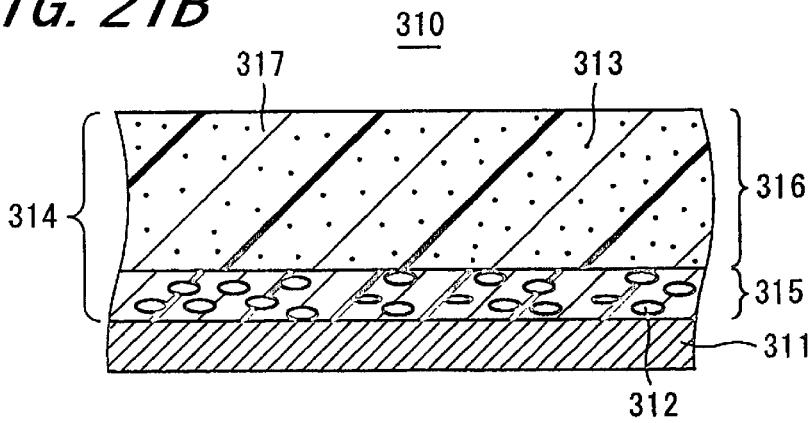
FIG. 21B is a fragmentary cross sectional view schematically showing the constitution of the photoreceptor 310.

FIG. 21A is a perspective view schematically showing the constitution of a photoreceptor 310. FIG. 21B is a fragmentary cross sectional view schematically showing the constitution of the photoreceptor 310. The photoreceptor 310 comprises a cylindrical electroconductive substrate 311 formed of an electroconductive material and a photosensitive layer 314 disposed on the outer circumferential surface of the electroconductive substrate 311. The photosensitive layer 314 has a stacked structure in which a charge generation layer 315 containing a charge generation substance 312 that generates charges by absorption of light and a charge transportation layer 316 containing a charge transportation substance 313 having an ability of accepting and transferring charges generated in the charge generation substance 312 and a binder resin 317 for binding the charge transportation substance 313 are stacked in this order on the outer circumferential surface of the electroconductive substrate 311. That is, the photoreceptor 310 is a stacked type photoreceptor.

The photosensitive layer 314 contains the enamine compound represented by the general formula (2) as the charge transportation substance 313:

[Ka 42]

(2)

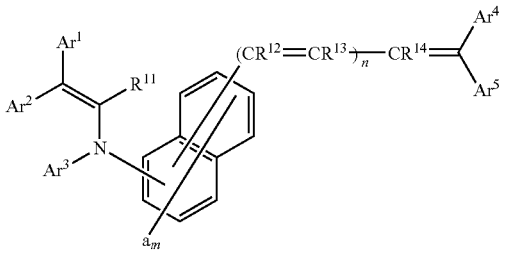

Since the enamine compound represented by the general formula (2) contained in the photosensitive layer 314 as the charge transportation substance 313 has a high charge mobility, it is possible to obtain a photoreceptor 310 having high chargeability, sensitivity, and responsivity, with no deterioration of the electric characteristics even in a case of repetitive use.

Further, since the enamine compound represented by the general formula (2) is excellent in the compatibility with the binder resin 317 and the solubility to a solvent, it is dispersed uniformly with no agglomeration in the binder resin 317, and dissolved uniformly with no agglomeration in the coating solution upon forming the charge transportation layer 316 by coating as will be described later. Accordingly, the photoreceptor 310 has a uniform charge transportation layer 316 with scarce defects such as a portion where the charge transportation substance 313 is agglomerated.

That is, by the use of the enamine compound represented by the general formula (2) as the charge transportation substance 313, as described above, it is possible to obtain a photoreceptor 310 having high chargeability, sensitivity, and responsivity, with no deterioration of the electric characteristics even in a case of repetitive use and with scarce defects in the charge transportation layer 316. Further, it is possible to improve the stability of the coating solution upon forming the charge transportation layer 316 by coating to improve the production efficiency of the photoreceptor 310.

As the charge transportation substance 313, the enamine compound represented by the general formula (3) is used suitably among the enamine compounds represented by the general formula (2):

(3)

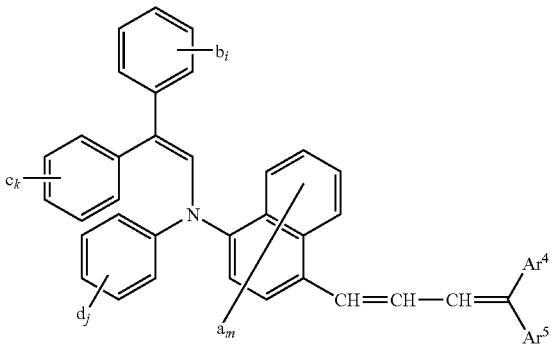

Since the enamine compound represented by the general formula (3) has a particularly high charge mobility among the enamine compounds represented by the general formula (2), an photoreceptor 310 having further higher sensitivity and responsivity can be obtained by using the enamine compound represented by the general formula (3) as the charge transportation substance 313. Accordingly, it is possible to obtain an image forming apparatus 301 of high reliability capable of providing images at high quality also in a case of forming images at a high speed.

Further, since the enamine compound represented by the general formula (3) can be synthesized relatively easily at a high yield and produced at a reduced cost among the enamine compounds represented by the general formula (2), the photoreceptor 310 having the excellent characteristics as described above can be produced at a reduced manufacturing cost. Accordingly, the manufacturing cost for the image forming apparatus 301 can be decreased.

Further, among the enamine compounds represented by the general formula (2), a particularly excellent compound with a view point of the characteristics, cost and productivity includes, in the same manner as described above, those in which both of $Ar^1$ and $Ar^2$ are phenyl group, $Ar^3$ is a phenyl group, tolyl group, p-methoxyphenyl group, biphenylyl group, naphthyl group or thienyl group, at least one of $Ar^4$ and $Ar^5$ is a phenyl group, p-tolyl group, p-methoxyphenyl group, naphthyl group, thienyl group, or thiazolyl group, and each of $R^{11}$, $R^{12}$, $R^{13}$, and $R^{14}$ is a hydrogen atom, and n is 1.

The enamine compound represented by the general formula (2) can be produced in the same manner as described above.

As the enamine compound represented by the general formula (2), those, for example, selected from the group consisting of the exemplified compounds shown in Table 6 to Table 37 described above are used each alone or as a mixture of two or more of them.

The enamine compound represented by the general formula (2) may be used also in admixture with the same other charge transportation substance as described previously for the charge transportation substance 313. Further, polymers having the groups derived from the compounds in the main chain or the side chain, for example, poly-(N-vinylcarbazole), poly-(1-vinylpyrene), and poly-(9-vinylanthracene) can also be mentioned.

In a case of using the enamine compound represented by the general formula (2) in admixture with other charge transportation substance as described above, since the charge transportation substance 313 may sometimes cause agglomeration to form a number of defects in the charge transportation layer 316 in a case where the ratio of other charge transportation substance is excessive, it is preferred to use a mixture in which the enamine compound represented by the general formula (2) is contained as a main ingredient as the charge transportation substance 313.

The charge transportation layer 316 is formed in a manner where the charge transportation substance 313 containing the enamine compound represented by the general formula (2) is bonded to the binder resin 317. Specific examples of the resin used for the binder resin 317 include, for example, vinyl polymer resins such as a polymethyl methacrylate resin, polystyrene resin, and polyvinyl chloride resin, copolymer resins containing two or more of repetitive units constituting them, polyarylate resin, polycarbonate resin, polyester resin, polyester carbonate resin, polysulfone resin, phenoxy resin, epoxy resin, silicone resin, polyamide resin, polyether resin, polyurethane resin, polyacrylamide resin, and phenol resin. Further, they also include thermosetting resins formed by partially crosslinking the resins described above. The resins may be used each alone or may be used as a mixture of two or more of them.

In the charge transportation layer 316, the ratio A/B for the weight A of the enamine compound represented by the general formula (2) contained as the charge transportation substance 313 and the weight B for the binder resin 317 is preferably from 10/12 to 10/30. By defining the ratio A/B to 10/12 to 10/30 and incorporating the binder resin 317 at a high ratio in the charge transportation layer 316, a photoreceptor 310 providing a tough photosensitive layer 314 and excellent durability can be obtained.

On the other hand, in a case where the ratio of the binder resin 317 is increased with the ratio A/B being 10/12 or less, the ratio of the enamine compound represented by the general formula (2) as the charge transportation substance 313 is lowered as a result. In a case of using the known charge transportation substance for the charge transportation substance 313 and defining the ratio between the weight of the charge transportation substance 313 and the weight of the binder resin 317 (charge transportation substance 313/binder resin 317) to 10/12 or less, the sensitivity and the responsivity become insufficient to sometimes cause image defects. However, since the enamine compound represented by the general formula (2) has a high charge mobility, even when the ratio of the enamine compound represented by the general formula (2) is lowered with the A/B being 10/12 or less, the photoreceptor 310 has sufficiently high sensitivity and responsivity and images at high quality can be provided.

Accordingly, by defining the ratio A/B as from 10/12 to 10/30, it is possible to attain a photoreceptor 310 having high sensitivity and responsivity and excellent in the durability and to obtain an image forming apparatus 301 capable of providing images at high quality for a longer period of time.

In a case where the ratio A/B exceeds 10/12 and the ratio of the binder resin 317 is excessively low, the wear amount of the photosensitive layer 314 increases to lower the chargeability. Accordingly, the upper limit for the ratio A/B is defined as 10/12 or less. Further, in a case where the A/B is less than 10/30 and the ratio of the binder resin 317 increases excessively high, the sensitivity of the photoreceptor 310 is lowered. Further, in a case of forming the charge transportation layer 316 by a dip coating method to be described later, since the viscosity of the coating solution increases to lower the coating speed, the productivity is worsened remarkably. Further, in a case of increasing the amount of the solvent in the coating solution in order to suppress increase of the viscosity of the coating solution, a brushing phenomenon occurs to cause clouding in the formed charge transportation layer 316. Accordingly, the lower limit for the ratio A/B is defined as 10/30 or more.

An additive such as a plasticizer or a leveling agent may also be added to the charge transportation layer 316 optionally in order to improve the film forming property, flexibility or surface smoothness. The plasticizer include, for example, a dibasic acid ester such as phthalate ester, fatty acid ester, phosphorate ester, chlorinated paraffin, and epoxy plasticizer. The leveling agent include, for example, silicone type leveling agent.

Fine particles of an inorganic compound or an organic compound may be added to the charge transportation layers 316 in order to increase the mechanical strength or improve the electric characteristics.

Further, various additives such as an antioxidant or a sensitizer may be added optionally to the charge transportation layer 316. This can improve potential characteristics. Further, the stability of the coating solution upon forming the charge transportation layer 316 by coating can be improved. Further, this can mitigate the fatigue deterioration to improve the durability upon repetitive use of the photoreceptor.

As the antioxidant, hindered phenol derivatives or hindered amine derivatives are used preferably. The hindered phenol derivatives are preferably used within a range of 0.1% by weight or more and 50% by weight or less relative to the charge transportation substance 313. Also, the hindered amine derivatives are used preferably within a range from 0.1% by weight or more and 50% by weight or less relative to the charge transportation substance 313. The hindered phenol derivative and the hindered amine derivative may be used in admixture. In this case, the total amount of the hindered phenol derivative and the hindered amine derivative to be used is preferably within a range from 0.1% by weight or more and 50% by weight or less relative to the charge transportation substance 313. In a case where the amount of the hindered phenol derivative to be used, the amount of the hindered amine derivative to be used, or the total amount of the hindered phenol derivative and the hindered amine derivative to be used is less than 0.1% by weight, no sufficient effect can be obtained for the improvement of the stability of the coating solution and the improvement of the durability of the photoreceptor. Further, if the amount exceeds 50% by weight, this gives an undesired effect on the characteristics of the photoreceptor. Accordingly, it is defined as 0.1% by weight or more and 50% by weight or less.

The charge transportation layer 316 is formed, for example, by dissolving or dispersing, in an appropriate solvent, the charge transportation substance 313 containing the enamine compound represented by the general formula (2) described above and the binder resin 317 to prepare a coating solution for a charge transportation layer, and coating the obtained coating solution on the outer circumferential surface of the charge generation layer 315.

As the solvent for the coating solution for charge transportation layer, those selected, for example, from the group consisting of aromatic hydrocarbons such as benzene, toluene, xylene, and monochlorobenzene, halogenated hydrocarbons such as dichloromethane and dichloroethane, ether such as THF, dioxane, and dimethoxymethyl ether, as well as non-protonic polar solvents such a N,N-dimethylformamide are used each alone or in admixture of two or more of them. These solvents are used each alone or two or more of them in combination. Further, if necessary, a solvent such as alcohols, acetonitriles, or methyl ethyl ketone may further be added to the solvent described above and used.

The coating method for the coating solution for charge transportation layer includes, for example, a spraying method, bar coating method, roll coating method, blade method, wringing method or dip coating method. Among the coating methods described above, an optimal method can be selected while taking the physical properties of the coating and the productivity into consideration. Among the coating methods described above, since the dip coating method is a method of dipping a substrate into a coating bath filled with the coating solution and then pulling up the substrate at a constant speed or at a gradually changing speed to form a layer on the surface of the substrate and, since the method is relatively simple and excellent in view of the productivity and the cost, it has been often utilized in a case of producing an electrophotographic photoreceptor and also often utilized in a case of forming the charge transportation layer 316.

The film thickness of the charge transportation layer 316 is preferably, 5 μm or more and 50 μm or less and, more preferably, 10 μm or more and 40 μm or less. In a case where the film thickness of the charge transportation layer 316 is less than 5 μm, the charge retainability on the surface of the photoreceptor is lowered. In a case where the film thickness of the charge transportation layer 316 exceeds 50 μm, resolution of the photoreceptor is lowered. Accordingly, it is defined as 5 μm or more and 50 μm or less.

The charge generation layer 315 contains the charge generation substance 312 as a main ingredient. The material effective as the charge generation substance 312 includes azo pigments such as a monoazo pigment, bisazo pigment, and trisazo pigment, indigo pigments such as indigo and thioindigo, perylene pigments such as peryleneimide and perylenic acid anhydride, polynuclear quinone pigments such as anthraquinone and pyrenequinone, phthalocyanine pigments such as metal phthalocyanine and non-metal phthalocyanine, squarylium dyes, pyrylium salts and thiopyrylium salts, triphenylmethane dyes, and inorganic materials such as selenium and amorphous silicon. The charge generation substances are used each alone or two or more of them in combination.

Among the charge generation substances described above, use of oxotitanium phthalocyanine is preferred. Since oxotitanium phthalocyanine is a charge generation substance having high charge generating efficiency and charge injecting efficiency, it generates a great amount of charges by absorption of light and efficiently injects the generated charges, without accumulating them in the inside thereof, into the charge transportation substance 313. Further, for the charge transportation substance 313, since the enamine compound of high charge mobility represented by the general formula (2) is used, the charges generated from oxotitanium phthalocyanine as the charge generation substance 312 by light absorption are efficiently injected into the enamine compound represented by the general formula (2) as the charge transportation substance 313 and transported smoothly to the surface of the photosensitive layer 314. Accordingly, by using oxotitanium phthalocyanine as the charge generation substance 312 a photoreceptor 310 of high sensitivity and high resolution can be obtained.

The charge generation substance 312 may be used in combination with sensitizing dyes, for example, triphenylmethane dyes typically represented by methyl violet, crystal violet, night blue, and Victoria blue, acrydine dyes typically represented by erythrosin, rhodamine B, rhodamine 3R, acrydine orange, and flaveosin, thiazine dyes typically represented by methylene blue andmethylene green, oxazine dyes typically represented by capri blue and merdora blue, cyanine dyes, stylyl dyes, pyrylium salt dyes, or thiopyrylium salt dyes.

The method of forming the charge generation layer 315 includes a method of vapor depositing under vacuum the charge generation substance 312 on the outer circumferential surface of the electroconductive substrate 311, or a method of coating a coating solution for charge generation layer obtained by dispersing the charge generation substance 312 in an appropriate solvent on the outer circumferential surface of the electroconductive substrate 311. Among them, a preferred method includes dispersing the charge generation substance 312 into a binder resin solution obtained by mixing a binder resin as a binder into an appropriate solvent by a known method to prepare a coating solution for charge generation layer and coating the obtained coating solution on the outer circumferential surface of the electroconductive substrate 311. The method is to be described below.

The binder resin used for the charge generation layer 315 includes, for example, polyester resin, polystyrene resin, polyurethane resin, phenol resin, alkyd resin, melamine resin, epoxy resin, silicone resin, acryl resin, methacryl resin, polycarbonate resin, polyarylate resin, phenoxy resin, polyvinyl butyral resin, and polyvinyl formal resin, as well as copolymer resins containing two or more of repetitive units constituting the resins described above. Specific examples of the copolymer resin include, for example, those insulative resins such as vinyl chloride-vinyl acetate copolymer resin, vinyl chloride-vinyl acetate-maleic acid anhydride copolymer resin, and acrylonitrile-styrene copolymer resin. The binder resin is not restricted to them but those resins used generally can be used as the binder resin. The resins are used each alone or two or more of them in combination.

As a solvent for the coating liquid for charge generation layer, for example, halogenated hydrocarbons such as dichloromethane or dichloroethane, ketones such as acetone, methyl ethyl ketone or cyclohexanone, esters such as ethyl acetate or butyl acetate, ethers such as tetrahydrofuran (referred to as THF) or dioxane, alkylethers of ethylene glycol such as 1,2-dimethoxyethane, aromatic hydrocarbons such as benzene, toluene or xylene, or aprotonic polar solvents such as N,N-dimethyl formamide or N,N-dimethylacetoamide, etc, are used. The solvents may be used alone or two or more of them may be mixed and used as a mixed solvent.

As the blending ratio between the charge generation substance 312 and the binder resin, it is preferred that the ratio of the charge generation substance 312 is within a range from 10% by weight to 99% by weight. In a case where the ratio of the charge generation substance 312 is less than 10% by weight, the sensitivity of the photoreceptor 310 is lowered. In a case where the ratio of the charge generation substance 312 exceeds 99% by weight, since not only the film strength of the charge generation layer 315 is lowered but also the dispersibility of the charge generation substance 312 is lowered to increase coarse particles to sometimes decrease the surface charges at the portion other than the portion to be erased by exposure, this increases image defects, particularly, image fogging referred to as "black speck" where toners are deposited to the white background to form fine black spots. Accordingly, it is defined as from 10% by weight to 99% by weight.

Before dispersing in the binder resin solution, the charge generation substance 312 may previously be pulverized by a pulverizer. The pulverizer used for pulverization includes, for example, a ball mill, sand mill, attritor, vibration mill, and supersonic dispersing machine.

The dispersing machine used upon dispersing the charge generation substance 312 into the binder resin solution includes, for example, a paint shaker, ball mill, and sand mill. As the dispersion conditions, appropriate conditions are selected so as not to cause intrusion of impurities due to abrasion of members constituting the container or dispersing machine to be used.

The coating method of the coating solution for charge generation layer includes, for example, a spraying method, bar coating method, roll coating method, blade method, wringing method, and dip coating method. Among the coating method described above, since the dip coating method is particularly excellent with various view points as described above, it has been often utilized also in a case of forming the charge generation layer 315. As the apparatus used for the dip coating method, a coating solution dispersing apparatus typically represented by a supersonic wave generation apparatus may be provided in order to stabilize the dispersibility of the coating solution.

The film thickness of the charge generation layer 315 is, preferably, 0.05 μm or more and 5 μm or less and, more preferably, 0.1 μm or more and 1 μm or less. In a case where the film thickness of the charge generation layer 315 is less than 0.05 μm, the light absorption efficiency is lowered to lower the sensitivity of the photoreceptor 310. In a case where the film thickness of the generation layer 315 exceeds 5 μm, the charge transfer in the charge generation layer constitutes a rate determining step in the process of erasing charges on the surface of the photoreceptor to lower the sensitivity of the photoreceptor 310. Accordingly, it is defined as 0.05 μm or more and 5 μm or less.

The photosensitive layer 314 has a stacked structure of the charge generation layer 315 and the charge transportation layer 316 formed as described above. In this embodiment, while the photosensitive layer 314 has a constitution in which the charge generation layer 315 and the charge transportation layer 316 are stacked in this order on the outer circumferential surface of the electroconductive substrate 311, this is not restrictive but it may be a constitution in which the charge transportation layer 316 and the charge generation layer 315 are stacked in this order on the outer circumferential surface of the electroconductive substrate 311. However, with a view point of the durability, the photosensitive layer 314 preferably has a constitution in which the charge generation layer 315 and the charge transportation layer 316 are stacked in this order on the outer circumferential surface of the electroconductive substrate 311.

Further, the photosensitive layer 314 is not restricted to the stacked type photosensitive layer having a stacked structure of the charge generation layer 315 and the charge transportation layer 316 but a single-layered type photosensitive layer comprising the charge transportation substance 313 containing the enamine compound represented by the general formula (2), the charge generation substance 312 and the binder resin 317 are contained in a single layer may also be provided. However, it is more preferred to provide a stacked type photosensitive layer having a stacked structure of the charge generation layer 315 and the charge transportation layer 316. As described above, by sharing the charge generating function and the charge transportation function respectively to separate layers, since materials optimal to the charge generating function and the charge transportation function can be selected for the materials constituting the respective layers, it is possible to obtain a photoreceptor 310 of higher sensitivity having high reliability with further improved stability during repetitive use compared with a case of providing the single layered type photosensitive layer.

In a case of providing the single layered type photosensitive layer as the photosensitive layer 314, the photosensitive layer is formed by the same method as that for the charge transportation layer 316. For example, a single layered type photosensitive layer can be formed by dissolving or dispersing the charge generation substance 312, the charge transportation substance 313 containing the enamine compound represented by the general formula (2), the binder resin 317 and, if necessary, the additives described above into the same solvent as that of the coating solution for charge transportation layer to prepare a coating solution for photosensitive layer and by coating the coating solution for photosensitive layer by way of a dip coating method, etc. on the outer circumferential surface of the electroconductive substrate 311.

Further, the ratio A'/B' for the weight A' of the enamine compound represented by the general formula (2) and the weight B' of the binder resin 317 in the single layered type photosensitive layer is preferably from 10/12 to 10/30 in the same manner as the A/B for the weight A of the enamine compound represented by the general formula (2) and the weight B of the binder resin 317 in the charge transportation layer 316 described above.

Further, one or more electron accepting materials or dyes may also be added to the photosensitive layer 314 in order to improve the sensitivity and suppress the increase of the residual potential and fatigue during repetitive use.

As the electron accepting material, electron attracting materials, for example, acid anhydrides such as succinic acid anhydride, maleic acid anhydride, phthalic acid anhydride, and 4-chloronaphthalic acid anhydride, cyano compound such as tetraethylcyanoethylene and terephthal malon dinitrile, aldehydes such as 4-nitrobenzoaldehyde, anthraquinones such as anthraquinone and 1-nitroanthraquinone, polynuclear or heterocyclic nitro compounds such as 2,4,7-trinitrofluolenone and 2,4,5,7-tetranitrofluolenone, as well as diphenoquinone compounds. Those formed by making the electron attracting materials to higher molecular weight, etc. may also be used.

As the dyes, organic photoconductive compounds, for example, xanthene dyes, thiazine dyes, triphenylmethane dyes, quinoline pigments, and copper phthalocyanine can be used. Such organic photoconductive compounds function as an optical sensitizer.

Further, various additives such as an antioxidant, a sensitizer, or a UV-absorber may be added optionally to each of the layers of the photosensitive layer 314. This can improve potential characteristics. Further, the stability of the coating solution upon forming the layer by coating can be improved. Further, this can mitigate the fatigue deterioration to improve the durability upon repetitive use of the photoreceptor.

Particularly preferred antioxidant includes, for example, phenol compounds, hydroquinone compounds, to copherol compounds and amine compounds. The antioxidant is preferably used within a range from 0.1% by weight or more and 50% by weight or less with respect to the charge transportation substance 313. In a case where the amount of the antioxidant to be used is less than 0.1% by weight, no sufficient effect can be obtained for the improvement of the stability of the coating solution and the durability of the photoreceptor. In a case where the amount of the antioxidant to be used exceeds 50% by weight, it gives an undesired effect on the characteristics of the photoreceptor. Accordingly, it is defined as 0.1% by weight or more and 50% by weight or less.

As the electroconductive material constituting the electroconductive substrate 311, for example, elemental metals such as aluminum, copper, zinc, and titanium, as well as alloys such as aluminum alloys and stainless steels can be used. Further, with no particular restriction to such metal materials, polymeric materials such as polyethylene terephthalate, nylon, or polystyrene, hard paper or glass on which metal foils are laminated, metal materials are vapor deposited, or a layer of an electroconductive compound such as an electroconductive polymer, tin oxide, or indium oxide is vapor deposited or coated on the surface thereof can also be used. These electroconductive materials are used upon processing to a specified shape. While the shape of the electroconductive substrate 311 is cylindrical in this embodiment, it is not restrictive but various shapes may be adopted conforming the shape of the photoreceptor 310.

The surface of the electroconductive substrate 311 may optionally be applied with a surface treatment with chemicals or hot water, a coloring treatment or a random reflection treatment, for example, by surface roughening, within a range not affecting the picture quality. In the electrophotographic process using laser as an exposure source, since the wavelength of laser beams is coherent, the laser light reflected on the surface of the photoreceptor and the laser light reflected in the photoreceptor may sometimes cause interference and the interference fringe caused by interference appears on the images to result in image defects. Image defects by the interference of the laser light of coherent wavelength can be prevented by applying the treatment described above to the surface of the electroconductive substrate 311.

The photoreceptor mounted to the image forming apparatus 301 of this embodiment shown in FIG. 20 is not restricted to the photoreceptor 310 having the layer constitution shown in FIG. 21 but photoreceptors having various layer structures can be used. For example, a photoreceptor 410 having the following layer constitution shown in FIG. 22 can be used.

Figure 22:
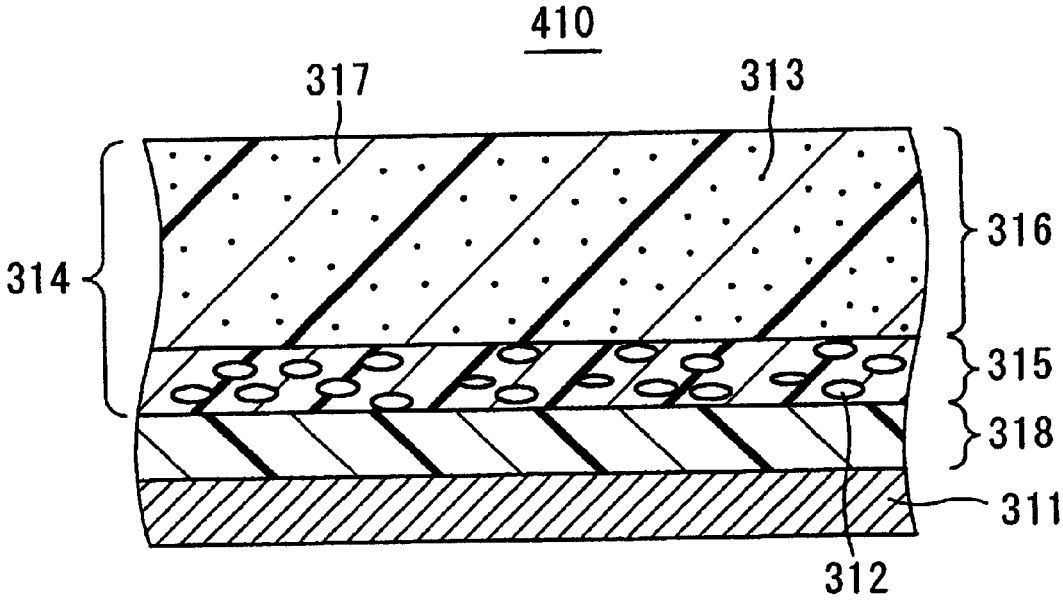
FIG. 22 is a fragmentary cross sectional view schematically showing another constitution of the photoreceptor mounted to the image forming apparatus 301 shown in FIG. 20.

FIG. 22 is a fragmentary cross sectional view schematically showing another constitution of the photoreceptor mounted to the image forming apparatus 301 shown in FIG. 20. The photoreceptor mounted to the image forming apparatus 301 of this embodiment may have a constitution in which an intermediate layer 318 is provided between the electroconductive substrate 311 and the photosensitive layer 314 as in the photoreceptor 410 shown in FIG. 22.

In a case where the intermediate layer 318 is not present between the electroconductive substrate 311 and the photosensitive layer 314, charges are injected from the electroconductive substrate 311 to the photosensitive layer 314 to lower the chargeability of the photosensitive layer 314, and the surface charges in the portion other than the portions to be erased by exposure are decreased to sometimes result in defects such as fogging to the images. Particularly, in a case of forming images by using a reversal development process, since toner images are formed to the portion decreased with the surface charges by exposure, when the surface charges are decreased by the factor other than the exposure, fogging of images referred to as the black speck in which fine black spots are formed by the deposition of the toner on the white background to remarkably deteriorate the image qualities. That is, in a case where the intermediate layer 318 is not present between the electroconductive substrate 311 and the photosensitive layer 314, this lowers the chargeability in the minute region due to the defects of the electroconductive substrate 311 or the photosensitive layer 314 to result in fogging of images such as black specks, which sometimes leads to remarkable image defects.

In the photoreceptor 410 shown in FIG. 22, since the intermediate layer 318 is provided between the electroconductive substrate 311 and the photosensitive layer 314 as described above, injection of charges from the electroconductive substrate 311 to the photosensitive layer 314 can be prevented. Accordingly, lowering of the chargeability in the photosensitive layer 314 can be prevented to suppress the decrease of the surface charges in the portion other than the portion to be erased by exposure, and occurrence of defects such as fogging in the images can be prevented. Further, since provision of the intermediate layer 318 can cover the defects on the surface of the electroconductive substrate 311 to obtain a uniform surface, the film forming property of the photosensitive layer 314 can be improved.

For the intermediate layer 318, a resin layer formed of various kinds of resin materials or an anodized film is used. Provision of the resin layer as the intermediate layer 318 can provide also an effect of suppressing the peeling of the photosensitive layer 314 from the electroconductive substrate 311 to improve the adhesion between the electroconductive substrate 311 and the photosensitive layer 314.

The resin materials forming the resin layer include, those resins such as polyethylene resin, polypropylene resin, polystyrene resin, acryl resin, vinyl chloride resin, vinyl acetate resin, polyurethane resin, epoxy resin, polyester resin, melamine resin, silicone resin, polyvinyl butyral resin, and polyamide resin, as well as copolymer resins containing two or more of repetitive units constituting the resins described above. Further, casin, gelatin, polyvinyl alcohol, ethyl cellulose, etc. can also be used. Among them, use of the polyamide resin is preferred and, particularly, use of alcohol soluble nylon resin is preferred. Preferred alcohol soluble nylon resin includes, for example, so-called copolymerized nylon formed by copolymerizing 6-nylon, 6,6-nylon, 6,10-nylon, 11-nylon and 2-nylon, as well as those resin formed by chemically modifying nylon such as N-alkoxymethyl modified nylon and N-alkoxyethyl modified nylon.

In a case of providing a resin layer as the intermediate layer 318, it is preferred that the intermediate layer 318 is incorporated with particles such as of metal oxide. Incorporation of the particles can control the volumic resistance value of the intermediate layer 318 and improve the effect of preventing injection of charges from the electroconductive substrate 311 to the photosensitive layer 314, and can maintain the electric characteristics of the photoreceptor under various circumstances.

The metal oxide particles include, for example, those particles of titanium oxide, aluminum oxide, aluminum hydroxide, and tin oxide.

The intermediate layer 318 comprising the resin layer is formed, for example, by dissolving or dispersing the resin in an appropriate solvent to prepare a coating solution for intermediate layer and coating the coating solution on the outer circumferential surface of the electroconductive substrate 311. In a case of incorporating particles such as of metal oxides to the intermediate layer 318, the intermediate layer 318 can be formed, for example, by dissolving the resin described above into an appropriate solvent to obtain a resin solution, into which the particles are dispersed to prepare a coating solution for intermediate layer and coating the coating solution to the outer circumferential surface of the electroconductive substrate 311.

As the solvent for the coating solution of intermediate layer, water, various kinds of organic solvents or a mixed solvent thereof is used. Particularly, a single solvent such as water, methanol, ethanol, or butanol, or mixed solvent such as water and alcohol, two or more kinds of alcohols, acetone or dioxolane and alcohols, and chlorine solvent such as dichloroethane, chloroform, or trichloroethane and alcohols are used suitably.

As the method of dispersing the particles in the resin solution, a general method of using a ball mill, sand mill, attritor, vibration mill, or supersonic dispersing machine, etc. can be used.

The total weight C for the resin and the metal oxide in the coating solution for intermediate layer relative to the weight D for the solvent in the coating solution for intermediate layer is, preferably, from 1/99 to 40/60 and, more preferably, from 2/98 to 30/70 as C/D. Further, the ratio E/F between the weight E of the resin and the metal oxide is, preferably, from 90/10 to 1/99 and, more preferably, from 70/30 to 5/95.

The coating method of the coating solution for intermediate layer includes, for example, a spraying method, a bar coating method, a roll coating method, a blade method, wringing method, and a dip coating method. Particularly, since the dip coating method is relatively simple and is excellent in view of the productivity and the cost, it has been often utilized also in a case of forming the intermediate layer 318.

The film thickness of the resin layer provided as the intermediate layer 318 is, preferably, from 0.01 μm or more and 20 μm or less and, more preferably, 0.05 μm or more and 10 μm or less. In a case where the film thickness of the resin layer is less than 0.01 μm, it no more substantially functions as the intermediate layer 318 and no uniform surface property by coating the defects of the surface of the electroconductive substrate 311 can be obtained, and injection of charges from the electroconductive substrate 311 to the photosensitive layer 314 can not be prevented to lower the chargeability of the photosensitive layer 314. It is not preferred to increase the film thickness of the intermediate layer 318 to more than 20 μm since formation of the intermediate layer 318 is difficult and the photosensitive layer 314 can not be formed uniformly on the outer circumferential surface of the intermediate layer 318 to lower the sensitivity of the photoreceptor in a case of forming the intermediate layer 318 by the dip coating method.

In a case where the electroconductive substrate 311 comprises aluminum, an anodized film may also be provided instead of the resin layer as the intermediate layer 318. In a case of providing the resin layer as the intermediate layer 318, since there may be a possibility of causing defects such as bruise to the intermediate layer 318, for example, by physical impacts to generate leakage and cause image defects, a care has to be taken in handling. However, since the anodized film is tough and less causes injuries, it is preferred to provide the anodized film as the intermediate layer 318 with a view point of leakage proofness.

The anodized film can be formed by applying anodization to the electroconductive substrate 311. The anodization is conducted in an acidic bath, for example, of chromic acid, sulfuric acid, oxalic acid, phosphoric acid, boric acid or sulfamic acid. Among them, the anodization in sulfuric acid provides a most preferred effect. In a case of anodization in sulfuric acid, it is preferred to set the sulfuric acid concentration to 50 to 400 g/L, a dissolved aluminum concentration to 2 to 20 g/L, the liquid temperature to 10 to 40° C., the electrolysis voltage to from 5 to 30 V, and current density to 0.5 to 2 $A/dm^2$.

For improving the stability of the film, it is preferred that the thus formed anodized film is applied with a low temperature hole sealing treatment of dipping into an aqueous solution containing nickel fluoride as a main ingredient, a high temperature hole sealing treatment of dipping in an aqueous solution containing nickel acetate as a main ingredient, or other hole sealing treatment such as steam hole sealing or boiling water hole sealing and the like.

The average film thickness of the anodized film provided as the intermediate layer 318 is, preferably, 0.1 μm or more and 20 μm or less and, more preferably, 1 μm or more and 10 μm or less. In a case where the average film thickness of the anodized film is less than 0.1 μm, it no more functions substantially as the intermediate layer 318 and can not cover the defects on the surface of the electroconductive substrate 311 to obtain uniform surface property, and injection of charges from the electroconductive substrate 311 to the photosensitive layer 314 can not be prevented to lower the chargeability of the photosensitive layer 314. In a case where the average film thickness of the anodized film exceeds 20 μm, the sensitivity of the photoreceptor is lowered. Accordingly, it is defined as 0.1 μm or more and 20 μm or less.

Referring again to FIG. 20, the constitution and the operation of the image forming apparatus 301 having the photoreceptor 310 is to be described.

The image forming apparatus 301 is cylindrical and comprises a photoreceptor 310 rotationally supported on a housing 388 and not illustrated driving means for rotationally driving the photoreceptor 310 around a rotational axis 344 in the direction of an arrow 341. The driving means comprise, for example, a motor as a power source and transmit the power from the motor by way of not illustrated gears to the support constituting the core of the photoreceptor 310 thereby rotationally driving the photoreceptor 310 at a predetermined circumferential speed. While the shape of the photoreceptor 310 is cylindrical in this embodiment, this is not limitative and may be a columnar shape, an endless belt shape or the like.

At the periphery of the photoreceptor 310, are provided a contact charger 332, image exposure means 330, a developing device 333, a transfer device 334, separation means 337, and a cleaner 336 in this order from the upstream to the downstream in the rotational direction of the photoreceptor 310 shown by the arrow 341. The cleaner 336 is provided together with a not illustrated charge eliminator. The photoreceptor 310, the contact charger 332, the developing device 333 and the cleaner 336 are provided integrally so as to be housed in the housing 338 to constitute a process cartridge 320. The process cartridge 320 is constituted attachable to and detachable from the image forming apparatus main body by using guide means such as not illustrated rails.

The contact charger 332 is contact charging means comprising a charging member **332*a* and not illustrated pressure loading means for conducting charging while contacting the charging member 332*a* against the outer circumferential surface 343 of the photoreceptor 310. The charging member 332*a* is pressed by the pressure loading means to the outer circumferential surface 343 of the photoreceptor 310 to form a contact portion. By the use of the contact charger 332 as the contact charging means, an image forming apparatus 301** with less generation of ozone deleterious to human bodies and usable for a long period of time can be attained.

The charging member **332*a* is in a brush shape and constituted including an electroconductive brush 350 and a cylindrical support 351 supporting the electroconductive brush 350, and the support 351 is supported rotationally, for example, on the housing 338. Since the charging member 332*a* have a brush-like shape, the contact portion between the charging member 332*a* and the outer circumferential surface 343 of the photoreceptor 310 is decreased to mitigate mechanical stress from the charging member 332*a* to the photosensitive layer 314 as the surface layer of the photoreceptor 310, the life of the photoreceptor 310 can be extended. Further, this can reduce the filming that occurs when the toner remaining on the outer circumferential surface 343 of the photoreceptor 310 is pressed to the surface 343 by the charging member 332*a***.

While the support 351 supporting the electroconductive brush 350 is a columnar shape in this embodiment, this is not restrictive but may be a cylindrical or plate-like shape. In a case where the shape of the support 351 is a columnar or cylindrical, the charging member **332*a* is used while being driven rotationally by an external rotational driving force or the contact frictional force with the photoreceptor 310. In a case where the support 351 is in a plate-like shape, the charging member 332*a*** is used being fixed.

The material constituting the charging member **332*a*** is not particularly limited but it may be any material so long as desired electrical resistance and shape can be obtained. For example, metals such as gold or silver or electroconductive polymer can be used. Further, a resin material in which an electroconductive powder such as of carbon black or metal is dispersed, or a resin material applied with ionic conduction treatment can also be used.

The charging member **332*a* is connected with an external power source 339 for applying a voltage. The outer circumferential surface 343 of the photoreceptor 310 can be charged to a predetermined potential by applying a voltage from the external power source 339 to the support 351 in a state of abutting the electroconductive brush 350 of the charging member 332*a* against the outer circumferential surface 343 of the photoreceptor 310. As the voltage applied to the charging member 332*a*, that is, to the support 351, only the DC voltage may be used but it is preferred to use a vibrating voltage superposing an AC voltage to a DC voltage in order to uniformly charge the outer circumferential surface 343 of the photoreceptor 310**.

The charging member 332*a* is in a brush-shape in this embodiment but it is not restrictive and may also be a roller shape, a blade shape, a belt shape or a plate shape. With a view point for the stability of charging, it is preferred that the charging member 332*a* is in a roller-like shape. Since the contact portion between charging member 332*a* and the photoreceptor 310 increases when the charging member 332*a* has a roller-like shape, the photoreceptor 310 can be charged stably.

In a case where the charging member 332*a* is in a roller shape, the charging member 332*a* is constituted including a columnar or cylindrical support and an elastic layer covering the outer circumferential surface of the support. The elastic layer may be constituted with a single layer, or may be constituted with two layers of a support layer covering the outer circumferential surface of the support and a resistive layer covering the outer circumferential surface of the support layer. Further, a protective layer may also be disposed further to the outer circumferential surface of the elastic layer. The elastic layer, the support layer, the resistive layer and the protective layer are formed so as to have desired electric resistance. The outer circumferential surface 343 of the photoreceptor 310 can be charged to a predetermined potential by applying a voltage from the external power source 339 to the support like in the case of the brush-like charging member 332*a*, in a state of abutting the elastic layer, the resistive layer or protective layer to the outer circumferential surface 343 of the photoreceptor 310.

As the material constituting the support for the roller-shape charging member 332*a*, electroconductive materials are used and, for example, metals such as gold or silver, or electroconductive polymers are used. Further, a resin material in which an electroconductive powder of carbon black or metal is dispersed, or a resin material applied with ionic conduction treatment can also be used.

As the material constituting the elastic layer or the support layer, those having conductivity or semiconductivity are used and insulative elastic materials to which electroconductive particles or semiconductive particles are dispersed are used suitably. The insulative elastic material include, for example, rubber materials such as silicone rubber, polyurethane rubber, ethylene-propylene-diene copolymer (simply referred to as EPDM) rubber and nitrile rubber. The electroconductive particles or semiconductive particles include, for example, carbon powder, carbon fiber, metal powder, and graphite.

As the material constituting the resistive layer or the protective layer, those having conductivity or semiconductivity are used, and binder resins in which electroconductive particles or semiconductive particles are dispersed are used suitably. The binder resin include, for example, acrylate resin, cellulose resin, polyamide resin, methoxy methylated nylon, ethoxy methylated nylon, polyurethane resin, polycarbonate resin, polyethylene resin, polyvinyl resin such as polyvinyl chloride, polyarylate resin, polythiophene resin, polyetser resin such as polyethylene terephthalate, polyolefin resin, fluorine resin, and styrene-butadiene copolymer resin. As the electroconductive particles or semiconductive particles, particles identical with those used for the elastic layer or support layer can be used.

The image exposure means 330 comprise, for example, a semiconductor laser as the light source, and a light 331 such as a laser beam outputted from the light source is irradiated to the outer circumferential surface 343 of the photoreceptor 310 situated between the contact charger 332 and the developing device 333 in accordance with the image information, to conduct image exposure to the charged outer circumferential surface 343 of the photoreceptor 310 to form electrostatic latent images on the outer circumferential surface 343.

The developing device 333 is developing means for developing electrostatic latent images formed by image exposure to the outer circumferential surface 343 of the photoreceptor 310 by a developer, which is disposed being opposed to the photoreceptor 310 and comprises a developing roller 333*a* for supplying a toner to the outer circumferential surface 343 of the photoreceptor 310, and a casing 333*b* that rotationally supports the developing roller 333*a* around a rotational axis parallel with the rotational axis 344 of the photoreceptor 310 and housing a developer containing the toner in the inner space thereof.

The transfer device 334 is transfer means for transferring toner images as visual images formed by development to the outer circumferential surface 343 of the photoreceptor 310 to transfer paper 345 as a recording medium supplied between the photoreceptor 310 and the transferring device 334 by not illustrated conveying means in the direction of an arrow 342 and it is disposed being opposed by way of the conveying means to the photoreceptor 310. In this embodiment, the transfer device 334 is contact type transfer means having a transfer roller 334*a*, pressing the transfer roller 334*a* to the photoreceptor 310 on the side opposite to the contact surface of the transfer paper 345 in contact with the outer circumferential surface 343 of the photoreceptor 310 and applying a voltage from the external power supply 340 to the transfer roller 334*a* in a state of press contacting the photoreceptor 310 and the transfer paper 345, thereby transferring the toner images to the transfer paper 345. The transfer device 334 is not restricted to such a contact type transfer means for conducting transfer utilizing the pressing force but it may be non-contact type transfer means for conducting transfer without using pressing-force. As the non-contact type transfer means, those comprising, for example, a corona discharger, and transferring toner images to the transfer paper 345 by applying charges at a polarity opposite to that of the toner from the corona discharger to the transfer paper 345 can be used.

Separation means 337 are means for separating the photoreceptor 310 and the transfer paper 345 in press contact with each other.

A cleaner 336 is cleaning means for removing to recover the toner remaining on the outer circumferential surface 343 of the photoreceptor 310 after the transferring operation by the transfer device 334 and it comprises a cleaning blade 336*a* for peeling the toner remaining on the outer circumferential surface 343 of the photoreceptor 310 from the outer circumferential surface 343, and a recovery casing 336*b* for containing the toner peeled by the cleaning blade 336*a*.

Further, a fixing device 335 as fixing means for fixing the toner images transferred to the transfer paper 345 is disposed in the direction of conveying the transfer paper 345 separated by the separation means 337 from the photoreceptor 310. The fixing device 335 comprises a heating roller 335*a* having not illustrated heating means and a press roller 335*b* opposed to the heating roller 335*a* and press contacted to the heating roller 335*a* to form a contact portion.

An image forming method according to a ninth embodiment of the invention includes a step of preparing an electrophotographic photoreceptor, a contact charging step of conducting charging while contacting a charging member to the obtained electrophotographic photoreceptor, an image exposure step of conducting image exposure to the charged electrophotographic photoreceptor thereby forming electrostatic latent images, and a developing step of developing the thus formed electrostatic latent images, wherein the step of preparing the electrophotographic photoreceptor includes preparing an electroconductive substrate formed of an electroconductive material and forming a photosensitive layer containing an enamine compound represented by the general formula (2) and a binder resin on the electroconductive substrate. That is, the image forming method is practiced by the image forming apparatus 301 according to this embodiment.

An image forming operation by the image forming apparatus 301 is to be described. At first, when the photoreceptor 310 is driven rotationally by driving means in the direction of the arrow 341, the charging member 332*a* of the contact charger 332 located upstream to the focusing point of the light 331 from the image exposure means 330 in the rotational direction of the photoreceptor 310 is pressed to the outer circumferential surface 343 of the photoreceptor 310 to form a contact portion. By applying a predetermined voltage from the external power supply 339 to the charging member 332*a* in this state, the outer circumferential surface 343 of the photoreceptor 310 is charged to a predetermined positive or negative potential.

Then, a light 331 is irradiated form the image exposure means 330 to the outer circumferential surface 343 of the photoreceptor 310 in accordance with image information. The light 331 from the light source is scanned repetitively in the longitudinal direction of the photoreceptor 310 as a main scanning direction. By rotationally driving the photoreceptor 310 and repetitively scanning the light 331 from the light source, image exposure is applied in accordance with the image information to the outer circumferential surface 343 of the photoreceptor 310. The image exposure eliminates the surface charges at the portion irradiated with the light 331 to cause a difference between the surface potential at the portion irradiated with the light 331 and the surface potential at the portion not irradiated with the light 331 to form electrostatic latent images on the outer circumferential surface 343 of the photoreceptor 310.

Then, when the toner is supplied to the outer circumferential surface 343 of the photoreceptor 310 formed with electrostatic latent images from the developing the roller 333*a* of the developing device 333 located downstream to the focusing point of the light 331 from the light source in the rotational direction of the photoreceptor 310, the electrostatic latent images are developed to form toner images to the outer circumferential surface 343 of the photoreceptor 310.

Further, in synchronization with image exposure to the photoreceptor 310, transfer paper 345 is supplied by conveying means from the direction of the arrow 342 to a position between the photoreceptor 310 and the transfer device 334. When the transfer paper 345 is supplied between the photoreceptor 310 and the transfer device 334, the transfer roller 334*a* of the transfer device 334 is pressed to the photoreceptor 310 to form a contact portion, by which the photoreceptor 310 and the transfer paper 345 are brought into press contact to each other. By applying a voltage from the external power supply 340 to the transfer roller 334*a* in this state, toner images formed on the outer circumferential 343 of the photoreceptor 310 is transferred to the transfer paper 345.

The transfer paper 345 transferred with the toner images is separated by the separation means 337 from the outer circumferential surface 343 of the photoreceptor 310, then conveyed by the conveying means to the fixing device 335 and heated and pressurized upon passage through the contact portion between the heating roller 335*a* and the press roller 335*b* of the fixing device 335. Thus, the toner images on the transfer paper 345 are fixed to the transfer paper 345 to form firm images. The transfer paper 345 thus formed with images is discharged by the conveying means to the outside of the image forming apparatus 301.

On the other hand, the toner remaining on the outer circumferential surface 343 of the photoreceptor 310 after the transferring operation by the transfer device 334 is peeled by the cleaning blade 336*a* of the cleaner 336 from the outer circumferential surface 343 of the photoreceptor 310 and recovered in the recovering casing 336*b*. The charges at the outer circumferential surface 343 of the photoreceptor 310 thus removed with the toner are eliminated by a charge eliminator disposed together with the cleaner 336, by which the electrostatic latent images on the outer circumferential surface 343 of the photoreceptor 310 are eliminated. Then, the photoreceptor 310 is further driven rotationally to repeat a series of operations starting from the charging to the photoreceptor 310 again. As described above, images are formed continuously.

When the charging is conducted in the image forming apparatus 301 by contacting the charging member 332*a* to the photoreceptor 310 by the contact charger 332, a high electric field exerts concentrically to the contact portion between the photosensitive layer 314 of the photoreceptor 310 and the charging member 332*a*. However, since the charge transportation layer 316 as the surface layer of the photosensitive layer 314 scarcely has defects as described above, charges supplied from the charging member 332*a* are not concentrated to a portion in the charge transportation layer 316 and the photosensitive layer 314 is uniformly charged. That is, the photosensitive layer 314 does not suffer from dielectric breakdown by local leakage. Accordingly, it is possible to obtain an image forming apparatus 301 of high reliability capable of stably providing images at high quality with no image defects caused leakage over a long period of time.

As an image forming apparatus 301 according to the eighth embodiment of the invention shown in FIG. 20, a test copying machine obtained by modifying a charger of a commercially available copying machine (manufactured by Sharp Corp.: AR-265S) from a scorotron charger to a contact charger 332 having a brush-like charging member 332*a* was provided and characteristics are evaluated. As the photoreceptor, 13 types were prepared which were manufactured under the different conditions respectively. The 13 kinds of the photoreceptors were prepared respectively as described below.

Example 21

7 parts by weight of titanium oxide (manufactured by Ishihara Sangyo Co.: TTO55A), and 13 parts by weight of copolymerized nylon resin (manufactured by Toray Co.: Amilan CM8000) were added to a mixed solvent of 159 parts by weight of methanol and 106 parts by weight of 1,3-dioxolane, and put to a dispersing treatment by a paint shaker for 8 hours to prepare a coating solution for intermediate layer. The obtained coating solution for intermediate layer was filled in a coating tank, and a cylindrical aluminum electroconductive substrate 311 of 30 mm diameter and 322.3 mm length size was dipped in and then pulling up from the coating tank and dried spontaneously to form an intermediate layer 318 of 1 μm thickness.

Then, after adding one part by weight of oxotitanium phthalocyanine as the charge generation substance 312 to a resin solution obtained by dissolving one part by weight of a polyvinyl butyral resin (manufactured by Sekisui Chemical Industry Co.: S-LEC BX-1) in 98 parts by weight of tetrahydrofuran (THF), they were dispersed by a paint shaker for 2 hours to prepare a coating solution for charge generation layer. After dip coating the obtained coating solution for charge generation layer to the intermediate layer 318 formed previously in the same manner as the coating solution for intermediate layer, it was dried spontaneously to form a charge generation layer 315 of 0.3 μm film thickness.

Then, 8 parts by weight of an enamine compound of Exemplified Compound No. 1 shown in Table 6 as the charge transportation substance 313, and 10 parts by weight of a bisphenol Z polycarbonate resin (manufactured by Mitsubishi Engineering Plastics Co.: Eupiron Z-200) are dissolved in a mixed solvent of 40 parts by weight of tetrahydrofurn and 40 parts by weight of toluene to prepare a coating solution for charge transportation layer. After dip coating the obtained coating solution for charge transportation layer on the previously formed charge generation layer 315 in the same manner as for the coating solution for intermediate layer described above, it was dried to form a charge transportation layer 316 of 20 μm film thickness.

As described above, a stacked type electrophotographic photoreceptor of the layer constitution shown in FIG. 22 was prepared.

Examples 22 to 26

Five types of electrophotographic photoreceptors were prepared in the same manner as in Example 21 except for using, instead of the enamine compound of the Exemplified Compound No. 1, Exemplified Compound No. 3 shown in Table 6, Exemplified Compound No. 61 shown in Table 14, Exemplified Compound No. 106 shown in Table 21, Exemplified Compound No. 146 shown in Table 26, or the enamine compound of Exemplified Compound No. 177 shown in Table 31 for the charge transportation substance 313 upon forming the charge transportation layer 316.

Example 27

An electrophotographic photoreceptor was prepared in the same manner as in Example 21 except for changing the amount of the enamine compound of Exemplified Compound No. 1 as the charge transportation substance 313 to 5 parts by weight and changing the amount of the bisphenol Z polycarbonate resin as the binder resin 317 to 13 parts by weight upon forming the charge transportation layer 316.

Example 28

An electrophotographic photoreceptor was prepared in the same manner as in Example 21 except for changing the amount of the enamine compound of Exemplified Compound No. 1 as the charge transportation substance 313 to 4 parts by weight and the amount of the bisphenol Z polycarbonate resin as the binder resin 317 to 13 parts by weight upon forming charge transportation layer 316.

Example 29

An electrophotographic photoreceptor was prepared in the same manner as in Example 21 except for changing the amount of the enamine compound of Exemplified Compound No. 1 as the charge transportation substance 313 to 9 parts by weight and the amount of the bisphenol Z polycarbonate resin as the binder resin 317 to 9 parts by weight upon forming charge transportation layer 316.

Example 30

An anodizing treatment was applied to a cylindrical aluminum electroconductive substrate 311 identical with that in Example 21 and, after forming an anodizing film of 6 μm film thickness on the electroconductive substrate 311, a hole sealing treatment was applied to form an intermediate layer 318. The anodizing treatment was conducted in sulfuric acid under the conditions at a sulfuric concentration of 180 g/L, a dissolved aluminum concentration of 4.5 g/L, a liquid temperature of 20° C., an electrolysis voltage of 10 V, and a current density of 1.5 A/dm$^2$.

Then, in the same manner as in Example 21, a charge generation layer 315 and a charge transportation layer 316 were formed, to prepare an electrophotographic photoreceptor.

Comparative Example 13

An electrophotographic photoreceptor was prepared in the same manner as in Example 21 except for using a comparative compound represented by the following structural formula (28) instead of the enamine compound of Exemplified Compound No. 1 as the charge transportation substance 313. In the followings, the comparative compound represented by the following structural formula (28) is sometimes referred to as TPD.

[Ka 44]

(28)

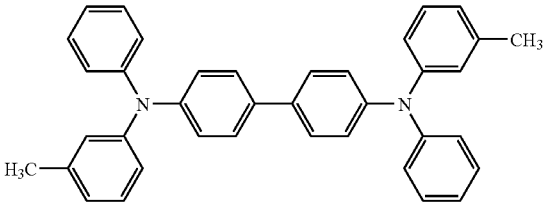

Comparative Example 14

An electrophotographic photoreceptor was prepared in the same manner as in Example 21 except for using 5 parts by weight of the Comparative Compound (TPD) represented by the structural formula (28) instead of 8 parts by weight of the enamine compound of Exemplified Compound No. 1 as the charge transportation substance 313 and changing the amount of the bisphenol Z polycarbonate resin as the binder resin 317 to 13 parts by weight.

Comparative Example 15

An electrophotographic photoreceptor was prepared in the same manner as in Example 21 except for using a comparative compound represented by the following structural formula (29) instead of the enamine compound of Exemplified Compound No. 1 as the charge transportation substance 313. In the followings, the comparative compound represented by the following structural formula (29) is sometimes referred to as ENA.

[Ka 45]

(29)

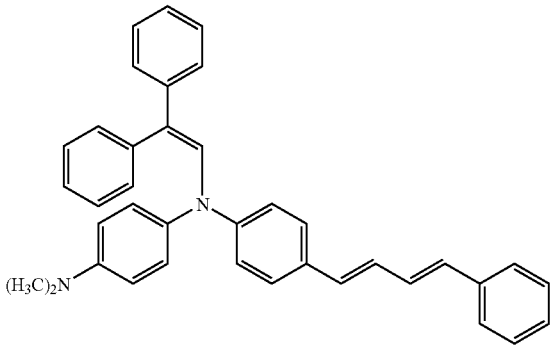

<Evaluation for Physical Property>

Physical properties were evaluated as described below.

The half-tone images were formed on transfer paper by using a test copying machine to which photoreceptors prepared in Examples 21 to 30 and Comparative Examples 13 to 15 were mounted respectively. The half tone images are images expressing the image density by gradation in black and white dots. For the obtained half-tone images, image density was measured as the reflectance density by using a Macbeth densitometer (manufactured by Macbeth Co.: RD914), which was compared with a predetermined allowable range for the image density. Further, obtained half-tone images were observed with naked eyes to confirm the presence or absence of black spots and white spots. Based on the results, the image quality of the obtained half-tone images was evaluated.

The evaluation criterion for the image quality is as described below.

○: good. The image density is substantially equal with the central value in the allowable range as a standard. Neither black spots nor white spots are present.

Δ: no practical problem. While the image density is lower or somewhat lower than the central value within the allowable range as the standard, it is within the allowable range. Neither black spots nor white spots are present.

x: not endurable for actual use. The image density is low being out of the allowable range, or black spots or white spots are formed.

Then, the developing device was taken out of the test copying machine and, instead, a surface potential meter was attached to the developing portion (manufactured by Trek Co.: Model 1344) to measure a surface potential V0 (−V) of the photoreceptor when a solid white original was copied, a surface potential VH (−V) of the photoreceptor when a half-tone original was copied, and a surface potential VL (−V) of the photoreceptor when a solid black original was copied thereby evaluating electric characteristics. In this test copying machine, reversal developing process was adopted.

The result of the evaluation described above was the result of evaluation for the initial stage.

Then, the surface potential meter was taken out and the developing machine was mounted again. After copying images of a predetermined pattern by 30,000 sheets of A4 size copy paper according to Japanese Industrial Standards (JIS) P0138, half-tone images were further formed. For the obtained half-tone images, quality of the images was evaluated in the same manner as in the initial stage. The standard criterion was identical with that in the initial stage. Further, the surface potentials V0, VH, and VL of the photoreceptor were measured in the same manner as that in the initial stage. The result of the evaluation described above was the result of the evaluation after repetitive use.

The result of evaluation is shown in Table 45.

TABLE 45

| | Charge transportation layer | | | Initial stage | | | | After repetitive use | | | |
|---|---|---|---|---|---|---|---|---|---|---|---|
| | Charge transportation substance | Charge transportation substance/ binder resin | Intermediate layer | V0 (−V) | VH (−V) | VL (−V) | Image quality | V0 (−V) | VH (−V) | VL (−V) | Image quality |
| Example 21 | Exemplified Compound 1 | 10/12.5 | Resin layer | 600 | 350 | 75 | ○ | 590 | 360 | 85 | ○ |
| Example 22 | Exemplified Compound 3 | 10/12.5 | Resin layer | 600 | 360 | 85 | ○ | 590 | 375 | 95 | ○ |
| Example 23 | Exemplified Compound 61 | 10/12.5 | Resin layer | 600 | 350 | 75 | ○ | 590 | 360 | 85 | ○ |
| Example 24 | Exemplified Compound 106 | 10/12.5 | Resin layer | 600 | 350 | 75 | ○ | 590 | 360 | 85 | ○ |
| Example 25 | Exemplified Compound 146 | 10/12.5 | Resin layer | 600 | 360 | 85 | ○ | 590 | 370 | 95 | ○ |
| Example 26 | Exemplified Compound 177 | 10/12.5 | Resin layer | 600 | 365 | 90 | ○ | 590 | 375 | 95 | ○ |
| Example 27 | Exemplified Compound 1 | 10/26 | Resin layer | 600 | 395 | 100 | ○ | 600 | 395 | 105 | Δ (image density somewhat low) |
| Example 28 | Exemplified Compound 1 | 10/32.5 | Resin layer | 600 | 400 | 105 | Δ (image density, somewhat low) | 600 | 455 | 155 | Δ (image density low) |
| Example 29 | Exemplified Compound 1 | 10/10 | Resin layer | 600 | 350 | 75 | ○ | 590 | 390 | 110 | Δ (image density somewhat low) |
| Example 30 | Exemplified Compound 1 | 10/12.5 | Anodized film | 600 | 355 | 80 | ○ | 590 | 365 | 90 | ○ |

TABLE 45-continued

| | Charge transportation layer | | | Initial stage | | | | After repetitive use | | | |
|---|---|---|---|---|---|---|---|---|---|---|---|
| | Charge transportation substance | Charge transportation substance/ binder resin | Intermediate layer | V0 (−V) | VH (−V) | VL (−V) | Image quality | V0 (−V) | VH (−V) | VL (−V) | Image quality |
| Comp. Ex. 13 | TPD | 10/12.5 | Resin layer | 600 | 420 | 130 | Δ (image density low) | 585 | 480 | 180 | X (black spots formed) |
| Comp. Ex. 14 | TPD | 10/26 | Resin layer | 600 | 450 | 150 | Δ (image density low) | 595 | 500 | 200 | X (image density, out or the range) |
| Comp. Ex. 15 | ENA | 10/12.5 | Resin layer | 600 | 360 | 85 | ○ | 590 | 450 | 150 | Δ (image density low) |

From the comparison between Examples 21 to 26 and Comparative Example 13, it was found that each photoreceptor of Examples 21 to 26 using the enamine compound represented by the general formula (2) for the charge transportation substance had a smaller absolute value VL both in the initial stage and after the repetitive use and was excellent in the sensitivity and the responsivity, compared with the photoreceptor of Comparative Example 13 using TPD. Further, it was found that each photoreceptor of Examples 21 to 26 had a smaller difference between the values for VO, VH, and VL in the initial stage and the values for VO, VH, and VL after the repetitive use and was excellent in the electric durability, compared with the photoreceptor of Comparative Example 13.

Further, it was found that the copying machine on which the photoreceptors of Examples 21 to 26 were mounted could provide images of good quality both in the initial stage and after the repetitive use. On the other hand, the copying machine on which the photoreceptor of Comparative Example 13 was mounted, injuries of the photosensitive layer caused by leakage appeared as black spots on the image after the repetitive use. It is considered to be attributable to that TPD used in the photoreceptor of Comparative Example 13 is inferior in the compatibility with the binder resin and the solubility to the solvent, compared with the enamine compound represented by the general formula (2) used for each photoreceptor of Examples 21 to 26.

That is, since the enamine compound represented by the general formula (2) was excellent in the compatibility with the binder resin and the solubility to the solvent, agglomeration of the enamine compound did not occur and a uniform photosensitive layer was formed in each photoreceptor of Examples 21 to 26 to which this enamin compound was used. Accordingly, for the copying machine on which each photoreceptor of Examples 21 to 26 was mounted, it is considered that charges were not concentrated to a portion in the photosensitive layer and good image quality could be kept also after the repetitive use even when charging was conducted by a contact charger exerting high electric field concentrically to the contact portion between the photoreceptor and the charging member. On the other hand, since TPD used for the photoreceptor of Comparative Example 13 was poor in the compatibility with the binder resin and the solubility to the solvent, the photosensitive layer in the photoreceptor of Comparative Example 13 was uniform in view of visual observation but an agglomerated portion of TPD was actually formed. Accordingly, it is considered that the charges were concentrated to the portion where TPD was agglomerated when charging was conducted by the contact charger, the photosensitive layer suffered from insulation breakdown and as a result, black spot appeared on the images.

Further, it was found from Comparative Example 14 that even in a case of using TPD for the charge transportation substance, black spots caused by leakage could be overcome by defining the ratio between the weight of TPD as the charge transportation substance and the weight of the binder resin (charge transportation substance/binder resin) to 10/26, that is, by decreasing the ratio of TPD and increasing the ratio of the binder resin than the photoreceptor of Comparative Example 13. This is considered to be attributable to that TPD was uniformly dissolved in the coating solution since the TPD ratio was lower to form the photosensitive layer as a uniform coating film. However, in the copying machine on which the photoreceptor of Comparative Example 14 was mounted, the sensitivity of the photoreceptor was insufficient and the image density was decreased to less than the standard, and images formed after the repetitive use were not suitable for actual use.

On the contrary, in the photoreceptor of Example 27, while the ratio A/B for the weight A of the enamine compound represented by the general formula (2) which is the charge transportation substance and the weight B of the binder resin was defined as 10/26 like in Comparative Example 14, that is, the ratio of the enamine compound was lowered and the ratio of the binder resin was increased than that of the photoreceptor of Example 21, but the sensitivity was sufficient and images of quality with no practical problem could be obtained even after the repetitive use in the copying machine on which the photoreceptor of Example 27 was mounted. This is considered to be attributable to that the charge mobility of the enamine compound represented by the general formula (2) is high.

Further, from the comparison between Example 21 and Example 28, it was found that the photoreceptor of Example 28 in which the ratio of the binder resin was further increased than that in the photoreceptor of Example 27 with the ratio A/B being defined as less than 10/30, the charge transportation ability of the photoreceptor was lowered, the absolute value of VL was increased and the sensitivity and the responsivity were lowered compared with the photoreceptor of Example 21. Further, for the copying machine on which the photoreceptor of Example 28 was mounted, it was found that while the images obtained in the initial stage was somewhat lower than the standard, images obtained after repetitive use were further lowered in the image density by the accumulation of residual potential.

Further, from the comparison between Example 21 and Example 29, in a copying machine mounting the photoreceptor of Example 29 in which the ratio A/B exceeded 10/12, the ratio of the enamine compound represented by the general formula (2) is increased and the ratio of the binder resin was lowered than in the photoreceptor of Example 21, while images of good quality in the initial stage like in the copying machine mounting the photoreceptor of Example 21, a phenomenon that the image density decreased somewhat was observed after the repetitive use. This is considered to be attributable to that the photoreceptor of Example 29 had good electric characteristics identical with that of the photoreceptor of Example 21 in the initial stage, but the chargeability of the photosensitive layer was lowered after the repetitive use since the wear amount of the photosensitive layer due to repetitive use was larger compared with that of the photoreceptor of Example 21. That is, in the case of charging by using the contact charger, since the charger and the photoreceptor are in contact with each other, charges move from the charger to the surface of the photoreceptor until the surface potential of the photoreceptor is equal with the potential of the charger. When the chargeability of the photoreceptor is lowered, the amount of charges moving from the charger to the surface of the photoreceptor increases till the potential becomes identical with that of the charger by so much as the lowering of the chargeability. As described above, since the amount of surface charges in the image exposure portion of the photoreceptor of Example 29 increases, more charges remain on the surface of the photoreceptor at the image exposure with the same amount of exposure as that for the photoreceptor of Example 21. Accordingly, in the photoreceptor of Example 29, the absolute value for VH and the absolute value for VL were increased more compared with the photoreceptor of Example 21, the amount of the toner deposited to the surface of the photoreceptor at a portion where the charges were decreased was decreased upon development and the image density was somewhat lowered as described above. Further also the images formed after the repetitive use showed no problem in view of actual use.

Further, from the comparison between Example 21 and Example 30, it was found that the photoreceptor of Example 30 in which an anodized film was disposed as an intermediate layer had good electric characteristics both in the initial stage and after the repetitive use like the photoreceptor of Example 21 in which a resin layer was disposed as an intermediate layer. Further, for the copying machine where the photoreceptor of Example 30 was mounted, it was found that good images were obtained and image defects caused by leakage did not occur even after the repetitive use like the copying machine on which the photoreceptor of Example 21 was mounted.

Further, from the comparison between Examples 21 to 26 and Comparative Example 15, it was found each the photoreceptor of Examples 21 to 26 using the enamine compound represented by the general formula (2) for the charge transportation substance had a smaller difference between the values for VH and VL in the initial stage and the values for VH and VL after the repetitive use, and was excellent in the electrical durability, compared with the photoreceptor of Comparative Example 15 using ENA as the enamine compound represented by the structural formula (29) not included in the general formula (2).

As described above, it was found that the copying machine mounting the photoreceptor containing the enamine compound represented by the general formula (2) in the photosensitive layer could obtain images at high quality with no image defects caused by leakage even when charging was conducted while contacting the charging member to the photoreceptor.

The present invention, can be practice in various other embodiments without departing the spirit or the principal feature thereof. Accordingly, the embodiments described previously are merely examples in every respect and the range of the invention is shown in the scope of the claims for patent and is no way restricted to the description of the specification. Further, all modifications or changes belonging to the scope of the claims are within the range of the invention.

INDUSTRIAL APPLICABILITY

As has been described above, according to the present invention, since the photosensitive layer disposed on the electroconductive substrate of the electrophotographic photoreceptor contains a polyarylate resin having the specified structural unit of excellent mechanical strength and an enamine compound having the the specified structure excellent in the compatibility with the polyarylate resin having the specified structural unit and having high charge mobility, it is possible to provide an electrophotographic photoreceptor excellent in the mechanical strength, capable of enduring the increase of mechanical strength accompanied to digitalization and increasing resolution of the electrophotographic apparatus, as well as having high durability capable of providing satisfactory electric characteristics stably over a long period of time.

Further, according to the invention, since the photosensitive layer contains the polyarylate resin having the structural unit of the characteristics excellent in the solubility to the solvent, the stability of the coating solution can be improved to improve the production efficiency of the electrophotographic photoreceptor in a case of forming the photosensitive layer by coating.

Further, according to the invention, since the photosensitive layer contains the enamine compound of the specified structure having a particularly high charge mobility, it is possible to attain an electrophotographic photoreceptor having high charge potential, high sensitivity, exhibiting sufficient responsivity, excellent in durability and of high reliability with no deterioration of the characteristics even in a case of use in a high speed electrophotographic process.

Further, according to the invention, since the photosensitive layer has a stacked structure in which a charge generation layer containing a charge generation substance, and a charge transportation layer containing a charge transportation substance containing an enamine compound of a specified structure of high charge mobility and a charge transportation layer containing a polyarylate resin having a specified structural unit excellent in the mechanical strength are stacked in this order from the electroconductive substrate to the outside, it is possible to provide an electrophotographic photoreceptor of higher sensitivity, high durability, excellent in wear resistance and with less change of characteristics due to film scraping of the photosensitive layer.

Further, according to the invention, since the intermediate layer is provided between the electroconductive substrate and the photosensitive layer, it is possible to prevent lowering of the chargeability of the photosensitive layer and prevent occurrence of defects such as fogging to images, as well as improve the film forming property of the photosensitive layer and adhesion between the electroconductive substrate and the photosensitive layer.

Further, according to the invention, since the process cartridge attachable to and detachable from the electrophotographic apparatus main body integrally comprises an electrophotographic photoreceptor excellent in the mechanical strength, capable of enduring the increase of the mechanical strength accompanied to digitalization and increasing resolution of the electrophotographic apparatus and capable of providing satisfactory electric characteristics stably for a long period of time and at least one of means selected from the group consisting of charging means, developing means and cleaning means, it is possible to provide a process cartridge capable of easily attaching or detaching the electrophotographic photoreceptor, and at least one of means selected from the group consisting of charging means, developing means and cleaning means to and from the electrophotographic apparatus main body and not requiring exchange for a long period of time.

Further, according to the invention, since the electrophotographic photoreceptor provided to the electrophotographic apparatus is excellent in the mechanical strength, capable of enduring increase of the mechanical stress accompanied to the digitalization and increasing resolution of the electrophotographic apparatus and capable of providing satisfactory electric characteristics stably for a long period of time, it is possible to provide an electrophotographic apparatus of high reliability capable of providing images at high quality for a long period of time.

Further, according to the invention, since the transfer means provided to the electrophotographic apparatus transfer developed images to a recording medium by press contacting the electrophotographic photoreceptor and the recording medium, and the photosensitive layer of the electrophotographic photoreceptor contains the polyarylate resin having the specified structural unit of excellent mechanical strength, it is possible to attain an electrophotographic apparatus of high reliability capable of increasing the pressing force by the transfer means, improving the transferring efficiency to the recording medium and capable of providing images at high quality with less transfer deviation or image defects such as whitening or blanking.

Further, according to the invention, since the photosensitive layer provided on the electroconductive substrate of the electrophotographic photoreceptor is excellent in the mechanical strength and contains the polycarbonate resin having the asymmetric diol ingredient exhibiting high solubility to a solvent whether the solvent is a halogen type organic solvent or non-halogen type organic solvent and the enamine compound of high charge mobility having the specified structure, it is possible to provide an electrophotographic photoreceptor having high charge potential and charge retainability, high sensitivity and having sufficient light responsivity, as well as is excellent in the durability not deteriorating the characteristics even in a case of use under a low temperature circumstance or in a high speed electrophotographic process, having high reliability, and satisfactory productivity.

Further, according to the invention, since the photosensitive layer contains the enamine compound of a specific structure that has a particularly high charge mobility, can be synthesized relatively easily at a high yield and can be produced at a reduced cost, an electrophotographic photoreceptor showing a further higher light responsivity can be produced at a reduced manufacturing cost.

Further, according to the invention, since the photosensitive layer contains a polycarbonate resin of particularly high mechanical strength having a structural unit containing a specified asymmetric diol ingredient, it is possible to obtain an electrophotographic photoreceptor particularly excellent in the durability, with less occurrence of injuries at the surface of the photosensitive layer and with less film reduction amount for the photosensitive layer.

Further, according to the invention, since the photosensitive layer contains a polycarbonate resin having an asymmetric diol ingredient and a siloxane structure, the surface friction coefficient of the photosensitive layer is decreased to improve the slidability and the transfer efficiency or the cleaning performance can be improved to obtain good images, injuries less occur to the surface of the photosensitive layer, and abnormal sounds referred to as ringing are less generated.

Further according to the invention, since the photosensitive layer further contains oxotitanium phthalocyanine having high charge generation efficiency and charge injection efficiency, having an maximum absorption peak in a wavelength region of a laser light irradiated from an infrared laser, an electrophotographic photoreceptor of high sensitivity and high resolution can be obtained and high quality images can be provided in a digital image forming apparatus using the infrared laser as an exposure light source.

Further, according to the invention, since the photosensitive layer has the stacked structure at least of the charge generation layer containing the charge generation substance and the charge transportation layer containing the charge transportation substance containing the enamine compound of high charge mobility having a specified structure, and at least the charge transportation layer of the charge generation layer and the charge transportation layer contains the polycarbonate resin having the asymmetric diol ingredient, it is possible to obtain an electrophotographic photoreceptor of higher sensitivity and with high durability with increased stability during repetitive use, and the productivity of the electrophotographic photoreceptor can be improved.

Further, according to the invention, since the binder resin containing the polycarbonate resin having the asymmetric diol ingredient can be incorporated at a high concentration in the charge transportation layer without deteriorating the light responsivity, it is possible to improve the printing resistance of the charge transportation layer, suppress the change of characteristics caused by the wear of the photosensitive layer thereby capable of improving the durability of the electrophotographic photoreceptor.

Further according to the invention, since the electrophotographic photoreceptor provided to image forming apparatus has high charge potential and charge retainability, high sensitivity and sufficient light responsivity, and also excellent in the durability with no deterioration of the characteristics even in a case of use under a low temperature circumstance or in a high speed electrophotographic process, or exposure to light, it is possible to obtain an image forming apparatus of high reliability capable of providing images at a high quality for a long period of time under various circumstances, and lowering of the image quality due to exposure of the electrophotographic photoreceptor to light, for example, during maintenance can be prevented to improve the reliability of the image forming apparatus.

The invention claimed is:

1. An electrophotographic photoreceptor comprising:

an electroconductive substrate formed of an electroconductive material; and a photosensitive layer disposed on the electroconductive substrate and containing a polyarylate resin having a structural unit represented by the following general formula (1) and an enamine compound represented by the following general formula (2):

(1)

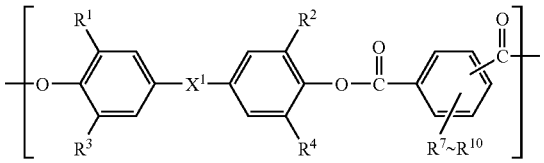

in which $X^1$ represents a single bond or —$CR^5R^6$—; $R^5$ and $R^6$ each represents a hydrogen atom, a halogen atom, an alkyl group which may have a substituent, or an aryl group which may have a substituent; further, $R^5$ and $R^6$ may join to each other to form a ring structure; $R^1$, $R^2$, $R^3$, and $R^4$ each represents a hydrogen atom, a halogen atom, an alkyl group which may have a substituent or an aryl group which may have a substituent; and wherein $R^7$~$R^{10}$ means $R^7$, $R^8$, $R^9$, and $R^{10}$ and wherein $R^7$, $R^8$, $R^9$, and $R^{10}$ each is directly attached to a different carbon atom on the indicated benzene ring not occupied by an ester group, and each represents a hydrogen atom, a halogen atom, or an alkyl group which may have a substituent or an aryl group which may have a substituent (2)

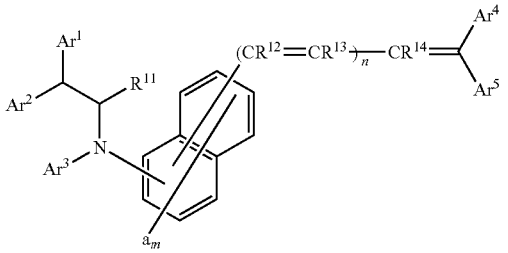

in which $Ar^1$ and $Ar^2$ each represents an aryl group selected from phenyl, naphthyl, pyrenyl, and anthryl groups which may have a substituent or a heterocyclic group selected from furyl, thienyl, thiazolyl, benzofuryl, benzothiophenyl, benzothiazolyl, and benxoxazolyl groups which may have a substituent; $Ar^3$ represents an aryl group which may have a substituent, a heterocyclic group which may have a substituent, an aralkyl group which may have a substituent, or an alkyl group which may have a substituent; $Ar^4$ and $Ar^5$ each represents a hydrogen atom, an aryl group which may have a substituent, a heterocyclic group which may have a substituent, an aralkyl group which may have a substituent, or an alkyl group which may have a substituent; however, both $Ar^4$ and $Ar^5$ do not form the hydrogen atoms; $Ar^4$ and $Ar^5$ may join to each other by way of an atom or an atomic group to form a ring structure; "a" represents an alkyl group which may have a substituent, an alkoxy group which may have a substituent, a dialkylamino group which may have a substituent, an aryl group which may have a substituent, a halogen atom or a hydrogen atom, and m represents an integer of 1 to 6; in a case where m is 2 or more, plural a may be identical or different with each other or may join to each other to form a ring structure; $R^{11}$ represents a hydrogen atom, a halogen atom, or an alkyl group which may have a substituent; $R^{12}$, $R^{13}$, and $R^{14}$ each represents a hydrogen atom, an alkyl group which may have a substituent, an aryl group which may have a substituent, a heterocyclic group which may have a substituent, or an aralkyl group which may have a substituent; n represents an integer of 1 to 3 and in a case where n is 2 or 3, plural $R^{12}$ may be identical or different with each other, and plural $R^{13}$ may be identical or different with each other; the substituent which may be present on $Ar^1$, $Ar^2$, $Ar^4$, $Ar^5$, a, $R^{12}$, $R^{13}$, and $R^{14}$ is selected from an alkyl group, an alkenyl group, an alkoxy group, an amino group, a halogen group, an aryl group, an aryloxy group, and an arylthio group; the substituent which may be present on $Ar^3$ is selected from an alkyl group, an alkoxy group, an amino group, a halogen group, an aryl group, an aryloxy group, and an arylthio group.

2. The electrophotographic photoreceptor of claim 1, wherein the photosensitive layer contains a polyarylate resin having a structural unit represented by the general formula (1), in which $X^1$ is —$CR^5R^6$—, each of $R^1$, $R^2$, $R^3$, $R^4$ $R^5$ and $R^6$ is a methyl group and each of $R^7$, $R^8$, $R^9$, and $R^{10}$ is a hydrogen atom.

3. The electrophotographic photoreceptor of claim 1, wherein the enamine compound represented by the following formula (2) is an enamine compound represented by the following general formula (3);

(3)

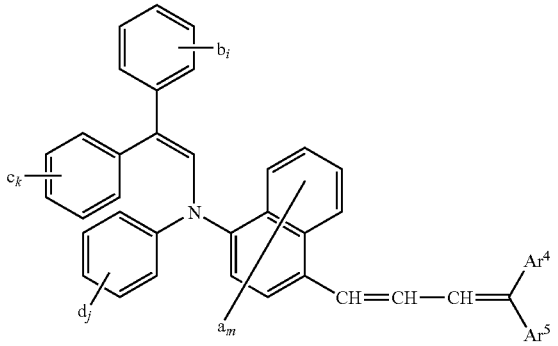

wherein b, c and d each represent an optionally-substituted alkyl group, an optionally-substituted alkoxy group, an optionally-substituted dialkylamino group, an optionally-substituted aryl group, a halogen atom, or a hydrogen atom; i, k and j each indicate an integer of from 1 to 5; and when i is 2 or more, then the "b"s may be the same or different and may bond to each other to form a cyclic structure; when k is 2 or more, then the "c"s may be the same or different and may bond to each other to form a cyclic structure; and when j is 2 or more, then the "d"s may be the same or different and may bond to each other to form a cyclic structure; $Ar^4$, $Ar^5$, "a" and "m" represent the same as those defined in formula (1).

4. The electrophotographic photoreceptor of claim 1, wherein the photosensitive layer has a stacked structure in which a charge generation layer containing a charge generation substance and a charge transportation layer containing the charge transportation substance containing the enamine compound represented by the general formula (2) and a polyarylate resin having the structural unit represented by the general formula (1) are stacked in this order to the outside from the electroconductive substrate.

5. The electrophotographic photoreceptor of claim 1, wherein an intermediate layer is disposed between the electroconductive substrate and the photosensitive layer.

6. A process cartridge attachable to and detachable from an electrophotographic apparatus main body, integrally comprising:

the electrophotographic photoreceptor of claim 1; and at least one of means selected from the group consisting of charging means for charging the electrophotographic photoreceptor, developing means for developing electrostatic latent images formed by subjecting the electrophotographic photoreceptor to exposure to light, and cleaning means for cleaning the electrophotographic photoreceptor after transferring the developed images onto a recording medium.

7. An electrophotographic apparatus comprising:

the electrophotographic photoreceptor of claim 1;

charging means for charging the electrophotographic photoreceptor;

exposure means for subjecting the charged electrophotographic photoreceptor to exposure to light;

developing means for developing electrostatic latent images formed by the exposure to light; and transfer means for transferring the developed images onto a recording medium.

8. The electrophotographic apparatus of claim 7, wherein the transfer means transfer developed images onto the recording medium by press contacting the electrophotographic photoreceptor and the recoding medium.

9. The electophotographic apparatus of claim 1, wherein the photosensitive layer includes a charge generation substance including any combination of a monoazo pigment, bisazo pigment, trisazo pigment, indigo, thioindigo, perylene-imide, perylenic acid anhydride, anthraquinone, pyrene-quinone, metal phthalocyanine, non-metal phthalocyanine, squarylium dyes, pyrylium salts, thiopyrylium salts, triphenylmethane dyes, selenium, and amorphous silicon.

* * * * *